US011541288B2

(12) United States Patent
Parsons et al.

(10) Patent No.: US 11,541,288 B2
(45) **Date of Patent: *Jan. 3, 2023**

(54) GOLF CLUB HEADS AND METHODS TO MANUFACTURE GOLF CLUB HEADS

(71) Applicant: PARSONS XTREME GOLF, LLC, Scottsdale, AZ (US)

(72) Inventors: Robert R. Parsons, Scottsdale, AZ (US); Michael R. Nicolette, Scottsdale, AZ (US); Bradley D. Schweigert, Cave Creek, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/350,242

(22) Filed: Jun. 17, 2021

(65) Prior Publication Data

US 2021/0308537 A1 Oct. 7, 2021

Related U.S. Application Data

(63) Continuation-in-part of application No. 17/155,486, filed on Jan. 22, 2021, which is a continuation of (Continued)

(51) Int. Cl.
*A63B 53/04* (2015.01)
*A63B 60/02* (2015.01)
*A63B 60/54* (2015.01)

(52) U.S. Cl.
CPC ..... *A63B 53/0466* (2013.01); *A63B 53/04* (2013.01); *A63B 60/02* (2015.10); (Continued)

(58) Field of Classification Search
CPC ..... A63B 53/0466; A63B 53/04; A63B 60/02; A63B 2053/0491; A63B 53/0408; (Continued)

(56) References Cited

U.S. PATENT DOCUMENTS 723,258 A 3/1903 Felton
1,133,129 A 3/1915 Govan
(Continued)

FOREIGN PATENT DOCUMENTS

CN 1302216 A 7/2001
CN 1572343 A 2/2005
(Continued)

OTHER PUBLICATIONS

"3M Scotch-Weld Structural Adhesives, Bonding Composite Parts to Multiple Materials", 3M Company, retrived from the Internet at www.3M.com/compositebonding (Year: 2016).
(Continued)

*Primary Examiner* — Sebastiano Passaniti

(57) ABSTRACT

Embodiments of golf club heads and methods to manufacture golf club heads are generally described herein. In one example, a golf club head may include a body portion having an interior cavity, a front portion, a back portion, a toe portion, a heel portion, a sole portion, and a top portion. A face portion is attached to the front portion to enclose the interior cavity. The golf club head may further include a port on the body portion that is connected to the interior cavity. A first mass portion may be coupled to the body portion such that the port is configured to receive the first mass portion to close the port. A second mass portion may be coupled to the body portion and include a different material than a material of the first mass portion. The maximum width of the interior cavity may be below a horizontal midplane of the body portion and above the port. The interior cavity may be at least partially filled with a filler material from the port. The interior cavity may at least partially extend over the port at a location of the maximum width. Other examples and embodiments may be described and claimed.

20 Claims, 35 Drawing Sheets

Related U.S. Application Data application No. 16/774,449, filed on Jan. 28, 2020, now Pat. No. 10,926,142, which is a continuation of application No. 16/179,406, filed on Nov. 2, 2018, now Pat. No. 10,583,336, application No. 17/350,242, which is a continuation-in-part of application No. 17/038,195, filed on Sep. 30, 2020, now Pat. No. 11,173,359, which is a continuation of application No. 16/365,343, filed on Mar. 26, 2019, now Pat. No. 10,821,340, which is a continuation of application No. 15/841,022, filed on Dec. 13, 2017, now Pat. No. 10,265,590, which is a continuation of application No. 15/701,131, filed on Sep. 11, 2017, now abandoned, which is a continuation-in-part of application No. 15/685,986, filed on Aug. 24, 2017, now Pat. No. 10,279,233, which is a continuation of application No. 15/628,251, filed on Jun. 20, 2017, now abandoned, which is a continuation of application No. 15/209,364, filed on Jul. 13, 2016, now Pat. No. 10,293,229, which is a continuation of application No. PCT/US2015/016666, filed on Feb. 19, 2015, said application No. 15/209,364 is a continuation of application No. 14/618,501, filed on Feb. 10, 2015, now Pat. No. 9,427,634, which is a continuation of application No. 14/589,277, filed on Jan. 5, 2015, now Pat. No. 9,421,437, which is a continuation of application No. 14/513,073, filed on Oct. 13, 2014, now Pat. No. 8,961,336, which is a continuation of application No. 14/498,603, filed on Sep. 26, 2014, now Pat. No. 9,199,143, application No. 17/350,242, which is a continuation-in-part of application No. 16/929,552, filed on Jul. 15, 2020, now Pat. No. 11,117,030, which is a continuation of application No. 15/683,564, filed on Aug. 22, 2017, now Pat. No. 10,716,978, which is a continuation of application No. 15/598,949, filed on May 18, 2017, now Pat. No. 10,159,876, which is a continuation of application No. 14/711,596, filed on May 13, 2015, now Pat. No. 9,675,853, application No. 17/350,242, which is a continuation-in-part of application No. 16/375,644, filed on Apr. 4, 2019, now abandoned, which is a continuation of application No. 15/824,755, filed on Nov. 28, 2017, now Pat. No. 10,286,268, which is a continuation of application No. 15/593,021, filed on May 11, 2017, now Pat. No. 9,844,710, application No. 17/350,242, which is a continuation-in-part of application No. 16/939,284, filed on Jul. 27, 2020, now Pat. No. 11,097,168, which is a continuation of application No. 15/793,648, filed on Oct. 25, 2017, now Pat. No. 10,729,949, which is a continuation-in-part of application No. 15/791,020, filed on Oct. 23, 2017, now abandoned, which is a continuation of application No. 15/785,001, filed on Oct. 16, 2017, now abandoned, application No. 17/350,242, which is a continuation-in-part of application No. 17/032,253, filed on Sep. 25, 2020, now Pat. No. 11,058,932, which is a continuation of application No. 16/597,358, filed on Oct. 9, 2019, now Pat. No. 10,814,193, said application No. 16/597,358 is a continuation of application No. 16/039,496, filed on Jul. 19, 2018, now Pat. No. 10,478,684, application No. 17/350,242, which is a continuation-in-part of application No. 17/114,939, filed on Dec. 8, 2020, now Pat. No. 11,358,039, which is a continuation of application No. 16/674,296, filed on Nov. 5, 2019, now Pat. No. 10,864,414, which is a continuation of application No. 15/934,579, filed on Mar. 23, 2018, now Pat. No. 10,512,829, application No. 17/350,242, which is a continuation-in-part of application No. 17/099,362, filed on Nov. 16, 2020, now Pat. No. 11,291,890, which is a continuation of application No. 16/820,136, filed on Mar. 16, 2020, now Pat. No. 10,874,919, which is a continuation of application No. 16/590,105, filed on Oct. 1, 2019, now Pat. No. 10,632,349, application No. 17/350,242, which is a continuation-in-part of application No. 17/178,989, filed on Feb. 18, 2021, which is a continuation of application No. 16/789,167, filed on Feb. 12, 2020, now Pat. No. 10,933,286, application No. 17/350,242, which is a continuation-in-part of application No. 17/161,987, filed on Jan. 29, 2021, now Pat. No. 11,167,187.

(60) Provisional application No. 62/581,456, filed on Nov. 3, 2017, provisional application No. 61/942,515, filed on Feb. 20, 2014, provisional application No. 61/945,560, filed on Feb. 27, 2014, provisional application No. 61/948,839, filed on Mar. 6, 2014, provisional application No. 61/952,470, filed on Mar. 13, 2014, provisional application No. 61/992,555, filed on May 13, 2014, provisional application No. 62/010,836, filed on Jun. 11, 2014, provisional application No. 62/011,859, filed on Jun. 13, 2014, provisional application No. 62/032,770, filed on Aug. 4, 2014, provisional application No. 62/041,538, filed on Aug. 25, 2014, provisional application No. 62/118,403, filed on Feb. 19, 2015, provisional application No. 62/159,856, filed on May 11, 2015, provisional application No. 62/338,390, filed on May 18, 2016, provisional application No. 62/502,442, filed on May 5, 2017, provisional application No. 62/508,794, filed on May 19, 2017, provisional application No. 62/512,033, filed on May 28, 2017, provisional application No. 62/570,493, filed on Oct. 10, 2017, provisional application No. 62/536,345, filed on Jul. 24, 2017, provisional application No. 62/642,531, filed on Mar. 13, 2018, provisional application No. 62/478,474, filed on Mar. 29, 2017, provisional application No. 62/637,840, filed on Mar. 2, 2018, provisional application No. 62/638,686, filed on Mar. 5, 2018, provisional application No. 62/639,842, filed on Mar. 7, 2018, provisional application No. 62/640,381, filed on Mar. 8, 2018, provisional application No. 62/908,467, filed on Sep. 30, 2019, provisional application No. 62/903,467, filed on Sep. 20, 2019, provisional application No. 62/877,934, filed on Jul. 24, 2019, provisional application No. 62/877,915, filed on Jul. 24, 2019, provisional application No. 62/865,532, filed on Jun. 24, 2019, provisional application No. 62/826,310, filed on Mar. 29, 2019, provisional application No. 62/814,959, filed on Mar. 7, 2019.

(52) U.S. Cl.

CPC ..... *A63B 53/0408* (2020.08); *A63B 53/0412* (2020.08); *A63B 53/0433* (2020.08); *A63B 53/0475* (2013.01); *A63B 60/54* (2015.10); *A63B 2053/0491* (2013.01)

(58) Field of Classification Search
CPC ..... A63B 53/0412; A63B 53/0433; A63B 53/0475; A63B 60/54
USPC ..... 473/324–350, 287–292
See application file for complete search history.

(56) References Cited

U.S. PATENT DOCUMENTS

| | | | |
|---|---|---|---|
| 1,306,029 | A | 6/1919 | Robertson |
| 1,534,600 | A | 4/1925 | Mattern |
| 1,538,312 | A | 5/1925 | Neish |
| 3,020,048 | A | 2/1962 | Carroll |
| 3,266,805 | A | 8/1966 | Bulla |
| 3,419,275 | A | 12/1968 | Winkleman |
| 3,466,047 | A | 9/1969 | Rodia et al. |
| 3,556,533 | A | 1/1971 | Hollis |
| 3,843,122 | A | 10/1974 | Florian |
| 3,845,960 | A | 11/1974 | Thompson |
| 3,970,236 | A | 7/1976 | Rogers |
| 3,979,122 | A | 9/1976 | Belmont |
| 3,985,363 | A | 10/1976 | Jepson et al. |
| 3,995,865 | A | 12/1976 | Cochran et al. |
| 4,043,563 | A | 8/1977 | Churchward |
| 4,085,934 | A | 4/1978 | Churchward |
| 4,145,052 | A | 3/1979 | Janssen et al. |
| 4,313,607 | A | 2/1982 | Thompson |
| 4,319,752 | A | 3/1982 | Thompson |
| 4,340,230 | A | 7/1982 | Churchward |
| 4,489,945 | A | 12/1984 | Kobayashi |
| 4,502,687 | A | 3/1985 | Kochevar |
| 4,511,145 | A | 4/1985 | Schmidt |
| 4,523,759 | A | 6/1985 | Igarashi |
| 4,545,580 | A | 10/1985 | Tomita et al. |
| 4,553,755 | A | 11/1985 | Kamada |
| 4,591,160 | A | 5/1986 | Piragino |
| 4,607,846 | A | 8/1986 | Perkins |
| 4,614,627 | A | 9/1986 | Curtis et al. |
| D294,617 | S | 3/1988 | Perkins |
| 4,754,977 | A | 7/1988 | Sahm |
| 4,803,023 | A | 2/1989 | Enomoto et al. |
| 4,824,116 | A | 4/1989 | Nagamoto et al. |
| 4,867,458 | A | 9/1989 | Sumikawa et al. |
| 4,869,507 | A | 9/1989 | Sahm |
| 4,928,972 | A | 5/1990 | Nakanishi et al. |
| 4,962,932 | A | 10/1990 | Anderson |
| 4,988,104 | A | 1/1991 | Shiotani et al. |
| 5,028,049 | A | 7/1991 | McKeighen |
| 5,050,879 | A | 9/1991 | Sun et al. |
| 5,090,702 | A | 2/1992 | Viste |
| 5,094,383 | A | 3/1992 | Anderson et al. |
| 5,106,094 | A | 4/1992 | Desbiolles et al. |
| 5,158,296 | A | 10/1992 | Lee |
| 5,176,384 | A | 1/1993 | Sata et al. |
| 5,178,392 | A | 1/1993 | Santioni |
| 5,184,823 | A | 2/1993 | Desboilles et al. |
| 5,209,473 | A | 5/1993 | Fisher |
| 5,213,328 | A | 5/1993 | Long et al. |
| 5,219,408 | A | 6/1993 | Sun |
| 5,244,211 | A | 9/1993 | Lukasiewicz |
| 5,255,918 | A | 10/1993 | Anderson et al. |
| 5,282,624 | A | 2/1994 | Viste |
| 5,282,625 | A | 2/1994 | Schmidt et al. |
| 5,290,036 | A | 3/1994 | Fenton et al. |
| 5,306,450 | A | 4/1994 | Okumoto et al. |
| 5,348,302 | A | 9/1994 | Sasamoto et al. |
| 5,351,958 | A | 10/1994 | Helmstetter |
| 5,385,348 | A | 1/1995 | Wargo |
| 5,419,559 | A | 5/1995 | Melanson et al. |
| 5,419,560 | A | 5/1995 | Bamber |
| 5,421,577 | A | 6/1995 | Kobayashi |
| 5,425,535 | A | 6/1995 | Gee |
| D361,358 | S | 8/1995 | Simmons |
| 5,447,309 | A | 9/1995 | Vincent |
| 5,447,311 | A | 9/1995 | Viollaz et al. |
| 5,451,056 | A | 9/1995 | Manning |
| D362,885 | S | 10/1995 | Blough et al. |
| 5,467,983 | A | 11/1995 | Chen |
| 5,485,998 | A | 1/1996 | Kobayashi |
| 5,499,819 | A | 3/1996 | Nagamoto |
| 5,505,453 | A | 4/1996 | Mack |
| 5,509,659 | A | 4/1996 | Igarashi |
| 5,518,243 | A | 5/1996 | Redman |
| 5,518,423 | A | 5/1996 | Green et al. |
| 5,533,729 | A | 7/1996 | Leu |
| 5,540,437 | A | 7/1996 | Bamber |
| 5,582,553 | A | 12/1996 | Ashcraft et al. |
| 5,593,356 | A | 1/1997 | Takeda |
| 5,595,548 | A | 1/1997 | Beck |
| D378,111 | S | 2/1997 | Parente et al. |
| 5,607,363 | A | 3/1997 | Chou |
| 5,637,045 | A | 6/1997 | Igarashi |
| 5,647,808 | A | 7/1997 | Hosokawa |
| 5,649,873 | A | 7/1997 | Fuller |
| 5,669,830 | A | 9/1997 | Bamber |
| 5,711,722 | A | 1/1998 | Miyajima et al. |
| 5,718,641 | A | 2/1998 | Lin |
| 5,766,091 | A | 6/1998 | Humphrey et al. |
| 5,766,092 | A | 6/1998 | Mimeur et al. |
| 5,769,735 | A | 6/1998 | Hosokawa |
| 5,772,527 | A | 6/1998 | Liu |
| 5,788,584 | A | 8/1998 | Parente et al. |
| 5,797,807 | A | 8/1998 | Moore |
| 5,827,132 | A | 10/1998 | Bamber |
| D408,485 | S | 4/1999 | Takahashi et al. |
| 5,899,821 | A | 5/1999 | Hsu et al. |
| 5,908,357 | A | 6/1999 | Hsieh |
| 5,913,735 | A | 6/1999 | Kenmi |
| 5,935,016 | A | 8/1999 | Antonious |
| 6,012,990 | A | 1/2000 | Nishizawa |
| 6,015,354 | A | 1/2000 | Ahn et al. |
| D421,080 | S | 2/2000 | Chen |
| 6,064,568 | A | 5/2000 | Schmitt |
| D426,276 | S | 6/2000 | Besnard et al. |
| 6,077,171 | A | 6/2000 | Yoneyama |
| 6,093,116 | A | 7/2000 | Hettinger et al. |
| 6,162,133 | A | 12/2000 | Peterson |
| 6,165,081 | A | 12/2000 | Chou |
| 6,203,449 | B1 | 3/2001 | Kenmi |
| 6,231,458 | B1 | 5/2001 | Cameron et al. |
| 6,238,302 | B1 | 5/2001 | Helmstetter et al. |
| D445,862 | S | 7/2001 | Ford |
| 6,290,607 | B1 | 9/2001 | Gilbert et al. |
| 6,290,609 | B1 | 9/2001 | Takeda |
| 6,306,048 | B1 | 10/2001 | McCabe et al. |
| 6,379,262 | B1 | 4/2002 | Boone |
| 6,386,990 | B1 | 5/2002 | Reyes et al. |
| 6,443,857 | B1 | 9/2002 | Chuang |
| 6,458,045 | B1 | 10/2002 | Chen |
| 6,475,427 | B1 | 11/2002 | Deshmukh et al. |
| 6,506,129 | B2 | 1/2003 | Chen |
| D469,833 | S | 2/2003 | Roberts et al. |
| 6,533,679 | B1 | 3/2003 | McCabe et al. |
| D478,140 | S | 8/2003 | Burrows |
| 6,604,568 | B2 | 8/2003 | Bliss et al. |
| 6,607,451 | B2 | 8/2003 | Kosmatka et al. |
| 6,616,547 | B2 | 9/2003 | Vincent et al. |
| 6,638,182 | B2 | 10/2003 | Kosmatka |
| 6,638,183 | B2 | 10/2003 | Takeda |
| 6,695,714 | B1 | 2/2004 | Bliss et al. |
| 6,702,693 | B2 | 3/2004 | Bamber |
| 6,780,123 | B2 | 8/2004 | Hasebe |
| 6,811,496 | B2 | 11/2004 | Wahl et al. |
| 6,830,519 | B2 | 12/2004 | Reed et al. |
| 6,855,067 | B2 | 2/2005 | Solheim et al. |
| D502,975 | S | 3/2005 | Schweigert et al. |
| 6,916,253 | B2 | 7/2005 | Takeda |
| D508,545 | S | 8/2005 | Roberts et al. |
| D508,969 | S | 8/2005 | Hasebe |
| 6,923,733 | B2 | 8/2005 | Chen |
| 6,949,031 | B2 | 9/2005 | Imamoto et al. |
| 6,971,961 | B2 | 12/2005 | Chen |
| D514,183 | S | 1/2006 | Schweigert et al. |
| 6,984,180 | B2 | 1/2006 | Hasebe |
| 7,029,403 | B2 | 4/2006 | Rice et al. |
| 7,037,213 | B2 | 5/2006 | Otoguro |

(56) References Cited

U.S. PATENT DOCUMENTS 7,048,647 B2 5/2006 Burrows
7,121,956 B2 10/2006 Lo
7,121,958 B2 10/2006 Cheng et al.
7,128,663 B2 10/2006 Bamber
7,153,222 B2 12/2006 Gilbert et al.
D534,595 S 1/2007 Hasebe
7,156,751 B2 1/2007 Wahl et al.
7,169,057 B2 1/2007 Wood et al.
7,182,698 B2 2/2007 Tseng
7,207,900 B2 4/2007 Nicolette et al.
D543,601 S 5/2007 Kawami
7,232,380 B2 6/2007 Nakahara
7,281,991 B2 10/2007 Gilbert et al.
D555,219 S 11/2007 Lin
7,303,485 B2 12/2007 Tseng
7,303,486 B2 12/2007 Imamoto
7,309,297 B1 12/2007 Solari
7,326,127 B2 2/2008 Hou et al.
7,351,164 B2 4/2008 Schweigert et al.
7,396,299 B2 7/2008 Nicolette et al.
7,448,961 B2 11/2008 Lin
7,553,241 B2 6/2009 Park et al.
7,559,854 B2 7/2009 Harvell et al.
7,575,523 B2 8/2009 Yokota
7,582,024 B2 9/2009 Shear
7,588,502 B2 9/2009 Nishino
7,594,862 B2 9/2009 Gilbert
7,611,424 B2 11/2009 Nagai et al.
7,658,686 B2 2/2010 Soracco
D618,293 S 6/2010 Foster et al.
7,744,484 B1 6/2010 Chao
7,744,486 B2 6/2010 Hou et al.
7,744,487 B2 6/2010 Tavares et al.
7,749,100 B2 7/2010 Tavares et al.
7,749,101 B2 7/2010 Imamoto et al.
7,785,212 B2 8/2010 Lukasiewicz et al.
7,794,333 B2 9/2010 Wallans et al.
7,798,917 B2 9/2010 Nguyen et al.
7,803,068 B2 9/2010 Clausen et al.
7,815,521 B2 10/2010 Ban et al.
7,846,040 B2 12/2010 Ban
7,938,736 B2 5/2011 Park et al.
7,938,738 B2 5/2011 Roach
8,012,040 B2 9/2011 Takechi
8,062,150 B2 11/2011 Gilbert et al.
8,088,025 B2 1/2012 Wahl et al.
8,092,319 B1 1/2012 Cackett et al.
8,105,180 B1 1/2012 Cackett et al.
8,147,353 B2 4/2012 Gilbert et al.
8,187,116 B2 5/2012 Boyd et al.
8,192,303 B2 6/2012 Ban
8,221,262 B1 7/2012 Cackett et al.
8,246,487 B1 8/2012 Cackett et al.
8,257,196 B1 9/2012 Abbott et al.
8,262,495 B2 9/2012 Stites
8,262,506 B2 9/2012 Watson et al.
8,277,337 B2 10/2012 Shimazaki
8,328,662 B2 12/2012 Nakamura et al.
8,328,663 B2 12/2012 Wahl et al.
8,342,985 B2 1/2013 Hirano
8,376,878 B2 2/2013 Bennett et al.
8,393,976 B2 3/2013 Soracco et al.
D681,142 S 4/2013 Fossum et al.
8,414,422 B2 4/2013 Peralta et al.
8,449,406 B1 5/2013 Frame et al.
8,475,293 B2 7/2013 Morin et al.
8,506,420 B2 8/2013 Hocknell et al.
8,535,176 B2 9/2013 Bazzel et al.
8,545,343 B2 10/2013 Boyd et al.
8,574,094 B2 11/2013 Nicolette et al.
8,657,700 B2 2/2014 Nicolette et al.
8,663,026 B2 3/2014 Blowers et al.
8,690,710 B2 4/2014 Nicolette et al.
8,753,230 B2 6/2014 Stokke et al.
8,790,196 B2 7/2014 Solheim et al.
8,827,832 B2 9/2014 Breier et al.
8,827,833 B2 9/2014 Amano et al.
8,845,455 B2 9/2014 Ban et al.
8,858,362 B1 10/2014 Leposky et al.
8,936,518 B2 1/2015 Takechi
D722,352 S 2/2015 Nicolette et al.
D723,120 S 2/2015 Nicolette
8,961,336 B1 2/2015 Parsons et al.
D724,164 S 3/2015 Schweigert et al.
D726,265 S 4/2015 Nicolette
D726,846 S 4/2015 Schweiger
9,005,056 B2 4/2015 Pegnatori
D729,892 S 5/2015 Nicolette et al.
D733,234 S 6/2015 Nicolette
9,044,653 B2 6/2015 Wahl et al.
9,061,186 B2 6/2015 Larson
9,079,081 B2 7/2015 Shimazaki
9,079,082 B2 7/2015 Hatton et al.
D738,449 S 9/2015 Schweiger
D739,487 S 9/2015 Schweiger
9,155,945 B2 10/2015 Demkowski et al.
9,192,830 B2 11/2015 Parsons et al.
9,192,832 B2 11/2015 Parsons et al.
9,199,143 B1 12/2015 Parsons et al.
D746,927 S 1/2016 Parsons et al.
D748,214 S 1/2016 Nicolette et al.
D748,215 S 1/2016 Parsons et al.
D748,749 S 2/2016 Nicolette et al.
D753,251 S 4/2016 Schweigert et al.
D753,252 S 4/2016 Schweiger
D755,319 S 5/2016 Nicolette et al.
D756,471 S 5/2016 Nicolette et al.
9,345,938 B2 5/2016 Parsons et al.
9,346,203 B2 5/2016 Parsons et al.
9,352,197 B2 5/2016 Parsons et al.
D759,178 S 6/2016 Nicolette
D760,334 S 6/2016 Schweigert et al.
9,364,727 B2 6/2016 Parsons et al.
9,399,158 B2 7/2016 Parsons et al.
9,421,437 B2 8/2016 Parsons et al.
9,427,634 B2 8/2016 Parsons et al.
9,440,124 B2 9/2016 Parsons et al.
9,468,821 B2 10/2016 Parsons et al.
9,517,393 B2 12/2016 Cardani et al.
9,533,201 B2 1/2017 Parsons et al.
9,550,096 B2 1/2017 Parsons et al.
9,573,027 B2 2/2017 Nivanh et al.
9,610,481 B2 4/2017 Parsons et al.
9,630,070 B2 4/2017 Parsons et al.
9,636,554 B2 5/2017 Parsons et al.
9,649,540 B2 5/2017 Parsons et al.
9,649,542 B2 5/2017 Nicolette
9,662,547 B2 5/2017 Parsons et al.
9,662,549 B2 5/2017 Vrska, Jr. et al.
9,675,853 B2 6/2017 Parsons et al.
9,750,993 B2 9/2017 Ritchie et al.
9,764,194 B2 9/2017 Parsons et al.
9,764,208 B1 9/2017 Parsons et al.
9,782,643 B2 10/2017 Parsons et al.
9,795,842 B1 10/2017 Parsons et al.
9,795,843 B2 10/2017 Parsons et al.
9,796,131 B2 10/2017 Parsons et al.
9,814,952 B2 11/2017 Parsons et al.
9,878,218 B2 1/2018 Parsons et al.
9,878,220 B2 1/2018 Parsons et al.
10,029,158 B2 7/2018 Parsons et al.
10,029,159 B2 7/2018 Parsons et al.
10,159,876 B2 12/2018 Parsons et al.
10,232,235 B2 * 3/2019 Parsons ..... A63B 53/0475
10,265,590 B2 4/2019 Parsons et al.
10,279,233 B2 5/2019 Parsons et al.
10,286,267 B2 5/2019 Nicolette
10,293,221 B2 5/2019 Parsons et al.
10,293,229 B2 5/2019 Parsons et al.
10,376,754 B2 8/2019 Parsons et al.
D863,478 S 10/2019 Parsons et al.
10,449,428 B2 10/2019 Parsons et al.
10,478,684 B2 11/2019 Parsons et al.
10,512,829 B2 12/2019 Parsons et al.

(56) References Cited

U.S. PATENT DOCUMENTS 10,596,424 B2 3/2020 Parsons et al.
10,596,425 B2 3/2020 Parsons et al.
10,632,349 B2 4/2020 Parsons et al.
10,716,978 B2 * 7/2020 Parsons ..... A63B 53/047
10,729,948 B2 * 8/2020 Parsons ..... A63B 53/0475
10,729,949 B2 8/2020 Parsons et al.
10,814,193 B2 10/2020 Parsons et al.
10,821,339 B2 * 11/2020 Parsons ..... A63B 60/02
10,821,340 B2 11/2020 Parsons et al.
10,828,538 B2 11/2020 Parsons et al.
10,864,414 B2 12/2020 Parsons et al.
10,874,919 B2 12/2020 Parsons et al.
10,874,921 B2 * 12/2020 Parsons ..... A63B 53/047
10,926,142 B2 * 2/2021 Parsons ..... A63B 60/02
10,933,286 B2 * 3/2021 Parsons ..... A63B 53/0466
11,117,030 B2 * 9/2021 Parsons ..... A63B 53/0487
11,141,633 B2 * 10/2021 Parsons ..... A63B 53/0487
11,344,775 B2 * 5/2022 Parsons ..... A63B 60/02
2001/0055996 A1 12/2001 Iwata et al.
2002/0004427 A1 1/2002 Cheng et al.
2002/0037775 A1 3/2002 Keelan
2002/0042307 A1 4/2002 Deshmukh
2002/0094884 A1 7/2002 Hocknell et al.
2002/0098900 A1 * 7/2002 Ford ..... A63B 69/3617 473/242
2002/0107087 A1 8/2002 Fagot
2003/0087709 A1 5/2003 McCabe
2003/0139226 A1 7/2003 Cheng et al.
2003/0194548 A1 10/2003 McLeod et al.
2004/0043830 A1 3/2004 Imamoto
2004/0082401 A1 4/2004 Takeda
2004/0092331 A1 5/2004 Best
2004/0110575 A1 6/2004 Stites et al.
2004/0204263 A1 10/2004 Fagot et al.
2004/0209704 A1 10/2004 Mahaffey
2004/0224785 A1 11/2004 Hasebe
2004/0242339 A1 12/2004 Gilbert et al.
2004/0266550 A1 12/2004 Gilbert et al.
2005/0009632 A1 1/2005 Schweigert et al.
2005/0014573 A1 1/2005 Lee
2005/0026716 A1 2/2005 Wahl et al.
2005/0043117 A1 2/2005 Gilbert et al.
2005/0054462 A1 3/2005 Breier et al.
2005/0107183 A1 5/2005 Takeda et al.
2005/0119066 A1 6/2005 Stites et al.
2005/0192116 A1 9/2005 Imamoto
2005/0197208 A1 9/2005 Imamoto
2005/0215349 A1 9/2005 Huang et al.
2005/0239569 A1 10/2005 Best et al.
2005/0239570 A1 10/2005 Best et al.
2005/0255936 A1 11/2005 Huang
2005/0266931 A1 12/2005 Hou et al.
2005/0277485 A1 12/2005 Hou et al.
2005/0278931 A1 12/2005 Deshmukh et al.
2006/0052185 A1 3/2006 Kawaguchi et al.
2006/0105856 A1 5/2006 Lo
2006/0111200 A1 5/2006 Poynor
2006/0122004 A1 6/2006 Chen et al.
2006/0199666 A1 9/2006 Cruz
2006/0229141 A1 10/2006 Galloway
2006/0240909 A1 10/2006 Breier et al.
2006/0258482 A1 11/2006 Cackett et al.
2007/0032308 A1 2/2007 Fagot et al.
2007/0129166 A1 6/2007 Shimazaki et al.
2007/0225084 A1 9/2007 Schweigert et al.
2007/0249431 A1 10/2007 Lin
2008/0022502 A1 1/2008 Tseng
2008/0058113 A1 3/2008 Nicolette et al.
2008/0188322 A1 8/2008 Anderson et al.
2008/0194355 A1 8/2008 Liu
2008/0300065 A1 12/2008 Schweigert
2008/0305888 A1 12/2008 Tseng
2008/0308212 A1 12/2008 Sheasley et al.
2008/0318705 A1 12/2008 Clausen et al.
2009/0011858 A1 1/2009 Binette et al.
2009/0029790 A1 1/2009 Nicolette et al.
2009/0042665 A1 2/2009 Morales et al.
2009/0048370 A1 2/2009 Lutz et al.
2009/0069908 A1 3/2009 Butler, Jr. et al.
2009/0163295 A1 6/2009 Tseng
2009/0280923 A1 11/2009 Park et al.
2010/0130306 A1 5/2010 Schweigert
2010/0178999 A1 7/2010 Nicolette et al.
2011/0070970 A1 3/2011 Wan
2011/0111883 A1 5/2011 Cackett
2011/0165963 A1 7/2011 Cackett et al.
2011/0207551 A1 8/2011 Breier et al.
2011/0269567 A1 11/2011 Ban et al.
2011/0281665 A1 11/2011 Kawaguchi et al.
2011/0294596 A1 12/2011 Ban
2012/0020615 A1 1/2012 Zhang et al.
2012/0071270 A1 3/2012 Nakano
2012/0211161 A1 8/2012 Lutz et al.
2012/0277027 A1 11/2012 Rice et al.
2013/0137532 A1 5/2013 Deshmukh et al.
2013/0225319 A1 8/2013 Kato
2013/0266813 A1 10/2013 Faulkner
2013/0281226 A1 10/2013 Ban
2013/0288823 A1 10/2013 Hebreo
2013/0303303 A1 11/2013 Ban
2013/0310192 A1 11/2013 Wahl et al.
2013/0324294 A1 12/2013 Dldknow
2013/0331201 A1 12/2013 Wahl et al.
2013/0344976 A1 12/2013 Stites
2014/0038737 A1 2/2014 Roach et al.
2014/0038743 A1 * 2/2014 Nivanh ..... A63B 53/04 473/324
2014/0045605 A1 2/2014 Fujiwara et al.
2014/0080621 A1 3/2014 Nicolette et al.
2014/0113983 A1 4/2014 Czaplicki et al.
2014/0128175 A1 5/2014 Jertson et al.
2014/0274441 A1 9/2014 Greer
2014/0274442 A1 9/2014 Honea et al.
2014/0274451 A1 9/2014 Knight et al.
2014/0274454 A1 9/2014 Snyder
2014/0364248 A1 12/2014 Wahl et al.
2015/0045141 A1 2/2015 Myrhum et al.
2015/0126305 A1 5/2015 Stokke et al.
2015/0192116 A1 7/2015 Haug et al.
2016/0038799 A1 2/2016 Cruz et al.
2016/0045793 A1 2/2016 Cardani et al.
2016/0160092 A1 6/2016 Awkal et al.
2017/0239533 A1 8/2017 Cole et al.
2017/0282026 A1 10/2017 Parsons et al.
2017/0282027 A1 10/2017 Parsons et al.
2017/0368429 A1 12/2017 Parsons et al.
2018/0028882 A1 2/2018 Hebreo et al.
2018/0028883 A1 2/2018 Morin et al.
2018/0050243 A1 2/2018 Parsons et al.
2018/0050244 A1 2/2018 Parsons et al.
2018/0133567 A1 5/2018 Parsons et al.
2018/0140910 A1 5/2018 Parsons et al.
2018/0169488 A1 6/2018 Parsons et al.
2018/0221727 A1 8/2018 Parsons et al.
2018/0236325 A1 8/2018 Parsons et al.
2018/0296885 A1 10/2018 Nakamura
2018/0296887 A1 10/2018 Motokawa
2019/0232125 A1 8/2019 Parsons et al.
2019/0232126 A1 8/2019 Nicolette
2019/0240549 A1 8/2019 Parsons et al.
2019/0247727 A1 8/2019 Parsons et al.
2020/0171360 A1 6/2020 Parsons et al.
2020/0171363 A1 6/2020 Parsons et al.
2020/0179773 A1 6/2020 Parsons et al.
2020/0246666 A1 8/2020 Parsons et al.
2020/0346082 A1 11/2020 Parsons et al.
2020/0353326 A1 11/2020 Parsons et al.
2021/0008420 A1 1/2021 Parsons et al.

FOREIGN PATENT DOCUMENTS

CN 1608696 A 4/2005
CN 1762514 A 4/2006
CN 101031342 A 9/2007

(56) References Cited

FOREIGN PATENT DOCUMENTS

| | | | |
|---|---|---|---|
| CN | 101754786 | A | 6/2010 |
| CN | 201658798 | U | 12/2010 |
| CN | 102143783 | A | 8/2011 |
| CN | 202087021 | U | 12/2011 |
| CN | 203108126 | U | 8/2013 |
| DE | 29715997 | U1 | 2/1998 |
| EP | 1955740 | B1 | 12/2010 |
| GB | 2249031 | A | 4/1992 |
| JP | S51140374 | A | 12/1976 |
| JP | S62200359 | U | 12/1987 |
| JP | H0241003 | U | 3/1990 |
| JP | H0284972 | U | 7/1990 |
| JP | H08257181 | A | 10/1996 |
| JP | H10127832 | A | 5/1998 |
| JP | H10277187 | A | 10/1998 |
| JP | H119742 | A | 1/1999 |
| JP | 2001346924 | A | 12/2001 |
| JP | 2002143356 | A | 5/2002 |
| JP | 2002535056 | A | 10/2002 |
| JP | 2004313777 | A | 11/2004 |
| JP | 2005218510 | A | 8/2005 |
| JP | 2005287679 | A | 10/2005 |
| JP | 2006223331 | A | 8/2006 |
| JP | 2007044445 | A | 2/2007 |
| JP | 2007136068 | A | 6/2007 |
| JP | 2008173314 | A | 7/2008 |
| JP | 3158662 | U | 4/2010 |
| JP | 2010069106 | A | 4/2010 |
| JP | 2010530782 | A | 9/2010 |
| JP | 2013027587 | A | 2/2013 |
| JP | 2013043091 | A | 3/2013 |
| WO | 9215374 | A1 | 9/1992 |

OTHER PUBLICATIONS

Calsac Corporation—Thermoplastic Polyurethane (Year: 2019).
Kozuchowski, Zak, "Callaway Mack Daddy 2 PM Grind Wedges" (http://www.goltwrx.com/276203/callaway-mack-daddy-2-pm-grind-wedges/), www.golfwrx.com, GolfWRX Holdings, LLC, published Jan. 21, 2015.
PCT/US14/71250: International Search Report and Written Opinion dated Mar. 12, 2015 (6 Pages).
PCT/US16/16626: International Search Report and Written Opinion dated Oct. 28, 2016 (9 pages).
PCT/US16/42075: International Search Report and Written Opinion dated Sep. 22, 2016 (13 Pages).
PCT/US19/17464: International Search Report and Written Opinion dated Apr. 29, 2019 (9 Pages).
PCT/US19/54104: International Search Report and Written Opinion dated Dec. 30, 2019 (10 Pages).
PCT/US2015/016666: International Search Report and Written Opinion dated May 14, 2015 (8 Pages).
PCT/US2018/023617: International Search Report and Written Opinion dated May 31, 2018 (10 Pages).
PCT/US2019/026099: International Search Report and Written Opinion dated May 7, 2019 (7 pages).
PCT/US2020/021869: International Search Report and Written Opinion dated May 14, 2020 (12 Pages).
Rocketbladez Press Release, "Golfballed", http://golfballed.com/index.php?option=com_content&view=article&id=724:taylormade- . . . Oct. 13, 2017, Published Jan. 3, 2013.
Taylor Made Golf Company, Inc., https://taylormadegolf.com/on/demandware.static/-/Sites-TMaG-Library/default/v1459859109590/docs/productspecs/TM—S2013—Catalog18.pdf., published Jan. 2013.
U.S. Appl. No. 29/512,313, Nicolette, "Golf Club Head," filed Dec. 18, 2014.
Wall, Jonathan, "Details: Phil's Prototype Mack Daddy PM-GRIND Wedge," (http://www.pgatour.com/equipmentreport/2015/01/21/callaway-wedge.html), www.pgatour.com, PGA Tour, Inc., Published Jan. 21, 2015.

* cited by examiner

GOLF CLUB HEADS AND METHODS TO MANUFACTURE GOLF CLUB HEADS

CROSS REFERENCE

This application is a continuation-in-part of application Ser. No. 17/155,486, filed Jan. 22, 2021, which is a continuation of application Ser. No. 16/774,449, filed Jan. 28, 2020, now U.S. Pat. No. 10,926,142, which is a continuation of application Ser. No. 16/179,406, filed Nov. 2, 2018, now U.S. Pat. No. 10,583,336, which claims the benefit of U.S. Provisional Application No. 62/581,456, filed Nov. 3, 2017.

This application is a continuation-in-part of application Ser. No. 17/038,195 filed Sep. 30, 2020, which is a continuation of application Ser. No. 16/365,343, filed Mar. 26, 2019, now U.S. Pat. No. 10,821,340, which is a continuation of application Ser. No. 15/841,022, filed Dec. 13, 2017, now U.S. Pat. No. 10,265,590, which is a continuation of application Ser. No. 15/701,131, filed Sep. 11, 2017, now abandoned, which is a continuation-in-part of application Ser. No. 15/685,986, filed Aug. 24, 2017, now U.S. Pat. No. 10,279,233, which is a continuation of application Ser. No. 15/628,251, filed Jun. 20, 2017, now abandoned, which is a continuation of application Ser. No. 15/209,364, filed on Jul. 13, 2016, now U.S. Pat. No. 10,293,229, which is a continuation of International Application No. PCT/US15/16666, filed Feb. 19, 2015, which claims the benefit of U.S. Provisional Application No. 61/942,515, filed Feb. 20, 2014, U.S. Provisional Application No. 61/945,560, filed Feb. 27, 2014, U.S. Provisional Application No. 61/948,839, filed Mar. 6, 2014, U.S. Provisional Application No. 61/952,470, filed Mar. 13, 2014, U.S. Provisional Application No. 61/992,555, filed May 13, 2014, U.S. Provisional Application No. 62/010,836, filed Jun. 11, 2014, U.S. Provisional Application No. 62/011,859, filed Jun. 13, 2014, and U.S. Provisional Application No. 62/032,770, filed Aug. 4, 2014.

U.S. application Ser. No. 15/209,364, filed on Jul. 13, 2016, now U.S. Pat. No. 10,293,229, is also a continuation of application Ser. No. 14/618,501, filed Feb. 10, 2015, now U.S. Pat. No. 9,427,634, which is a continuation of application Ser. No. 14/589,277, filed Jan. 5, 2015, now U.S. Pat. No. 9,421,437, which is a continuation of application Ser. No. 14/513,073, filed Oct. 13, 2014, now U.S. Pat. No. 8,961,336, which is a continuation of application Ser. No. 14/498,603, filed Sep. 26, 2014, now U.S. Pat. No. 9,199,143, which claims the benefits of U.S. Provisional Application No. 62/041,538, filed Aug. 25, 2014.

This application is a continuation-in-part of application Ser. No. 16/929,552, filed Jul. 15, 2020, which is a continuation of application Ser. No. 15/683,564, filed Aug. 22, 2017, now U.S. Pat. No. 10,716,978, which is a continuation of application Ser. No. 15/598,949, filed May 18, 2017, now U.S. Pat. No. 10,159,876, which is a continuation of application Ser. No. 14/711,596, filed May 13, 2015, now U.S. Pat. No. 9,675,853, which claims the benefit of U.S. Provisional Application No. 62/118,403, filed Feb. 19, 2015, U.S. Provisional Application No. 62/159,856, filed May 11, 2015, U.S. Provisional Application No. 61/992,555, filed May 13, 2014, U.S. Provisional Application No. 62/010,836, filed Jun. 11, 2014, U.S. Provisional Application No. 62/011,859, filed Jun. 13, 2014, U.S. Provisional Application No. 62/032,770, filed Aug. 4, 2014, and U.S. Provisional Application No. 62/041,538, filed Aug. 25, 2014.

This application is a continuation-in-part of U.S. application Ser. No. 16/375,644, filed Apr. 4, 2019, which is a continuation of U.S. application Ser. No. 15/824,755, filed Nov. 28, 2017, now U.S. Pat. No. 10,286,268, which is a continuation of U.S. application Ser. No. 15/593,021, filed May 11, 2017, now U.S. Pat. No. 9,844,710, which claims the benefit of U.S. Provisional Application Ser. No. 62/338,390, filed May 18, 2016.

This application is a continuation-in-part of application Ser. No. 16/939,284, filed Jul. 27, 2020, which is a continuation of application Ser. No. 15/793,648, filed Oct. 25, 2017, now U.S. Pat. No. 10,729,949, which is a continuation-in-part of application Ser. No. 15/791,020, filed Oct. 23, 2017, now abandoned, which is a continuation of application Ser. No. 15/785,001, filed Oct. 16, 2017, now abandoned, which claims the benefit of U.S. Provisional Application No. 62/502,442, filed May 5, 2017, U.S. Provisional Application No. 62/508,794, filed May 19, 2017, U.S. Provisional Application No. 62/512,033, filed May 28, 2017, and U.S. Provisional Application No. 62/570,493, filed Oct. 10, 2017.

This application is a continuation-in-part of application Ser. No. 17/032,253, filed Sep. 25, 2020, which is a continuation of application Ser. No. 16/597,358, filed Oct. 9, 2019, now U.S. Pat. No. 10,814,193, which is a continuation of application Ser. No. 16/039,496, filed Jul. 19, 2018, now U.S. Pat. No. 10,478,684, which claims the benefit of U.S. Provisional Application No. 62/536,345, filed Jul. 24, 2017, and U.S. Provisional Application No. 62/642,531, filed Mar. 13, 2018.

This application is a continuation-in-part of application Ser. No. 17/114,939, filed Dec. 8, 2020, which is a continuation of application Ser. No. 16/674,296, filed Nov. 5, 2019, now U.S. Pat. No. 10,864,414, which is a continuation of application Ser. No. 15/934,579, filed Mar. 23, 2018, now U.S. Pat. No. 10,512,829, which claims the benefit of U.S. Provisional Application No. 62/478,474, filed Mar. 29, 2017, U.S. Provisional Application No. 62/637,840, filed Mar. 2, 2018, U.S. Provisional Application No. 62/638,686, filed Mar. 5, 2018, U.S. Provisional Application No. 62/639,842, filed Mar. 7, 2018, and U.S. Provisional Application No. 62/640,381, filed Mar. 8, 2018.

This application is a continuation-in-part of application Ser. No. 17/099,362, filed Nov. 16, 2020, which is a continuation of application Ser. No. 16/820,136, filed Mar. 16, 2020, now U.S. Pat. No. 10,874,919, which is a continuation of application Ser. No. 16/590,105, filed Oct. 1, 2019, now U.S. Pat. No. 10,632,349, which claims the benefit of U.S. Provisional Application No. 62/908,467, filed Sep. 30, 2019, U.S. Provisional Application No. 62/903,467, filed Sep. 20, 2019, U.S. Provisional Application No. 62/877,934, filed Jul. 24, 2019, U.S. Provisional Application No. 62/877,915, filed Jul. 24, 2019, U.S. Provisional Application No. 62/865,532, filed Jun. 24, 2019, U.S. Provisional Application No. 62/826,310, filed Mar. 29, 2019, and U.S. Provisional Application No. 62/814,959, filed Mar. 7, 2019.

This application is a continuation-in-part of application Ser. No. 17/178,989, filed Feb. 18, 2021, which is a continuation of application Ser. No. 16/789,167, filed Feb. 12, 2020, now U.S. Pat. No. 10,933,286.

This application is a continuation-in-part of U.S. application Ser. No. 17/161,987, filed Jan. 29, 2021.

The disclosures of all of the above referenced applications are incorporated herein by reference.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to golf equipment, and more particularly, to golf club heads and methods to manufacturing golf club heads.

BACKGROUND

Various materials (e.g., steel-based materials, titanium-based materials, tungsten-based materials, etc.) may be used to manufacture golf club heads. By using multiple materials to manufacture golf club heads, the position of the center of gravity (CG) and/or the moment of inertia (MOI) of the golf club heads may be optimized to produce certain trajectory and spin rate of a golf ball.

Figure 1:
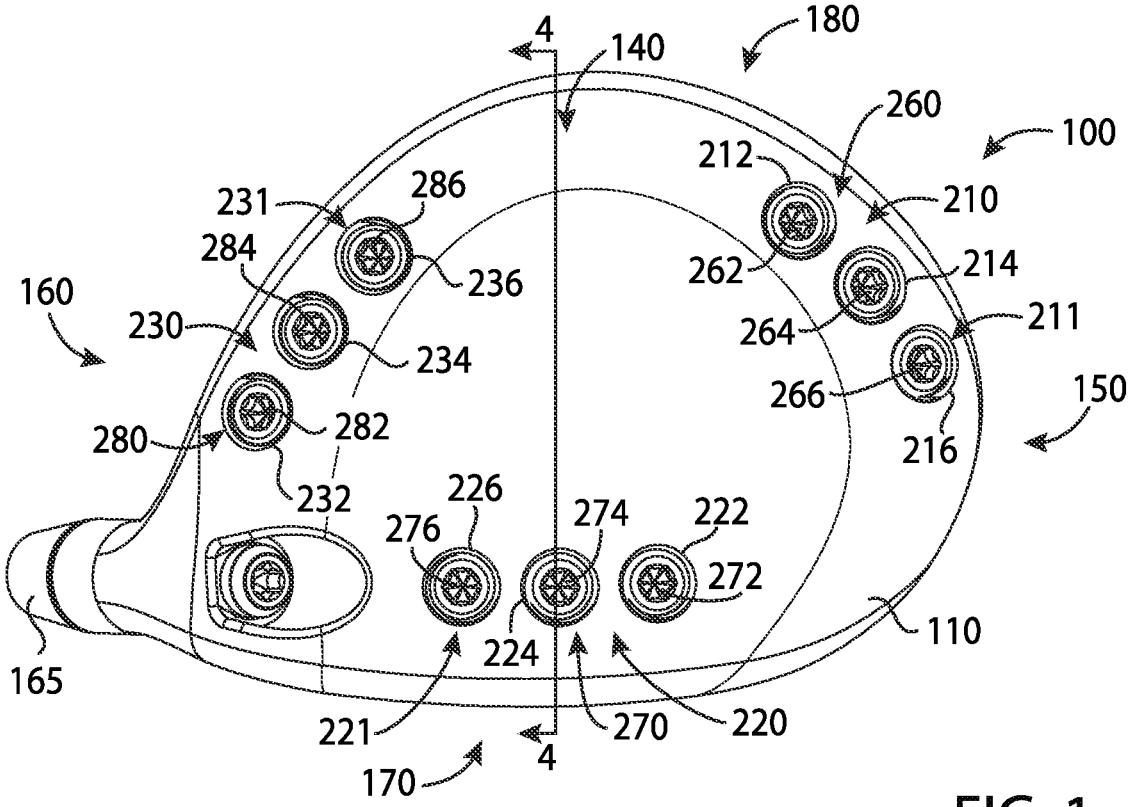
FIGS. 1, 2, 3, and 4 depict a bottom perspective view, a toe-side perspective view, a heel-side perspective view, and a cross-sectional perspective view (along line 4-4 of FIG. 1), respectively, of a golf club head according to an embodiment of the apparatus, methods, and articles of manufacture described herein.
Figure 2:
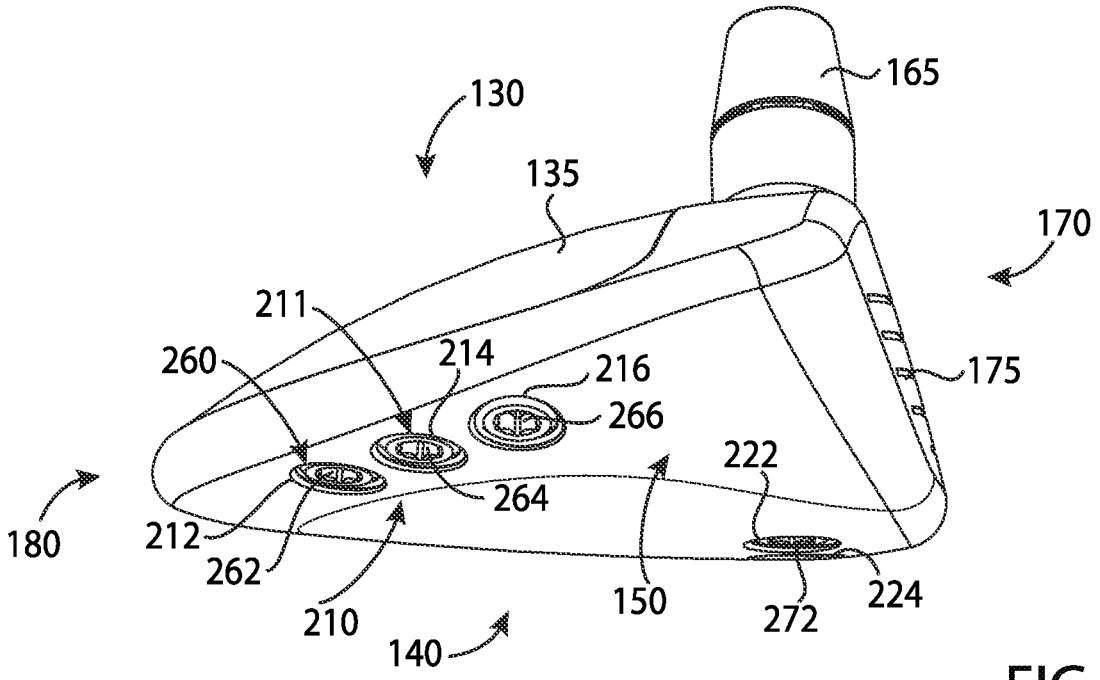
Figure 3:
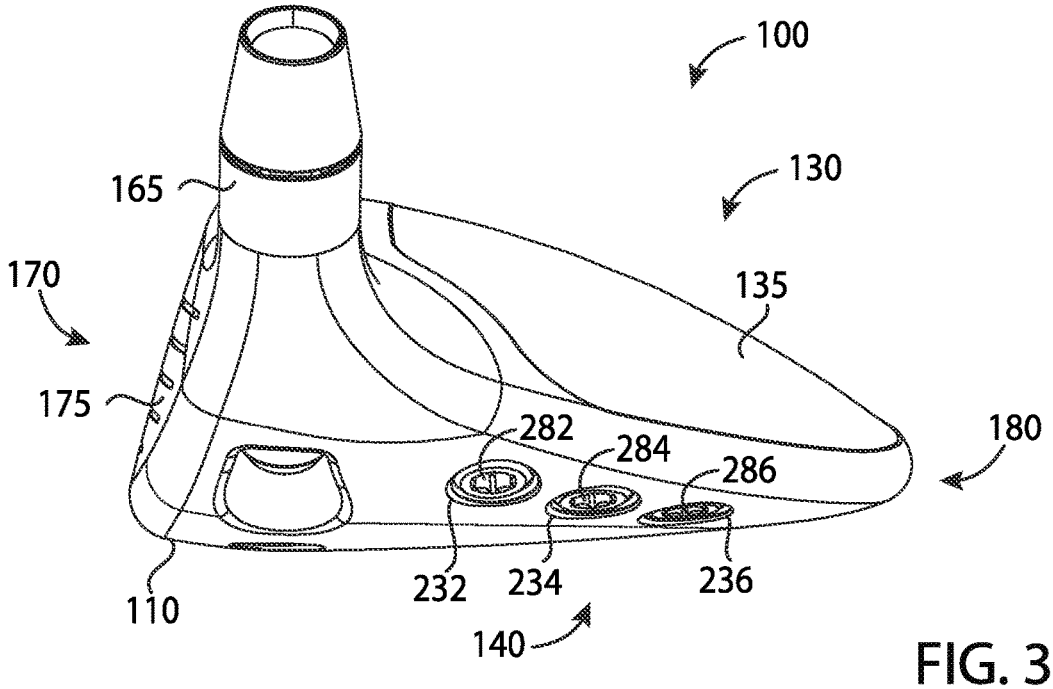

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of embodiments of the present disclosure.

DESCRIPTION

In general, golf club heads and methods to manufacture golf club heads are described herein. The apparatus, methods, and articles of manufacture described herein are not limited in this regard.

In the example of FIGS. 1-4, a golf club head 100 may include a body portion 110 with a top portion 130 having a crown portion 135, a sole portion 140 with an outer surface 142 and an inner surface 144, a toe portion 150, a heel portion 160, a front portion 170, and a back portion 180. The crown portion 135 may be a separate piece that may be attached to the top portion 130 and constructed from a composite material. The sole portion 140 may include a skirt portion (not shown) defined as a side portion of the golf club head 100 between the top portion 130 and the sole portion 140 excluding the front portion 170 and extending across a periphery of the golf club head 100 from the toe portion 150, around the back portion 180, and to the heel portion 160. The front portion 170 may include a face portion 175 to engage a golf ball (not shown). The golf club head 100 may have a neutral axis 401. The neutral axis 401 may be perpendicular to the face portion 175 and may intersect a center of the face portion 175. The body portion 110 may also include a hosel portion 165 for receiving a shaft (not shown). Alternatively, the body portion 110 may include a bore instead of the hosel portion 165. The body portion 110 may be made from any one or a combination of materials described herein or described in any of the incorporated by reference applications. A maximum front-to-rear distance of the golf club head 100 may be greater than a maximum heel-to-toe distance of the golf club head 100. Although FIGS. 1-4 may depict a particular type of golf club head (e.g., driver-type club head), the apparatus methods, and articles of manufacture described herein may be applicable to other types of club heads (e.g., a fairway wood-type club head, a hybrid-type club head, an iron-type club head, a putter-type club head). The apparatus, methods, and articles of manufacture described herein are not limited in this regard.

The sole portion 140 may include a plurality of port regions, which are shown for example as a first port region 210 with a first set of ports 211 (generally shown as ports 212, 214, and 216) near the toe portion 150, a second port region 220 with a second set of ports 221 (generally shown as ports 222, 224, and 226) near the front portion 170, and a third port region 230 with a third set of ports 231 (generally shown as ports 232, 234, and 236) near the heel portion 160. Although FIGS. 1-4 show a certain configuration of port regions and ports, the number of port regions, the number and configuration of ports in each region, and the location of the ports may be similar to any of the golf club heads described herein on in any of the incorporated by reference applications. The body portion 110 may also include a plurality of mass portions, shown as a first set of mass portions 260 (generally shown as mass portions 262, 264, and 266), a second set of mass portions 270 (generally shown as mass portions 272, 274, and 276), and a third set of mass portions 280 (generally shown as mass portions 282, 284 and 286). Each port may interchangeably receive any of the mass portions. The masses of the first set of mass portion 260, the second set of mass portions 270 and/or the third set of mass portions 280 may be similar or different. Accordingly, by using mass portions having similar or different masses in each of the ports of the first port region 210, the second port region 220 and/or the third port region 230, the overall mass in each port region and/or the mass distribution in each port region may be adjusted as described herein and in any of the incorporated by reference applications to generally optimize and/or adjust the swing weight, center of gravity, moment of inertia, and/or an overall feel of the golf club head for an individual using the golf club head 100. The apparatus, methods, and articles of manufacture described herein are not limited in this regard.

Figure 4:
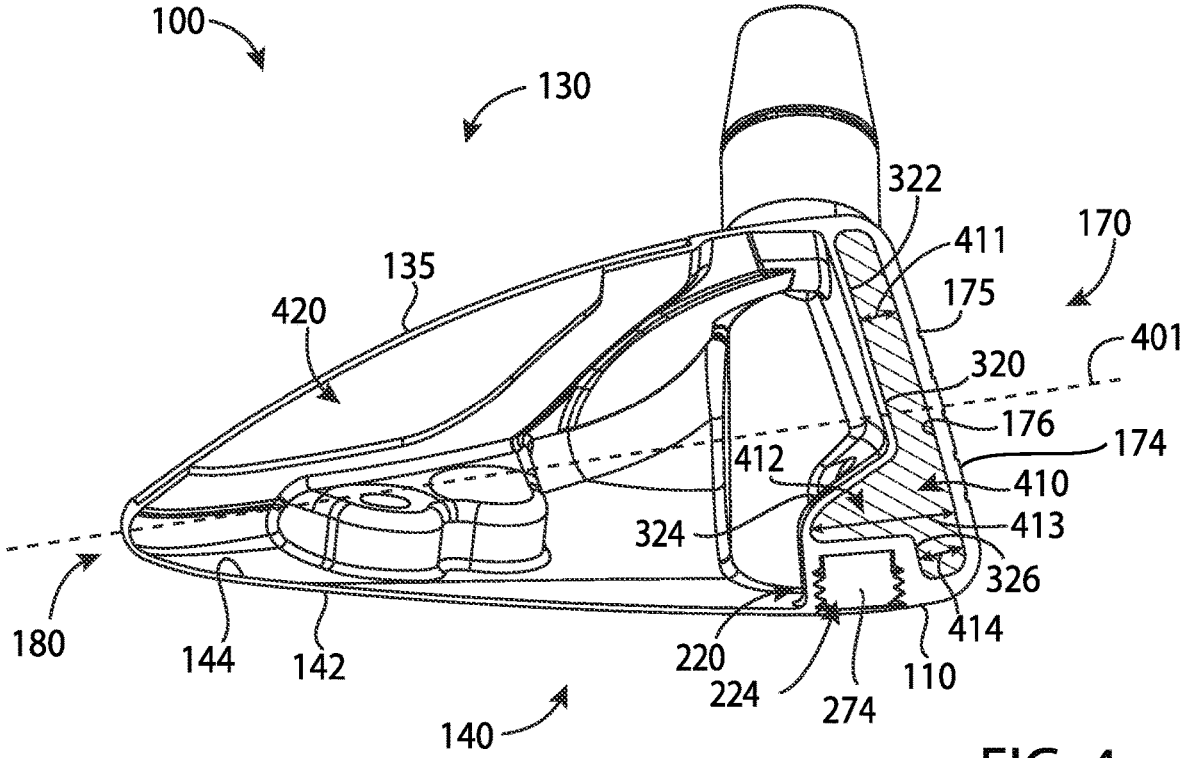

Certain regions of the interior of the body portion 110 may include a polymer material, which may also be referred to herein as the filler material, similar to any of the polymer materials described herein or described in any of the incorporated by reference applications. The filler material may dampen vibration, dampen noise, lower the center of gravity and/or provide a better feel and sound for the golf club head 100 when striking a golf ball (not shown). The golf club head 100, may have one or more interior regions and/or cavities that may include a filler material similar to any of the golf club heads described herein or described in any of the incorporated by reference applications. In one example, as shown in FIG. 4, the body portion 110 may include a cavity wall portion 320. The cavity wall portion 320 may form a first interior cavity portion 410 and a second interior cavity portion 420 within the body portion 110. The first interior cavity portion 410 and the second interior cavity portion 420 may be separated by the cavity wall portion 320. Alternatively, the first interior cavity portion 410 and the second interior cavity portion 420 may be connected through one or more openings in the cavity wall portion 320. The apparatus, methods, and articles of manufacture described herein are not limited in this regard.

As illustrated in FIG. 4, the cavity wall portion 320 may include a first wall portion 322 extending from a location at or proximate to the top portion 130 toward the sole portion 140. The first wall portion 322 may extend toward the sole portion 140 at a certain angle or orientation relative to the face portion 175. In one example, the first wall portion 322 may extend toward the sole portion 140 and away from the face portion 175. Accordingly, a first width 411 ($W_{C1}$) of the first interior cavity portion 410 may increase in a direction from the top portion 130 to the sole portion 140. In another example, the first wall portion 322 may extend toward the sole portion 140 and toward the face portion 175. Accordingly, the first width 411 of the first interior cavity portion 410 may decrease in a direction from the top portion 130 to the sole portion 140. In the illustrated example of FIG. 4, the first wall portion 322 of the of the cavity wall portion 320 may extend from a location at or proximate to the top portion 130 generally parallel or substantially parallel with the face portion 175. Accordingly, the first width 411 of the first interior cavity portion 410 may be constant or substantially constant. The apparatus, methods, and articles of manufacture described herein are not limited in this regard.

The first interior cavity portion 410 may include an enlarged cavity portion 412 between the top portion 130 and the sole portion 140. As shown in the illustrated example of FIG. 4, the enlarged cavity portion 412 extends partially or fully over the second port region 220. Accordingly, the enlarged cavity portion 412 may have a second width 413 ($W_{C2}$) of the first interior cavity portion 410 that may be greater than the first width 411 of the first interior cavity portion 410. The second width 413 may be about two times greater than the first width 411. The second width 413 may be at least two times greater than the first width 411. The enlarged cavity portion 412 may be located at least partially below the neutral axis 401 of the golf club head 100. The enlarged cavity portion 412 may be located wholly below a neutral axis 401 of the golf club head 100. The first width 411 may be located above the neutral axis 401. The second width 413 may be located below the neutral axis 401. The enlarged cavity portion 412 may be defined by a second wall portion 324 that may extend from the first wall portion 322 toward the back portion 180 and the sole portion 140, and traverse back over the second port region 220. The first interior cavity portion 410 may include a third wall portion 326 that extends from the second wall portion 324 to a location at or proximate to the sole portion 140. The first interior cavity portion 410 may have a third width 414 ($W_{C3}$) extending from the third wall portion 326 to the back surface 176 of the face portion 175. The third width 414 may be located below the enlarged cavity portion 412. The third width 414 may be located below the second width 413. The third width 414 may be less than the second width 413. The third width 414 may be substantially equal to the first width 411. As shown in the illustrated example of FIG. 4, the third width 414 may be located between the second port region 220 and the face portion 175. The third width 414 may be located proximate to the sole portion 140. In another example, the first width 411 may be similar to the second width 413 of the first interior cavity portion 410 (not shown). Accordingly, the first wall portion 322 of the cavity wall portion 320 may located farther back toward the back portion 180 than the location of the first wall portion 322 shown in FIG. 4 such that the portion of the first interior cavity portion 410 above the second port region 220 extends over the one or more ports of the second port region 220. In other examples, the first interior cavity portion 410 may be configured similar any of the interior cavities described herein and shown in FIGS. 5-13. The apparatus, methods, and articles of manufacture described herein are not limited in this regard.

In one example, the first interior cavity portion 410 may be unfilled (i.e., empty space). Alternatively, the first interior cavity portion 410 may be partially (i.e., less than 100% filled) or entirely filled with a filler material (i.e., a cavity filling portion) to absorb shock, isolate vibration, dampen noised, and/or provide structural support for the face portion. For example, at least 50% of the first interior cavity portion 410 may be filled with a TPE material to absorb shock, isolate vibration, and/or dampen noise when the golf club head 100 strikes a golf ball via the face portion 175. In one example, the first interior cavity portion 410 may be partially or entirely filled with a filler material through a port (e.g. port 224) located in the sole portion 140. In one example, as shown in FIG. 4, the port 224 may include an opening that accesses the first interior cavity portion 410. The opening may provide a fluid pathway for filler material to be introduced to the first interior cavity portion 410. The apparatus, methods, and articles of manufacture described herein are not limited in this regard.

When the face portion 175 of the golf club head 100 strikes a golf ball, the face portion 175 and the filler material may deform and/or compress. The kinetic energy of the impact may be transferred to the face portion 175 and/or the filler material. For example, some of the kinetic energy may be transformed into heat by the filler material or work done in deforming and/or compressing the filler material. Further, some of the kinetic energy may be transferred back to the golf ball to launch the golf ball at a certain velocity. A filler material with a relatively higher COR may transfer relatively more kinetic energy to the golf ball and dissipate relatively less kinetic energy. Accordingly, a filler material with a relatively high COR may generate relatively higher golf ball speeds because a relatively greater part of the kinetic energy of the impact may be transferred back to the golf ball to launch the golf ball from the golf club head 100. The apparatus, methods, and articles of manufacture described herein are not limited in this regard.

With the support of the cavity wall portion 320 to form the first interior cavity portion 410 and filling at least a portion of the first interior cavity portion 410 with a filler material, the face portion 175 may be relatively thin without degrading the structural integrity, sound, and/or feel of the golf club head 100. In one example, the face portion 175 may have a thickness of less than or equal to 0.075 inch (e.g., a distance between a front surface 174 and the back surface 176). In another example, the face portion 175 may have a thickness of less than or equal to 0.2 inch. In another example, the face portion 175 may have a thickness of less than or equal to 0.06 inch. In yet another example, the face portion 175 may have a thickness of less than or equal to 0.05 inch. Further, the face portion 175 may have a thickness of less than or equal to 0.03 inch. In yet another example, a thickness of the face portion 175 may be greater than or equal to 0.03 inch and less than or equal to 0.2 inch. The apparatus, methods, and articles of manufacture described herein are not limited in this regard.

In the illustrated example of FIGS. 1-4, the second interior cavity portion 420 may be unfilled (i.e., empty space). Alternatively (not shown), the second interior cavity portion 420 may be partially or entirely filled with a filler material (i.e., a cavity filling portion), which may include one or more similar or different types of materials described herein and may be different or similar to the filler material used to fill the first interior cavity portion 410. The apparatus, methods, and articles of manufacture described herein are not limited in this regard.

Figure 5:
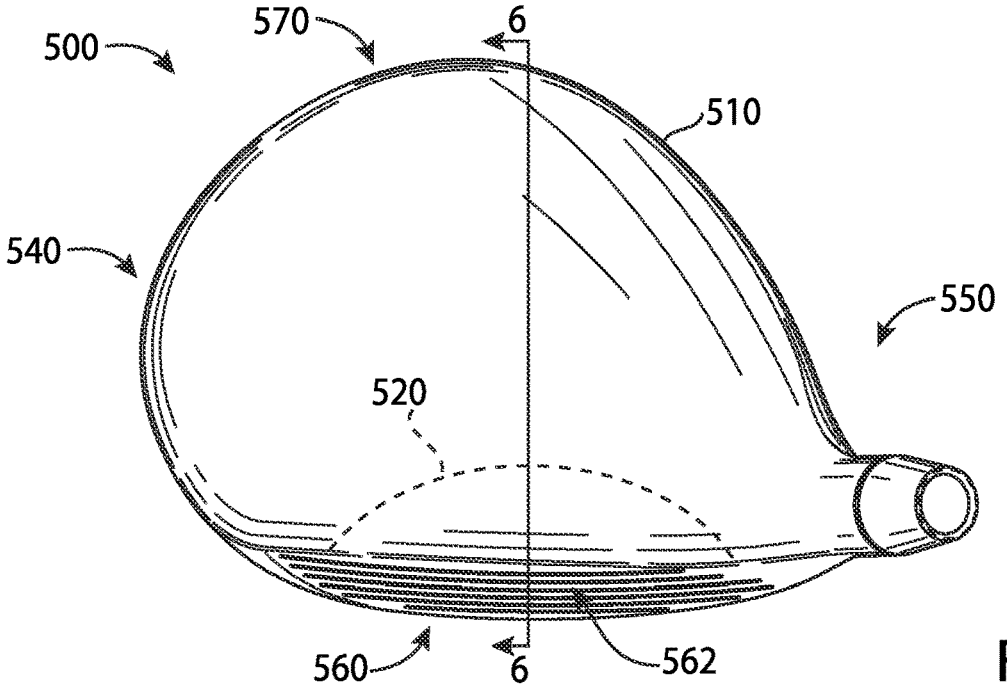
FIGS. 5, 6, and 7 depict a top view, a schematic cross-sectional view (along line 6-6 of FIG. 5), and a front view, respectively, of a golf club head according to an embodiment of the apparatus, methods, and articles of manufacture described herein.
Figure 6:
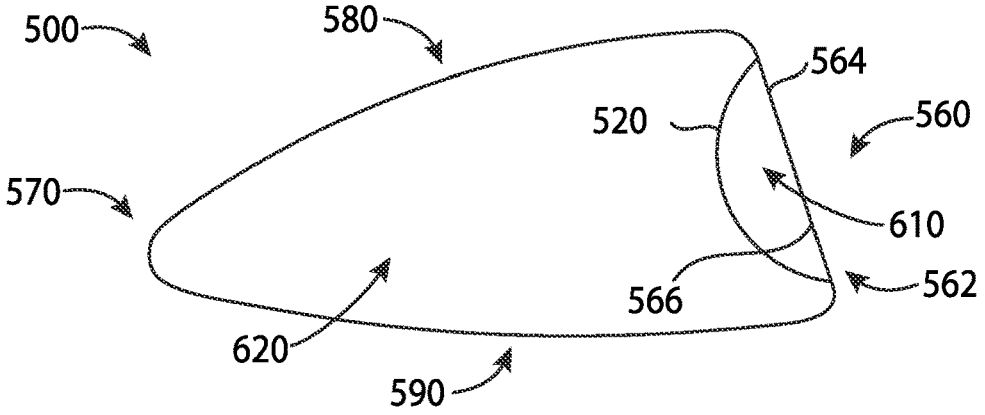
Figure 7:
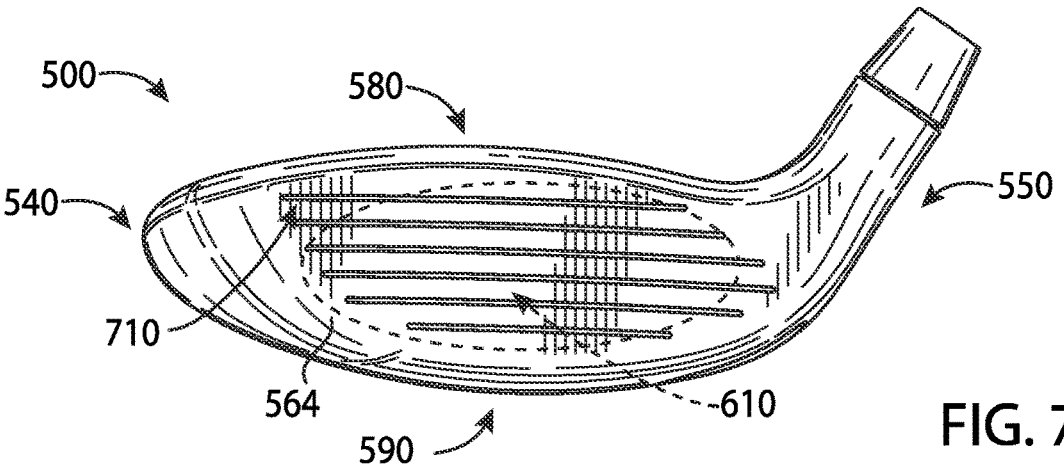

While each of the examples herein may describe a certain type of golf club head, the apparatus, methods, and articles of manufacture described herein may be applicable to other types of golf club heads. Referring to FIGS. 5-7, for example, a golf club head 500 may include a body portion 510 and a cavity wall portion 520. Although FIGS. 5-7 may depict a particular type of club head (e.g., a fairway wood-type club head), the apparatus, methods, and articles of manufacture described herein may be applicable to other types of club head (e.g., a driver-type club head, a hybrid-type club head, an iron-type club head, a putter-type club head, etc.). The apparatus, methods, and articles of manufacture described herein are not limited in this regard.

The body portion 510 may include a toe portion 540, a heel portion 550, a front portion 560, a back portion 570, a top portion 580 (e.g., a crown portion), and a sole portion 590 (e.g., a sole portion). The front portion 560 may include a face portion 562 (e.g., a strike face). The face portion 562 may include a front surface 564 and a back surface 566. As generally shown in FIG. 7, the front surface 564 may include a plurality of grooves 710. The cavity wall portion 520 may form a first interior cavity portion 610 and a second interior cavity portion 620 within the body portion 510. As illustrated in FIG. 6, for example, the cavity wall portion 520 may extend from the back surface 566 of the face portion 562. The cavity wall portion 520 may be a single curved wall section. In particular, the cavity wall portion 520 may have a convex arc profile relative to the back surface 566 (e.g., C shape) to form a dome-like structure with an elliptical base (e.g., FIG. 7) or a circular base on the back surface 566. In another example, the cavity wall portion 520 may form a cone-like structure or a cylinder-like structure with the body portion 510. Alternatively, the cavity wall portion 520 may be a concave arc profile relative to the back surface 566. The apparatus, methods, and articles of manufacture described herein are not limited in this regard.

The first interior cavity portion 610 may be partially or entirely filled with a suitable filler material such as any of the filler materials described herein or described in any of the incorporated by reference applications to absorb shock, isolate vibration, dampen noise, and/or provide structural support. The elastic polymer material may be injected into the first interior cavity portion 610 via an injection molding process via a port on the face portion 562. With the support of the cavity wall portion 520 to form the first interior cavity portion 610 and filling at least a portion of the first interior cavity portion 610 with an elastic polymer material, the face portion 562 may be relatively thin without degrading the structural integrity, sound, and/or feel of the golf club head 500. The apparatus, methods, and articles of manufacture described herein are not limited in this regard.

Figure 8:
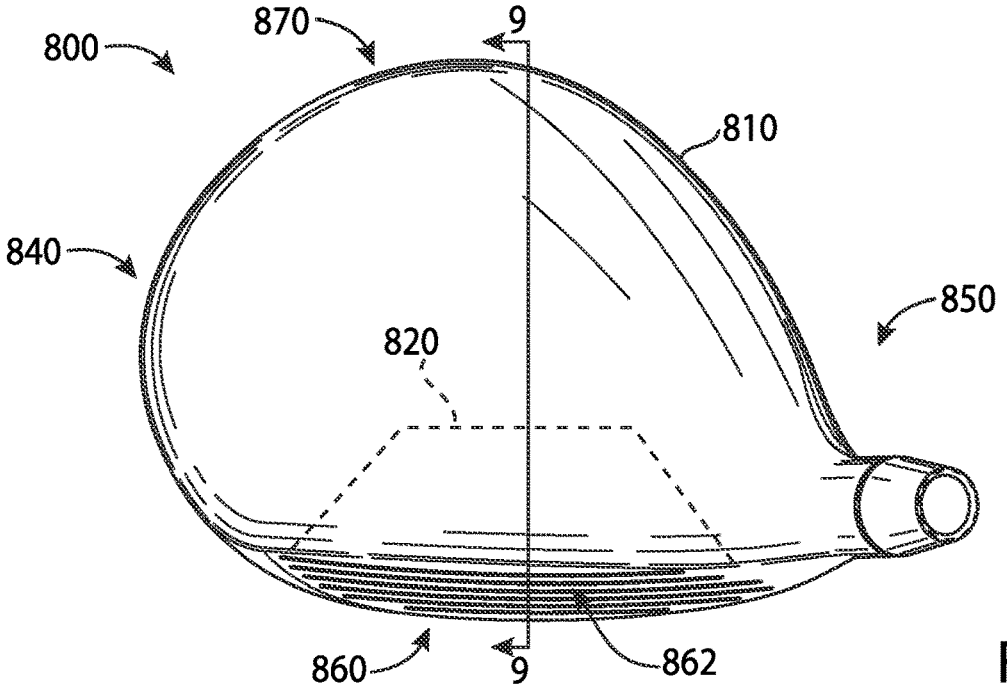
FIGS. 8, 9, and 10 depict a top view, a schematic cross-sectional view (along line 9-9 of FIG. 8), and a front view, respectively, of a golf club head according to an embodiment of the apparatus, methods, and articles of manufacture described herein.
Figure 9:
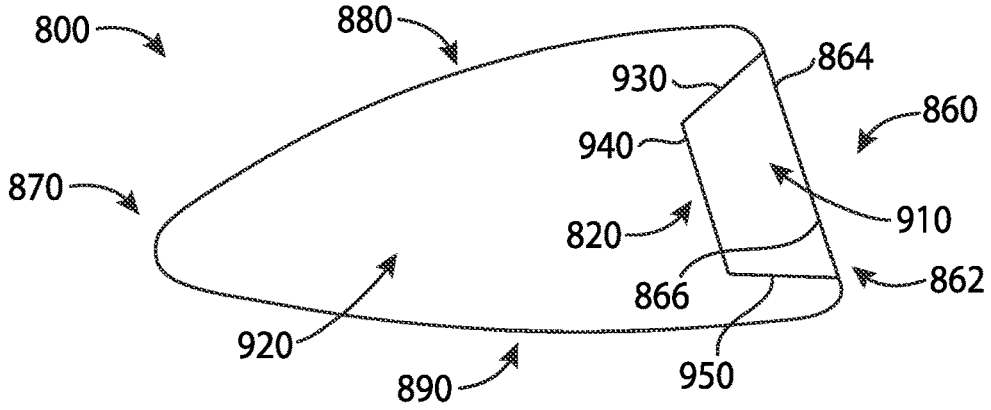
Figure 10:
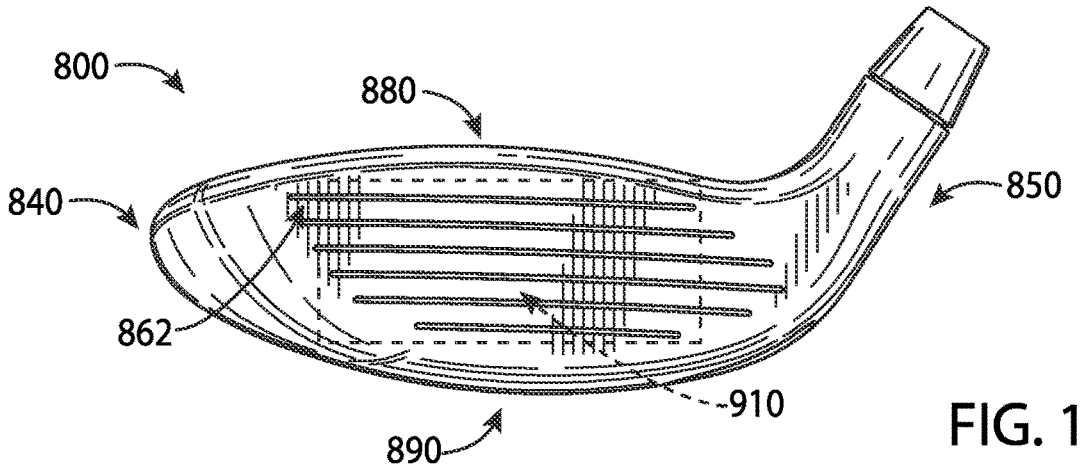

The cavity wall portion 520 may include multiple sections. Turning to FIGS. 8-10, for example, a golf club head 800 may include a body portion 810 and a cavity wall portion 820. The body portion 810 may include a toe portion 840, a heel portion 850, a front portion 860, a back portion 870, a top portion 880 (e.g., a crown portion), and a sole portion 890 (e.g., a sole portion). The front portion 860 may include a face portion 862 (e.g., a strike face) with a front surface 864 and a back surface 866. The cavity wall portion 820 may extend from the back surface 866 to form a first interior cavity portion 910 and a second interior cavity portion 920 within the body portion 810. The cavity wall portion 820 may include two or more wall sections, generally shown as wall section 930, wall section 940, and wall section 950 in FIG. 9. Similar to the first interior cavity portion 610 (FIGS. 5-7), the first interior cavity portion 910 may be partially or entirely filled with a filler material. The filler material may be injected into the first interior cavity portion 910 via an injection molding process via a port on the face portion 862. The apparatus, methods, and articles of manufacture described herein are not limited in this regard.

Figure 11:
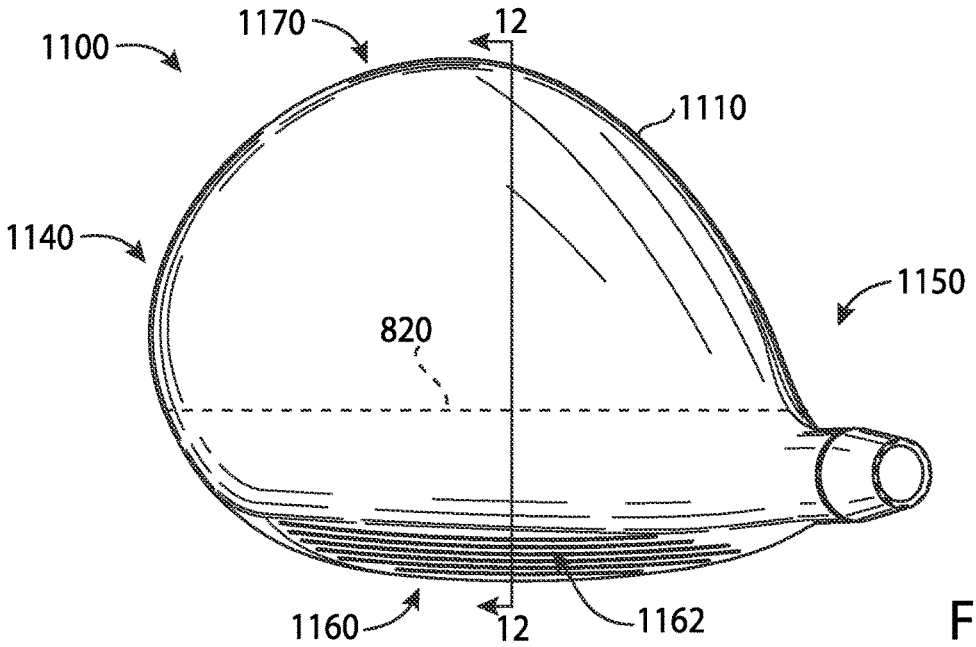
FIGS. 11, 12, and 13 depict a top view, a schematic cross-sectional view (along line 12-12 of FIG. 11), and another schematic cross-sectional view (along line 12-12 of FIG. 11), respectively, of a golf club head according to an embodiment of the apparatus, methods, and articles of manufacture described herein.
Figure 12:
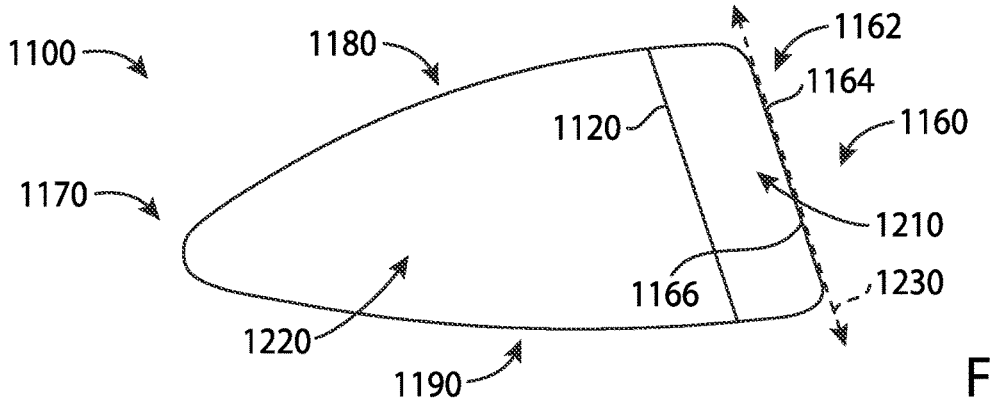
Figure 13:
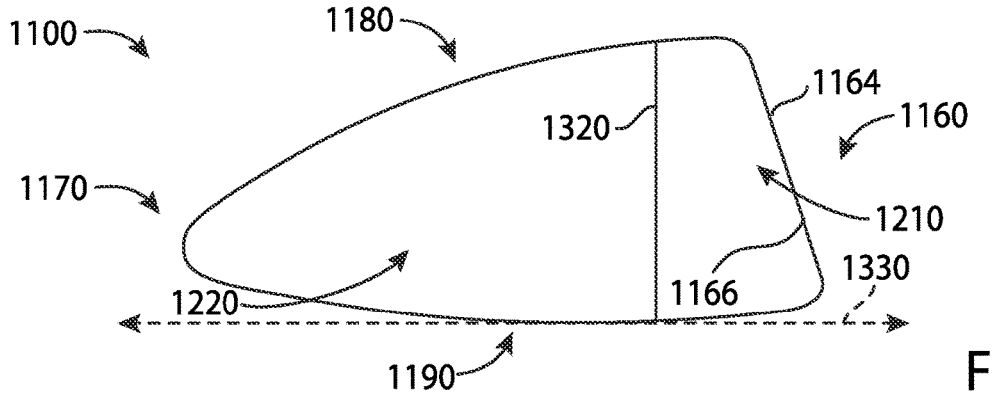
Figure 14:
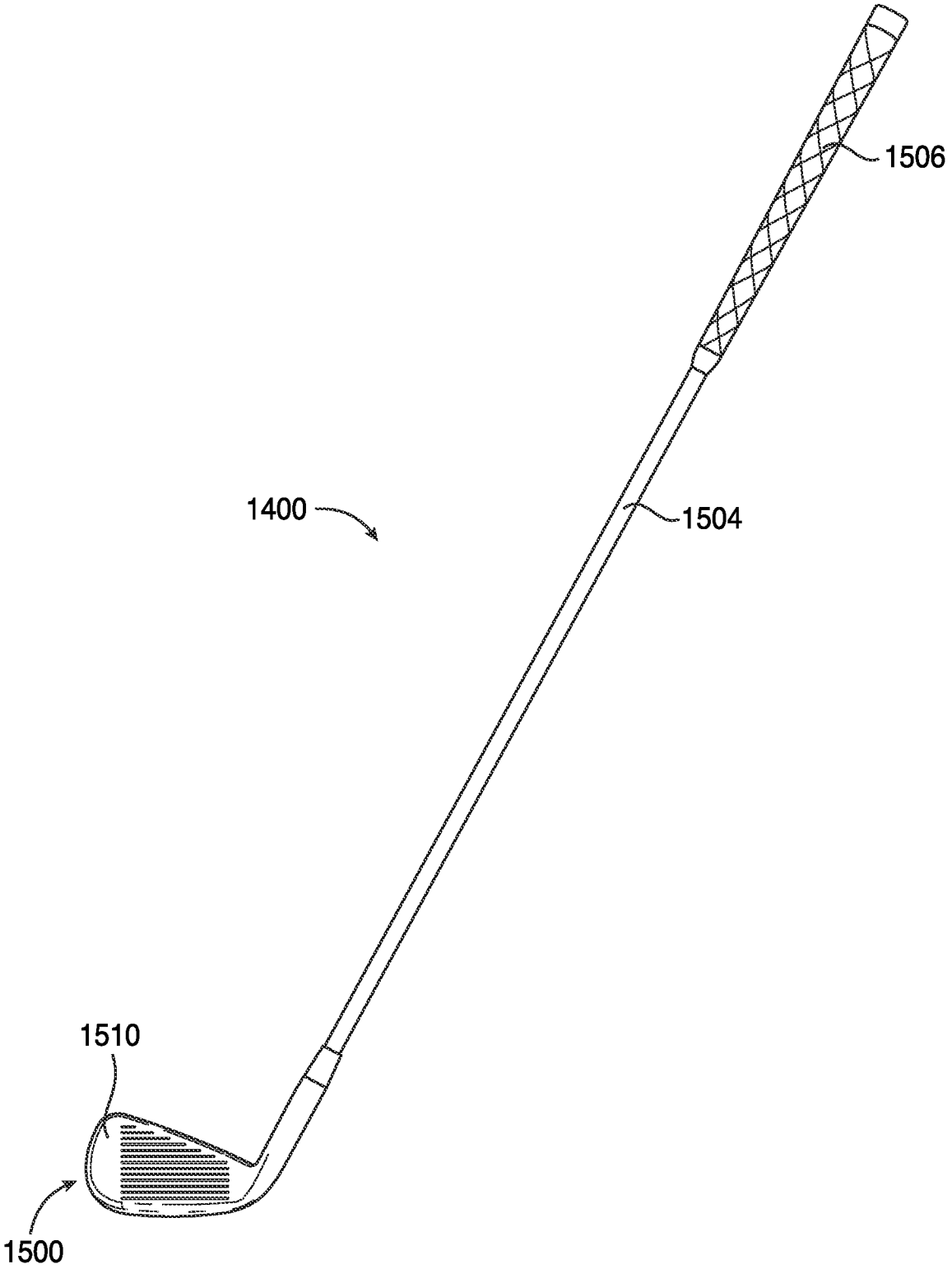
FIG. 14 depicts a front view of a golf club according to an embodiment of the apparatus, methods, and articles of manufacture described herein.
Figure 15:
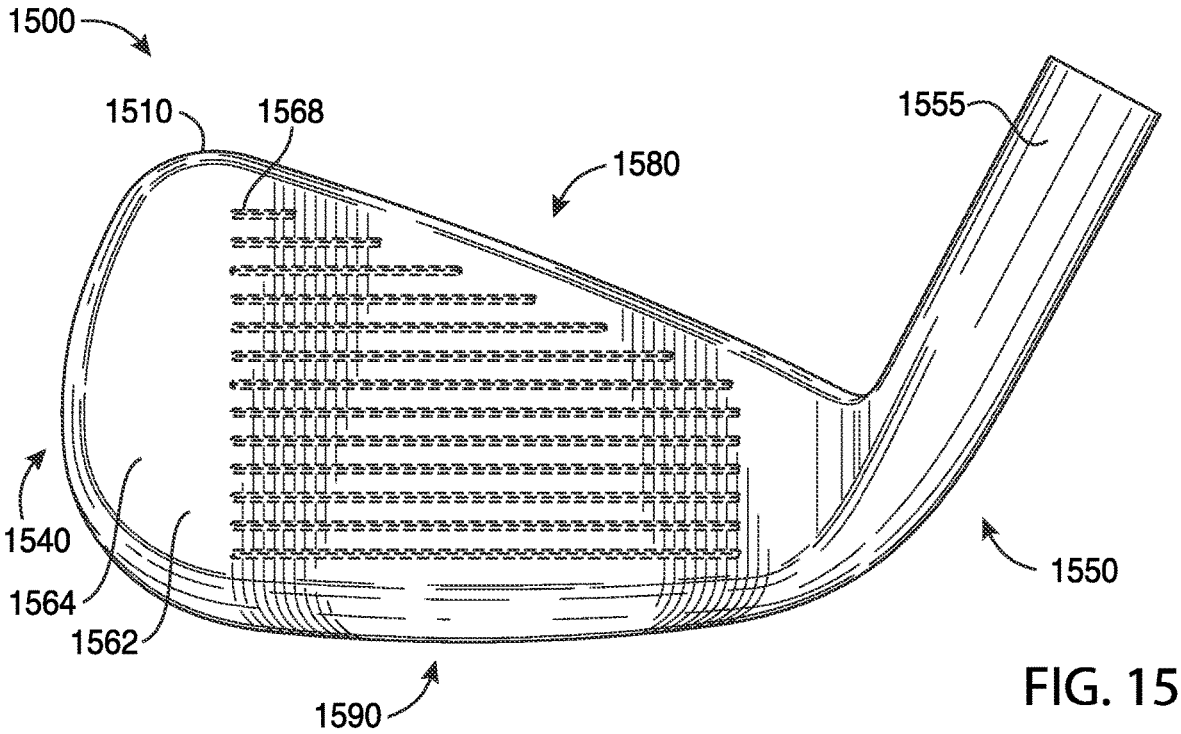
FIGS. 15, 16, 17, 18, 19, 20, 21, 22, 23, and 24 depict a front view, a rear view, a top view, a bottom view, a heel-side view, a toe-side view, a cross-sectional view along line 21-21 of FIG. 18, a cross-sectional view along line 22-22 of FIG. 17, a cross-sectional view along line 23-23 of FIG. 18, and another rear view, respectively, of a golf club head of the golf club of FIG. 14.
Figure 16:
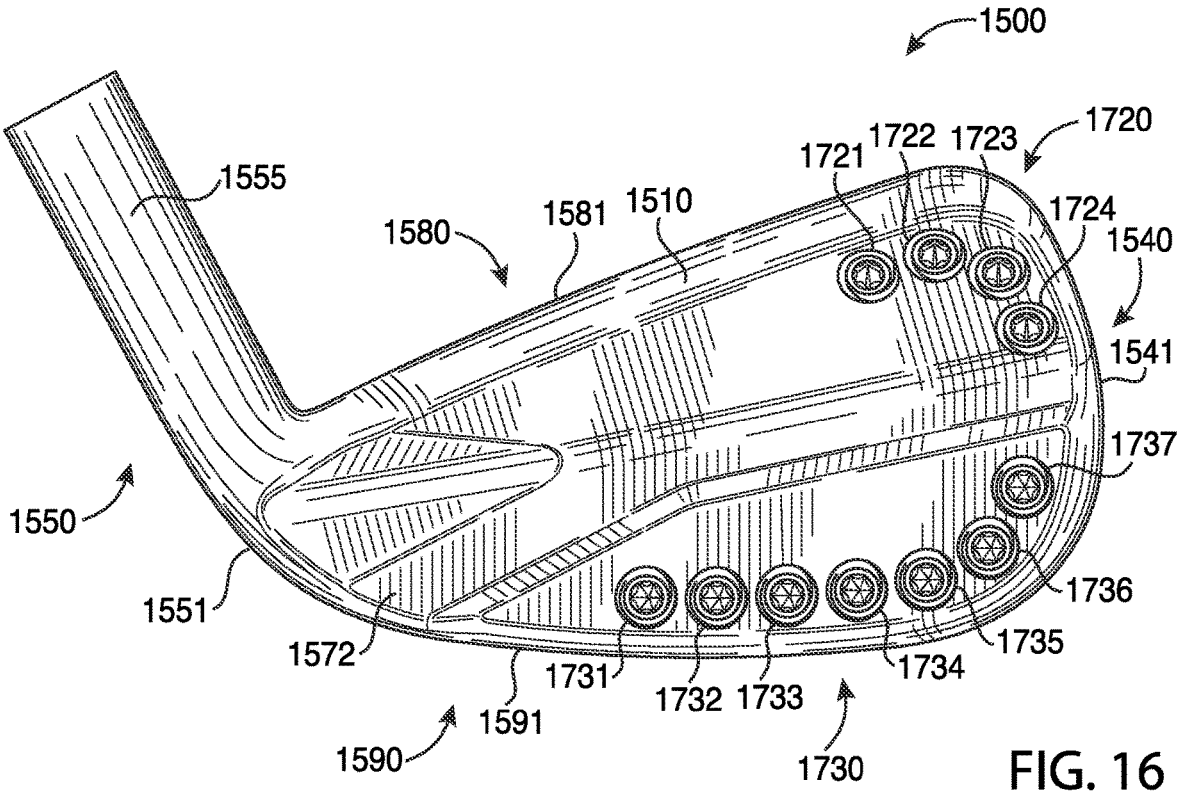
Figure 17:
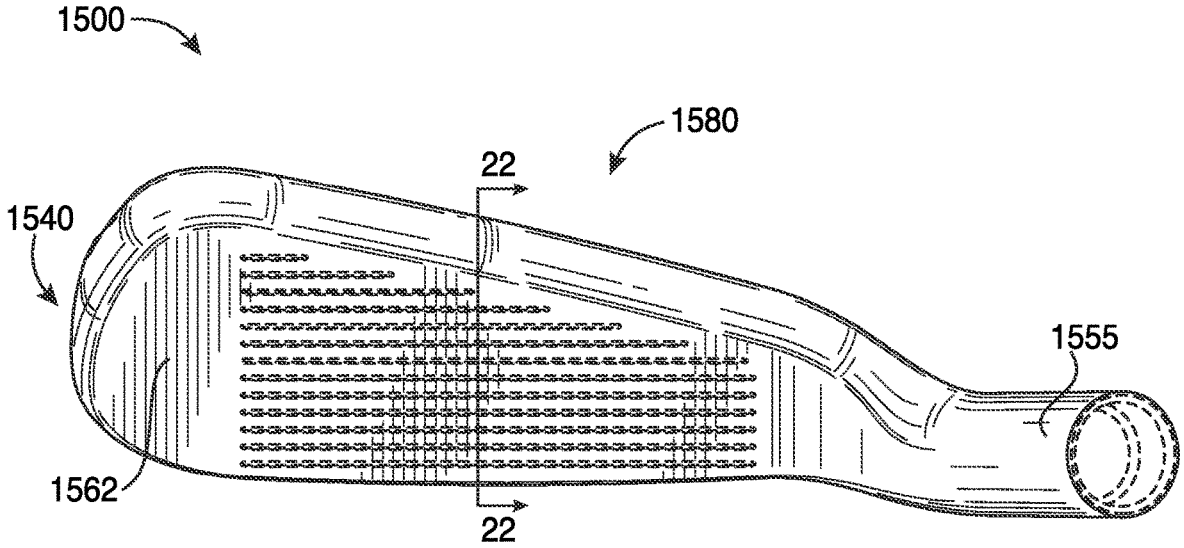
Figure 18:
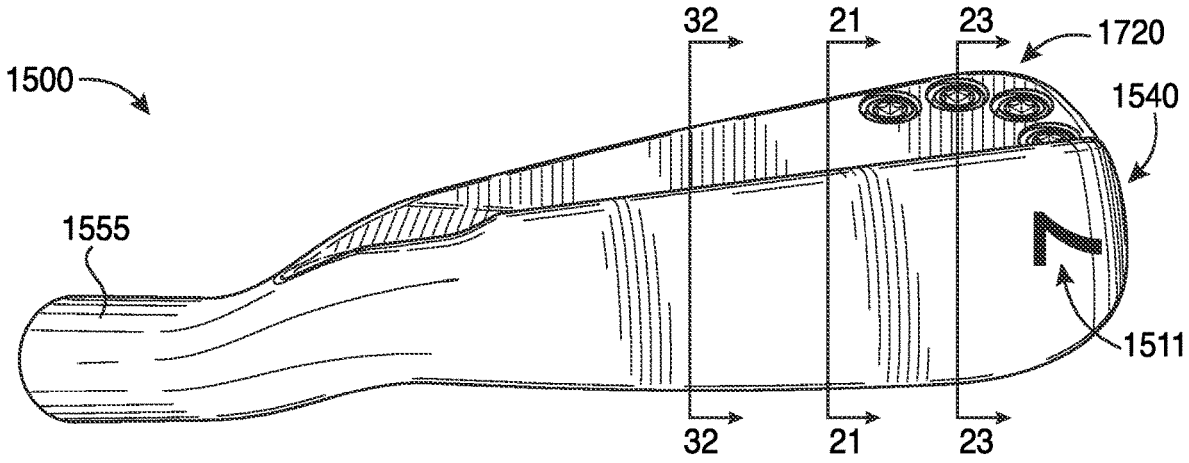
Figure 19:
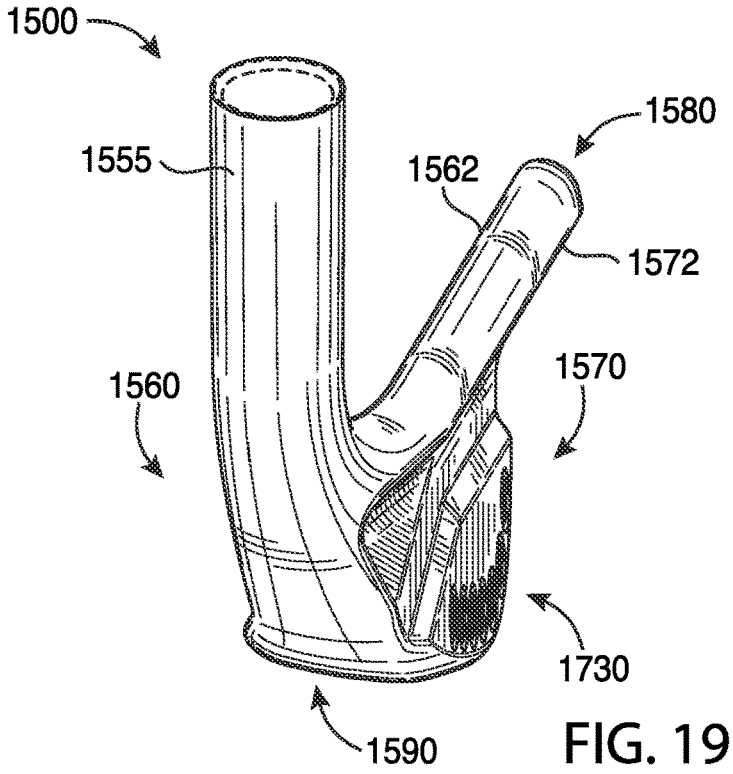

As illustrated in FIGS. 11 and 12, for example, a golf club head 1100 may include a body portion 1110 and a cavity wall portion 1120. The body portion 1110 may include a toe portion 1140, a heel portion 1150, a front portion 1160, a back portion 1170, a top portion 1180 (e.g., a crown portion), and a sole portion 1190 (e.g., a sole portion). The front portion 1160 may include a face portion 1162 (e.g., a strike face) with a front surface 1164 and a back surface 1166. The face portion 1162 may be associated with a loft plane 1230 that defines the loft angle of the golf club head 1100. The cavity wall portion 1120 may be a single flat wall section. In particular, the cavity wall portion 1120 may extend between the toe portion 1140 and the heel portion 1150 and between the top portion 1180 and the sole portion 1190 to form a first interior cavity portion 1210 and a second interior cavity portion 1220 within the body portion 1110. The cavity wall portion 1120 may be parallel or substantially parallel to the loft plane 1230. Alternatively, as shown in FIG. 13, a cavity wall portion 1320 may be perpendicular or substantially perpendicular to a ground plane 1330. Similar to the interior cavity portion 610 (FIGS. 5-7) and interior cavity portion 910 (FIGS. 8-10), the first interior cavity portion 1210 may be partially or entirely filled with an elastic polymer or elastomer material. The elastic polymer material may be injected into the first interior cavity portion 1210 via an injection molding process via a port on the face portion 1162 and/or the sole portion 1190 as described herein or described in any of the incorporated by reference applications. The apparatus, methods, and articles of manufacture described herein are not limited in this regard.

Alternatively, the cavity wall portion 1120 may extend between the sole portion 1190 and a top-and-front transition region (i.e., a transition region between the top portion 1180 and the front portion 1160) so that the cavity wall portion 1120 and the loft plane 1230 may not be parallel to each other. In another example, the cavity wall portion 1120 may extend between the top portion 1180 and a sole-and-front transition region (i.e., a transition region between the sole portion 1190 and the front portion 1160) so that the cavity wall portion 1120 and the loft plane 1230 may be not parallel to each other. Although FIGS. 11-13, may depict the cavity wall portion 1120 and the cavity wall portion 1320 being flat or substantially flat, the cavity wall portion 1120 and/or the cavity wall portion 1320 may be concave or convex relative to the face portion 1162. The apparatus, methods, and articles of manufacture described herein are not limited in this regard.

While above examples may describe a cavity wall portion dividing an interior cavity of a hollow body portion to form two separate interior cavities with one interior cavity partially or entirely filled with an elastic polymer material, the apparatus, methods, and articles of manufacture described herein may include two or more cavity wall portions dividing an interior cavity of a hollow body portion to form three or more separate interior cavities with at least two interior cavities partially or entirely filled with an elastic polymer material. In one example, one interior cavity may be partially or entirely filled with a TPE material whereas another interior cavity may be partially or entirely filled with a TPU material. The apparatus, methods, and articles of manufacture described herein are not limited in this regard.

In the example of FIGS. 14-35, a golf club 1400 may include a golf club head 1500, a shaft 1504, and a grip 1506. The golf club head 1500 may be attached to one end of the shaft 1504 and the grip 1506 may be attached to the opposite end of the shaft 1504. An individual can hold the grip 1506 and swing the golf club head 1500 with the shaft 1504 to strike a golf ball (not shown). The golf club head 1500 may include a body portion 1510 having a toe portion 1540 with a toe portion edge 1541, a heel portion 1550 with a heel portion edge 1551, a front portion 1560 with a face portion 1562 (e.g., a strike face) having a front surface 1564 and a back surface 1566, a back portion 1570 with a back wall portion 1572, a top portion 1580 with a top portion edge 1581, and a sole portion 1590 with a sole portion edge 1591. The sole portion edge 1591 may include a marking 1511 such as a numerical identifier that may identify the type of golf club (e.g., 4-iron, 7-iron, etc.). The toe portion 1540, the heel portion 1550, the front portion 1560, the back portion 1570, the top portion 1580, and/or the sole portion 1590 may partially overlap each other. For example, a portion of the toe portion 1540 may overlap portion(s) of the front portion 1560, the back portion 1570, the top portion 1580, and/or the sole portion 1590. In a similar manner, a portion of the heel portion 1550 may overlap portion(s) of the front portion 1560, the back portion 1570, the top portion 1580, and/or the sole portion 1590. In another example, a portion of the back portion 1570 may overlap portion(s) of the toe portion 1540, the heel portion 1550, the top portion 1580, and/or the sole portion 1590. The apparatus, methods, and articles of manufacture described herein are not limited in this regard.

The golf club head 1500 may be an iron-type golf club head (e.g., a 1-iron, a 2-iron, a 3-iron, a 4-iron, a 5-iron, a 6-iron, a 7-iron, an 8-iron, a 9-iron, etc.) or a wedge-type golf club head (e.g., a pitching wedge, a lob wedge, a sand wedge, an n-degree wedge such as 44 degrees)(°, 48°, 52°, 56°, 60°, etc.). Although FIGS. 14-35 may depict a particular type of club head, the apparatus, methods, and articles of manufacture described herein may be applicable to other types of club heads (e.g., a driver-type club head, a fairway wood-type club head, a hybrid-type club head, a putter-type club head, etc.). The apparatus, methods, and articles of manufacture described herein are not limited in this regard.

The toe portion 1540 may include a portion of the body portion 1510 opposite of the heel portion 1550. The heel portion 1550 may include a hosel portion 1555 configured to receive a shaft (a shaft 1504 shown for example in FIG. 14) with a grip (a grip 1506 shown for example in FIG. 14) on one end and the golf club head 1500 on the opposite end of the shaft to form a golf club 1400. The front surface 1564 of the face portion 1562 may include one or more score lines, slots, or grooves 1568 extending to and/or between the toe portion 1540 and the heel portion 1550. While the figures may depict a particular number of grooves, the apparatus, methods, and articles of manufacture described herein may include more or less grooves. The face portion 1562 may be used to impact a golf ball (not shown). The face portion 1562 may be an integral portion of the body portion 1510. Alternatively, the face portion 1562 may be a separate piece or an insert coupled to the body portion 1510 via various manufacturing methods and/or processes (e.g., a bonding process such as adhesive, a welding process such as laser welding, a brazing process, a soldering process, a fusing process, a mechanical locking or connecting method, any combination thereof, or other suitable types of manufacturing methods and/or processes). The face portion 1562 may be associated with a loft plane 1567 that defines the loft angle 1569 of the golf club head 1500. The loft angle 1569 defines an angle between the loft plane 1567 and a vertical plane 1596. The loft angle 1569 may vary based on the type of golf club (e.g., a long iron, a middle iron, a short iron, a wedge, etc.). In one example, the loft angle may be between five degrees and seventy-five degrees. In another example, the loft angle may be between twenty degrees and sixty degrees. The apparatus, methods, and articles of manufacture described herein are not limited in this regard.

Figure 20:
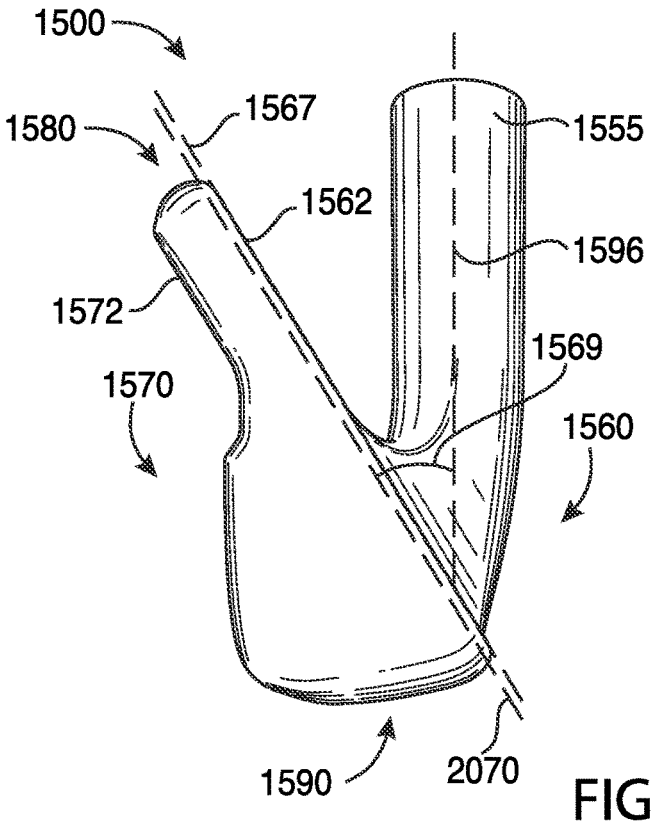

The back portion 1570 may include a portion of the body portion 1510 opposite of the front portion 1560. In one example, the back portion 1570 may be a portion of the body portion 1510 behind the back surface 1566 of the face portion 1562. As shown in FIG. 20, for example, the back portion 1570 may be a portion of the body portion 1510 behind a plane 2070 defined by the back surface 1566 of the face portion 1562. In another example, as shown in FIG. 20, the plane 2070 may be parallel to the loft plane 1567 of the face portion 1562. As mentioned above, for example, the face portion 1562 may be a separate piece or an insert coupled to the body portion 1510. Accordingly, the back portion 1570 may include remaining portion(s) of the body portion 1510 other than the face portion 1562. The apparatus, methods, and articles of manufacture described herein are not limited in this regard.

Figure 28:
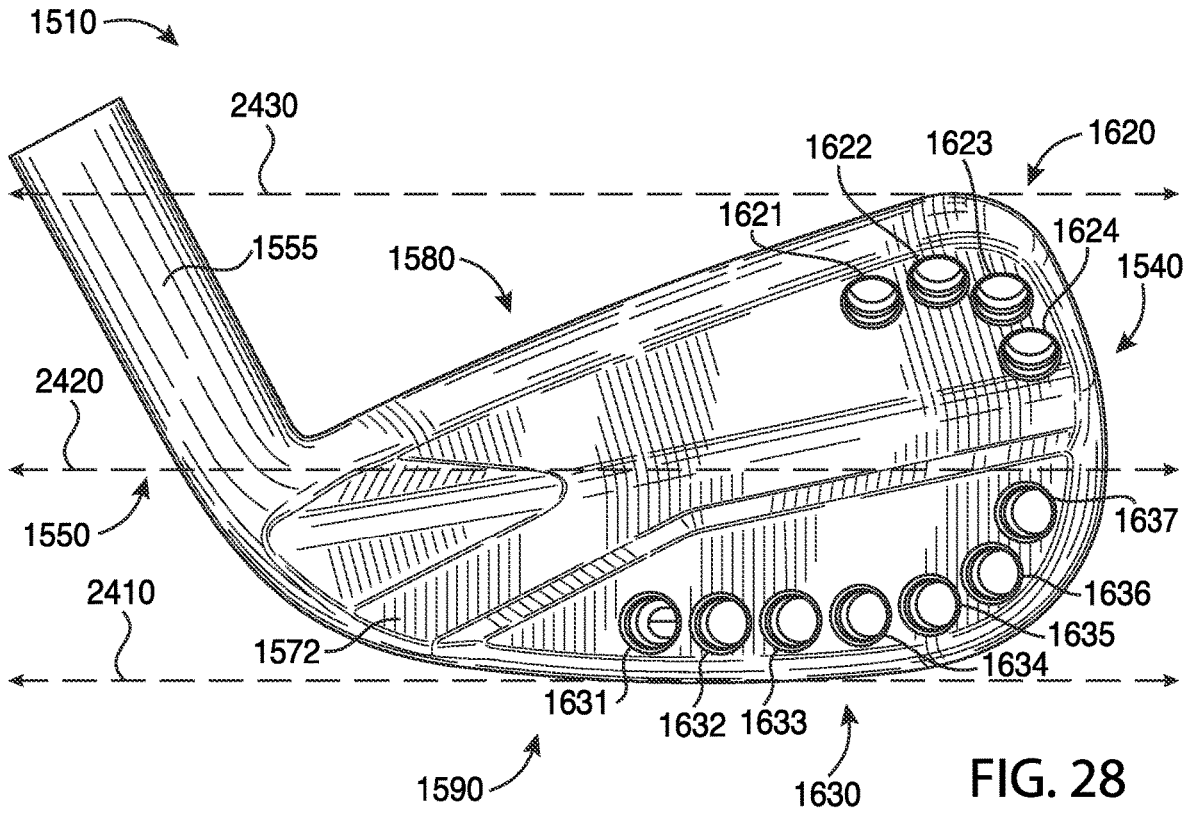
FIG. 28 depicts a rear view of the golf club head of FIG. 15.

Further, the body portion 1510 may include one or more ports, which may be exterior ports and/or interior ports (e.g., located inside the body portion 1510). The interior walls of the body portion 1510 may include one or more ports. In one example, the back portion 1570 may include one or more ports (e.g., inside an interior cavity, generally shown as interior cavity 2100 in FIG. 21). In another example, the body portion 1510 may include one or more ports along a periphery of the body portion 1510. As illustrated in FIG. 28, for example, the body portion 1510 may include one or more ports on the back portion 1570, generally shown as a first set of ports 1620 (e.g., shown as ports 1621, 1622, 1623, and 1624) and a second set of ports 1630 (e.g., shown as ports 1631, 1632, 1633, 1634, 1635, 1636, and 1637). In another example, one or more ports may be on the back wall portion 1572. One or more ports may be associated with a port diameter, which may be defined as the largest distance to and/or between opposing ends or boundaries of a port. For example, a port diameter for a rectangular port (e.g., a slot, slit, or elongated rectangular opening) may refer to a diagonal length of a rectangle. In another example, a port diameter of an elliptical port may refer to the major axis of an ellipse. As shown in FIG. 28, for example, each port may have a circular shape with a port diameter equivalent to a diameter of a circle. In one example, the port diameter of the first set of ports 1620 and/or the second set of ports 1630 may be about 0.25 inch (6.35 millimeters). Any two adjacent ports of the first set of ports 1620 may be separated by less than or equal to the port diameter. In a similar manner, any two adjacent ports of the second set of ports 1630 may be separated by less than or equal to the port diameter. Some adjacent ports may be separated by greater than the port diameter. The apparatus, methods, and articles of manufacture described herein are not limited in this regard.

Figure 24:
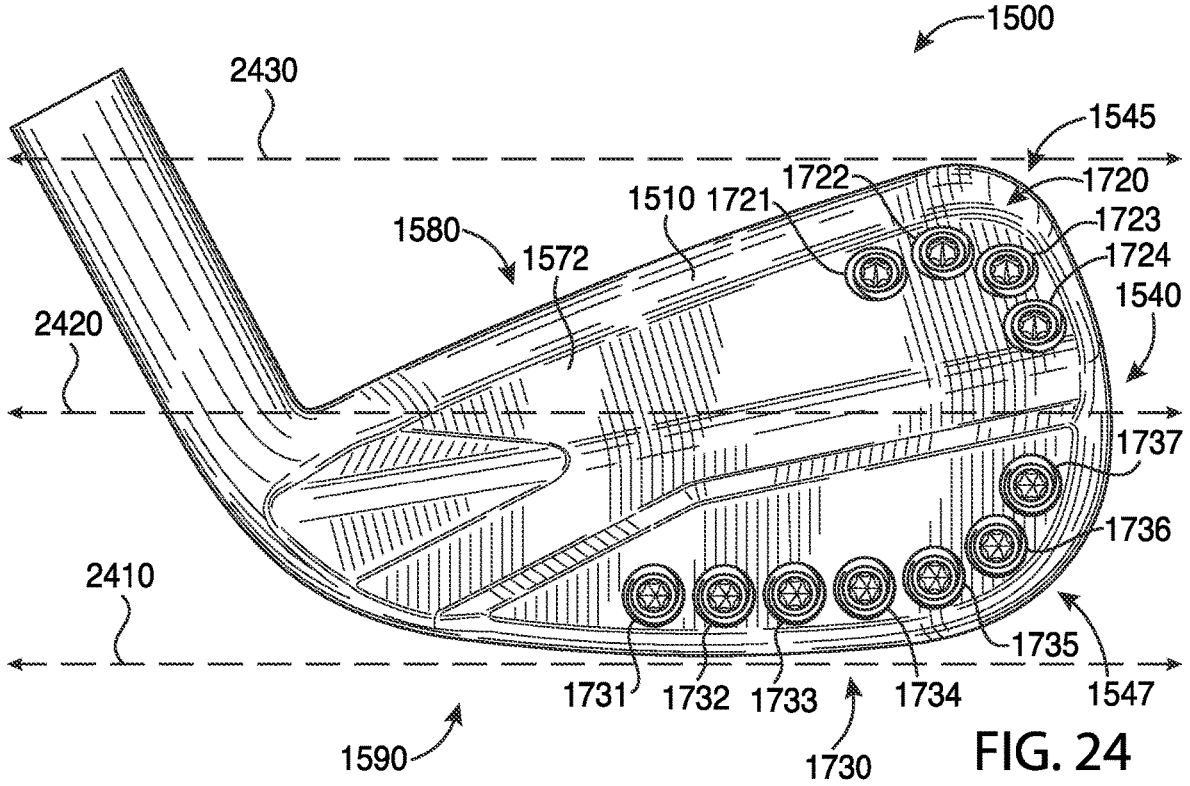

The body portion 1510 may include one or more mass portions, which may be integral mass portion(s) or separate mass portion(s) that may be coupled to the body portion 1510. In the illustrated example as shown in FIG. 24, the body portion 1510 may include a first set of mass portions 1720 (e.g., shown as mass portions 1721, 1722, 1723, and 1724) and a second set of mass portions 1730 (e.g., shown as mass portions 1731, 1732, 1733, 1734, 1735, 1736, and 1737). While the above example, may describe a particular number or portions of mass portions, a set of mass portions may include a single mass portion or a plurality of mass portions. For example, the first set of mass portions 1720 may be a single mass portion. In a similar manner, the second set of mass portions 1730 may be a single mass portion. Further, the first set of mass portions or the second set of mass portions 1730 may be a portion of the physical structure of the body portion 1510. The apparatus, methods, and articles of manufacture described herein are not limited in this regard.

The body portion 1510 may be made of a first material whereas the first set of mass portions 1720 and/or the second set of mass portions 1730 may be made of a second material. The first material and the second material may be similar or different materials. For example, the body portion 1510 may be partially or entirely made of a steel-based material (e.g., 17-4 PH stainless steel, Nitronic® 50 stainless steel, maraging steel or other types of stainless steel), a titanium-based material, an aluminum-based material (e.g., a high-strength aluminum alloy or a composite aluminum alloy coated with a high-strength alloy), any combination thereof, non-metallic materials, composite materials, and/or other suitable types of materials. In one example, one or more mass portions of the first set of mass portions 1720 and/or the second set of mass portions 1730 may be partially or entirely made of a high-density material such as a tungsten-based material or other suitable types of materials. In another example, one more mass portions of the first set of mass portions 1720 and/or the second set of mass portions 1730 may be partially or entirely made of other suitable metal material such as a stainless steel-based material, a titanium-based material, an aluminum-based material, any combination thereof, and/or other suitable types of materials. Further, one or more mass portions of the first set of mass portions 1720 and/or the second set of mass portions 1730 may be made of different types of materials (e.g., metal core and polymer sleeve surrounding the metal core). The body portion 1510, the first set of mass portions 1720, and/or the second set of mass portions 1730 may be partially or entirely made of similar or different non-metal materials (e.g., composite, plastic, polymer, etc.). The apparatus, methods, and articles of manufacture are not limited in this regard.

One or more ports may be configured to receive a mass portion having a similar shape as the port. For example, a rectangular port may receive a rectangular mass portion. In another example, an elliptical port may receive an elliptical mass portion. As shown in FIG. 28, for example, the first set of ports 1620 and the second set of ports 1630 may be cylindrical ports configured to receive one or more cylindrical mass portions. In particular, one or more mass portions of the first set of mass portions 1720 (e.g., generally shown as mass portions 1721, 1722, 1723, and 1724) may be disposed in a port located at or proximate to the toe portion 1540 and/or the top portion 1580. For example, the mass portion 1721 may be partially or entirely disposed in the port 1621. One or more mass portions of the second set of mass portions 1730 (e.g., generally shown as mass portions 1731, 1732, 1733, 1734, 1735, 1736, and 1737) may be disposed in a port located at or proximate to the toe portion 1540 and/or the sole portion 1590. For example, the mass portion 1735 may be partially or entirely disposed in the port 1635. The first set of mass portions 1720 and/or the second set of mass portions 1730 may be coupled to the body portion 1510 with various manufacturing methods and/or processes (e.g., a bonding process, a welding process, a brazing process, a mechanical locking method, any combination thereof, or other suitable manufacturing methods and/or processes).

Alternatively, the golf club head 1500 may not include (i) the first set of mass portions 1720, (ii) the second set of mass portions 1730, or (iii) both the first set of mass portions 1720 and the second set of mass portions 1730. In particular, the body portion 1510 may not include ports at or proximate to the top portion 1580 and/or the sole portion 1590. For example, the mass of the first set of mass portions 1720 (e.g., 3 grams) and/or the mass of the second set of mass portions 1730 (e.g., 16.8 grams) may be integral part(s) of the body portion 1510 instead of separate mass portion(s). In one example, the body portion 1510 may include interior and/or exterior integral mass portions at or proximate to the toe portion 1540 and/or at or proximate to the heel portion 1550. In another example, a portion of the body portion 1510 may include interior and/or exterior integral mass portions extending to and/or between the toe portion 1540 and the heel portion 1550. The first and/or second set of mass portions 1720 and 1730, respectively, may affect the mass, the center of gravity (CG), the moment of inertia (MOI), or other physical properties of the golf club head 1500. The apparatus, methods, and articles of manufacture described herein are not limited in this regard.

Figure 25:
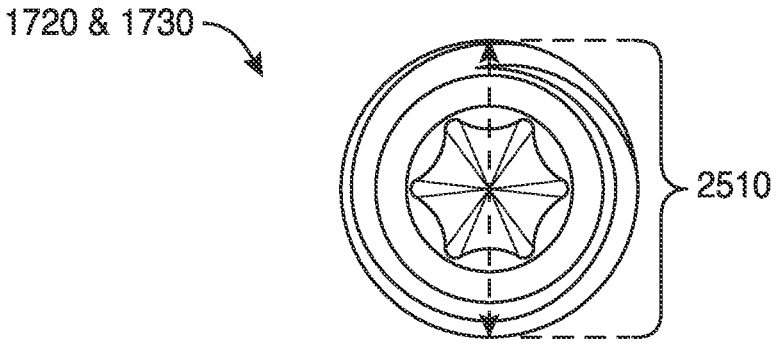
FIG. 25 depicts a top view of a mass portion associated with a golf club head according to an embodiment of the apparatus, methods, and articles of manufacture described herein.

One or more mass portions of the first set of mass portions 1720 and/or the second set of mass portions 1730 may have similar or different physical properties (e.g., color, marking, shape, size, density, mass, volume, external surface texture, materials of construction, etc.). Accordingly, the first set of mass portions 1720 and/or the second set of mass portions 1730 may contribute to the ornamental design of the golf club head 1500. In the illustrated example as shown in FIG. 25, one or more mass portions of the first set of mass portions 1720 and/or the second set of mass portions 1730 may have a cylindrical shape (e.g., a circular cross section). Alternatively, one or more mass portions of the first set of mass portions 1720 may have a first shape (e.g., a cylindrical shape) whereas one or more mass portions of the second set of mass portions 1730 may have a second shape (e.g., a cubical shape). In another example, the first set of mass portions 1720 may include two or more mass portions with different shapes (e.g., the mass portion 1721 may be a first shape whereas the mass portion 1722 may be a second shape different from the first shape). Likewise, the second set of mass portions 1730 may also include two or more mass portions with different shapes (e.g., the mass portion 1731 may be a first shape whereas the mass portion 1732 may be a second shape different from the first shape). In another example, one or more mass portions of the first set of mass portions 1720 and/or the second set of mass portions 1730 may have a different color(s), marking(s), shape(s), density or densities, mass(es), volume(s), material(s) of construction, external surface texture(s), and/or any other physical property as compared to one or more mass portions of the first set of mass portions 1720 and/or the second set of mass portions 1730. The apparatus, methods, and articles of manufacture described herein are not limited in this regard.

Although the above examples may describe mass portions having a particular shape, the apparatus, methods, and articles of manufacture described herein may include mass portions of other suitable shapes (e.g., a portion of or a whole sphere, cube, cone, cylinder, pyramid, cuboidal, prism, frustum, rectangular, elliptical, or other suitable geometric shape). While the above examples and figures may depict multiple mass portions as a set of mass portions, two or more mass portions of the first set of mass portions 1720 and/or the second set of mass portions 1730 may be a single piece of mass portion. In one example, the first set of mass portions 1720 may be a single piece of mass portion instead of a series of four separate mass portions. In another example, the second set of mass portions 1730 may be a single piece of mass portion instead of a series of seven separate mass portions. The apparatus, methods, and articles of manufacture described herein are not limited in this regard.

Figure 26:
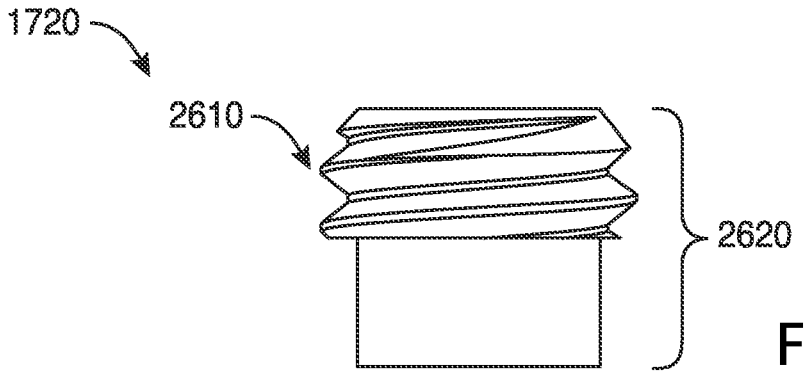
FIGS. 26 and 27 depict side views of two different mass portions associated with a golf club head according to an embodiment of the apparatus, methods, and articles of manufacture described herein.
Figure 27:
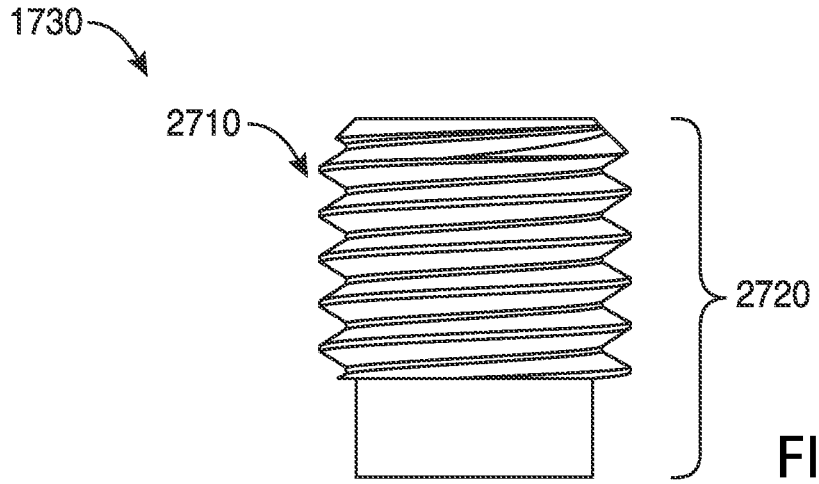

Referring to FIGS. 26 and 27, for example, the first set of mass portions 1720 and/or the second set of mass portions 1730 may include threads, generally shown as threads 2610 and threads 2710, respectively, to engage with correspondingly configured threads in the ports to secure in the ports of the back portion 1570 (e.g., generally shown as 1620 and 1630 in FIG. 28). Accordingly, one or more mass portions as described herein may be shaped similar to and function as a screw or threaded fastener for engaging threads in a port. For example, one or more mass portions of the first set of mass portions 1720 and/or the second set of mass portions 1730 may be a screw. One or more mass portions of the first set of mass portions 1720 and/or the second set of mass portions 1730 may not be readily removable from the body portion 1510 with or without a tool. Alternatively, one or more mass portions of the first set of mass portions 1720 and/or the second set of mass portions 1730 may be readily removable (e.g., with a tool) so that a relatively heavier or lighter mass portion may replace one or more mass portions of the first set of mass portions 1720 and the second set of mass portions 1730. In another example, one or more mass portions of the first set of mass portions 1720 and/or the second set of mass portions 1730 may be secured in the ports of the back portion 1570 with epoxy or adhesive so that the one or more mass portions of the first set of mass portions 1720 and/or the second set of mass portions 1730 may not be readily removable. In yet another example, one or more mass portions of the first set of mass portions 1720 and/or the second set of mass portions 1730 may be secured in the ports of the back portion 1570 with both epoxy and threads so that the one more mass portions of the first set of mass portions 1720 and/or the second set of mass portions 1730 may not be readily removable. In yet another example, one or more mass portions described herein may be press fit in a port. In yet another example, one or more mass portions described herein may be formed inside a port by injection molding. For example, a liquid metallic material (i.e., molten metal) or a plastic material (e.g. rubber, foam, or any polymer material) may be injected into a port. After the liquid material is cooled and/or cured inside the port, the resulting solid material (e.g., a metal material, a plastic material, or a combination thereof), may be a mass portion. The apparatus, methods, and articles of manufacture described herein are not limited in this regard.

As mentioned above, one or more mass portions of the first set of mass portions 1720 and/or the second set of mass portions 1730 may be similar in some physical properties but different in other physical properties. For example, a mass portion may be made from an aluminum-based material or an aluminum alloy whereas another mass portion may be made from a tungsten-based material or a tungsten alloy. In another example, a mass portion may be made from a polymer material whereas another mass portion may be made from a steel-based material. In yet another example, as illustrated in FIG. 25, one or more mass portions of the first set of mass portions 1720 and/or the second set of mass portions 1730 may have a diameter 2510 of about 0.25 inch (6.35 millimeters) but one or more mass portions of the first set of mass portions 1720 and/or the second set of mass portions 1730 may be different in height. In particular, one or more mass portions of the first set of mass portions 1720 may be associated with a first height 2620 (FIG. 26), and one or more mass portions of the second set of mass portions 1730 may be associated with a second height 2720 (FIG. 27). The first height 2620 may be relatively shorter than the second height 2720. In one example, the first height 2620 may be about 0.125 inch (3.175 millimeters) whereas the second height 2720 may be about 0.3 inch (7.62 millimeters). In another example, the first height 2620 may be about 0.16 inch (4.064 millimeters) whereas the second height 2720 may be about 0.4 inch (10.16 millimeters). Alternatively, the first height 2620 may be equal to or greater than the second height 2720. Although the above examples may describe particular dimensions, one or more mass portions described herein may have different dimensions. The apparatus, methods, and articles of manufacture described herein are not limited in this regard.

Referring to FIGS. 24 and 28, for example, the golf club head 1500 may be associated with a ground plane 2410, a horizontal midplane 2420, and a top plane 2430. In particular, the ground plane 2410 may be a tangential plane to the sole portion 1590 of the golf club head 1500 when the golf club head 1500 is at an address position (e.g., the golf club head 1500 is aligned to strike a golf ball). A top plane 2430 may be a tangential plane to the top portion 1580 of the golf club head 1500 when the golf club head 1500 is at the address position. The ground plane 2410 and the top plane 2430 may be substantially parallel to each other. The horizontal midplane 2420 may be vertically halfway between the ground plane 2410 and the top plane 2430.

The body portion 1510 may include any number of ports (e.g., no ports, one port, two ports, etc.) above the horizontal midplane 2420 and/or below the horizontal midplane 2420. In one example, the body portion 1510 may include a greater number of ports below the horizontal midplane 2420 than above the horizontal midplane 2420. In the illustrated example as shown in FIG. 28, the body portion 1510 may include four ports (e.g., generally shown as ports 1621, 1622, 1623, and 1624) above the horizontal midplane 2420 and seven ports (e.g., generally shown as ports 1631, 1632, 1633, 1634, 1635, 1636, and 1637) below the horizontal midplane 2420. In another example (not shown), the body portion 1510 may include two ports above the horizontal midplane 2420 and five ports below the horizontal midplane 2420. In yet another example (not shown), the body portion 1510 may not have any ports above the horizontal midplane 2420 but have one or more ports below the horizontal midplane 2420. Accordingly, the body portion 1510 may have more ports below the horizontal midplane 2420 than above the horizontal midplane 2420. Further, the body portion 1510 may include a port at or proximate to the horizontal midplane 2420 with a portion of the port above the horizontal midplane 2420 and a portion of the port below the horizontal midplane 2420. Accordingly, the port may be (i) above the horizontal midplane 2420, (ii) below the horizontal midplane 2420, or (iii) both above and below the horizontal midplane 2420. The apparatus, methods, and articles of manufacture described herein are not limited in this regard.

To provide optimal perimeter weighting for the golf club head 1500, the first set of mass portions 1720 (e.g., generally shown as mass portions 1721, 1722, 1723, and 1724) may be configured to counter-balance the mass of the hosel portion 1555. For example, as shown in FIG. 24, the first set of mass portions 1720 (e.g., generally shown as mass portions 1721, 1722, 1723 and 1724) may be located at or near the periphery of the body portion 1510 and extend from the top portion 1580 to a transition region 1545 between the top portion 1580 and the toe portion 1540, and from the transition region 1545 to the toe portion 1540. In other words, the first set of mass portions 1720 may be located on the golf club head 1500 at a generally opposite location relative to the hosel portion 1555. In another example, at least a portion of the first set of mass portions 1720 may be located near the periphery of the body portion 1510 and extend through the transition region 1545. In another example, at least a portion of the first set of mass portions 1720 may extend at or near the periphery of the body portion 1510 and extend along a portion of the top portion 1580. In yet another example, at least a portion of the first set of mass portions 1720 may extend at or near the periphery of the body portion 1510 and extend along a portion of the toe portion 1540. Further, the first set of mass portions 1720 may be above the horizontal midplane 2420 of the golf club head 1500. For example, the first set of mass portions 1720 may be at or near the horizontal midplane 2420. In another example, a portion of the first set of mass portions 1720 may be at or above the horizontal midplane 2420 and another portion of the first set of mass portions 1720 may be at or below the horizontal midplane 2420. Accordingly, a set of mass portions, which may be a single mass portion, may have portions above the horizontal midplane 2420 and below the horizontal midplane 2420. The apparatus, methods, and articles of manufacture described herein are not limited in this regard.

At least a portion of the first set of mass portions 1720 may be at or near the toe portion 1540 to increase the MOI of the golf club head 1500 about a vertical axis of the golf club head 1500 that extends through the CG of the golf club head 1500. Accordingly, the first set of mass portions 1720 may be at or near the periphery of the body portion 1510 and extend through the top portion 1580 and/or the toe portion 1540 to counter-balance the mass of the hosel portion 1555 and/or increase the MOI of the golf club head 1500. The locations of the first set of mass portions 1720 (i.e., the locations of the first set of ports 1620) and the physical properties and materials of construction of the first set of mass portions 1720 may be determined to optimally affect the mass, mass distribution, CG, MOI, structural integrity and/or or other static and/or dynamic characteristics of the golf club head 1500. The apparatus, methods, and articles of manufacture described herein are not limited in this regard.

The second set of mass portions 1730 (e.g., generally shown as mass portions 1731, 1732, 1733, 1734, 1735, 1736, and 1737) may be configured to place the CG of the golf club head 1500 at an optimal location and optimize the MOI of the golf club head 1500. Referring to FIG. 24, all or a substantial portion of the second set of mass portions 1730 may be generally at or near the sole portion 1590. For example, the second set of mass portions 1730 (e.g., generally shown as mass portions 1731, 1732, 1733, 1734, 1735, 1736, and 1737) may be at or near the periphery of the body portion 1510 and extend from the sole portion 1590 to the toe portion 1540. As shown in the example of FIG. 24, the mass portions 1731, 1732, 1733, and 1734 may be located at or near the periphery of the body portion 1510 and extend along the sole portion 1590 to lower the CG of the golf club head 1500. The mass portions 1735, 1736 and 1737 may be located near the periphery of the body portion 1510 and extend from the sole portion 1590 to the toe portion 1540 through a transition region 1547 between the sole portion 1590 and the toe portion 1540 to lower the CG and increase the MOI of the golf club head 1500. For example, the MOI of the golf club head 1500 about a vertical axis extending through the CG may increase. To lower the CG of the golf club head 1500, all or a portion of the second set of mass portions 1730 may be located closer to the sole portion 1590 than to the horizontal midplane 2420. For example, the mass portions 1731, 1732, 1733, 1734, 1735, and 1736 may be closer to the sole portion 1590 than to the horizontal midplane 2420. The locations of the second set of mass portions 1730 (i.e., the locations of the second set of ports 1630) and the physical properties and materials of construction of the second set of mass portions 1730 may be determined to optimally affect the mass, mass distribution, CG, MOI, structural integrity and/or or other static and/or dynamic characteristics of the golf club head 1500. The apparatus, methods, and articles of manufacture described herein are not limited in this regard.

Figure 23:
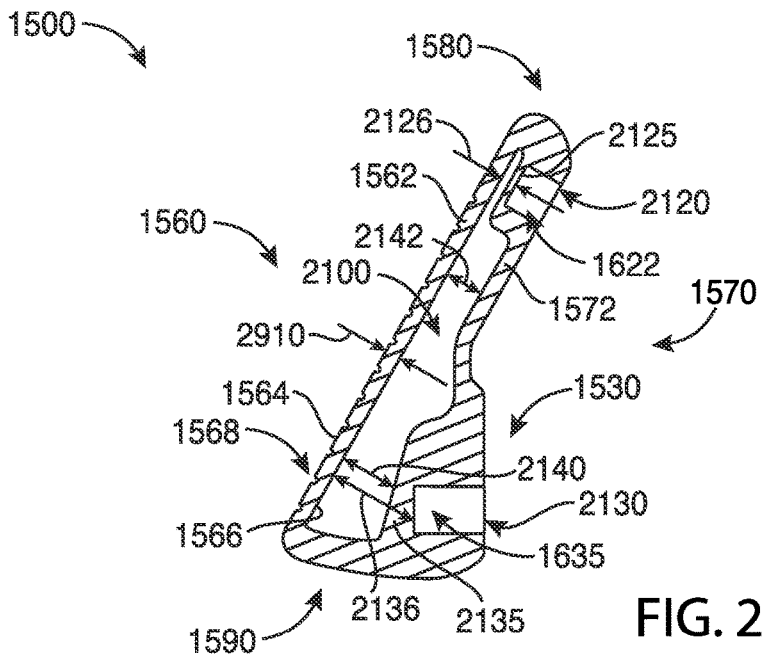
Figure 32:
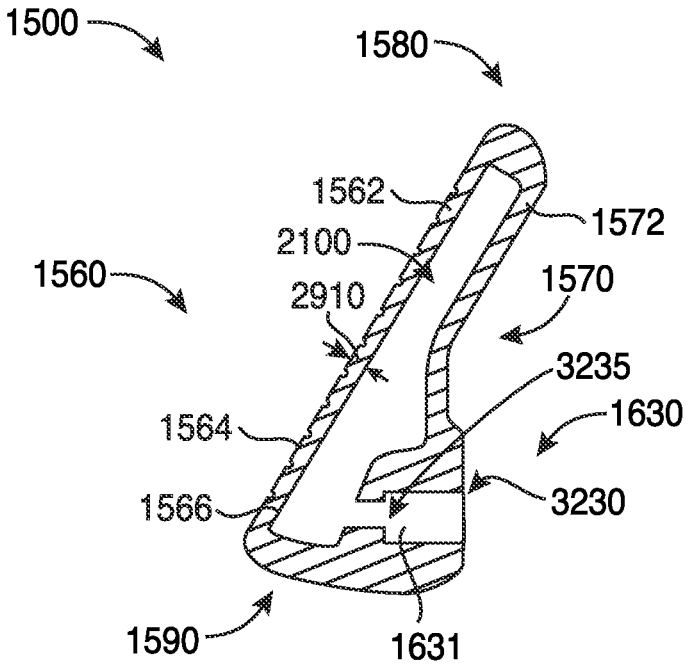
FIG. 32 depicts a cross-sectional view along line 32-32 of FIG. 18 of the golf club head of FIG. 15.

Turning to FIGS. 21-23, and 32, for example, one or more mass portions of the first set of mass portions 1720 and/or the second set of mass portions 1730 may be located away from the back surface 1566 of the face portion 1562 (e.g., not directly coupled to each other). That is, one or more mass portions of the first set of mass portions 1720 and/or the second set of mass portions 1730 and the back surface 1566 may be partially or entirely separated by an interior cavity 2100 of the body portion 1510. As shown in FIGS. 23 and 32, for example, one or more ports of the first set of ports 1620 and the second set of ports 1630 may include an opening (e.g., generally shown as 2120 and 2130) and a port wall (e.g., generally shown as 2125 and 2135). The port walls 2125 and 2135 may be integral portions of the back wall portion 1572 (e.g., a section of the back wall portion 1572) or the body portion 1510 depending on the location of each port. The opening 2120 may be configured to receive a mass portion such as mass portion 1721. The opening 2130 may be configured to receive a mass portion such as mass portion 1735. The opening 2120 may be located at one end of the port 1621, and the port wall 2125 may be located or proximate to at an opposite end of the port 1621. In a similar manner, the opening 2130 may be located at one end of the port 1635, and the port wall 2135 may be located at or proximate to an opposite end of the port 1635. The port walls 2125 and 2135 may be separated from the face portion 1562 (e.g., separated by the interior cavity 2100). The port wall 2125 may have a distance 2126 from the back surface 1566 of the face portion 1562 as shown in FIG. 23. The port wall 2135 may have a distance 2136 from the back surface 1566 of the face portion 1562. The distances 2126 and 2136 may be determined to optimize the location of the CG of the golf club head 1500 when the first set of ports 1620 and the second set of ports 1630 receive mass portions as described herein. According to one example, the distance 2136 may be greater than the distance 2126 so that the CG of the golf club head 1500 may be moved toward the back portion 1570. As a result, a width 2140 of a portion of the interior cavity 2100 below the horizontal midplane 2420 may be greater than a width 2142 of the interior cavity 2100 above the horizontal midplane 2420. The apparatus, methods, and articles of manufacture described herein are not limited in this regard.

As described herein, the CG of the golf club head 1500 may be relatively farther back away from the face portion 1562 and relatively lower towards a ground plane (e.g., one shown as 2410 in FIG. 24) with all or a substantial portion of the second set of mass portions 1730 being at or closer to the sole portion 1590 than to the horizontal midplane 2420 and the first set of mass portions 1720 and the second set of mass portions 1730 being away from the back surface 1566 than if the second set of mass portions 1730 were directly coupled to the back surface 1566. The body portion 1510 may include any number of mass portions (e.g., no mass portions, one mass portion, two mass portions, etc.) and/or any configuration of mass portions (e.g., mass portion(s) integral with the body portion 1510) above the horizontal midplane 2420 and/or below the horizontal midplane 2420. The locations of the first set of ports 1620 and the second set of ports 1630 and/or the locations (e.g., internal mass portion(s), external mass portion(s), mass portion(s) integral with the body portion 1510, etc.), physical properties and materials of construction of the first set of mass portions 1720 and/or the second set of mass portions 1730 may be determined to optimally affect the mass, mass distribution, CG, MOI characteristics, structural integrity and/or or other static and/or dynamic characteristics of the golf club head 1500. Different from other golf club head designs, the interior cavity 2100 of the body portion 1510 and the location of the first set of mass portions 1720 and/or the second set of mass portions 1730 along the periphery of the golf club head 1500 may result in a golf ball traveling away from the face portion 1562 at a relatively higher ball launch angle and a relatively lower spin rate. As a result, the golf ball may travel farther (i.e., greater total distance, which includes carry and roll distances). The apparatus, methods, and articles of manufacture described herein are not limited in this regard.

While the figures may depict ports with a particular cross-section shape, the apparatus, methods, and articles of manufacture described herein may include ports with other suitable cross-section shapes. In one example, the ports of the first and/or second sets of ports 1620 and 1630 may have U-like cross-section shape. In another example, the ports of the first and/or second set of ports 1620 and 1630 may have V-like cross-section shape. One or more of the ports associated with the first set of mass portions 1720 may have a different cross-section shape than one or more ports associated with the second set of mass portions 1730. For example, the port 1621 may have a U-like cross-section shape whereas the port 1635 may have a V-like cross-section shape. Further, two or more ports associated with the first set of mass portions 1720 may have different cross-section shapes. In a similar manner, two or more ports associated with the second set of mass portions 1730 may have different cross-section shapes. The apparatus, methods, and articles of manufacture described herein are not limited in this regard.

The first set of mass portions 1720 and the second set of mass portions 1730 may be similar in mass (e.g., all of the mass portions of the first set of mass portions 1720 and the second set of mass portions 1730 weigh about the same). Alternatively, the first set of mass portions 1720 and the second set of mass portions 1730 may be different in mass individually or as an entire set. In particular, one or more mass portions of the first set of mass portions 1720 (e.g., generally shown as 1721, 1722, 1723, and 1724) may have relatively less mass than one or more portions of the second set of mass portions 1730 (e.g., generally shown as 1731, 1732, 1733, 1734, 1735, 1736, and 1737). For example, the second set of mass portions 1730 may account for more than 50% of the total mass from mass portions of the golf club head 1500. As a result, the golf club head 1500 may be configured to have at least 50% of the total mass from mass portions disposed below the horizontal midplane 2420. Two or more mass portions in the same set may be different in mass. In one example, the mass portion 1721 of the first set of mass portions 1720 may have a relatively lower mass than the mass portion 1722 of the first set of mass portions 1720. In another example, the mass portion 1731 of the second set of mass portions 1730 may have a relatively lower mass than the mass portion 1735 of the second set of mass portions 1730. Accordingly, more mass may be distributed away from the CG of the golf club head 1500 to increase the MOI about the vertical axis through the CG. The apparatus, methods, and articles of manufacture described herein are not limited in this regard.

In one example, the golf club head 1500 may have a mass in the range of about 220 grams to about 330 grams based on the type of golf club (e.g., a 4-iron versus a lob wedge). The body portion 1510 may have a mass in the range of about 200 grams to about 310 grams with the first set of mass portions 1720 and/or the second set of mass portions 1730 having a mass of about 20 grams (e.g., a total mass from mass portions). One or more mass portions of the first set of mass portions 1720 and/or the second set of mass portions 1730 may have a mass greater than or equal to about 0.1 gram and less than or equal to about 20 grams. In one example, one or more mass portions of the first set of mass portions 1720 may have a mass of about 0.75 gram whereas one or more mass portions of the second set of mass portions 1730 may have a mass of about 2.4 grams. The sum of the mass of the first set of mass portions 1720 or the sum of the mass of the second set of mass portions 1730 may be greater than or equal to about 0.1 grams and less than or equal to about 20 grams. In one example, the sum of the mass of the first set of mass portions 1720 may be about 3 grams whereas the sum of the mass of the first set of mass portions 1730 may be about 16.8 grams. The total mass of the second set of mass portions 1730 may weigh more than five times as much as the total mass of the first set of mass portions 1720 (e.g., a total mass of the second set of mass portions 1730 of about 16.8 grams versus a total mass of the first set of mass portions 1720 of about 3 grams). The golf club head 1500 may have a total mass of 19.8 grams from the first set of mass portions 1720 and the second set of mass portions 1730 (e.g., sum of 3 grams from the first set of mass portions 1720 and 16.8 grams from the second set of mass portions 1730). Accordingly, in one example, the first set of mass portions 1720 may account for about 15% of the total mass from mass portions of the golf club head 1500 whereas the second set of mass portions 1730 may be account for about 85% of the total mass from mass portions of the golf club head 1500. The apparatus, methods, and articles of manufacture described herein are not limited in this regard.

By coupling the first set of mass portions 1720 and/or the second set of mass portions 130, respectively, to the body portion 1510 (e.g., securing the first set of mass portions 1720 and/or the second set of mass portions 1730 in the ports on the back portion 1570), the location of the CG and the MOI) of the golf club head 1500 may be optimized. In particular, as described herein, the first set of mass portions 1720 may lower the location of the CG towards the sole portion 1590 and further back away from the face portion 1562. Further, the first set of mass portions 1720 and/or the second set of mass portions 1730 may increase the MOI as measured about a vertical axis extending through the CG (e.g., perpendicular to the ground plane 2410). The MOI may also be higher as measured about a horizontal axis extending through the CG (e.g., extending towards the toe portion 1540 and the heel portion 1550 of the golf club head 1500). As a result, the club head 1500 may provide a relatively higher launch angle and a relatively lower spin rate than a golf club head without the first and/or second sets of mass portions 1720 and 1730, respectively. The apparatus, methods, and articles of manufacture described herein are not limited in this regard.

Although the figures may depict the mass portions as separate and individual parts that may be visible from an exterior of the golf club head 1500, the two or more mass portions of the first set of mass portions 1720 and/or the second set of mass portions 1730 may be a single piece of mass portion that may be an exterior mass portion or an interior mass portion (i.e., not visible from an exterior of the golf club head 1500). In one example, all of the mass portions of the first set of mass portions 1720 (e.g., generally shown as 1721, 1722, 1723, and 1724) may be combined into a single piece of mass portion (e.g., a first mass portion). In a similar manner, all of the mass portions of the second set of mass portions 1730 (e.g., generally shown as 1731, 1732, 1733, 1734, 1735, 1736, and 1737) may be combined into a single piece of mass portion as well (e.g., a second mass portion). In this example, the golf club head 1500 may have only two mass portions. In another example (not shown), the body portion 1510 may not include the first set of mass portions 1720, but include the second set of mass portions 1730 in the form of a single piece of internal mass portion that may be farther from the heel portion 1550 than the toe portion 1540. In yet another example (not shown), the body portion 1510 may not include the first set of mass portions 1720, but include the second set of mass portions 1730 with a first internal mass portion farther from the heel portion 1550 than the toe portion 1540 and a second internal mass portion farther from the toe portion 1540 than the heel portion 1550. The first internal mass portion and the second internal mass portion may be (i) integral parts of the body portion 1510 or (ii) separate from the body portion 1510 and coupled to the body portion 1510. The apparatus, methods, and articles of manufacture described herein are not limited in this regard.

While the figures may depict a particular number of mass portions, the apparatus, methods, and articles of manufacture described herein may include more or less number of mass portions. In one example, the first set of mass portions 1720 may include two separate mass portions instead of three separate mass portions as shown in the figures. In another example, the second set of mass portions 1730 may include five separate mass portions instead of seven separate mass portions as shown in the figures. Alternatively, as mentioned above, the apparatus, methods, and articles of manufacture described herein may not include any separate mass portions (e.g., the body portion 1510 may be manufactured to include the mass of the separate mass portions as integral part(s) of the body portion 1510). The apparatus, methods, and articles of manufacture described herein are not limited in this regard.

Referring to FIGS. 21-32, for example, the body portion 1510 may be a hollow body including the interior cavity 2100 extending between the front portion 1560 and the back portion 1570. Further, the interior cavity 2100 may extend between the top portion 1580 and the sole portion 1590. The interior cavity 2100 may be associated with a cavity height 2150 ($H_C$), and the body portion 1510 may be associated with a body height 2250 ($H_B$). While the cavity height 2150 and the body height 2250 may vary between the toe portion 1540 and the heel portion 1550, the cavity height 2150 may be at least 50% of a body height 2250 ($H_C>0.5*H_B$). For example, the cavity height 2150 may vary between 70%-85% of the body height 2250. With the cavity height 2150 of the interior cavity 2100 being greater than 50% of the body height 2250, the golf club head 1500 may produce relatively more consistent feel, sound, and/or result when the golf club head 1500 strikes a golf ball via the face portion 1562 than a golf club head with a cavity height of less than 50% of the body height. The apparatus, methods, and articles of manufacture described herein are not limited in this regard.

In one example, the interior cavity 2100 may be unfilled (i.e., empty space). The body portion 1510 with the interior cavity 2100 may weigh about 100 grams less than the body portion 1510 without the interior cavity 2100. Alternatively, the interior cavity 2100 may be partially or entirely filled with a filler material (i.e., a cavity filling portion), which may include one or more similar or different types of materials. In one example, the filler material may include an elastic polymer or an elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), other polymer material(s), bonding material(s) (e.g., adhesive), and/or other suitable types of materials that may absorb shock, isolate vibration, and/or dampen noise. For example, at least 50% of the interior cavity 2100 may be filled with a TPE material to absorb shock, isolate vibration, and/or dampen noise when the golf club head 1500 strikes a golf ball via the face portion 1562. The apparatus, methods, and articles of manufacture described herein are not limited in this regard.

In another example, the filler material may be a polymer material such as an ethylene copolymer material that may absorb shock, isolate vibration, and/or dampen noise when the golf club head 1500 strikes a golf ball via the face portion 1562. In particular, at least 50% of the interior cavity 2100 may be filled with a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, an ethylene copolymer having high compression and low resilience similar to thermoset polybutadiene rubbers, and/or a blend of highly neutralized polymer compositions, highly neutralized acid polymers or highly neutralized acid polymer compositions, and fillers. For example, the ethylene copolymer may include any of the ethylene copolymers associated with DuPont' High-Performance Resin (HPF) family of materials (e.g., DuPont' HPF AD1172, DuPont' HPF AD1035, DuPont® HPF 1000 and DuPont™ HPF 2000), which are manufactured by E.I. du Pont de Nemours and Company of Wilmington, Del. The DuPont™ HPF family of ethylene copolymers are injection moldable and may be used with conventional injection molding equipment and molds, provide low compression, and provide high resilience, i.e., relatively high coefficient of restitution (COR). The apparatus, methods, and articles of manufacture described herein are not limited in this regard.

For example, the filler material may have a density of less than or equal to 1.5 g/cm$^3$. The filler material may have a compression deformation value ranging from about 0.0787 inch (2 mm) to about 0.1968 inch (5 mm). The filler material may have a surface Shore D hardness ranging from 40 to 60. As mentioned above, the filler material may be associated with a relatively high coefficient of restitution (COR). The filler material may be associated with a first COR ($COR_1$) and the face portion 1562 may be associated with a second COR ($COR_2$), which may be similar or different from the first COR. The first COR and the second COR may be associated with a COR ratio (e.g., $COR_{12}$ ratio=$COR_1/COR_2$ or $COR_{21}$ ratio=$COR_2/COR_1$). In one example, the COR ratio may be less than two (2). In another example, the COR ratio may be in a range from about 0.5 to about 1.5. In yet another example, the COR ratio may be in a range from about 0.8 to about 1.2. The apparatus, methods, and articles of manufacture described herein are not limited in this regard.

The golf club head 1500 may be associated with a third COR ($COR_3$), which may be similar or different from the first COR and/or the second COR. As mentioned above, the filler material may be associated with the first COR. The first and third CORs may be associated with a COR ratio (e.g., $COR_{13}$ ratio=$COR_1/COR_3$ or $COR_{31}$ ratio=$COR_3/COR_1$). In one example, the COR ratio may be less than two (2). In another example, the COR ratio may be in a range from about 0.5 to about 1.5. In yet another example, the COR ratio may be in a range from about 0.8 to about 1.2. The apparatus, methods, and articles of manufacture described herein are not limited in this regard.

The CORs of the filler material, the face portion 1562, and/or the golf club head 1500 (e.g., the first COR ($COR_1$), the second COR ($COR_2$), and/or the third COR ($COR_3$), respectively) may be measured by methods similar to methods that measure the COR of a golf ball and/or a golf club head as defined by one or more golf standard organizations and/or governing bodies (e.g., United States Golf Association (USGA)). In one example, an air cannon device may launch or eject an approximately 1.55 inch (38.1 mm) spherical sample of the filler material at an initial velocity toward a steel plate positioned at about 4 feet (1.2 meters) away from the air cannon device. The sample may vary in size, shape or any other configuration. A speed monitoring device may be located at a distance in a range from 2 feet (0.6 meters) to 3 feet (0.9 meters) from the air cannon device. The speed monitoring device may measure a rebound velocity of the sample of the filler material after the sample of the filler material strikes the steel plate. The COR may be the rebound velocity divided by the initial velocity. In one example, the filler material may have a COR value in a range from approximately 0.50 to approximately 0.95 when measured with an initial velocity in a range from 100 ft/s (30.48 m/s) to 250 ft/s (76.2 m/s). In another example, the filler material may have a COR value in a range from approximately 0.65 to approximately 0.85 when measured with an initial velocity in a range from 100 ft/s (30.48 m/s) to 150 ft/s (45.72 m/s). In another example, the filler material may have a COR value in a range from approximately 0.75 to approximately 0.8 when measured with an initial velocity in a range from 100 ft/s (30.48 m/s) to 150 ft/s (45.72 m/s). In another example, the filler material may have a COR value in a range from approximately 0.55 to approximately 0.90 when measured with an initial velocity in a range from 100 ft/s (30.48 m/s) and 250 ft/s (76.2 m/s). In another example, the filler material may have a COR value in a range from approximately 0.75 to approximately 0.85 when measured with an initial velocity in a range from 110 ft/s (33.53 m/s) to 200 ft/s (60.96 m/s). In yet another example, the filler material may have a COR value in a range from approximately 0.8 to approximately 0.9 when measured with an initial velocity of about 1525 ft/s (38.1 m/s). While a particular example may be described above, other methods may be used to measure the CORs of the filler material, the face portion 1562, and/or the golf club head 1500. The apparatus, methods, and articles of manufacture described herein are not limited in this regard.

When the face portion 1562 of the golf club head 1500 strikes a golf ball, the face portion 1562 and the filler material may deform and/or compress. The kinetic energy of the impact may be transferred to the face portion 1562 and/or the filler material. For example, some of the kinetic energy may be transformed into heat by the filler material or work done in deforming and/or compressing the filler material. Further, some of the kinetic energy may be transferred back to the golf ball to launch the golf ball at a certain velocity. A filler material with a relatively higher COR may transfer relatively more kinetic energy to the golf ball and dissipate relatively less kinetic energy. Accordingly, a filler material with a relatively high COR may generate relatively higher golf ball speeds because a relatively greater part of the kinetic energy of the impact may be transferred back to the golf ball to launch the golf ball from the golf club head 1500.

The filler material may include a bonding portion. In one example, the bonding portion may be one or more bonding agents (e.g., one or more adhesive or epoxy materials). For example, the bonding agent may assist in bonding or adhering the filler material to at least the back surface 1566 of the face portion 1562. The bonding agent may also absorb shock, isolate vibration, and/or dampen noise when the golf club head 1500 strikes a golf ball via the face portion 1562. Further, the bonding agent may be an epoxy material that may be flexible or slightly flexible when cured. In one example, the filler material may include any of the 3M™ Scotch-Weld™ DP100 family of epoxy adhesives (e.g., 3M™ Scotch-Weld™ Epoxy Adhesives DP100, DP100 Plus, DP100NS and DP100FR), which are manufactured by 3M corporation of St. Paul, Minn. In another example, the filler material may include 3M™ Scotch-Weld™ DP100 Plus Clear adhesive. In yet another example, the filler material may include low-viscosity, organic, solvent-based solutions and/or dispersions of polymers and other reactive chemicals such as MEGUM™, ROBOND™ and/or THIXON™ materials manufactured by the Dow Chemical Company, Auburn Hills, Mich. In yet another example, the filler material may be LOCTITE® materials manufactured by Henkel Corporation, Rocky Hill, Conn. The apparatus, methods, and articles of manufacture described herein are not limited in this regard.

Further, the filler material may include a combination of one or more bonding agents such as any of the bonding agents described herein and one or more polymer materials such as any of the polymer materials described herein. In one example, the filler material may include one or more bonding agents that may be used to bond the polymer material to the back surface 1566 of the face portion 1562. The one or more bonding agents may be applied to the back surface 1566 of the face portion 1562. The filler material may further include one or more polymer materials may partially or entirely fill the remaining portions of the interior cavity 2100. Accordingly, two or more separate materials may partially or entirely fill the interior cavity 2100. The apparatus, methods, and articles of manufacture described herein are not limited in this regard.

The filler material may only include one or more polymer materials that adhere to inner surface(s) of the interior cavity 2100 without a separate bonding agent (e.g., an adhesive or epoxy material). For example, the filler material may include a mixture of one or more polymer materials and one or more bonding agents (e.g., adhesive or epoxy material(s)). Accordingly, the mixture including the one or more polymer materials and the one or more bonding agents may partially or entirely fill the interior cavity 2100 and adhere to inner surface(s) of the interior cavity 2100. In another example, the interior cavity 2100 may be partially or entirely filled with one or more polymer materials without any bonding agents. In yet another example, the interior cavity 2100 may be partially or entirely filled with one or more bonding agents and/or adhesive materials such as an adhesive or epoxy material. The apparatus, methods, and articles of manufacture described herein are not limited in this regard.

Figure 29:
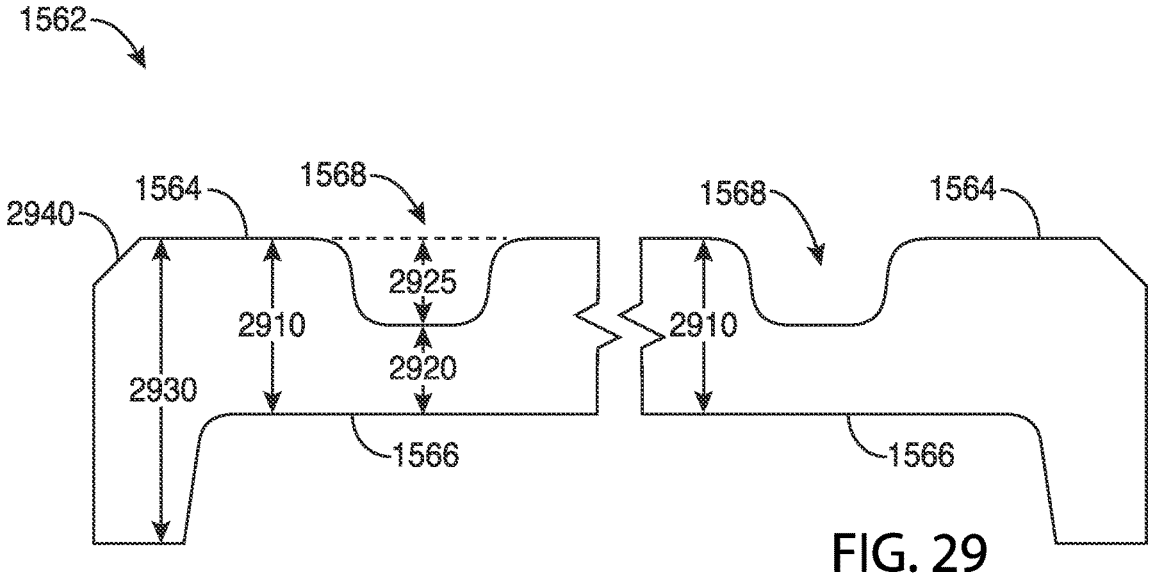
FIG. 29 depicts a cross-sectional view of a face portion associated with a golf club head according to an embodiment of the apparatus, methods, and articles of manufacture described herein.

Turning to FIG. 29, for example, a thickness of the face portion 1562 may be a first thickness 2910 ($T_1$) or a second thickness 2920 ($T_2$). The first thickness 2910 may be a thickness of a section of the face portion 1562 adjacent to a groove 1568 whereas the second thickness 2920 may be a thickness of a section of the face portion 1562 below the groove 1568. For example, the first thickness 2910 may be a maximum distance between the front surface 1564 and the back surface 1566. The second thickness 2920 may be based on the groove 1568. In particular, the groove 1568 may have a groove depth 2925 ($D_{groove}$). The second thickness 2920 may be a maximum distance between the bottom of the groove 1568 and the back surface 1566. The sum of the second thickness 2920 and the groove depth 2925 may be substantially equal to the first thickness 2910 (e.g., $T_2+D_{groove}=T_1$). Accordingly, the second thickness 2920 may be less than the first thickness 2910 (e.g., $T_2<T_1$).

To lower and/or move the CG of the golf club head 1500 further back, mass from the front portion 1560 of the golf club head 1500 may be removed by using a relatively thinner face portion 1562. For example, the first thickness 2910 or the second thickness 2920 may be less than or equal to 0.1 inch (2.54 millimeters). In another example, the first thickness 2910 may be about 0.075 inch (1.905 millimeters) (e.g., $T_1$=0.075 inch). With the support of the back wall portion 1572 to form the interior cavity 2100 and filling at least a portion of the interior cavity 2100 with an elastic polymer material, the face portion 1562 may be relatively thinner (e.g., $T_1$<0.075 inch) without degrading the structural integrity, sound, and/or feel of the golf club head 1500. In one example, the first thickness 2910 may be less than or equal to 0.060 inch (1.524 millimeters) (e.g., $T_1 \leq 0.060$ inch). In another example, the first thickness 2910 may be less than or equal to 0.040 inch (1.016 millimeters) (e.g., $T_1 \leq 0.040$ inch). Based on the type of material(s) used to form the face portion 1562 and/or the body portion 1510, the face portion 1562 may be even thinner with the first thickness 2910 being less than or equal to 0.030 inch (0.762 millimeters) (e.g., $T_1 \leq 0.030$ inch). The groove depth 2925 may be greater than or equal to the second thickness 2920 (e.g., $D_{groove} \geq T_2$). In one example, the groove depth 2925 may be about 0.020 inch (0.508 millimeters) (e.g., $D_{groove}$=0.020 inch). Accordingly, the second thickness 2920 may be about 0.010 inch (0.254 millimeters) (e.g., $T_2$=0.010 inch). In another example, the groove depth 2925 may be about 0.015 inch (0.381 millimeters), and the second thickness 2920 may be about 0.015 inch (e.g., $D_{groove}=T_2$=0.015 inch). Alternatively, the groove depth 2925 may be less than the second thickness 2920 (e.g., $D_{groove}<T_2$). Without the support of the back wall portion 1572 and the elastic polymer material to fill in the interior cavity 2100, a golf club head may not be able to withstand multiple impacts by a golf ball on a face portion. In contrast to the golf club head 1500 as described herein, a golf club head with a relatively thin face portion but without the support of the back wall portion 1572 and the elastic polymer material to fill in the interior cavity 2100 (e.g., a cavity-back golf club head) may produce unpleasant sound (e.g., a tinny sound) and/or feel during impact with a golf ball. The apparatus, methods, and articles of manufacture described herein are not limited in this regard.

Based on manufacturing processes and methods used to form the golf club head 1500, the face portion 1562 may include additional material at or proximate to a periphery of the face portion 1562. Accordingly, the face portion 1562 may also include a third thickness 2930, and a chamfer portion 2940. The third thickness 2930 may be greater than either the first thickness 2910 or the second thickness 2920 (e.g., $T_3>T_1>T_2$). In particular, the face portion 1562 may be coupled to the body portion 1510 by a welding process. For example, the first thickness 2910 may be about 0.030 inch (0.762 millimeters), the second thickness 2920 may be about 0.015 inch (0.381 millimeters), and the third thickness 2930 may be about 0.050 inch (1.27 millimeters). Accordingly, the chamfer portion 2940 may accommodate some of the additional material when the face portion 1562 is welded to the body portion 1510.

Figure 30:
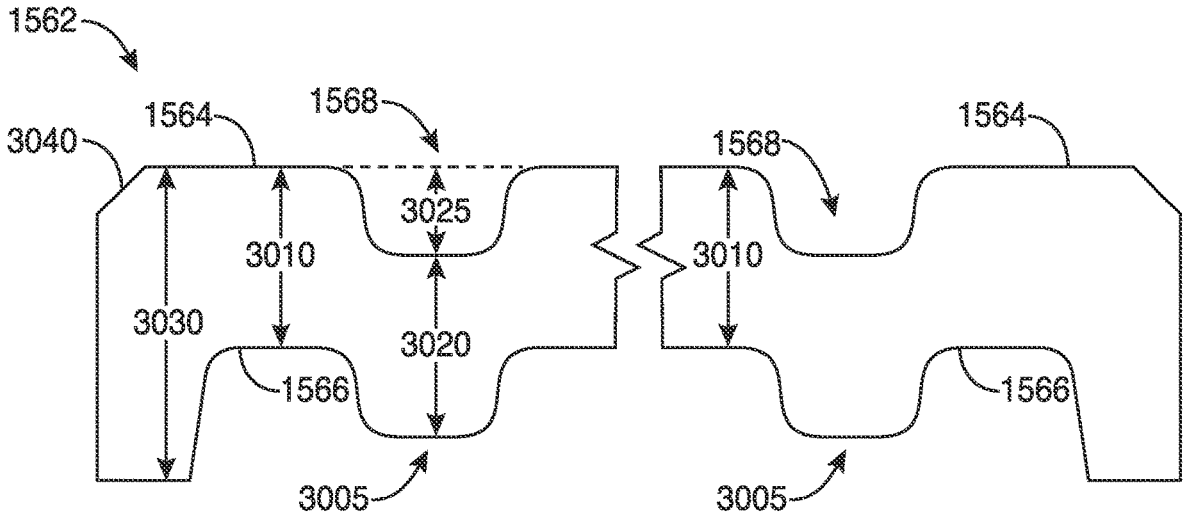
FIG. 30 depicts a cross-section view of a face portion associated with a golf club head according to an embodiment of the apparatus, methods, and articles of manufacture described herein.

As illustrated in FIG. 30, for example, the face portion 1562 may include a reinforcement section, generally shown as 3005, below one or more grooves 1568. In one example, the face portion 1562 may include a reinforcement section 3005 below each groove. Alternatively, face portion 1562 may include the reinforcement section 3005 below some grooves (e.g., every other groove) or below only one groove. The face portion 1562 may include a first thickness 3010, a second thickness 3020, a third thickness 3030, and a chamfer portion 3040. The groove 1568 may have a groove depth 3025. The reinforcement section 3005 may define the second thickness 3020. The first thickness 3010 and the second thickness 3020 may be substantially equal to each other (e.g., $T_1=T_2$). In one example, the first thickness 3010 and the second thickness 3020 may be about 0.030 inch (0.762 millimeters) (e.g., $T_1=T_2$=0.030 inch). The groove depth 3025 may be about 0.015 inch (0.381 millimeters), and the third thickness 3030 may be about 0.050 inch (1.27 millimeters). The groove 1568 may also have a groove width. The width of the reinforcement section 3005 may be greater than or equal to the groove width. The apparatus, methods, and articles of manufacture described herein are not limited in this regard.

Alternatively, the face portion 1562 may vary in thickness at and/or between the top portion 1580 and the sole portion 1590. In one example, the face portion 1562 may be relatively thicker at or proximate to the top portion 1580 than at or proximate to the sole portion 1590 (e.g., thickness of the face portion 1562 may taper from the top portion 1580 towards the sole portion 1590). In another example, the face portion 1562 may be relatively thicker at or proximate to the sole portion 1590 than at or proximate to the top portion 1580 (e.g., thickness of the face portion 1562 may taper from the sole portion 1590 towards the top portion 1580). In yet another example, the face portion 1562 may be relatively thicker between the top portion 1580 and the sole portion 1590 than at or proximate to the top portion 1580 and the sole portion 1590 (e.g., thickness of the face portion 1562 may have a bell-shaped contour). The apparatus, methods, and articles of manufacture described herein are not limited in this regard. As described herein, the interior cavity 2100 may be partially or fully filled with a filler material, which may be a polymer material, a bonding agent (such as an adhesive or epoxy material), or a combination of polymer material(s) and bonding agent(s) to at least partially provide structural support for the face portion 1562. In particular, the filler material may also provide vibration and/or noise dampening for the body portion 1510 when the face portion 1562 strikes a golf ball. Alternatively, the filler material may only provide vibration and/or noise dampening for the body portion 1510 when the face portion 1562 strikes a golf ball. In one example, the body portion 1510 of the golf club head 1500 (e.g., an iron-type golf club head) may have a body portion volume ($V_b$) between about 2.0 cubic inches (32.77 cubic centimeters) and about 4.2 cubic inches (68.83 cubic centimeters). The volume of the filler material filling the interior cavity ($V_e$), such as the interior cavity 2100, may be between 0.5 and 1.7 cubic inches (8.19 and 27.86 cubic centimeters, respectively). A ratio of the filler material volume ($V_e$) to the body portion volume ($V_b$) may be expressed as:

$$0.2 \leq \frac{V_e}{V_b} \leq 0.5$$

Where: $V_e$ is the filler material volume in units of $in^3$, and $V_b$ is the body portion volume in units of $in^3$.

In another example, the ratio of the filler material volume ($V_e$) to the body portion volume ($V_b$) may be between about 0.2 and about 0.4. In yet another example, the ratio of the filler material volume ($V_e$) to the body portion volume ($V_b$) may be between about 0.25 and about 0.35. The apparatus, methods, and articles of manufacture described herein are not limited in this regard.

Based on the amount of filler material filling the interior cavity, for example, the thickness of the face portion may be between about 0.025 inches (0.635 millimeters) and about 0.1 inch (2.54 millimeters). In another example, the thickness of the face portion ($T_f$) may be between about 0.02 inches (0.508 millimeters) and about 0.09 inches (2.286 millimeters). The thickness of the face portion ($T_f$) may depend on the volume of the filler material in the interior cavity ($V_e$), such as the interior cavity 2100. The ratio of the thickness of the face portion ($T_f$) to the volume of the filler material ($V_e$) may be expressed as:

$$0.01 \leq \frac{T_f}{V_e} \leq 0.2$$

Where: $T_f$ is the thickness of the face portion in units of inches, and $V_e$ is the filler material volume in units of $in^3$.

In one example, the ratio of the thickness of the face portion ($T_f$) to the volume of the filler material ($V_e$) may be between 0.02 and 0.09. In another example, the ratio of the thickness of the face portion ($T_f$) to the volume of the filler material ($V_e$) may be between 0.04 and 0.14. The thickness of the face portion ($T_f$) may be the same as $T_1$ and/or $T_2$ mentioned above. The apparatus, methods, and articles of manufacture described herein are not limited in this regard.

The thickness of the face portion ($T_f$) may depend on the volume of the filler material in the interior cavity ($V_e$), such as the interior cavity 2100, and the body portion volume ($V_b$). The volume of the filler material ($V_e$) may be expressed as:

$$V_e = a*V_b + b \pm c*T_f$$

$a \cong 0.48$ $b \cong -0.38$ $0 \leq c \leq 10$

Where: $V_e$ is the filler material volume in units of $in^3$, $V_b$ is the body portion volume in units of $in^3$, and $T_f$ is the thickness of the face portion in units of inches.

As described herein, for example, the body portion volume ($V_b$) may be between about 2.0 cubic inches (32.77 cubic centimeters) and about 4.2 cubic inches (68.83 cubic centimeters). In one example, the thickness of the face portion ($T_f$) may be about 0.03 inches (0.762 millimeters). In another example, the thickness of the face portion ($T_f$) may be about 0.06 inches (1.524 millimeters). In yet another example, the thickness of the face portion ($T_f$) may be about 0.075 inches (1.905 millimeters). The apparatus, methods, and articles of manufacture described herein are not limited in this regard.

Further, the volume of the filler material ($V_e$) when the interior cavity is fully filled with the filler material may be similar to the volume of the interior cavity ($V_c$). Accordingly, when the interior cavity is fully filled with a filler material, the volume of the filler material ($V_e$) in any of the equations provided herein may be replaced with the volume of the interior cavity ($V_c$). Accordingly, the above equations expressed in terms of the volume of the interior cavity ($V_c$) may be expressed as:

$$0.2 \leq \frac{Vc}{Vb} \leq 0.5$$

$$0.01 \leq \frac{Tf}{Vc} \leq 0.2$$

$$Vc = a.Vb + b \pm c.Tf$$

$$a \cong 0.48$$

$$b \cong -0.38$$

$$0 \leq c \leq 10$$

Where: $V_c$ is the volume of the interior cavity in units of $in^3$, $V_b$ is the body portion volume in units of $in^3$, and $T_f$ is the thickness of the face portion in units of inches.

As described herein, the filler material may include a bonding agent that may be bonded to the back surface 1566 of the face portion 1562 to attach the remaining portions of the filler material to the back surface 1566 of the face portion 1562, dampen noise and vibration, provide a certain feel and sound for the golf club head, and/or at least partially structurally support the face portion 1562. The thickness of the bonding agent and/or a portion of the filler material may depend on a thickness of the face portion 1562. In one example, a relationship between a thickness of the face portion 1562 and a thickness of a bonding agent and/or a portion of the filler material may be expressed as:

$$0.1 \leq \frac{Tf}{Ta} \leq 4.0$$

Where:

$T_f$ is the thickness of the face portion in units of inches, and $T_a$ is the thickness of the bonding agent and/or the thickness of the filler material in units of inches.

In one example, the bonding agent and/or the filler material may have a thickness ranging from 0.02 inch (0.51 millimeters) to 0.2 inch (5.08 millimeters). In another example, the bonding agent and/or the filler material may have a thickness ranging from 0.04 inch (0.1.02 millimeters) to 0.08 inch (2.03 millimeters). In another example, the bonding agent and/or the filler material may have a thickness ranging from 0.03 inch (0.76 millimeters) to 0.06 inch (1.52 millimeters). In yet another example, the bonding agent and/or the filler material may have a thickness ranging from 0.01 inch (0.25 millimeters) to 0.3 inch (7.62 millimeters). The apparatus, methods, and articles of manufacture described herein are not limited in this regard.

Figure 31:
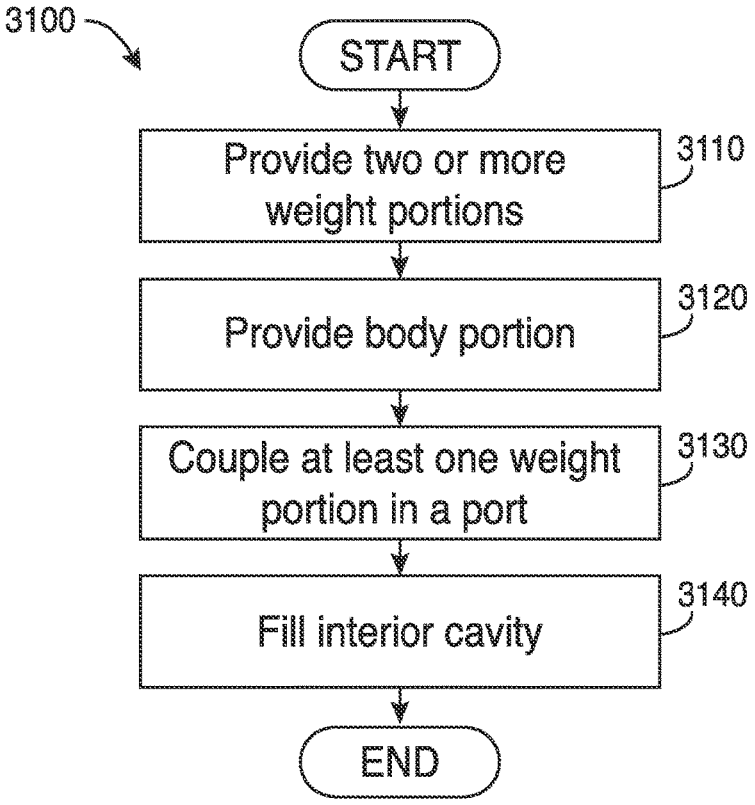
FIG. 31 depicts one manner in which a golf club head according to an embodiment of the apparatus, methods, and articles of manufacture described herein may be manufactured.

FIG. 31 depicts one manner in which the example golf club head described herein may be manufactured. In the example of FIG. 31, the process 3100 may begin with providing one or more mass portions, generally shown as the first set of mass portions 1720 and the second set of mass portions 1730 (block 3110). The first set of mass portions 1720 and/or the second set of mass portions 1730 may be made of a first material such as a tungsten-based material, a titanium-based material, a steel-based material, an aluminum-based material, a non-metal material, any combination thereof, or other suitable type of materials. In one example, the mass portions of the first set of mass portions 1720 and the second set of mass portions 1730 may be tungsten-alloy screws.

The process 3100 may provide a body portion 1510 having the face portion 1562, the interior cavity 2100, and the back portion 1570 with two or more ports, generally shown as 1620 and 1630 (block 3120). The body portion 1510 may be made of a second material, which may be different than the first material or similar to the first material. The body portion 1510 may be manufactured using an investment casting process, a billet forging process, a stamping process, a computer numerically controlled (CNC) machining process, a die casting process, any combination thereof, or other suitable manufacturing processes. In one example, the body portion 1510 may be made of 17-4 PH stainless steel using a casting process. In another example, the body portion 1510 may be made of other suitable type of stainless steel (e.g., Nitronic® 50 stainless steel manufactured by AK Steel Corporation, West Chester, Ohio) using a forging process. By using Nitronic® 50 stainless steel to manufacture the body portion 1510, the golf club head 1500 may be relatively stronger and/or more resistant to corrosion than golf club heads made from other types of steel. One or more ports of the body portion 1510 may include an opening and a port wall. For example, the port 1621 may include the opening 2120 and the port wall 2125 with the opening 2120 and the port wall 2125 being on opposite ends of each other. The interior cavity 2100 may separate the port wall 2125 of the port 1621 and the back surface 1566 of the face portion 1562. In a similar manner, the port 1635 may include the opening 2130 and the port wall 2135 with the opening 2130 and the port wall 2135 being on opposite ends of each other. The interior cavity 2100 may separate the port wall 2135 of the port 1635 and the back surface 1566 of the face portion 1562.

The process 3100 may couple one or more mass portions of the first set of mass portions 1720 and the second set of mass portions 1730 into one of the one or more ports (blocks 3130). In one example, the process 3100 may insert and secure the mass portion 1721 in the port 1621, and the mass portion 1735 in the port 1635. The process 3100 may use various manufacturing methods and/or processes to secure the first set of mass portions 1720 and/or the second set of mass portions 1730 in the ports such as the ports 1621 and 1635 (e.g., epoxy, welding, brazing, mechanical lock(s), any combination thereof, etc.).

The process 3100 may partially or entirely fill the interior cavity 2100 with a filler material, which may be one or a combination of a polymer material (e.g., an ethylene copolymer material such as DuPont' HPF family of materials) (block 3140) and/or a bonding agent (e.g., an adhesive or epoxy material such as 3M™ Scotch-Weld™ Epoxy Adhesives DP100, DP100 Plus, DP100NS and DP100FR). In one example, the filler material may fill at least 50% of the interior cavity 2100. As mentioned above, the filler material may absorb shock, isolate vibration, and/or dampen noise in response to the golf club head 1500 striking a golf ball. In one example, the interior cavity 2100 may be filled with filler material, which may be a polymer material, a thermoplastic elastomer material, a thermoplastic polyurethane material, a bonding agent, and/or a combination thereof. In another example, the interior cavity 2100 may be entirely filled with a bonding agent. As illustrated in FIG. 32, for example, the golf club head 1500 may include one or more ports (e.g., one shown as 1631 in FIG. 28) with a first opening 3230 and a second opening 3235. The second opening 3235 may be used to access the interior cavity 2100. In one example, the process 3100 (FIG. 31) may fill the interior cavity 2100 with a filler material by injecting the filler material into the interior cavity 2100 from the first opening 3230 via the second opening 3235. The first opening 3230 and the second opening 3235 may be same or different in size and/or shape. While the above example may describe and depict a particular port with a second opening, any other ports of the golf club head 1500 may include a second opening (e.g., the port 1621). The apparatus, methods, and articles of manufacture described herein are not limited in this regard.

Referring back to FIG. 31, the example process 3100 is merely provided and described in conjunction with other figures as an example of one way to manufacture the golf club head 1500. While a particular order of actions is illustrated in FIG. 31, these actions may be performed in other temporal sequences. For example, two or more actions depicted in FIG. 31 may be performed sequentially, concurrently, or simultaneously. In one example, blocks 3110, 3120, 3130, and/or 3140 may be performed simultaneously or concurrently. Although FIG. 31 depicts a particular number of blocks, the process may not perform one or more blocks. In one example, the interior cavity 2100 may not be filled (i.e., block 3140 may not be performed). The apparatus, methods, and articles of manufacture described herein are not limited in this regard. Referring back to FIGS. 14-32, the face portion 1562 may include a non-smooth back surface to improve adhesion and/or mitigate delamination between the face portion 1562 and the elastic polymer material used to fill the interior cavity 2100 (e.g., FIG. 21). Various methods and/or processes such as an abrasive blasting process (e.g., a bead blasting process, a sand blasting process, other suitable blasting process, or any combination thereof) and/or a milling (machining) process may be used to form the back surface 1566 into a non-smooth surface. For example, the back surface 1566 may have with a surface roughness (Ra) ranging from 0.5 to 250 μin (0.012 to 6.3 μm). The apparatus, methods, and articles of manufacture are not limited in this regard.

Figure 33:
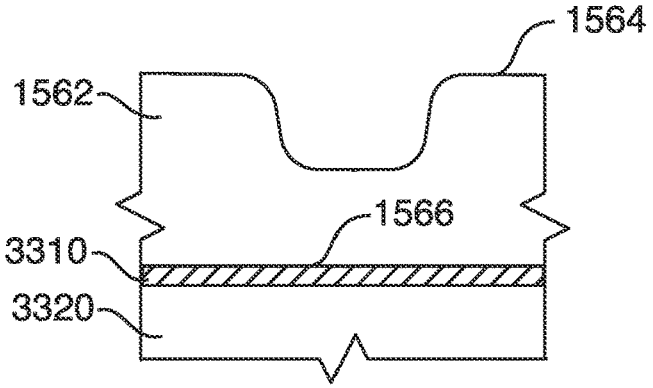
FIG. 33 depicts a cross-sectional view of a portion of the example golf club head of FIG. 15.

Referring to FIG. 33, for example, the golf club head 1500 may include the face portion 1562, a bonding portion 3310, and a polymer material 3320. The bonding portion 3310 may provide connection, attachment and/or bonding of the polymer material 3320 to the face portion 1562. In one example, the bonding portion 3310 and/or the polymer material 3320 may define a filler material as described herein. The bonding portion 3310 may be a bonding agent such as any of adhesive or epoxy materials described herein, a tacky material, a combination of bonding agents, a bonding structure or attachment device (i.e., a physical and/or mechanical structure or device), a combination of bonding structures and/or attachment devices, and/or a combination of one or more bonding agents, one or more bonding structures and/or one or more attachment devices. The bonding portion 3310 may be integral with the polymer material 3320 to partially or entirely fill the interior cavity 2100. In other words, the polymer material 3320 may include inherent bonding properties. For example, the bonding portion 3310 may be a bonding agent mixed with the polymer material 3320 to provide bonding of the mixture to the back surface 1566 of the face portion 1562 and/or other inner surface(s) of the body portion 1510. In one example, the bonding portion may include one or more surface textures or surface structures on the back surface 1566 of the face portion 1562 to assist in adhesion of the polymer material to the back surface 1566 of the face portion. The apparatus, methods, and articles of manufacture are not limited in this regard.

Figure 21:
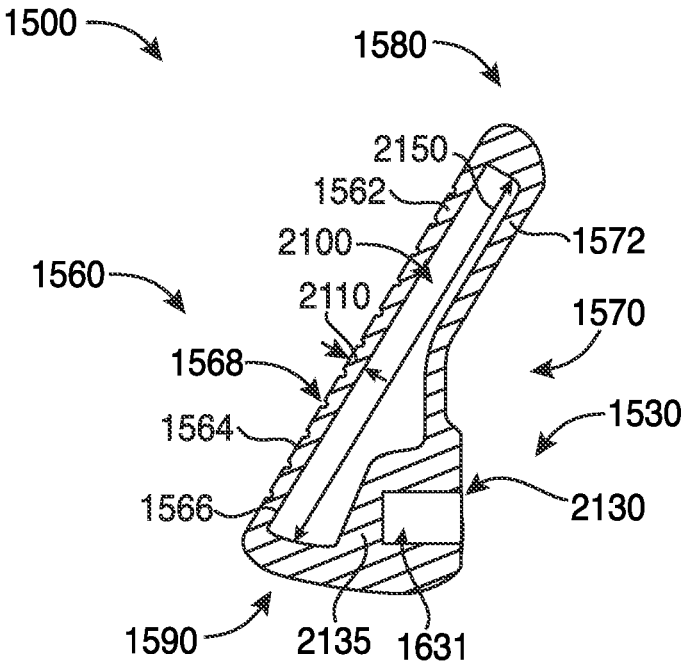
Figure 22:
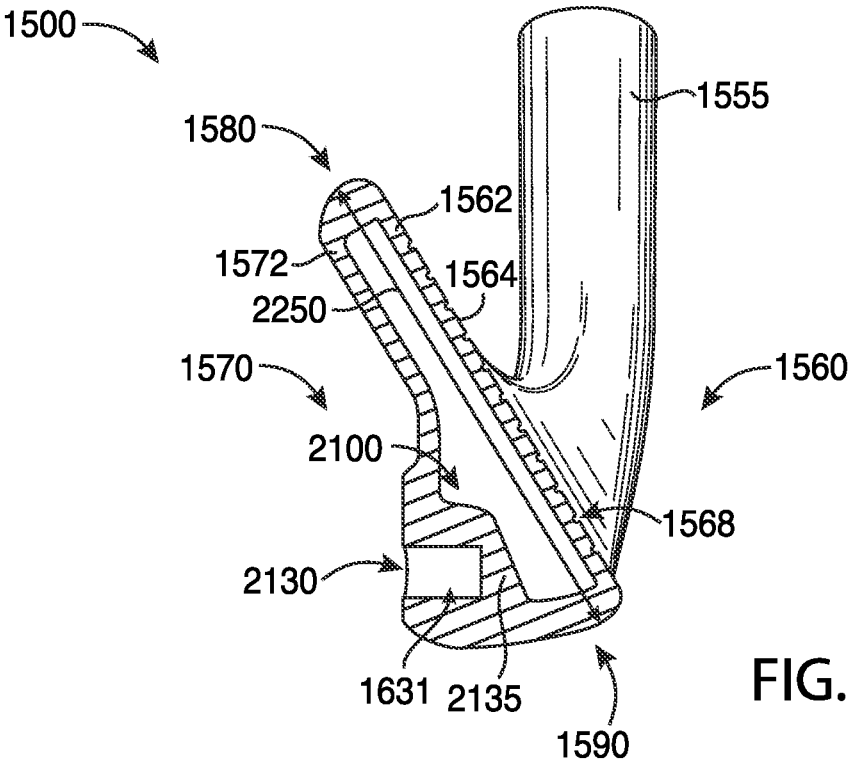

For example, the golf club head 1500 may include a bonding agent such as any adhesive or epoxy materials described herein to improve adhesion and/or mitigate delamination between the face portion 1562 and the polymer material 3320 used to fill the interior cavity 2100 of the golf club head 1500 (e.g., FIG. 21). The bonding portion 3310 may be applied to the back surface 1566 of the face portion 1562 to bond the polymer material 3320 to the face portion 1562 (e.g., extending between the back surface 1566 and the polymer material 3320). For example, the bonding portion 3310 may be applied before or during when the interior cavity 2100 is filled with the polymer material 3320 via an injection molding process or other suitable process. The apparatus, methods, and articles of manufacture are not limited in this regard.

Figure 34:
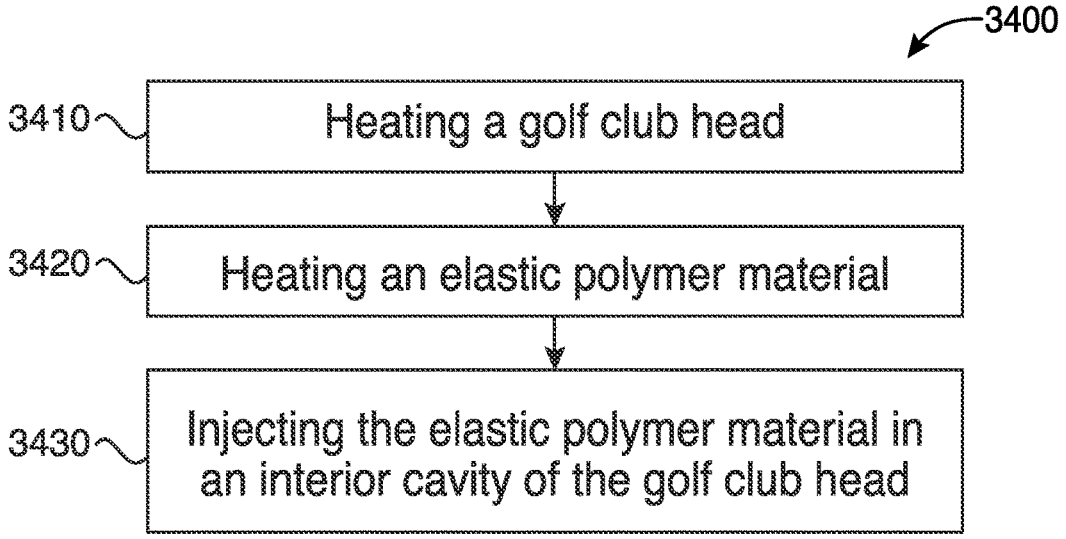
FIG. 34 depicts another manner in which an example golf club head described herein may be manufactured.

FIG. 34 depicts one manner to partially or entirely fill the interior cavity 2100 of the golf club head 1500 or any of the golf club heads described herein with a filler material. The process 3400 may begin with heating the golf club head 1500 to a certain temperature (block 3410). In one example, the golf club head 1500 may be heated to a temperature ranging between 150° C. and 250° C., which may depend on factors such as the vaporization temperature of the one or more components of the filler material to be injected in the interior cavity 2100. The filler material may then be heated to a certain temperature (block 3420). In one example, the filler material may be a non-foaming and injection-moldable thermoplastic elastomer (TPE) material. Accordingly, the filler material may be heated to reach a liquid or a flowing state prior to being injected into the interior cavity 2100. The temperature at which the filler material may be heated may depend on the type of polymer material used to form the filler material. The heated filler material may be injected into the interior cavity 2100 to partially or fully fill the interior cavity 2100 (block 3430). The filler material may be injected into the interior cavity 2100 from one or more of the ports described herein (e.g., one or more ports of the first set of ports 1620 and the second set of ports 1630 shown in FIG. 28). One or more other ports may allow the air inside the interior cavity 2100 displaced by the filler material to vent from the interior cavity 2100. In one example, the golf club head 1500 may be oriented horizontally as shown in FIG. 28 during the injection molding process. The filler material may be injected into the interior cavity 2100 from ports 1631 and 1632. The ports 1621, 1622 and/or 1623 may serve as air ports for venting the displaced air from the interior cavity 2100. Thus, regardless of the orientation of the golf club head 1500 during the injection molding process, the filler material may be injected into the interior cavity 2100 from one or more lower positioned ports while one or more upper positioned ports may serve as air vents. The mold (e.g., the golf club head 1500) may then be cooled passively (e.g., at room temperature) or actively so that the filler material reaches a solid state and adheres to the back surface 1566 of the face portion 1562. The filler material may directly adhere to the back surface 1566 of the face portion 1562. Alternatively, the filler material may adhere to the back surface 1566 of the face portion 1562 with the aid of the one or more structures on the back surface 1566 and/or the bonding portion 3310 shown in FIG. 33 (e.g., a bonding agent as described herein). The apparatus, methods, and articles of manufacture described herein are not limited in this regard.

As described above, the filler material may be heated to a liquid state (i.e., non-foaming) and solidifies after being injection molded in the interior cavity 2100. A filler material with a low modulus of elasticity may provide vibration and/or noise dampening for the face portion 1562 when the face portion 1562 impacts a golf ball. For example, a polymer material that foams when heated may provide vibration and/or noise dampening. However, such a foaming polymer material may not have sufficient rigidity to provide structural support to a relatively thin face portion because of possible excessive deflection and/or compression of the polymer material when absorbing the impact of a golf ball. In one example, the one or more components of the filler material that is injection molded in the interior cavity 2100 may have a relatively high modulus of elasticity to provide structural support to the face portion 1562 and yet elastically deflect to absorb the impact forces experienced by the face portion 1562 when striking a golf ball. Thus, a non-foaming and injection moldable polymer material with a relatively high modulus of elasticity may be used for partially or entirely filling the interior cavity 2100 to provide structural support and reinforcement for the face portion 1562 in addition to providing vibration and noise dampening. That is, the non-foaming and injection moldable polymer material may be a structural support portion for the face portion 1562. The apparatus, methods, and articles of manufacture are not limited in this regard.

As described herein, the filler material may include a bonding portion. The bonding portion may include an adhesive or epoxy material with a thickness to provide structural support for the face portion 1562. Accordingly, the filler material may include a foaming polymer material to provide vibration and noise dampening whereas the bonding portion may provide structural support for the face portion 1562. The thickness of the bonding portion may depend on a thickness and physical properties of the face portion 1562 as described herein. The apparatus, methods, and articles of manufacture are not limited in this regard.

Figure 35:
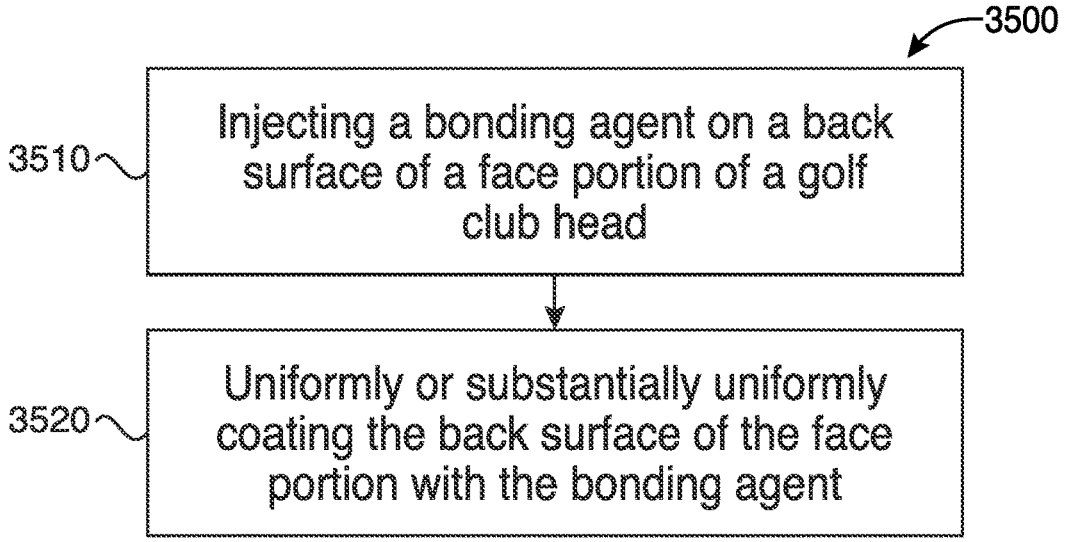
FIG. 35 depicts yet another manner in which an example golf club head described herein may be manufactured.

As described herein, the filler material may include a bonding agent (e.g., an adhesive or epoxy material) and a polymer material. FIG. 35 depicts one manner in which a bonding agent as described herein may be applied to a golf club head prior to partially or entirely filling the interior cavity 2100. In the example of FIG. 35, the process 3500 may begin with injecting a bonding agent on the back surface 1566 of the face portion 1562 (block 3510). The bonding agent may be injected on the back surface 1566 prior to or after heating the golf club head as described above depending on the properties of the bonding agent. The bonding agent may be injected through one or more of the first set of ports 1620 and/or the second set of ports 1630. The bonding agent may be injected on the back surface 1566 through several or all of the first set of ports 1620 and the second set of ports 1630. For example, an injection instrument such as a nozzle or a needle may be inserted into each port until the tip or outlet of the instrument is near the back surface 1566. The bonding agent may then be injected on the back surface 1566 from the outlet of the instrument. Additionally, the instrument may be moved, rotated and/or swiveled while inside the interior cavity 2100 so that the bonding agent is injected onto an area of the back surface 1566 surrounding the instrument. For example, the outlet of the injection instrument may be moved in a circular pattern while inside a port to inject the bonding agent in a corresponding circular pattern on the back surface 1566. Each of the first set of ports 1620 and the second set of ports 1630 may be utilized to inject a bonding agent on the back surface 1566. However, utilizing all of first ports 1620 and/or the second set of ports 1630 may not be necessary. For example, using every other adjacent port may be sufficient to inject a bonding agent on the entire back surface 1566. In another example, ports 1621, 1622 1631, 1633 and 1636 may be used to inject the bonding agent on the back surface 1566. The apparatus, methods, and articles of manufacture are not limited in this regard.

The process 3500 may also include spreading the bonding agent on the back surface 1566 (block 3520) after injection of the bonding agent onto the back surface 1566 so that a generally uniform coating of the bonding agent is provided on the back surface 1566. According to one example, the bonding agent may be spread on the back surface 1566 by injecting air into the interior cavity 2100 through one or more of the first set of ports 1620 and the second set of ports 1630. The air may be injected into the interior cavity 2100 and on the back surface 1566 by inserting an air nozzle into one or more of the first set of ports 1620 and the second set of ports 1630. According to one example, the air nozzle may be moved, rotated and/or swiveled at a certain distance from the back surface 1566 so as to uniformly blow air onto the bonding agent to spread the bonding agent on the back surface 1566 for a uniform coating or a substantially uniform coating of the bonding agent on the back surface 1566. The apparatus, methods, and articles of manufacture are not limited in this regard.

The example process 3500 is merely provided and described in conjunction with other figures as an example of one way to manufacture the golf club head 1500. While a particular order of actions is illustrated in FIG. 35, these actions may be performed in other temporal sequences. Further, two or more actions depicted in FIG. 35 may be performed sequentially, concurrently, or simultaneously. The process 3500 may include a single action of injecting and uniformly or substantially uniformly coating the back surface 1566 with the bonding agent. In one example, the bonding agent may be injected on the back surface 1566 by being converted into fine particles or droplets (i.e., atomized) and sprayed on the back surface 1566. Accordingly, the back surface 1566 may be uniformly or substantially uniformly coated with the bonding agent in one action (i.e., a substantially uniform coating of bonding agent particles, droplets or beads). A substantially uniform coating of the back surface 1566 with the bonding agent may be defined as a coating having slight non-uniformities due to the injection process or the manufacturing process. However, such slight non-uniformities may not affect the bonding of the polymer material to the back surface 1566 with the bonding agent as described herein. For example, spraying the bonding agent on the back surface 1566 may result in overlapping regions of the bonding agent having a slightly greater coating thickness than other regions of the bonding agent on the back surface 1566. The apparatus, methods, and articles of manufacture are not limited in this regard.

Figure 36:
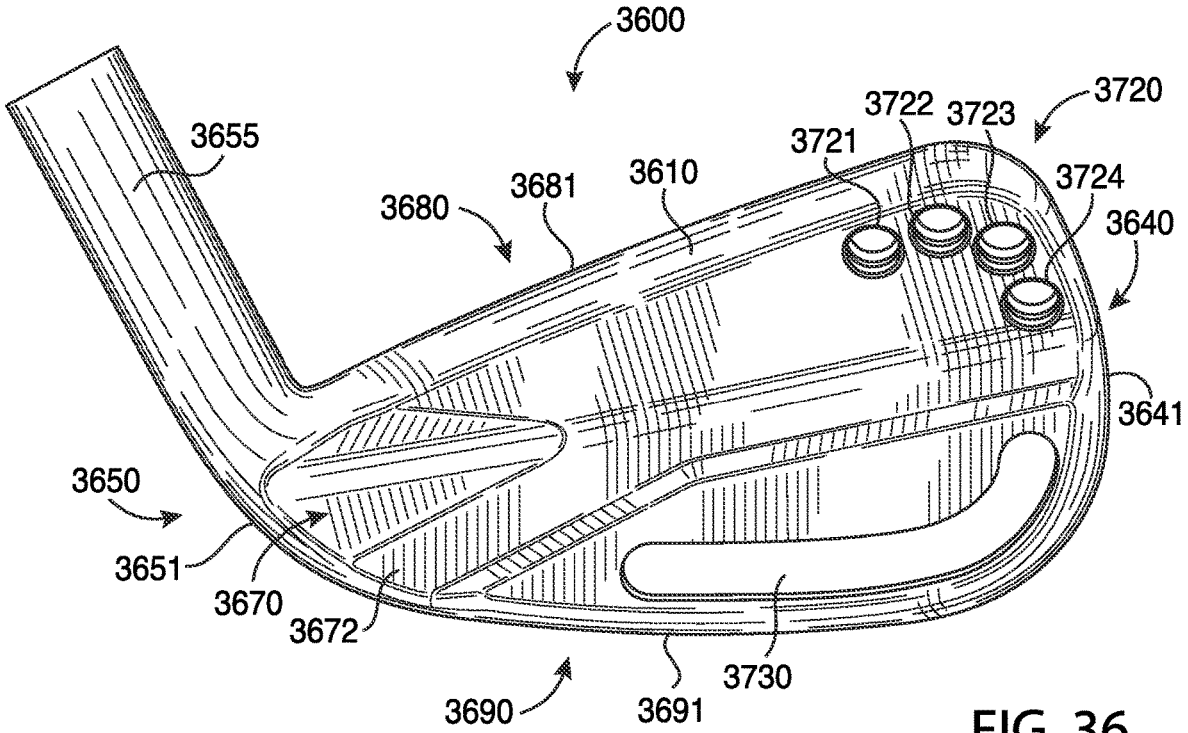
FIGS. 36 and 37 depict rear views of a golf club head according to an embodiment of the apparatus, methods, and articles of manufacture described herein.
Figure 37:
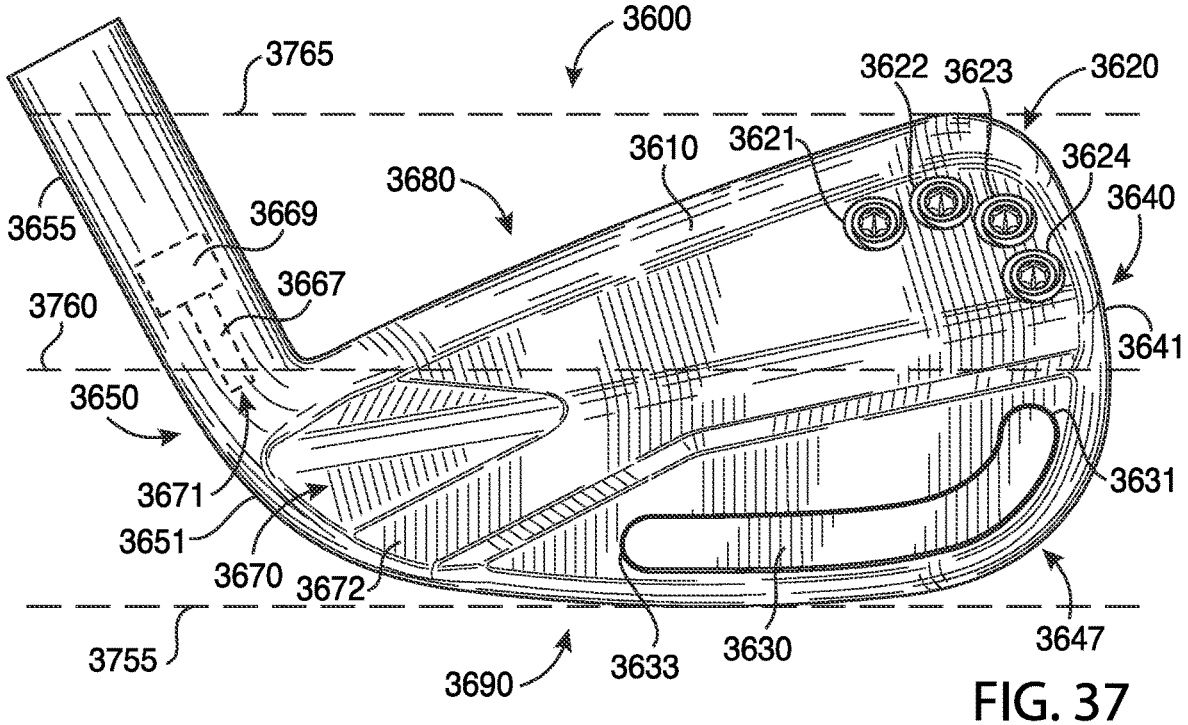
Figure 38:
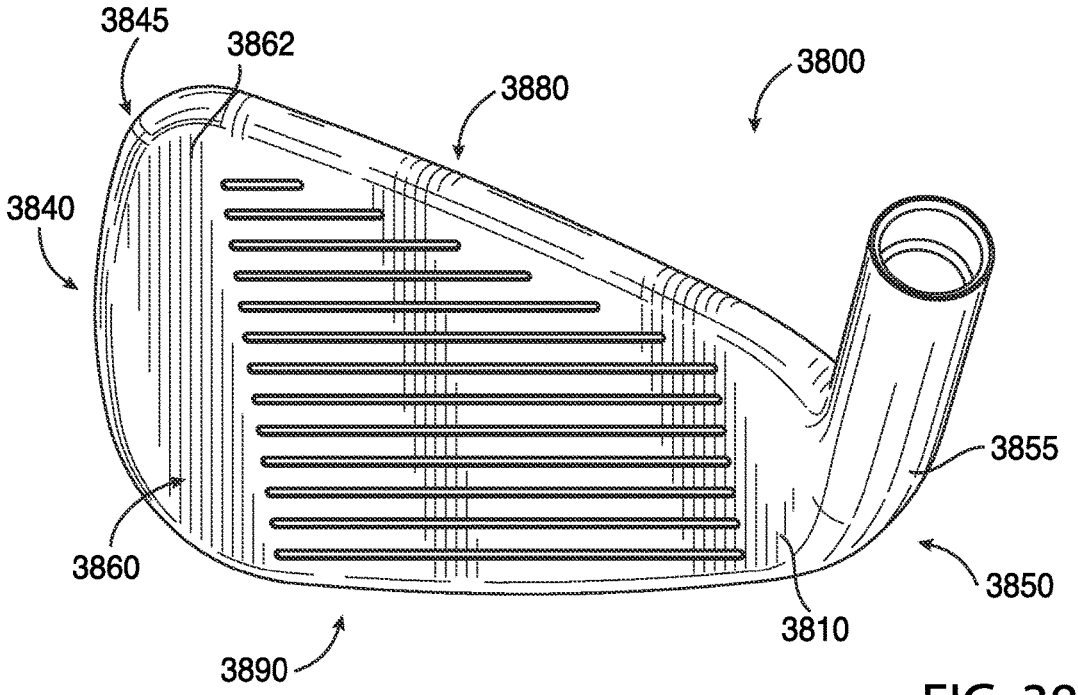
FIGS. 38, 39, 40, 41, 42, and 43 depict a front perspective view, a rear perspective view, a rear perspective view, a perspective bottom view, a perspective toe-side view, and a perspective heel-side view, respectively, of a golf club head according to an embodiment of the apparatus, methods, and articles of manufacture described herein.

As described herein, any two or more of the mass portions may be configured as a single mass portion. In the example of FIGS. 36 and 37, a golf club head 3600 may include a body portion 3610 and two or more mass portions, generally shown as a first set of mass portions 3620 (e.g., shown as mass portions 3621, 3622, 3623, and 3624) and a second mass portion 3630. The body portion 3610 may include a toe portion 3640 with a toe portion edge 3641, a heel portion 3650 with a heel portion edge 3651, a front portion (not shown), a back portion 3670 with a back wall portion 3672, a top portion 3680 with a top portion edge 3681, and a sole portion 3690 with a sole portion edge 3691. The golf club head 3600 may be similar in many respects to any of the golf club heads described herein.

The body portion 3610 may be made of a first material whereas the first set of mass portions 3620 and/or the second mass portion 3630 may be made of a second material. The first material and the second material may be similar or different materials. The first material and the second material of the body portion 3610 and/or the first set of mass portions and the second mass portion 3630 may be similar to the first material and the second material of the golf club head 1500. For example, the body portion 3610 may be partially or entirely made of a steel-based material (e.g., 17-4 PH stainless steel, Nitronic® 50 stainless steel, maraging steel or other types of stainless steel), a titanium-based material, an aluminum-based material (e.g., a high-strength aluminum alloy or a composite aluminum alloy coated with a high-strength alloy), any combination thereof, and/or other suitable types of materials. The first set of mass portions 3620 and the second mass portion 3630 may be partially or entirely made of a high-density material such as a tungsten-based material or other suitable types of materials. Alternatively, the body portion 3610 and/or the first set of mass portions 3620 and the second mass portion 3630 may be partially or entirely made of a non-metal material (e.g., composite, plastic, etc.). The apparatus, methods, and articles of manufacture are not limited in this regard.

The golf club head 3600 may be an iron-type golf club head (e.g., a 1-iron, a 2-iron, a 3-iron, a 4-iron, a 5-iron, a 6-iron, a 7-iron, an 8-iron, a 9-iron, etc.) or a wedge-type golf club head (e.g., a pitching wedge, a lob wedge, a sand wedge, an n-degree wedge such as 44 degrees)(°, 48°, 52°, 56°, 60°, etc.). Although FIGS. 36 and 37 may depict a particular type of club head, the apparatus, methods, and articles of manufacture described herein may be applicable to other types of club heads (e.g., a driver-type club head, a fairway wood-type club head, a hybrid-type club head, a putter-type club head, etc.). The apparatus, methods, and articles of manufacture described herein are not limited in this regard. The toe portion 3640 and the heel portion 3650 may be on opposite ends of the body portion 3610. The heel portion 3650 may include a hosel portion 3655 configured to receive a shaft (an example shown in FIG. 14) with a grip (an example shown in FIG. 14) on one end and the golf club head 3600 on the opposite end of the shaft to form a golf club.

The back portion 3670 may include a back wall portion 3672 with one or more ports along a periphery of the back portion 3670, generally shown as a first set of ports 3720 (e.g., shown as ports 3721, 3722, 3723, and 3724) above a horizontal midplane 3760 and a second port 3730 below the horizontal midplane 3760, which may be vertically halfway between the ground plane 3755 and the top plane 3765. The first set of ports 3720 and/or the second port 3730 may be at any internal or external location on the body portion 3610. Each port of the first set of ports 3720 may be associated with a port diameter. In one example, the port diameter may be about 0.25 inch (6.35 millimeters). Any two adjacent ports of the first set of ports 3720 may be separated by less than the port diameter. As shown in FIGS. 36 and 37, a distance between each port of the first set of ports 3720 and the toe portion edge 3641 may be less than a distance between each port of the first set of ports 3720 and the hosel portion 3655, respectively. The first set of ports 3720 and the second port 3730 may be ports configured to receive one or more mass portions.

Each mass portion of the first set of mass portions 3620 (e.g., shown as mass portions 3621, 3622, 3623, and 3624) may be disposed in a port of the first set of ports 3720 (e.g., shown as ports 3721, 3722, 3723, and 3724) located at or proximate to the toe portion 3640 and/or the top portion 3680 on the back portion 3670. For example, the mass portion 3621 may be partially or entirely disposed in the port 3721. In another example, the mass portion 3622 may be disposed in a port 3722 located in a transition region between the top portion 3680 and the toe portion 3640 (e.g., a top-and-toe transition region). The configuration of the first set of ports 3720 and the first set of mass portions 3620 is similar to many respects to the golf club head 1500. Accordingly, a detailed description of the configuration of the first set of ports 3720 and the first set of mass portions 3620 is not provided.

The second port 3730 may be a recess extending from the toe portion 3640 or a location proximate to the toe portion 3640 to the sole portion 3690 or a location proximate to the sole portion 3690 and through the transition region between the toe portion 3640 and the sole portion 3690. Accordingly, as shown in FIG. 37, the second port 3730 may resemble an L-shaped recess. The second mass portion 3630 may resemble the shape of the second port 3730 and may be configured to be disposed in the second port 3730. The second mass portion 3630 may have a first end 3631 and a second end 3633. As shown in FIG. 37, a distance between the first end 3631 and the toe portion edge 3641 may be less than a distance between the second end 3633 and the toe portion edge 3641. As further shown in FIG. 37, a distance between the first end 3631 and the horizontal midplane 3760 may be less than a distance between the second end 3633 and the horizontal midplane 3760. The second mass portion 3630 may be partially or fully disposed in the port 3730. For example, as shown in FIG. 36, the length of the second port 3730 may be greater than the width of the second port 3730. Accordingly, as shown in FIG. 37, the length of the second mass portion 3630 may be greater than the width of the second mass portion 3630. The second mass portion 3630 may have any shape such as oval, rectangular, triangular, or any geometric or non-geometric shape. The second port 3730 may be shaped similar to the second mass portion 3630. However, portions of the second mass portion 3630 that are inserted in the second port 3730 may have similar shapes as the second port 3730. In one example (not shown), the second port 3730 may have a generally rectangular shape and located at or near the sole portion 3690 extending to and/or between the toe portion 3640 and the heel portion 3650. Accordingly, at least a portion of the second mass portion 3630 may have a similar shape as the second port 3730. As described herein, any of the mass portions described herein, including the first set of mass portions 3620 and the second mass portion 3630 may be coupled to the back portion 3670 of the body portion 3610 with various manufacturing methods and/or processes (e.g., a bonding process, a welding process, a brazing process, a mechanical locking method, any combination thereof, or other suitable manufacturing methods and/or processes). The second mass portion 3630 may be a polymer material that may be injection molded into the second port 3730 as described herein. Also as described herein, any of the mass portions described herein including the mass portion 3630 may be integral with the body portion 3610. The apparatus, methods, and articles of manufacture are not limited in this regard.

The second mass portion 3630 may be configured to place the center of gravity of the golf club head 1500 at an optimal location and optimize the moment of inertia of the golf club head about a vertical axis that extends through the center of gravity of the golf club head 3600. All or a substantial portion of the second mass portion 3630 may be generally near the sole portion 3690. For example, the second mass portion 3630 may be near the periphery of the body portion 3610 and extend from the sole portion 3690 to the toe portion 3640. As shown in the example of FIG. 37, the second mass portion 3630 may be located near the periphery of the body portion 3610 and partially or substantially extend along the sole portion 3690 to lower the center of gravity of the golf club head 3600. A portion of the second mass portion 3630 may be located near the periphery of the body portion 3610 and extend from the sole portion 3690 to the toe portion 3640 through a transition region 3647 between the sole portion 3690 and the toe portion 3640 to lower the center of gravity and increase the moment of inertia of the golf club head 3600 about a vertical axis that extends through the center of gravity. To lower the center of gravity of the golf club head 3600, all or a portion of the second mass portion 3630 may be located closer to the sole portion 3690 than to a horizontal midplane 3760 of the golf club head 3600. The location of the second mass portion 3630 (i.e., the location of the port 3730) and the physical properties and materials of construction of the mass portions of the second port 3730 may be determined to optimally affect the weight, weight distribution, center of gravity, moment of inertia characteristics, structural integrity and/or or other static and/or dynamic characteristics of the golf club head 3600. The apparatus, methods, and articles of manufacture described herein are not limited in this regard.

The mass portions of the first set of mass portions 3620 may have similar or different physical properties (e.g., color, shape, size, density, mass, volume, etc.). In the illustrated example as shown in FIG. 37, each of the mass portions of the first set of mass portions 3620 may have a cylindrical shape (e.g., a circular cross section). Alternatively, each of the mass portions of the first set of mass portions 3620 may have different shapes. Although the above examples may describe mass portions having a particular shape, the apparatus, methods, and articles of manufacture described herein may include mass portions of other suitable shapes (e.g., a portion of or a whole sphere, cube, cone, cylinder, pyramid, cuboidal, prism, frustum, or other suitable geometric shape). The apparatus, methods, and articles of manufacture described herein are not limited in this regard.

To balance the weight of a golf club head, such as any of the golf club heads described herein, a golf club head may include one or more hosel portion mass portions. In one example, the golf club head 3600 may include hosel portion mass portions 3667 and 3669. The hosel portion mass portion 3667 may be permanently attached to the hosel portion 3655 whereas the hosel portion mass portion 3669 may be removable and exchangeable with other hosel portion mass portions to balance the mass of the golf club head 3600 at the hosel portion 3655. The hosel portion mass portions 3667 and 3669 may be a third set of mass portions for the golf club head 3600. In one example, the hosel portion mass portions 3667 and 3669 and the first set of mass portions 3620 may be collectively the first set of mass portions. The apparatus, methods, and articles of manufacture described herein are not limited in this regard.

While the figures may depict a particular number of mass portions in the hosel portion 3655 (e.g., two shown as hosel portion mass portions 3667 and 3669), the apparatus, methods, and articles of manufacture described herein may include separate mass portions or a single mass portion (e.g., the hosel portion mass portions 3667 and 3669 may be a single mass portion). The hosel portion mass portions 3667 and/or 3669 may be the same or different material than the body portion 3610 and/or other mass portions of the golf club head 3600 (e.g., generally shown as 3620 and 3630). The mass of each of the hosel portion mass portions 3667 and 3669 may be greater than, less than, or equal to the mass of any other mass portions of the golf club head 3600 (e.g., generally shown as 3620 and 3630). Further, the hosel portion 3655 may include one or more ports configured to receive and/or engage one or more mass portions. In one example, a port (e.g. one shown as 3671 in FIG. 37) in the hosel portion 3655 may be connected to an interior cavity (e.g., one schematically shown as 2100 in FIG. 21) of the golf club head. The port 3671 in the hosel portion 3655 may include an opening. Accordingly, the interior cavity may be partially or entirely filled through an opening of the port 3671 in the hosel portion 3655. For example, the polymer material may be injected into the interior cavity from the port 3671. The hosel portion mass portions 3667 and/or 3669 may enclose the port 3671 in the hosel portion 3655. In one example, the hosel portion mass portions 3667 and/or 3669 may be a screw to engage the port 3671 in the hosel portion 3655. In another example, the hosel portion mass portions 3667 and/or 3669 may not include any threads (i.e., the hosel portion mass portions 3667 and/or 3669 may be coupled to the port 3671 in the hosel portion 3655 with or without adhesive. The apparatus, methods, and articles of manufacture described herein are not limited in this regard.

As illustrated in FIGS. 38-43, a golf club head 3800 may include a body portion 3810, and one or more mass portions, generally shown as a first set of mass portions 3820 (e.g., shown as mass portion 3821 and mass portion 3822), a second set of mass portions 3830 (e.g., shown as mass portions 3831, 3832, 3833, 3834, 3835, 3836, and 3837), and a third mass portion 3812. The third mass portion 3812 may be a continuous one-piece portion coupled to the body portion 3810. In other words, the third mass portion 3812 may be integrally manufactured with the body portion 3810 and/or be constructed from the same material as the body portion 3810. Alternatively, the third mass portion 3812 may be a separate piece from the body portion 3810 and attached to the body portion 3810 as described herein. The second set of mass portions 3830 (e.g., shown as mass portions 3831, 3832, 3833, 3834, 3835, 3836, and 3837) may be coupled to the third mass portion 3812 as described herein. The body portion 3810 may include a toe portion 3840, a heel portion 3850, a front portion 3860, a back portion 3870, a top portion 3880, and a sole portion 3890. The heel portion 3850 may include a hosel portion 3855 configured to receive a shaft (shown for example in FIG. 14) with a grip (shown for example in FIG. 14) on one end and the golf club head 3800 on the opposite end of the shaft to form a golf club. The front portion 3860 may include a face portion 3862 (e.g., a strike face). The body portion 3810 may be similar to the body portion of any of the golf club heads described herein. Further, the golf club head 3800 may be any type of golf club head such as any of the golf club heads described herein and be manufactured by any of the methods described herein (e.g., the process 3100 shown in FIG. 31). The apparatus, methods, and articles of manufacture are not limited in this regard.

The body portion 3810, the first set of mass portions 3820, the second set of mass portions 3830, and/or the third mass portion 3812 may be made of similar or different materials. For example, the body portion 3810, the first set of mass portions 3820, the second set of mass portions 3830, and/or the third mass portion 3812 may be made of steel, aluminum, titanium, tungsten, metal alloys, polymers, composite materials, or any combinations thereof. The material(s) of the golf club head 3800, the first set of mass portions 3820, the second set of mass portions 3830, and/or the third mass portion 3812 may be similar to any of the golf club heads and the mass portions described herein such as the golf club head 1500. The apparatus, methods, and articles of manufacture are not limited in this regard.

Figure 39:
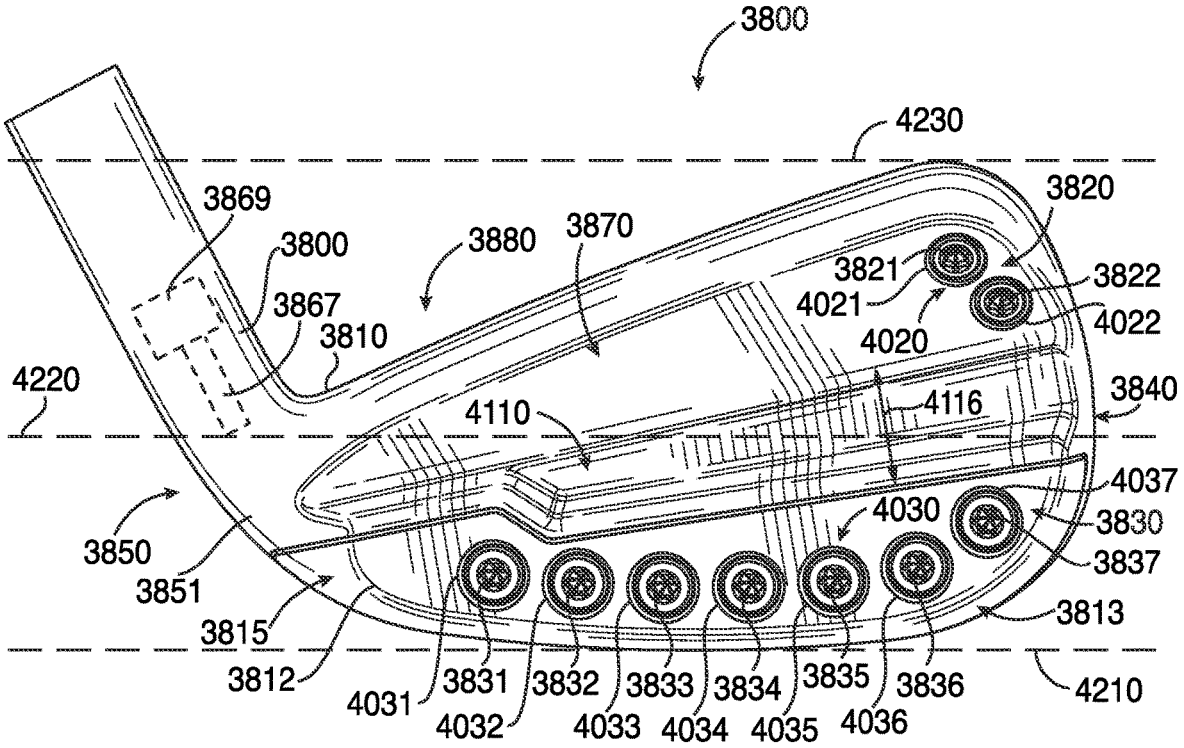
Figure 40:
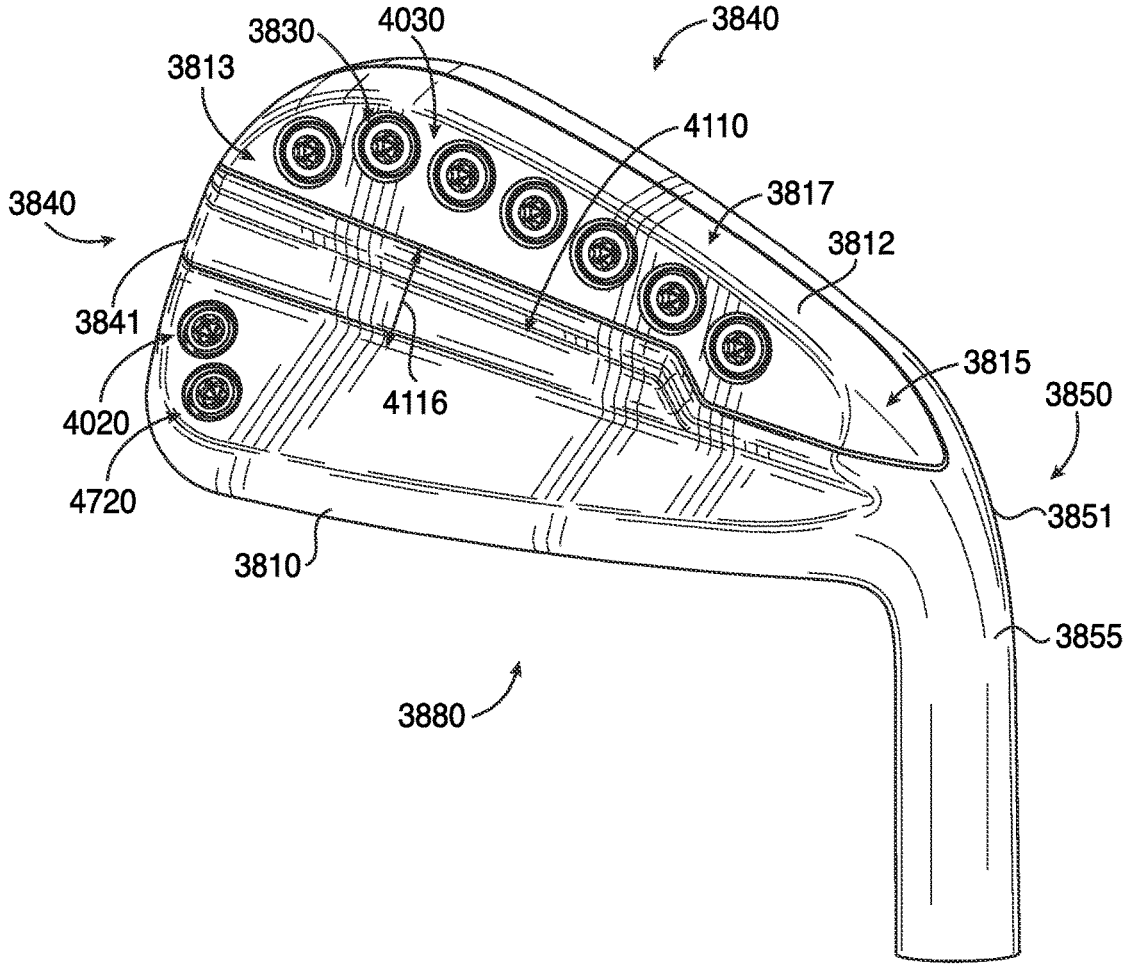

Turning to FIG. 39, for example, the golf club head 3800 may be associated with a ground plane 4210, a horizontal midplane 4220, and a top plane 4230. In particular, the ground plane 4210 may be a plane substantially parallel with the ground and tangential to the sole portion 3890 of the golf club head 3800 when the golf club head 3800 is at an address position (e.g., the golf club head 3800 is aligned to strike a golf ball). The top plane 4230 may be a tangential to the top portion 3880 of the golf club head 3800 when the golf club head 3800 is at the address position. The ground plane 4210 and the top plane 4230 may be substantially parallel to each other. The horizontal midplane 4220 may be located at half the vertical distance between the ground plane 4210 and the top plane 4230.

The third mass portion 3812 may be a portion of the golf club head 3800 made from a different material than the body portion 3810. The third mass portion 3812 may be located on the back portion 3870 below the horizontal midplane 4220 of the golf club head 3800. In one example (not shown), a portion of the third mass portion 3812 may be at or above the horizontal midplane 4220. The third mass portion 3812 may be made of a material with a relatively greater density than the material of the body portion 3810 to lower the CG of the golf club head 3800 and/or to move the CG of the golf club head 3800 toward the back of the golf club head 3800. In one example, the body portion 3810 may be made of a low density and high strength metal such as titanium or titanium alloy material(s), and the third mass portion 3812 may be made of a high density material such as tungsten or tungsten alloy material(s). In addition, or alternatively, at least a portion of the body portion 3810 may be made of a high strength and low density material such as composite materials whereas the third mass portion 3812 may be made of a high density material such as tungsten material(s). Accordingly, the CG of the golf club head 3800 may be located lower than the CG of a comparable golf club head entirely made of a low density material such as titanium and/or composite material(s). The apparatus, methods, and articles of manufacture described herein are not limited in this regard.

The body portion 3810 may include one or more ports along a periphery of the body portion 3810 or the back portion 3870, generally shown as a first set of ports 4020 (e.g., shown as ports 4021 and 4022) and a second set of ports 4030 (e.g., shown as ports 4031, 4032, 4033, 4034, 4035, 4036 and 4037). One or more ports may be an opening of the body portion 3810. The first set of ports 4020 and the second set of ports 4030, respectively, may be ports configured to receive one or more mass portions of the first set of mass portions 3820 and/or the second set of mass portions 3830 similar to the example(s) of the golf club head 1500 as described herein. The first set of ports 4020 (e.g., generally shown as ports 4021 and 4022) may be recesses or bores of the body portion 3810 configured to receive one or more mass portions of the first set of mass portions 3820 and/or mass portions of the second set of mass portions 3830. The second set of ports 4030 (e.g., generally shown as ports 4031, 4032, 4033, 4034, 4035, 4036 and 4037) may be recesses or bores of the third mass portion 3812 configured to receive one or more mass portions of the first set of mass portions 3820 and/or mass portions of the second set of mass portions 3830. The third set of ports 4030 may be recesses or bores in the body portion 3810 when the third mass portion 3812 is integral with the body portion 3810 similar to the golf club head 1500. One or more mass portions of the first set of mass portions 3820 and the second set of mass portions 3830 may be coupled to one or more ports of the first set of ports 4020 and the second set of port 4030 with various manufacturing methods and/or processes (e.g., a bonding process, a welding process, a brazing process, a mechanical locking method, any combination thereof, or other suitable manufacturing methods and/or processes) such as the methods and processes described herein. The locations of the ports, the distances between the ports, the configurations and/or properties of the ports and the mass portions (e.g., dimensions and/or masses) may be similar to any of the golf club heads, ports and/or mass portions described herein. The apparatus, methods, and articles of manufacture described herein are not limited in this regard.

The third mass portion 3812 may be made of a material with a relatively greater density than the material of the body portion 3810. In one example, the third mass portion 3812 may be made of tungsten or tungsten alloy material(s) whereas the body portion 3810 may be made of titanium or titanium alloy material(s). Referring back to FIG. 39, for example, the third mass portion 3812 may be located below the horizontal midplane 4220 of the golf club head 3800 and on the back portion 3870 of the golf club head 3800 to place the CG of the golf club head 3800 lower and farther back as compared to a comparable golf club head substantially made of the same material as the material of the body portion 3810. The apparatus, methods, and articles of manufacture described herein are not limited in this regard.

Figure 41:
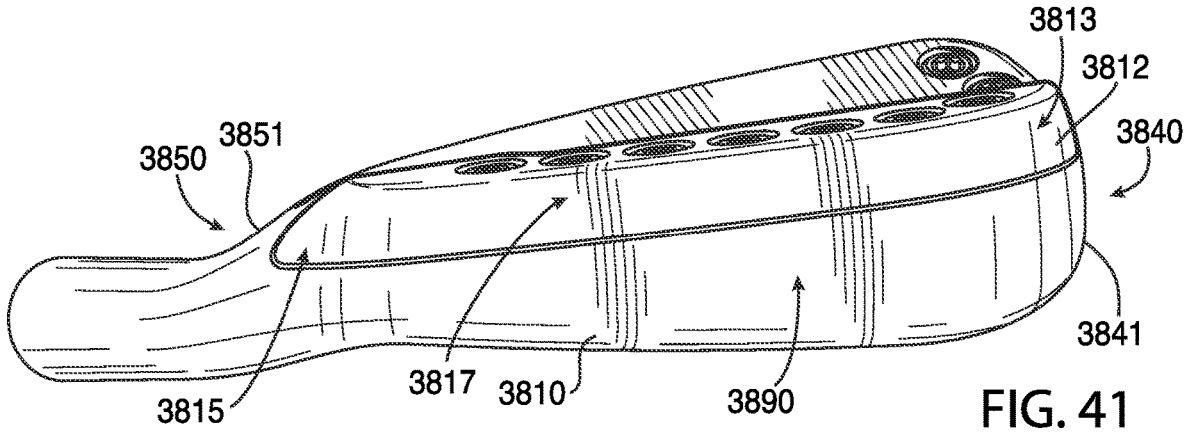
Figure 42:
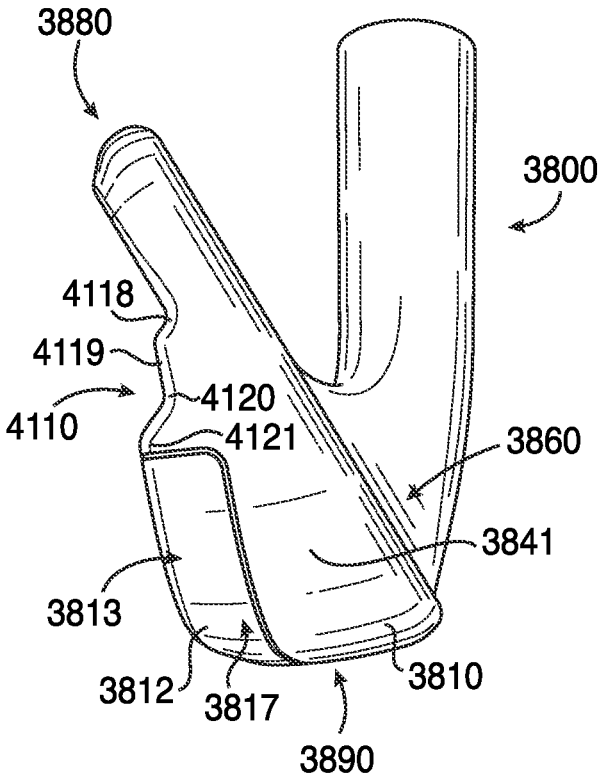
Figure 43:
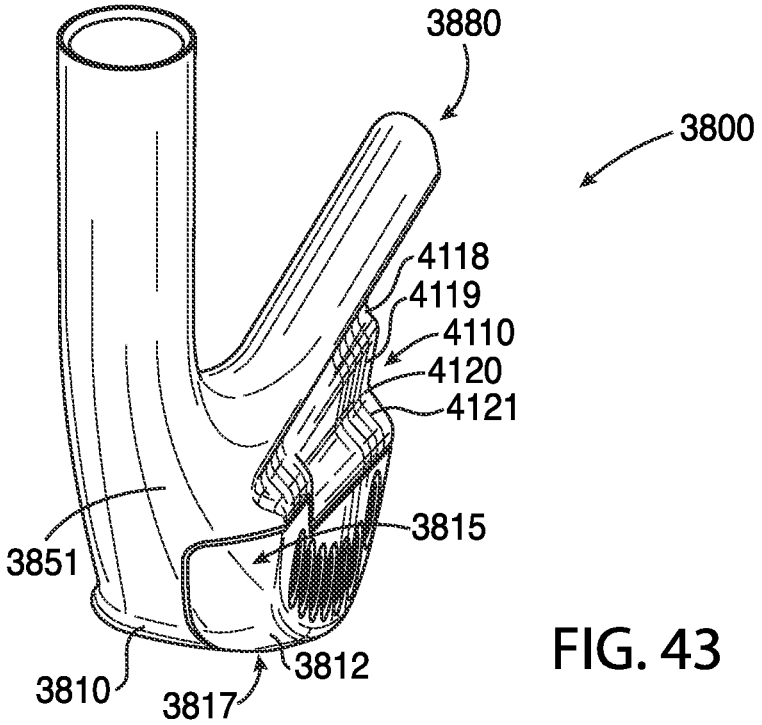
Figure 44:
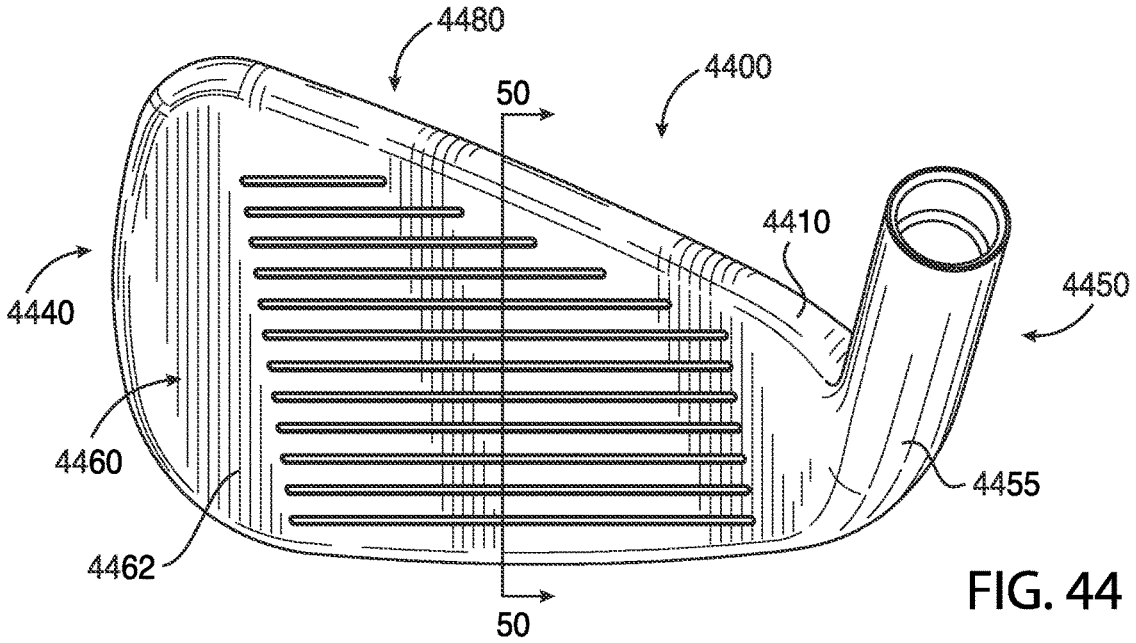
FIGS. 44, 45, 46, 47, 48, 49, 50, 51, 52, and 53 depict a front view, a rear view, a bottom view, a perspective toe-side view, a perspective heel-side view, a perspective cross-sectional view taken at section lines 49-49 of FIG. 51, a perspective cross-sectional view taken at section lines 50-50 of FIG. 44, a front perspective view of the example golf club head of FIG. 44 shown with the face portion removed, a perspective cross-sectional view of the example golf club head of FIG. 44 taken at section lines 52-52 of FIG. 51, and an enlarged view of area 53 of FIG. 49, respectively, of a golf club head according to an embodiment of the apparatus, methods, and articles of manufacture described herein.
Figure 45:
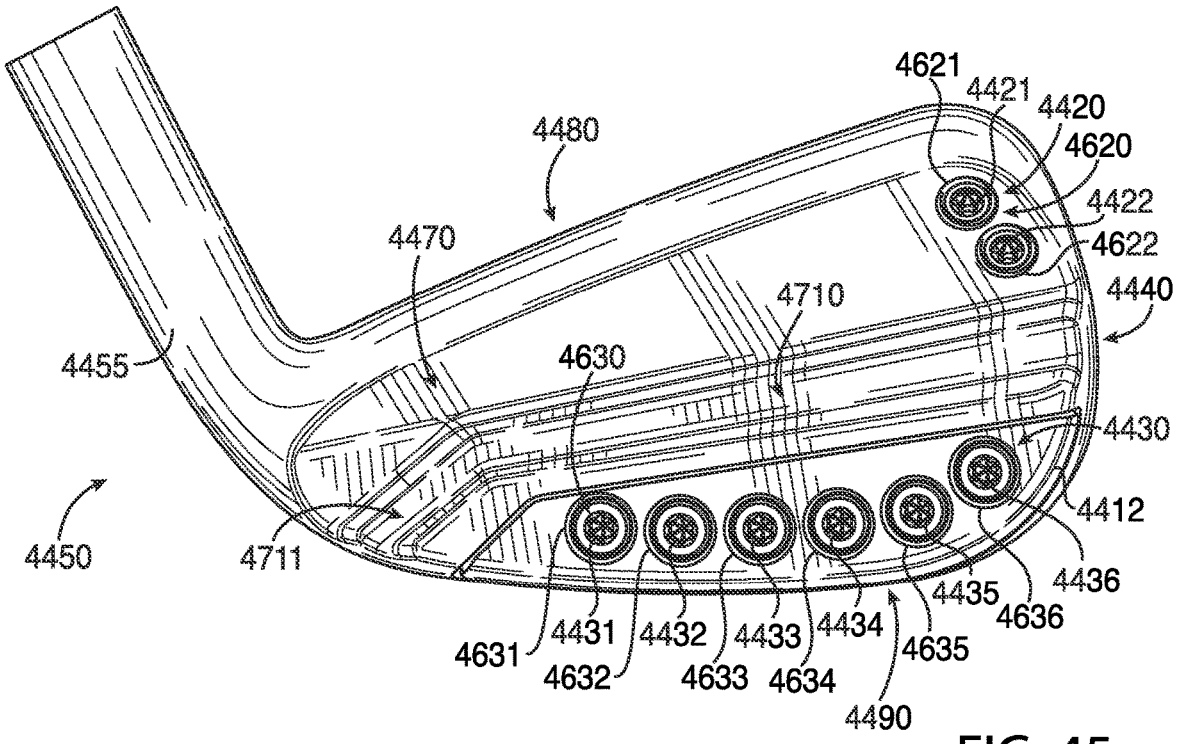

The third mass portion 3812 may include a third mass toe portion 3813, a third mass heel portion 3815 and a third mass sole portion 3817. The third mass portion 3812 may extend to and/or between the toe portion 3840, the heel portion 3850, and/or the sole portion 3890. For example, the third mass portion 3812 may extend to the toe portion edge 3841 of the toe portion 3840 of the golf club head 3800 so that the third mass portion 3812 may be a portion of the toe portion 3840 of the golf club head 3800 as shown in FIG. 42. The third mass portion 3812 may extend to the heel portion edge 3851 of the heel portion 3850 of the golf club head 3800 so that the third mass heel portion 3815 may be a portion of the heel portion 3850 of the golf club head 3800 as shown in FIG. 43. The third mass portion 3812 may extend to the bottom edge of the sole portion 3890 of the golf club head 3800 so that the third mass portion 3812 may be a portion of the sole portion 3890 of the golf club head 3800 as shown in FIG. 41. Accordingly, the third mass portion 3812 may be a portion of the golf club head 3800 extending to and/or between a location below the horizontal midplane 4220 of the golf club head and the sole portion 3890 of the golf club head 3800, and extending to and/or between the toe portion 3840 and the heel portion 3850 of the golf club head 3800. The apparatus, methods, and articles of manufacture described herein are not limited in this regard.

The third mass toe portion 3813 of the third mass portion 3812 may have a larger mass than the third mass heel portion 3815 of the third mass portion 3812 to shift more mass toward the toe portion 3840 of the golf club head 3800 to increase the MOI of the golf club head 3800. Accordingly, the third mass portion 3812 may have a relatively larger third mass toe portion 3813 that may taper to a relatively smaller third mass heel portion 3815. The tapering of the third mass portion 3812 from the third mass toe portion 3813 of the third mass portion 3812 to the third mass heel portion 3815 of the third mass portion 3812 may be defined by a reduction in the height, a reduction in the width and/or a reduction in size and/or shape of the cross sectional area of the third mass portion 3812. The apparatus, methods, and articles of manufacture described herein are not limited in this regard.

In one example, the third mass heel portion 3815 of the third mass portion 3812 at or proximate to the heel portion 3850 of the golf club head 3800 may include a material with a relatively lower density than the remaining material of the third mass portion 3812 to lower the mass of the golf club head 3800 at or proximate to the heel portion 3850 and/or to provide more mass at or proximate to the toe portion 3840 of the golf club head 3800. In one example, the body portion 3810 may be made of a material with a relatively greater density than titanium or titanium alloy material(s) such as steel material. Accordingly, the third mass portion 3812 may include a reduced mass portion at or proximate to the heel portion 3850 of the golf club head 3800 to lower the mass of the golf club head 3800 at or proximate the heel portion 3850 to balance the golf club head 3800 and move the CG toward a center portion of the golf club head 3800. For example, a portion of the third mass portion 3812 at or proximate to the third mass heel portion 3815 of the third mass portion 3812 may include a portion (not shown) that may include a material with a relatively lower density than the remaining material of the third mass portion 3812. In one example, a portion of the third mass portion 3812 at or proximate to the third mass heel portion 3815 of the third mass portion 3812 may include aluminum or aluminum alloy material(s). The apparatus, methods, and articles of manufacture described herein are not limited in this regard.

The third mass portion 3812 may be a separate piece from the body portion 3810 and may be removed from the body portion 3810. Accordingly, the third mass portion 3812 may be removed and exchanged with another third mass portion 3812 having a different mass to allow for adjustability of the mass distribution and/or the total mass of the golf club head 3800. The third mass portion 3812 may be attached to the body portion 3810 by one or more mass portions of the second set of mass portions 3830. For example, one or more of the ports of the second set of ports 4030 may be through bores of the third mass portion 3812 that align with corresponding recesses or bores (not shown) on the body portion 3810. One or more mass portions of the second set of mass portions 3830 may be inserted into the one or more ports of the second set of ports 4030 and extend through the recesses or bores on the body portion 3810 to fasten the third mass portion 3812 to the body portion 3810. The second set of mass portions 3830 (e.g., mass portions 3831, 3832, 3833, 3834, 3835, 3836 and 3837) may be configured to place the CG of the golf club head 3800 at an optimal location and/or optimize the MOI of the golf club head about a vertical axis (not shown) that extends through the CG of the golf club head 3800 similar to the second set of mass portions 1730 of the golf club head 1500. The apparatus, methods, and articles of manufacture described herein are not limited in this regard.

In one example, the body portion 3810 or any of the body portions of the golf club heads described herein may be made of one or more metal or metal alloy material(s), non-metallic materials such as composite materials, plastic materials, or wood, and/or any combinations thereof. The third mass portion 3812 may be made of a material that has a greater density than the material of the body portion 3810. For example, the body portion 3810 may be made of titanium or titanium alloy material(s) whereas the third mass portion 3812 may be made of tungsten or tungsten alloy material(s). Accordingly, the hosel portion 3855 may be made of the same material as the material of the body portion 3810 or a different material. To balance the mass of the golf club head 3800 due to the hosel portion 3855 being made of a low-density metal material such as titanium or titanium alloy material(s), the golf club head 3800 may include hosel portion mass portions 3867 and 3869. The hosel portion mass portion 3867 may be permanently attached to the hosel portion 3865 whereas the hosel portion mass portion 3869 may be removable and exchangeable with other hosel portion mass portions to balance the mass of the golf club head 3800 at the hosel portion 3865. The hosel portion mass portions 3867 and 3869 may be a fourth set of mass portions for the golf club head 3800. Accordingly, the golf club head 3800 may include a first set of mass portions 3820 and/or a fourth set of mass portions defined by the hosel portion mass portions 3867 and 3869 above or proximate to the horizontal midplane 4220, and a second set of mass portions 3830 and/or a fourth mass portion below or proximate to the horizontal midplane 4220. In one example, the hosel portion mass portions 3867 and 3869 and the first set of mass portions 3820 may be collectively the first set of mass portions, and the second set of mass portions 3830 and the third mass portion 3812 may be collectively the second set of mass portions. The apparatus, methods, and articles of manufacture described herein are not limited in this regard.

The mass portions of the second set of mass portions 3830 may have similar or different masses. In one example, the mass portions 3831, 3832, 3833, 3834 and 3835 may be made of a material with a relatively lower density than the mass portions 3836 and 3837. For example, the mass portions 3831, 3832, 3833, 3834 and 3835 may be made of titanium or titanium alloy material(s), while the mass portions 3836 and 3837 may be made of tungsten or tungsten alloy material(s). The mass portions 3831, 3832, 3833, 3834 and 3835 may be changed with mass portions having relatively greater or less mass to affect the swing weight of the golf club head 3800. Accordingly, the total mass of the mass portions 3836 and 3837 may be greater than the total mass of the mass portions 3831, 3832, 3833, 3834 and 3835 to increase the MOI of the golf club head 3800. In one example, the mass of one or more of the mass portions may progressively increase from the heel portion 3850 to the toe portion 3840. In another example, the mass of one or more of the mass portions 3831, 3832, 3833, 3834 and 3835 may progressively increase from the heel portion 3850 to the toe portion 3840 whereas the mass of one or more the mass portions 3836 and 3837 may be constant and greater than the mass of any of the mass portions 3831, 3832, 3833, 3834 and 3835. In yet another example, each of the mass portions 3831, 3832, 3833, 3834 and 3835 may have similar masses, and each of the mass portions 3836 and 3837 may also have similar masses but greater than the mass of any of the mass portions 3831, 3832, 3833, 3834 and 3835. The apparatus, methods, and articles of manufacture described herein are not limited in this regard.

Alternatively, two or more mass portions in the same set may be different in mass. In one example, the mass portion 3821 of the first set of mass portions 3820 may have a relatively less mass than the mass portion 3822 of the first set of mass portions 3820. In another example, the mass portion 3831 of the second set of mass portions 3830 may have a relatively less mass than the mass portion 3835 of the second set of mass portions 3830. Accordingly, more mass may be distributed away from the heel portion 3850 to increase the MOI about the vertical axis through the CG.

While the figures may depict ports with a particular cross-section shape, the apparatus, methods, and articles of manufacture described herein may include ports with other suitable cross-section shapes. The ports of the first and/or second sets of ports 4020 and 4030, respectively, may have cross-sectional shapes that are similar to the cross-sectional shapes of any of the ports described herein. The apparatus, methods, and articles of manufacture described herein are not limited in this regard.

The first set of mass portions 3820 and the second set of mass portions 3830 may be similar in mass (e.g., all of the mass portions of the first set of mass portions 3820 and the second set of mass portions 3830 may weigh about the same). Alternatively, one or more mass portions of the first set of mass portions 3920 and the second set of mass portions 3830 may be different in mass individually or as an entire set. In particular, one or more mass portions of the first set of mass portions 3820 (e.g., shown as mass portion 3821 and mass portion 3822) may have relatively less mass than any of the mass portions of the second set of mass portions 3830 (e.g., shown as 3831, 3832, 3833, 3834, 3835, 3836 and 3837). For example, the second set of mass portions 3830 may account for more than 41% of the total mass of the mass portion(s) of the golf club head 3800. In another example, the second set of mass portions 3830 may account for between 55% and 75% of the total mass of the mass portion(s) of the golf club head 3800. In yet another example, the second set of mass portions 3830 may account for between 60% and 90% of the total mass of the mass portion(s) of the golf club head 3800. As a result, the golf club head 3800 may be configured to have at least 41% of the total mass of the mass portion(s) disposed below the horizontal midplane 4220. Further, the total mass of the mass portion(s) may be greater below the horizontal midplane 4220 that the total mass of the mass portion(s) above the horizontal midplane 4220. The mass of the body portion 3810, one or more mass portions of the first set of mass portions 3820, the total mass of the first set of mass portions 3820, one or more mass portions of the second set of mass portions 3830, and/or the total mass of the second set of mass portions 3830 may be similar to the golf club head 1500 as described herein. The apparatus, methods, and articles of manufacture described herein are not limited in this regard.

With the first set of mass portions 3820 and the second set of mass portions 3830, (e.g., securing the first set of mass portions 3820 and the second set of mass portions 3830 in the ports on the body portion 3810 and/or having first set of mass portions 3820 and the second set of mass portions 3830 being integral with the body portion 3810), and having the third mass portion 3812 being made of a material with a relatively greater density than the material of the body portion 3810, the location of the CG and the MOI of the golf club head 3800 may be optimized. In particular, the third mass portion 3812 and the first set of mass portions 3820 and the second set of mass portions 3830 may lower the location of the CG towards the sole portion 3890 and further back away from the face portion 3862. Further, the MOI may be higher as measured about a vertical axis extending through the CG (e.g., perpendicular to the ground plane 4210). The MOI may also be higher as measured about a horizontal axis extending through the CG (e.g., extending towards the toe portion 3840 and the heel portion 3850 of the golf club head 3800). As a result, the club head 3800 may provide a relatively higher launch angle and a relatively lower spin rate than a golf club head without the third mass portion 3812 and the first set of mass portions 3820 and the second set of mass portions 3830. The apparatus, methods, and articles of manufacture described herein are not limited in this regard.

Although the figures may depict the mass portions as separate and individual parts visible from an exterior of the golf club head 3800, one or more mass portions of the first set of mass portions 3820 and/or the second set of mass portions 3830, respectively, may be a single piece of an exterior mass portion and/or an interior mass portion (e.g., not visible from an exterior of the golf club head 1500). In one example, all of the mass portions of the first set of mass portions 3820 (e.g., shown as mass portion 3821 and mass portion 3822) may be combined into a single piece of mass portion (e.g., a first mass portion). In a similar manner, all of the mass portions of the second set of mass portions 3830 (e.g., 3831, 3832, 3833, 3834, 3835, 3836 and 3837) may be combined into a single piece of mass portion as well (e.g., a second mass portion). In this example, the golf club head 3800 may have only two mass portions. In another example (not shown), the body portion 3810 may not include the first set of mass portions 3820, but include the second set of mass portions 3830 as a single piece of interior mass portion located farther from the heel portion 3850 than the toe portion 3840. In yet another example (not shown), the body portion 3810 may not include the first set of mass portions 3820, but include the second set of mass portions 3830 with a first interior mass portion located farther from the heel portion 3850 than the toe portion 3840 and a second interior mass portion located farther from the toe portion 3840 than the heel portion 3850. The first interior mass portion and the second interior mass portion may be (i) integral parts of the body portion 3810 or (ii) separate from the body portion 3810 and coupled to the body portion 3810. The apparatus, methods, and articles of manufacture described herein are not limited in this regard.

The body portion 3810 of the golf club head 3800 may be a hollow body including the interior cavity (not shown) similar to the golf club head 1500. Further, the interior cavity may be unfilled, partially filled with one or more filler materials, or entirely filled with one or more filler materials similar to the golf club head 1500 as described herein. The apparatus, methods, and articles of manufacture described herein are not limited in this regard.

Referring back to FIGS. 38-43, for example, the back portion 3870 may include a channel 4110 with a length extending to and/or between the toe portion 3840 and the heel portion 3850. The channel 4110 may extend parallel (not shown) to the horizontal midplane 4220 or extend at an angle relative to the horizontal midplane 4220 as shown in the example of FIG. 39. The channel 4110 may extend from a location at or proximate to the toe portion edge 3841 of the toe portion 3840 at or near the horizontal midplane 4220 to a location at or proximate to the heel portion edge 3851 of the heel portion 3850 below the horizontal midplane 4220. In one example (not shown), the channel 4110 may extend from the toe portion edge 3841 to a location between the toe portion 3840 and the heel portion 3850. In another example (not shown), the channel 4110 may extend from the heel portion edge 3851 of the heel portion 3850 to a location between the toe portion 3840 and the heel portion 3850. In yet another example, the channel 4110 may partially extend to and/or between the toe portion 3840 and the heel portion 3850. The apparatus, methods, and articles of manufacture described herein are not limited in this regard.

In one example, as shown in FIGS. 38-43, the top channel width ($W_{CT}$) 4116 may decrease in a direction from the toe portion 3840 to the heel portion 3850. The top channel width 4116 may be between 0.22 inch (0.55 cm) and 0.65 inch (1.66 cm) at the toe portion edge 3841, and between 0.15 inch (0.29 cm) and 0.37 inch (1.16 cm) at the heel portion edge 3851. In another example, the top channel width 4116 may be between 0.30 inch (0.77 cm) and 0.57 inch (1.35 cm) at the toe portion edge 3841, and between 0.21 inch (0.54 cm) and 0.31 inch (1.01 cm) at the heel portion edge 3851. In another example, the top channel width 4116 may be between 0.28 inch (0.94 cm) and 0.5 inch (1.27 cm) at the toe portion edge 3841, and between 0.26 inch (0.66 cm) and 0.26 inch (0.89 cm) at the heel portion edge 3851. The apparatus, methods, and articles of manufacture described herein are not limited in this regard.

In one example, as shown in FIG. 39, the top channel width 4116 may decrease in a direction from the toe portion edge 3841 to the heel portion edge 3851. In another example (not shown), the top channel width 4116 may increase in a direction from the toe portion edge 3841 to the heel portion edge 3851. In yet another example (not shown), the top channel width 4116 may remain constant in a direction from the toe portion edge 3841 to the heel portion edge 3851. The top channel width 4116 may vary in any manner in a direction from the toe portion edge 3841 to the heel portion edge 3851. For example, the top channel width 4116 may vary in a direction from the toe portion edge 3841 to the heel portion edge 3851 by between 25% and 75% of the top channel width 4116 at or proximate to the toe portion edge 3841. In another example, the top channel width 4116 may vary in a direction from the toe portion edge 3841 to the heel portion edge 3851 by between 26% and 65%. In another example, the top channel width 4116 may vary in a direction from the toe portion edge 3841 to the heel portion edge 3851 by between 31% and 60%. In yet another example, the top channel width 4116 may decrease continuously and uniformly in a direction from the toe portion edge 3841 to the heel portion edge 3851 (shown in FIGS. 38-43). In yet another example, the top channel width 4116 may increase continuously and uniformly in a direction from the toe portion edge 3841 to the heel portion edge 3851 (not shown). In yet another example, the top channel width 4116 may change in a discontinuous or step-wise manner (not shown) in a direction from the toe portion edge 3841 to the heel portion edge 3851 (not shown). The apparatus, methods, and articles of manufacture described herein are not limited in this regard.

As illustrated in the example of FIGS. 38-43, the channel 4110 may include a first groove portion 4118, a first step portion 4119, a second groove portion 4120, and a second step portion 4121. Each of the first groove portions 4118 and the second groove portions 4120 may include side walls that form a generally right angle, an acute angle, or an obtuse angle relative to the channel width 4116 or a bottom portion of each groove portion, respectively. Accordingly, the groove portions 4118 and 4120 may define valley-shaped groove portions. The areas of joinder between the sidewalls of the groove portions 4118 and 4120 and the bottom portion of each groove portion may include a chamfer or a transition region. The channel 4110 may have any shape or configuration. In one example, the channel 4110 may have U-shaped cross section along a portion or the entire length of the channel 4110. In another example, the channel 4110 may have a square or rectangular cross section along a portion or the entire length of the channel 4110. In yet another example, the channel 4110 may be a longitudinal recess in the body portion 3810 without having any multiple groove and or step portions. The apparatus, methods, and articles of manufacture described herein are not limited in this regard.

The depth of each groove portion 4118 and 4120 may be generally constant or may vary in a direction from the toe portion edge 3841 to the heel portion edge 3851. In one example, the depth of each groove portion 4118 and/or 4120 may decrease in a direction from the toe portion edge 3841 to the heel portion edge 3851. In another example, as shown in FIGS. 38-43, the depth of each groove portion 4118 and/or 4120 may increase in a direction from the toe portion edge 3841 to the heel portion edge 3851. In one example, the depth of each groove portion 4118 and/or 4120 may be between 0.04 inch (0.09 cm) and 0.11 inch (0.28 cm) at the toe portion edge 3841 and between 0.06 inch (0.16 cm) and 0.19 inch (0.48 cm) at the heel portion edge 3851. In another example, the depth each groove portion 4118 and/or 4120 may be between 0.05 inch (0.13 cm) and 0.09 inch (0.24 cm) at the toe portion edge 3841 and between 0.09 inch (0.22 cm) and 0.16 inch (0.32 cm) at the heel portion edge 3851. In yet another example, the depth each groove portion 4118 and/or 4120 may be between 0.06 inch (0.16 cm) and 0.08 inch (0.21 cm) at the toe portion edge 3841 and between 0.11 inch (0.27 cm) and 0.14 inch (0.28 cm) at the heel portion edge 3851. The apparatus, methods, and articles of manufacture described herein are not limited in this regard.

The first step portion 4119 may define a transition portion between the first groove portion 4118 and the second groove portion 4120. The second step portion 4121 may define a transition portion between the second groove portion 4120 and the portion of back portion 3870 below the channel 4110. The width of the first step portion 4119 and/or the second step portion 4121 may be generally constant or may vary in a direction from the toe portion edge 3841 to the heel portion edge 3851. In one example, the width of the first step portion 4119 and/or the second step portion 4121 may decrease in a direction from the toe portion edge 3841 to the heel portion edge 3851. In another example, the width of the first step portion 4119 and/or the second step portion 4121 may increase in a direction from the toe portion edge 3841 to the heel portion edge 3851. The apparatus, methods, and articles of manufacture described herein are not limited in this regard.

The channel 4110 may define a portion of the body portion 3810 from which mass has been removed to form the channel 4110. The removed mass defined by the channel 4110 may be redistributed to other portions of the body portion 3810 to provide certain characteristics to the golf club head 3800. At least a portion of the removed mass defined by the channel 4110 may be redistributed below the horizontal midplane 4220 of the body portion 3810 to lower the CG of the golf club head 3800 while maintaining or substantially maintaining the overall mass of the body portion 3810. Further, at least a portion of the removed mass defined by the channel 4110 may be redistributed below the horizontal midplane 4220 of the body portion 3810 and closer to the toe portion 3840 than the heel portion 3850 to increase the MOI of the golf club head 3800. In one example, the removed mass defined by the channel 4110 may be redistributed and incorporated into the body portion 3810 below the horizontal midplane 4220 by increasing the volume of the body portion 3810 below the horizontal midplane 4220. Accordingly, the volume and the mass of the body portion 3810 below the horizontal midplane 4220 may be increased. In another example, the removed mass defined by the channel 4110 may be redistributed and incorporated into the third mass portion 3812. In yet another example, the removed mass defined by the channel 4110 may be redistributed and incorporated into the body portion 3810 as additional mass portion(s). The increased mass below the horizontal midplane 4220 and/or toward the toe portion 3840 may lower the CG and/or increase the MOI of the golf club head 3800. The apparatus, methods, and articles of manufacture described herein are not limited in this regard.

The configuration of the channel 4110, such as width, depth, volume, cross-sectional shape, and/or any other characteristics described herein may vary as the channel 4110 extends to and/or between the toe portion 3840 and the heel portion 3850. Accordingly, the mass that is removed from the body portion 3810 due to the presence of the channel 4110 may similarly vary. According to another example, the masses of one or more of the mass portions of the second set of mass portions 3830 may correspondingly vary in a direction from the toe portion 3840 to the heel portion 3850 at a similar rate, a substantially similar rate, or a discrete and step-wise (e.g., mass portions varying in groups of multiple mass portions) yet generally similar rate as the variation in the channel configuration in a direction from the toe portion 3840 to the heel portion 3850. In yet another example, all of the mass portions of the second set of mass portions 3830 may have similar masses. The apparatus, methods, and articles of manufacture described herein are not limited in this regard.

The masses of one or more of the mass portion(s) of the first set of mass portions 3820 and/or the second set of mass portions 3830 may vary. The mass of one or more mass portion(s) may be increased and/or decreased by changing the length, diameter, and/or the material(s) of construction of the mass portions. For example, the mass of a mass portion may be increased by increasing the length of the mass portion without increasing the diameter of the mass portion so that the mass portion can be used in any of the ports of the body portion 3810. In another example, the mass of a mass portion may be increased by using a material with a relatively greater density for the mass portion. The apparatus, methods, and articles of manufacture described herein are not limited in this regard.

In one example, the masses of one or more mass portion(s) the second set of mass portions 3830 may decrease in a direction from the toe portion 3840 to the heel portion 3850 to increase the MOI of the golf club head 3800. In one example, one or more mass portion(s) of the mass portions of the second set of mass portions 3830 may have a lower mass relative to an adjacent mass portion of the second set of mass portions 3830 in a direction from the toe portion 3840 to the heel portion 3850. In another example, groups of mass portions of the second set of mass portions 3830 may have similar masses and yet have a smaller overall mass than an adjacent group of mass portions in a direction from the toe portion 3840 to the heel portion 3850. Accordingly, the masses of the mass portions of the second set of mass portions 3830 may decrease in a direction from the toe portion 3840 to the heel portion 3850 individually, in groups or in any manner. The apparatus, methods, and articles of manufacture described herein are not limited in this regard.

Turning to FIGS. 44-53, a golf club head 4400 may include a body portion 4410. The body portion 4410 may include a toe portion 4440, a heel portion 4450, a front portion 4460, a back portion 4470, a top portion 4480, and a sole portion 4490. The heel portion 4450 may include a hosel portion 4455 configured to receive a shaft (one example shown in FIG. 14) with a grip (one example shown in FIG. 14) on one end and the golf club head 4400 on the opposite end of the shaft to form a golf club. The golf club head 4400 may also include a face portion 4462 (e.g., a strike face) that may be attached to the front portion 4460. In another example, the face portion 4462 may be an integral part of the body portion 4410. The golf club head 4400 may be any type of golf club head such as any of the golf club heads described herein and be manufactured by any of the methods described herein and illustrated in FIG. 31. The golf club head 4400 may be similar to the golf club head 1500. The apparatus, methods, and articles of manufacture are not limited in this regard.

The body portion 4410 may include one or more mass portions, generally shown as a first set of mass portions 4420 (e.g., shown as mass portions 4421 and 4422), a second set of mass portions 4430 (e.g., shown as mass portions 4431, 4432, 4433, 4434, 4435, and 4436), and a third mass portion 4412. The body portion 4410 may include one or more ports along a periphery of the body portion 4410, generally shown as a first set of ports 4620 (e.g., shown as ports 4621 and 4622) and a second set of ports 4630 (e.g., shown as ports 4631, 4632, 4633, 4634, 4635, and 4636). The body portion 4410, the first set of ports 4620, the second set of ports 4630, the first set of mass portions 4420, and the second set of mass portions 4430 may be similar to the corresponding parts of the golf club heads 1500 and/or 3800. The apparatus, methods, and articles of manufacture are not limited in this regard.

As shown in FIGS. 44-48, for example, the third mass portion 4412 may be an integral part of the body portion 4410 and made of one or more material(s) that are similar to or different from the material(s) of the body portion 4410. Accordingly, in one example, the body portion 4410 may be similar to the body portion 1510 of the golf club head 1500. In another example, the third mass portion 4412 may be similar to the third mass portion 3812 of the golf club head 3800. Accordingly, in one example (not shown), the third mass portion 4412 may be a separate piece from the body portion 4410 and may be removable from the body portion 4410. In another example, all or portion(s) of the third mass portion 4412 may be made of similar material(s) as the third mass portion 3812. The apparatus, methods, and articles of manufacture are not limited in this regard.

The back portion 4470 may include a channel 4710 with a length extending in a direction from the toe portion 4440 to the heel portion 4450. The channel 4710 may be similar to the channel 4110 of the golf club head 3800. The channel 4110 of the golf club head 3800 may extend from the toe portion 3840 to the heel portion 3850 at an angle relative to the horizontal midplane 4220 as shown in the example of FIG. 39. The channel 4710 may similarly extend from the toe portion 4440 of the body portion 4410 toward the heel portion 4450. The channel 4710, however, may include a channel portion 4711 proximate to the heel portion 4450 that extends toward the heel portion 4450 and the sole portion 4490. The apparatus, methods, and articles of manufacture described herein are not limited in this regard.

The body portion 4410 of the golf club head 4400 may be a hollow body portion including an interior cavity 5100 similar to the body portion 1510 of the golf club head 1500. Further, the interior cavity 5100 may be unfilled, partially filled with one or more filler materials, or entirely filled with one or more filler materials similar to the interior cavity 2100 of the golf club head 1500 as described herein. The apparatus, methods, and articles of manufacture described herein are not limited in this regard.

For example, as shown in FIGS. 49-53, the interior cavity 5100 may include a first inner perimeter portion 5102 proximate to the front portion 4460 with a first inner perimeter portion height ($H_{PP1}$) 5104 and a second inner perimeter portion 5112 located more forward than the first inner perimeter portion 5102 with a second inner perimeter portion height ($H_{PP2}$) 5114. The second inner perimeter portion height 5114 may define the largest dimension of the interior cavity 5100 in a direction from the top portion 4480 to the sole portion 4490. The second inner perimeter portion height 5114 may be greater than the first inner perimeter portion height 5104 to define an undercut portion 5122 at or near the front portion 4460. The front portion 4460 may have a front edge height ($H_{FE}$) 4461, which may define the height of the most forward part of the front portion 4460. Accordingly, the front portion 4460 may include a perimeter ledge portion 5132 with a perimeter ledge portion width ($W_{PLP}$) 5134. The perimeter ledge portion width 5134 may be the difference between the front edge height 4461 and the second inner perimeter portion height 5114 (e.g., $W_{PLP}=H_{FE}-H_{PP2}$). The perimeter ledge portion width 5134 may extend around all or portion(s) of the front portion 4460 in a continuous or discontinuous manner (e.g., including segments and/or gaps). The perimeter ledge portion 5132 may define an outer boundary of the front portion 4460. The perimeter ledge portion 5132 may be an exterior surface portion of the body portion 4410 at the front portion 4460 outside the interior cavity 5100 and forward of the undercut portion 5122. Any one or more of the transition regions between the first inner perimeter portion 5102, the second inner perimeter portion 5112, the undercut portion 5122, and the perimeter ledge portion 5132 may be configured to reduce stress concentration areas at or proximate to the transition regions and/or the attachment area of the face portion 4462 to the perimeter ledge portion 5132. For example, the transition region between the undercut portion 5122 and the perimeter ledge portion 5132 may be chamfered to reduce the stress on the face portion 4462 when the face portion 4462 strikes a golf ball. The apparatus, methods, and articles of manufacture described herein are not limited in this regard.

Figure 52:
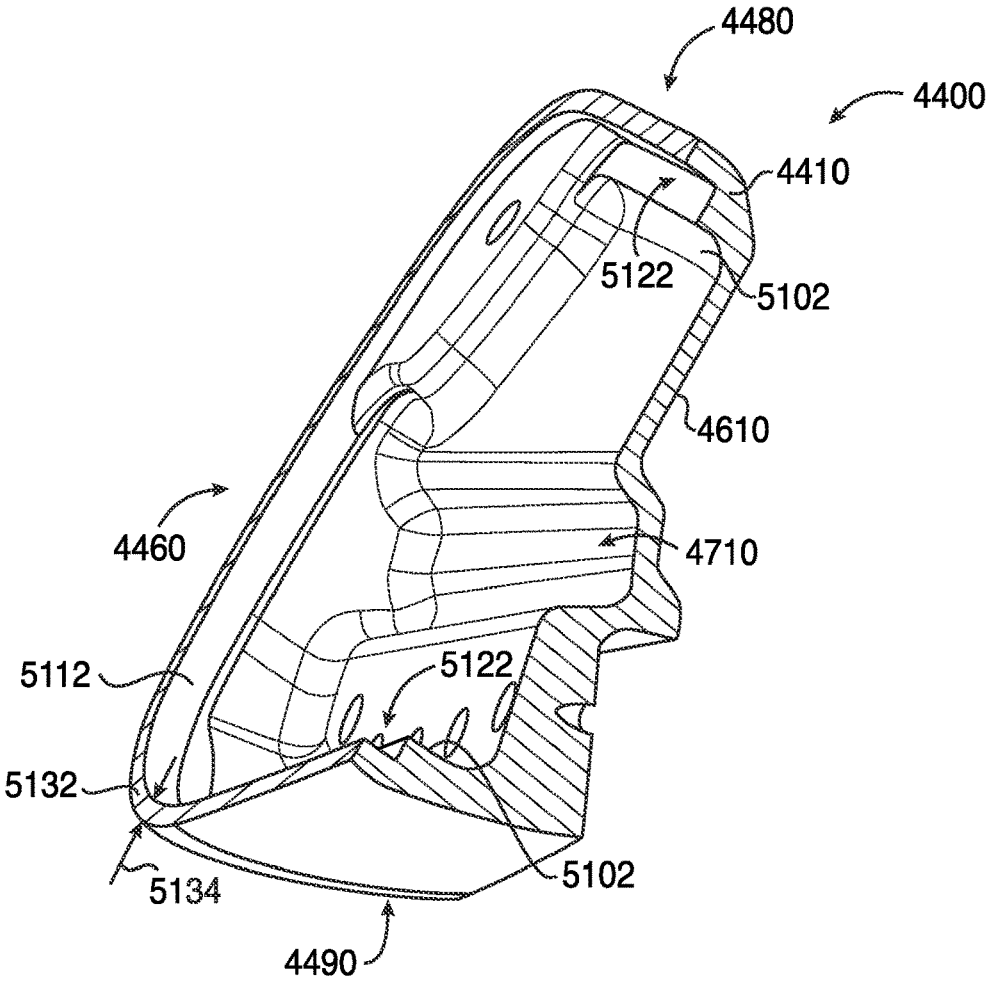
Figure 53:
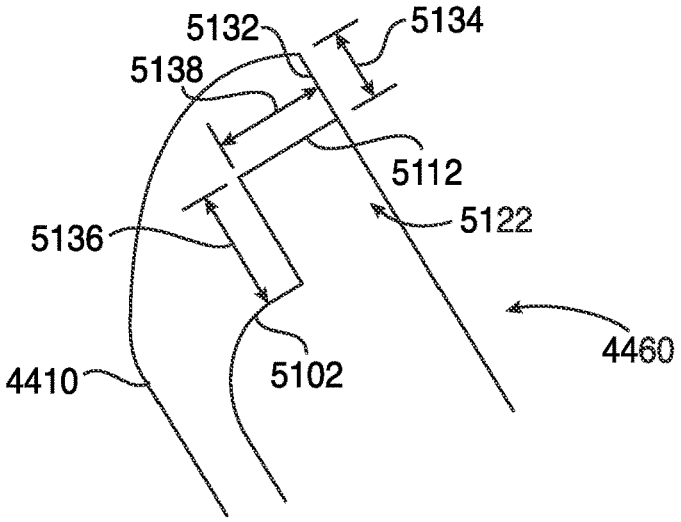

As illustrated in FIGS. 52 and 53, for example, the configuration (e.g., dimensions, cross-sectional shape, etc.) of the undercut portion 5122 at or proximate to any location around the perimeter of the front portion 4460 may determine the configuration of the perimeter ledge portion 5132 including the perimeter ledge portion width 5134 at or proximate to that particular location. The undercut portion 5122 may have an undercut portion height ($H_{UC}$) 5136 and an undercut portion width ($W_{UC}$) 5138 at or proximate to any location around the perimeter of the front portion 4460. In one example, the undercut portion height 5136 and/or the undercut portion width 5138 may be constant around the perimeter of the front portion 4460. In another example, the undercut portion height 5136 may vary at different locations around the perimeter of the front portion 4460. In one example, the undercut portion height 5136 may be between about 0.05 inch (1.27 millimeters) and about 0.15 inch (3.81 millimeters), and the undercut portion width 5138 may be between about 0.05 inch (1.27 millimeters) and about 0.2 inch (5.08 millimeters) at or proximate to one or more locations around the perimeter of the front portion 4460. In another example, the undercut portion height 5136 may be between about 0.075 inch (1.905 millimeters) and about 0.125 inch (3.18 millimeters), and the undercut portion width 5138 may be between about 0.08 inch (2.03 millimeters) and about 0.15 inch (3.81 millimeters) at or proximate to one or more locations around the perimeter of the front portion 4460. In yet another example, the undercut portion height 5136 may be between about 0.09 inch (2.29 millimeters) and about 0.11 inch (2.79 millimeters), and the undercut portion width 5138 may be between about 0.09 inch (2.29 millimeters) and about 0.11 inch (2.79 millimeters) at or proximate to one or more locations around the perimeter of the front portion 4460. The undercut portion height 5136 and/or the undercut portion width 5138 may be less than or greater than the ranges described herein. The configuration (e.g., dimensions, cross-sectional shape, etc.) of the undercut portion 5122 may be constant or vary around the perimeter of the front portion 4460. For example, the undercut portion 5122 may have an undercut portion height 5136 of 0.1 inch (2.54 millimeters) at or around at one location on the front portion 4460 but an undercut portion height 5136 of 0.075 inch (1.91 millimeters) at or around another location on the front portion 4460. The configuration (e.g., dimensions, cross-sectional shape, etc.) of the undercut portion 5122 may be constant or vary for different types of golf club heads. For example, different iron-type golf club heads may have similar or different configuration (e.g., dimensions, cross-sectional shape, etc.) of the undercut portion 5122. While the figures may depict a substantially right-angle undercut portion, the apparatus, methods, and articles of manufacture described herein may include a radiused undercut portion. The apparatus, methods, and articles of manufacture described herein are not limited in this regard.

The face portion 4462 may have a face portion height ($H_{FP}$) 4463, which may be similar to the front edge height ($H_{FE}$) 4461. Accordingly, the perimeter ledge portion 5132 may define a surface for the face portion 4462 to attach to the body portion 4410. The face portion 4462 may be attached to the perimeter ledge portion 5132 by welding, soldering, using one or more adhesives, and/or other suitable methods. In another example, the face portion 4462 may be an integral part of the body portion 4410. The apparatus, methods, and articles of manufacture described herein are not limited in this regard.

Figure 61:
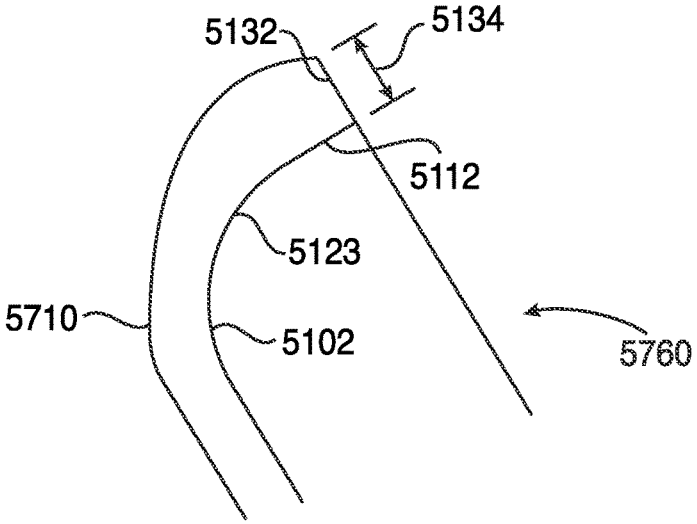
FIG. 61 depicts an enlarged cross-sectional view of a portion of a golf club head according to an embodiment of the apparatus, methods, and articles of manufacture described herein.
Figure 62:
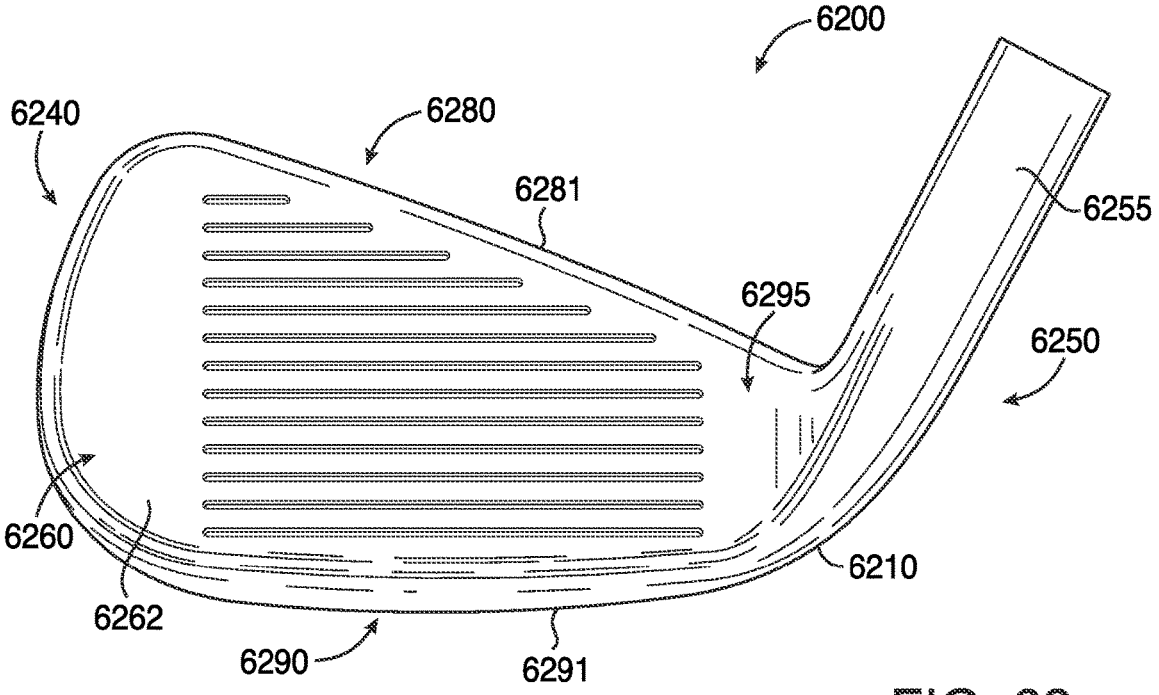
FIGS. 62, 63, 64, 65, 66, and 67 depict a front perspective view, a rear perspective view, a heel-side perspective view, a toe-side perspective view with a face portion removed, a front and toe-side perspective view with a face portion removed, and a front perspective view with a face portion removed, respectively, of golf club head according to an embodiment of the apparatus, methods, and articles of manufacture described herein.

In one example, as shown in FIG. 53, the undercut portion 5122 may define a transition region between the first inner perimeter portion 5102 and the second inner perimeter portion 5112. In another example, as shown in FIG. 61, the back wall portion of the back portion 4470 may include a curved inner wall portion 5123 that extends from the first inner perimeter portion 5102 to the second inner perimeter portion 5112. In other words, the curved inner wall portion 5123 may define a curved transition region on an inner surface portion of the back wall portion of the back portion 4470 between the first inner perimeter portion 5102 and the second inner perimeter portion 5112. The apparatus, methods, and articles of manufacture described herein are not limited in this regard.

Figure 60:
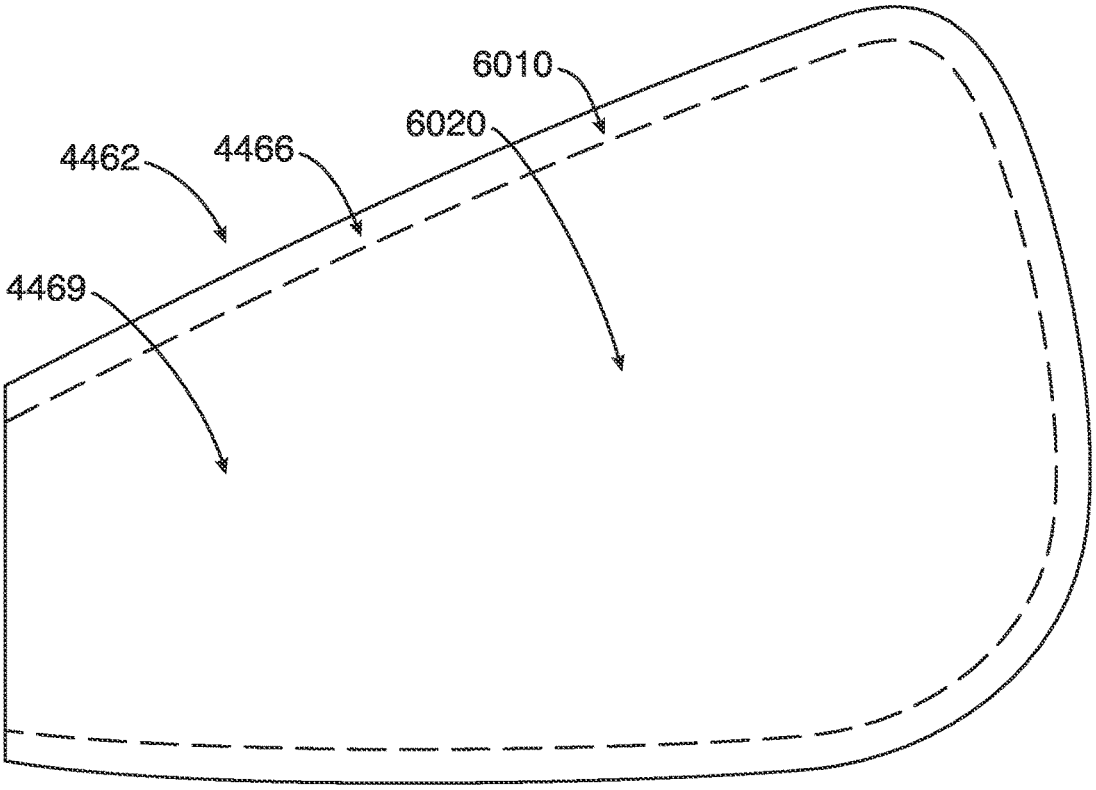
FIG. 60 depicts a back view of a face portion of a golf club head according to an embodiment of the apparatus, methods, and articles of manufacture described herein.

As mentioned above, the difference between the front edge height 4461 and the second inner perimeter portion height 5114 may define the perimeter ledge portion width 5134. Accordingly, the configuration of the undercut portion 5122 and/or the magnitude of the second inner perimeter portion height 5114 may determine the perimeter ledge portion width 5134 and other configuration(s) of the perimeter ledge portion 5132. As mentioned above, the face portion 4462 may attach to the front portion 4460 of the body portion 4410. In one example, as shown in FIG. 60, the face portion 4462 may include a face perimeter portion 4466 to attach to the perimeter ledge portion 5132 of the front portion 4460. The face portion 4462 may include a strike portion 4467, which may extend from opposing sides of the perimeter ledge portion 5132. The strike portion 4467 of the face portion 4462 may be a portion of the face portion 4462 that bends as the face portion 4462 strikes a golf ball (not shown). In another example, the strike portion 4467 may include one or more grooves. The height of the strike portion 4467 may be similar to the second inner perimeter portion height 5114. The location of the perimeter ledge portion 5132 and the perimeter ledge portion width 5134 may provide a relatively large face portion strike portion 4467 (e.g., large second inner perimeter portion height 5114) to provide relatively greater flexibility to strike a golf ball. The undercut portion 5122 may be made as large as possible considering the physical characteristics and materials of the golf club head 4400 and/or the face portion 4462 (e.g., face portion thickness) to provide a perimeter ledge portion 5132 with as small as possible perimeter ledge portion width 5134 to increase the size of the strike portion 4467 of the face portion 4462 as much as possible. The increased size of the strike portion 4467 may increase ball speed and/or distance for an individual using the golf club head 4400. The apparatus, methods, and articles of manufacture described herein are not limited in this regard.

The perimeter ledge portion width 5134 may be constant or vary along the perimeter of the front portion 4460. In one example, the perimeter ledge portion width 5134 may be constant in a range between about 0.04 inch (1.02 millimeters) and about 0.14 inch (3.56 millimeters). In another example, the perimeter ledge portion width 5134 may be constant in a range between about 0.06 inch (1.52 millimeters) and about 0.12 inch (3.05 millimeters). In yet another example, the perimeter ledge portion width 5134 may be constant in a range between and about 0.08 inch (2.03 millimeters) and about 0.1 inch (2.54 millimeters). In addition or alternatively, the perimeter ledge portion width 5134 may vary along the perimeter of the front portion 4460 in any of the width ranges described herein. The apparatus, methods, and articles of manufacture described herein are not limited in this regard.

Figure 50:
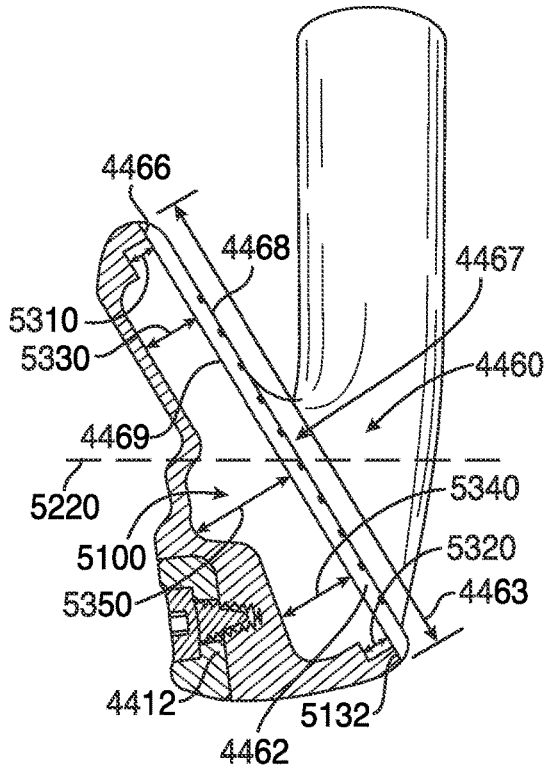

In one example, as shown in FIG. 50, the interior cavity 5100 may include a width between an inner surface of the back wall portion of the back portion 4470 and an inner surface of the face portion 4462. The interior cavity 5100 may include a first width 5310 ($W_1$) defined by the undercut portion width 5138 above a horizontal midplane 5220 of the body portion 4410. The interior cavity 5100 may also include a second width 5320 ($W_2$) defined by the undercut portion width 5138 below the horizontal midplane 5220. As described herein, the undercut portion height 5136 and/or the undercut portion width 5138 may be constant or vary at different locations around the perimeter of the front portion 4460. Accordingly, in one example, the first width 5310 may be similar to the second width 5320. In another example, the first width 5310 may be greater than the second width 5320. In yet another example, the second width 5320 may be greater than the first width 5310. The apparatus, methods, and articles of manufacture described herein are not limited in this regard.

The interior cavity 5100 may include a third width 5330 ($W_3$) between the first width 5310 and the horizontal midplane 5220. The third width 5330 may be greater than the first width 5310 ($W_3>W_1$) and greater than the second width 5320 ($W_3>W_2$). The interior cavity 5100 may also include a fourth width 5340 ($W_4$) between the second width 5320 and the horizontal midplane 5220. The fourth width 5340 may be greater than the first width 5310 ($W_4>W_1$) and greater than the second width 5320 ($W_4>W_2$). In one example, the fourth width 5340 may be generally greater than the third width 5330 ($W_4>W_3$). In another example, the fourth width 5340 may be similar to the third width 5330 ($W_4=W_3$) at one or more locations in the interior cavity 5100. In yet another example, the fourth width 5340 may be less than the third width ($W_4<W_3$) at one or more locations in the interior cavity 5100. The apparatus, methods, and articles of manufacture described herein are not limited in this regard.

The interior cavity 5100 may include a fifth width 5350 ($W_5$) between the third width 5330 and the fourth width 5340. In one example, the fifth width 5350 may be greater than the third width 5330 ($W_5>W_3$) and greater than the fourth width 5340 ($W_5>W_4$). The fifth width 5350 may be located between the fourth width 5340 and the horizontal midplane 5220. In another example, the fifth width 5350 may extend from a location below the horizontal midplane 5220 to a location at or proximate to the horizontal midplane 5220. In yet another example, the fifth width 5350 may extend from a location below the horizontal midplane 5220 to a location above the horizontal midplane 5220. In yet another example, the fifth width 5350 may define the maximum width of the interior cavity 5100 at one or more locations in the interior cavity 5100. The apparatus, methods, and articles of manufacture described herein are not limited in this regard.

Figure 51:
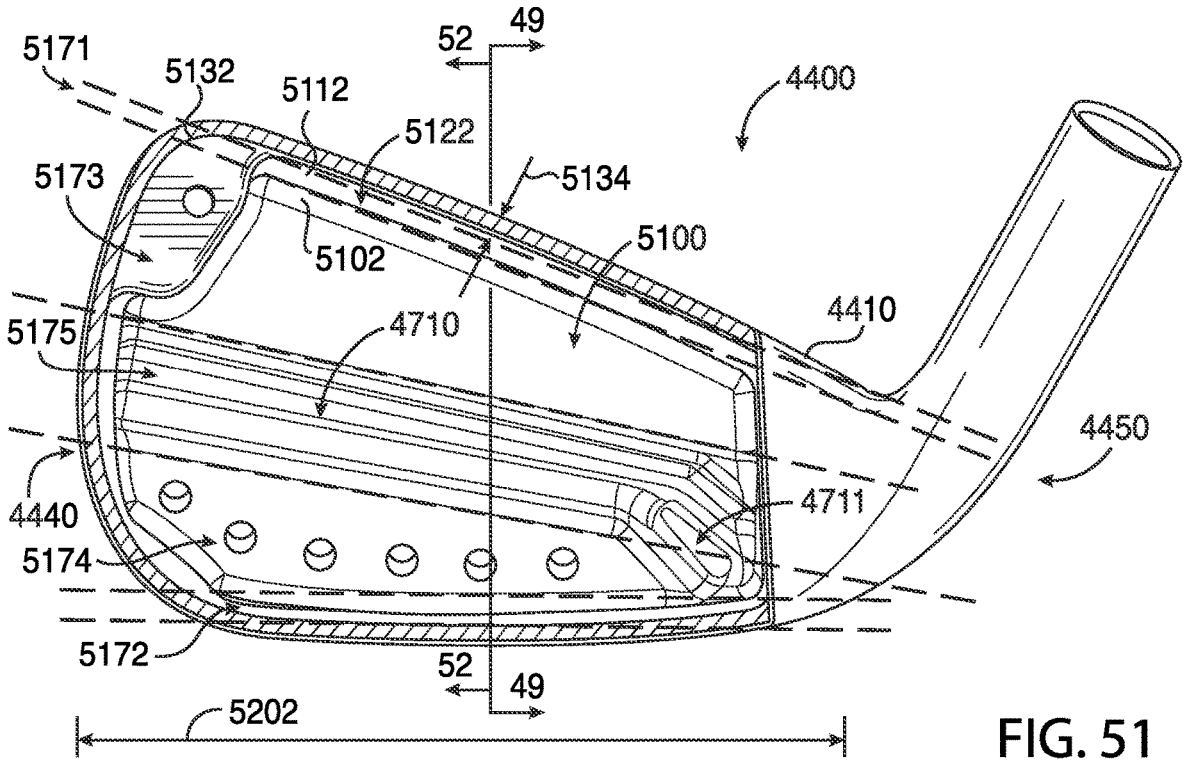

As shown in FIG. 51, for example, the first width 5310, the second width 5320, the third width 5330, the fourth width 5340, and the fifth width 5350 may define one or more regions of the body portion 4410 that extend to and/or between the toe portion 4440 and the heel portion 4450 and that are vertically positioned relative to each other. The first width 5310 may define a first region 5171 including the undercut portion 5122 above the horizontal midplane 5220. The second width 5320 may define a second region 5172 including the undercut portion 5122 below the horizontal midplane 5220. As described herein, the undercut portions 5122 may provide a relatively large strike portion 4467 to provide relatively greater flexibility to the face portion 4462 for striking a golf ball. The third width 5330 may define a third region 5173, which may be a region of the interior cavity 5100 above the horizontal midplane 5220 and below the undercut portion 5122. The fourth width 5340 may define a fourth region 5174, which may be a region of the interior cavity 5100 below the horizontal midplane 5220 and above the undercut portion 5122. The fifth width 5350 may define a fifth region 5175 between the third region 5173 and the fourth region 5174. The apparatus, methods, and articles of manufacture described herein are not limited in this regard.

Although the figures may depict and the above examples may describe particular dimensions, the first inner perimeter portion 5102, the second inner perimeter portion 5112, the undercut portion 5122, the perimeter ledge portion 5132, and/or the face portion 4462 may vary in lengths, widths, locations on the body portion 4410, etc. The configurations of the first inner perimeter portion 5102, the second inner perimeter portion 5112, the undercut portion 5122, the perimeter ledge portion 5132, and/or the face portion 4462 described herein may be applicable along a width 5202 of the front portion 4460 (e.g., as shown in FIG. 51). Further, the configurations of the first inner perimeter portion 5102, the second inner perimeter portion 5112, the undercut portion 5122, the perimeter ledge portion 5132 and/or the face portion 4462 described herein may be applicable along all or parts of the perimeter of the front portion 4460. In one example, the first inner perimeter portion 5102, the second inner perimeter portion 5112, and/or the undercut portion 5122 may extend partially or at one or more continuous or discontinuous locations at or near the front portion 4460. In another example, the first inner perimeter portion 5102, the second inner perimeter portion 5112, and/or the undercut portion 5122 may extend continuously at or near the entire front portion 4460. In yet another example, the perimeter ledge portion 5132 may extend around the entire front portion 4460. In yet another example, the perimeter ledge portion 5132 may extend along one or more continuous or discontinuous portions of the front portion 4460. The apparatus, methods, and articles of manufacture described herein are not limited in this regard.

To form the golf club head 4400, the face portion 4462 may be coupled to the body portion 4410. Referring to FIGS. 49-51 and 60, for example, the face portion 4462 may include a front surface 4468 and a back surface 4469 opposite of the front surface 4468. The front surface 4468 may include at least one groove configured to impact a golf ball. The back surface 4469 may include a first back surface contact region associated with a first total surface area ($TSA_1$) (e.g., generally shown as 6010 in FIG. 60), and a second back surface contact region with a second total surface area ($TSA_2$) (e.g., generally shown as 6020 in FIG. 60). For example, the back surface 4469 may be associated with a third total surface area ($TSA_3$) including the first total surface area and the second total surface area (e.g., $TSA_3=TSA_1+TSA_2$). The first back surface contact region 6010 may be located at or proximate to a perimeter of the face portion 4462 (e.g., generally shown as the face perimeter portion 4466 in FIG. 60). The first back surface contact region 6010 may be an area of the back surface 4469 coupled to the perimeter ledge portion 5132 of the body portion 4410 (e.g., the first total surface area). In one example, the first back surface contact region 6010 may have a constant width or a variable width in a range between about 0.04 inch (1.02 millimeters) and about 0.2 inch (5.08 millimeters). The first total surface area may be less than the second total surface area (e.g., $TSA_1<TSA_2$). In one example, the first total surface area may be less than 30% of the third total surface area (e.g., $TSA_1<0.3\ TSA_3$). In another example, the first total surface area may be less than 20% of the third total surface area (e.g., $TSA_1<0.2\ TSA_3$). In yet another example, the first total surface area may be less than 10% of the third total surface area (e.g., $TSA_1<0.1\ TSA_3$). In still yet another example, the first total surface area may be greater than or equal to 5% and less than or equal to 21% of the third total surface area (e.g., $0.05\ TSA_3<TSA_1<0.20\ TSA_3$). In further yet another example, the first total surface area may be greater than or equal to 9% and less than or equal to 17% of the third total surface area (e.g., $0.09\ TSA_3<TSA_1<0.17\ TSA_3$).

The second back surface contact region 6020 may be an area of the back surface 4469 coupled to the filler material (e.g., the second total surface area). In one example, the second total surface area may be at least 50% of the third total surface area (e.g., $TSA_2\geq0.5\ TSA_3$). In another example, the second total surface area may be at least 60% of the third total surface area (e.g., $TSA_{2\geq}0.6\ TSA_3$). In yet another example, the second total surface area may be at least 70% of the third total surface area (e.g., $TSA_{2\geq}0.7\ TSA_3$). In still yet another example, the second total surface area may be at least 80% of the third total surface area (e.g., $TSA_2\geq0.8\ TSA_3$). In further yet another example, the second total surface area may be at least 90% of the third total surface area (e.g., $TSA_2\geq0.9\ TSA_3$). In further yet another example, the second total surface area may be greater than or equal to 79% and less than or equal to 95% of the third total surface area (e.g., $0.79\ TSA_3<TSA_2<0.95\ TSA_3$). In further yet another example, the second total surface area may be greater than or equal to 83% and less than or equal to 91% of the third total surface area (e.g., $0.83\ TSA_3<TSA_2<0.91\ TSA_3$). The apparatus, methods, and articles of manufacture described herein are not limited in this regard.

The face portion 4462 may be coupled to the body portion 4410 to form the interior cavity 5100. As mentioned above, the body portion 4410 may include a body contact region along a perimeter of the body portion 4410 at or proximate to the toe portion 4440, the heel portion 4450, the top portion 4480, and/or the sole portion 4490 (e.g., the perimeter ledge portion 5132). The first back surface contact region 6010 may be coupled to the body contact region whereas the second back surface contact region 6020 may be coupled to the filler material in the interior cavity 5100. In one example, the filler material may be coupled to at least 50% of the second total surface area of the second back surface contact region 6020. In another example, the filler material may be coupled to at least 60% of the second total surface area of the second back surface contact region 6020. In yet another example, the filler material may be coupled to at least 70% of the second total surface area of the second back surface contact region 6020. In still yet another example, the filler material may be coupled to at least 80% of the second total surface area of the second back surface contact region 6020. In further yet another example, the filler material may be coupled to at least 90% of the second total surface area of the second back surface contact region 6020. In further yet another example, the filler material may be coupled to the entire second total surface area of the second back surface contact region 6020.

In one example, the first back surface contact region 6010 of the face portion 4462 and the body contact region of the body portion 4410 may be coupled to each other along the perimeter of the body portion 4410 (e.g., the perimeter ledge portion 5132) at the toe portion 4440, the top portion 4480, and/or the sole portion 4490 (i.e., a side wall of the face portion 4462 instead of the back surface 4469 may be coupled to the body portion 4410 at or proximate to the heel portion 4450 and/or the hosel portion 4455). Accordingly, the back surface 4469 may be coupled to both the body portion 4410 and the filler material. The apparatus, methods, and articles of manufacture described herein are not limited in this regard.

Figure 54:
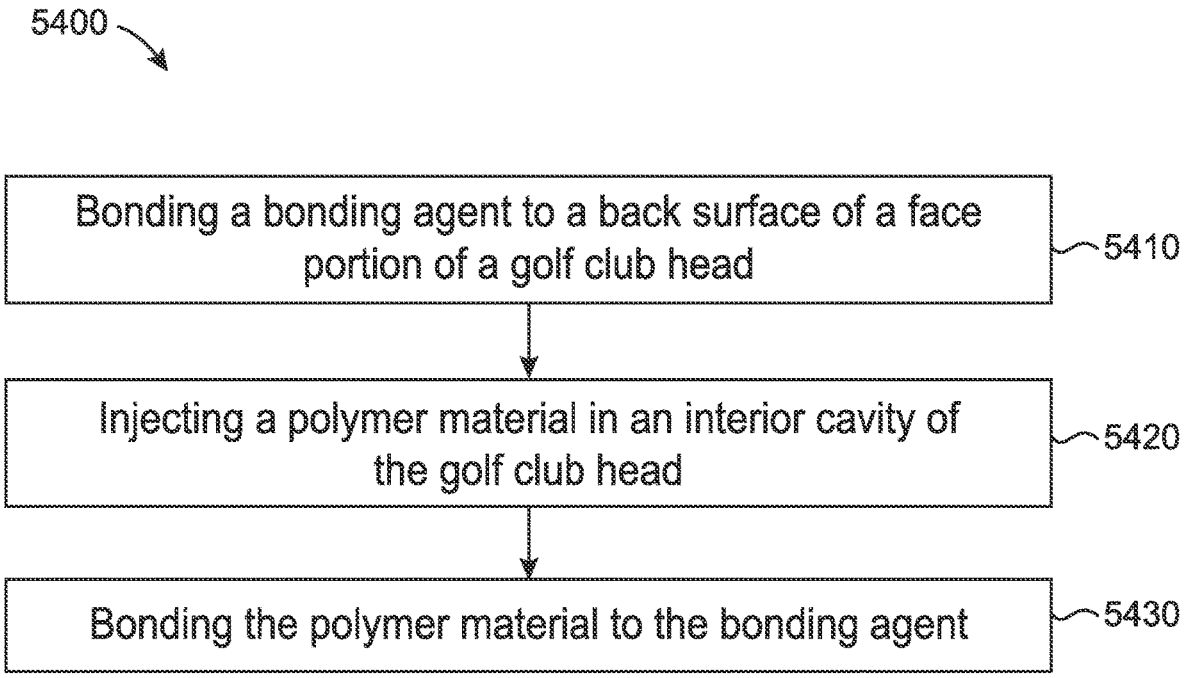
FIGS. 54 and 55 depict yet other manners in which an example golf club head described herein may be manufactured.
Figure 55:
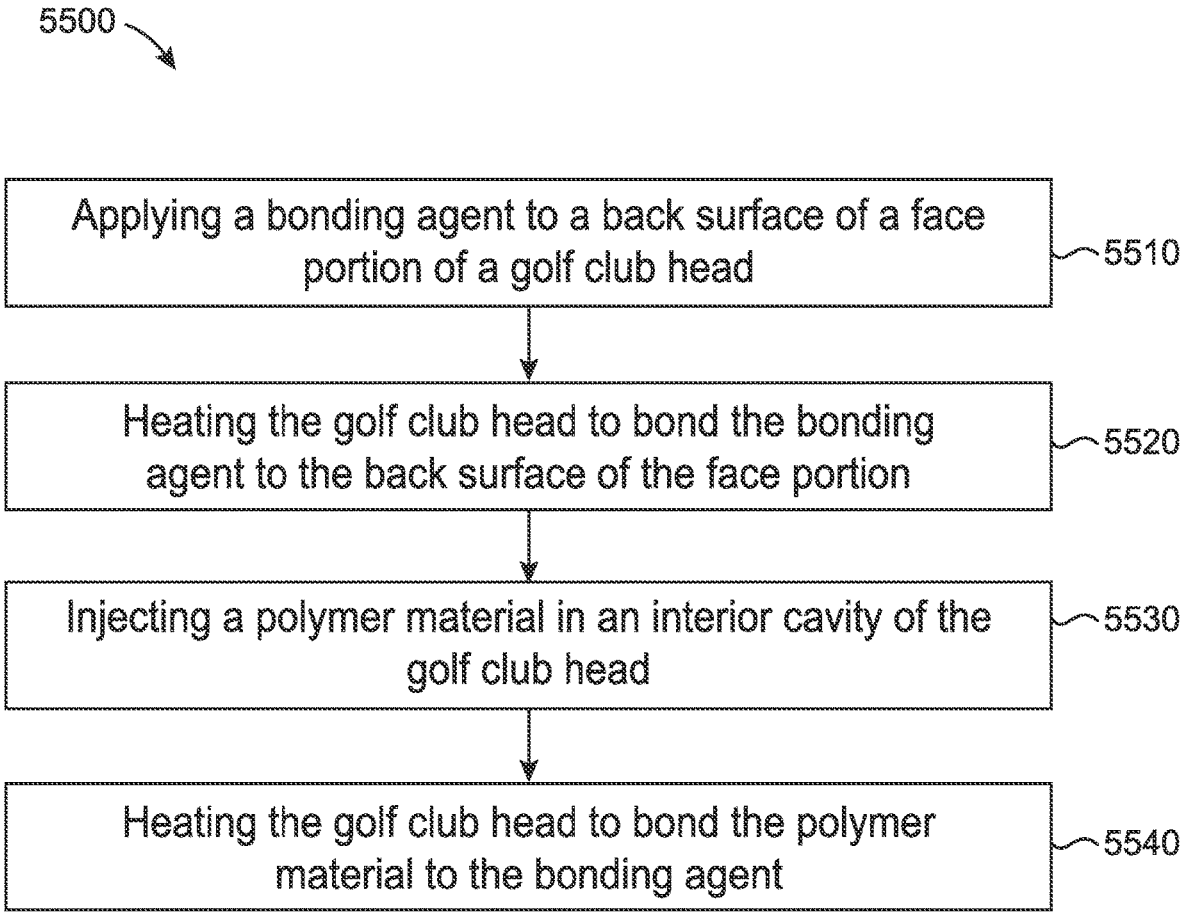
Figure 56:
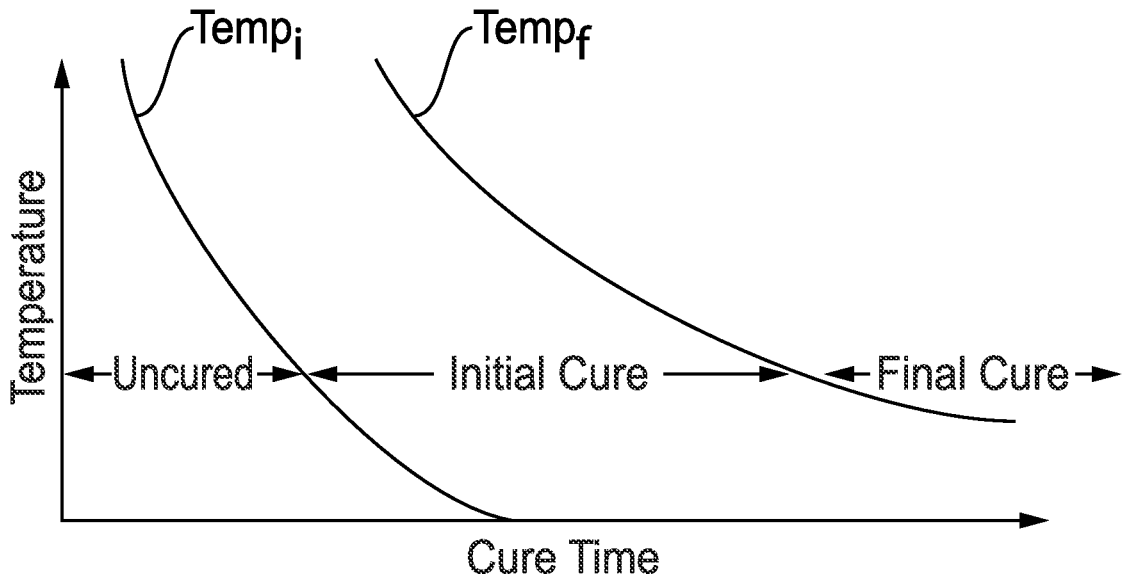
FIG. 56 depicts an example of curing a bonding agent.

For brevity, the description of processes described herein with reference to FIGS. 54-56 may be provided in reference to the golf club head 1500. However, any apparatus, methods, and articles of manufacture described herein is applicable to any of the golf club heads described herein. FIG. 54 depicts one manner that the interior cavity of any of the golf club heads described herein may be partially or entirely filled with one or more filler materials such as any of the filler materials described herein. The example process 5400 may begin with bonding a bonding agent to the back surface 1566 of the face portion 1562 of the golf club head 1500 (block 5410). The bonding agent may have an initial bonding state, which may be a temporary bonding state, and a final bonding state, which may be a permanent bonding state. The initial bonding state and the final bonding states may be activated when the bonding agent is exposed to heat, radiation, and/or other chemical compounds. For example, as described herein, the bonding agent may be an epoxy having an initial cure state and a final cure state that are activated by the epoxy being heated to different temperatures for a period of time, respectively, by conduction, convention, and/or radiation. In another example, the bonding agent may be a bonding material that is activated to an initial bonding state and a final bonding state by being exposed to different doses and/or duration of ultraviolet radiation, respectively. In another example, the bonding agent may be a bonding material that is activated to an initial bonding state and a final bonding state by being exposed to different compounds or different amounts of the same compound, respectively. According to the process 5400, the bonding agent may be bonded to the back surface 1566 of the face portion 1562 by being activated to the initial bonding state. A polymer material is then injected in the interior cavity 2100 of the golf club head 1500 (block 5420). The example process 5400 then includes bonding the polymer material to the bonding agent (block 5430). Bonding the polymer material to the bonding agent may include activating the bonding agent to the final bonding state to permanently bond the polymer material to the bonding agent and to permanently bond the bonding agent to the back surface 1566 of the face portion 1562. The example process 5400 is merely provided and described in conjunction with other figures as an example of one way to manufacture the golf club head 1500. While a particular order of actions is illustrated in FIG. 54, these actions may be performed in other temporal sequences. Further, two or more actions depicted in FIG. 54 may be performed sequentially, concurrently, or simultaneously.

FIG. 55 depicts one manner that the interior cavity 2100 of the golf club head 1500 or any of the golf club heads described herein may be partially or entirely filled with one or more filler materials such any of the filler materials described herein. The process 5500 may begin with applying a bonding agent (e.g., a bonding portion 3310 of FIG. 33) to the back surface 1566 of the face portion 1562 of the golf club head 1500 (block 5510). The bonding agent may be any type of adhesive and/or other suitable materials. In one example, the bonding agent may be an epoxy. Prior to applying the bonding agent, the golf club head 1500 may be cleaned to remove any oils, other chemicals, debris or other unintended materials from the golf club head 1500 (not shown). The bonding agent may be applied on the back surface 1566 as described herein depending on the properties of the bonding agent. The bonding agent may be applied to the back surface 1566 of the face portion 1562 through one or more of the first set of ports 1620 and/or the second set of ports 1630. For example, the bonding agent may be in liquid form and injected on the back surface 1566 through several or all of the first set of ports 1620 and the second set of ports 1630. An injection instrument (not shown) such as a nozzle or a needle may be inserted into each port until the tip or outlet of the injection instrument is near the back surface 1566. The bonding agent may then be injected on the back surface 1566 from the outlet of the injection instrument. Additionally, the injection instrument may be moved, rotated, and/or swiveled while inside the interior cavity 2100 so that the bonding agent may be injected onto an area of the back surface 1566 surrounding the injection instrument. For example, the outlet of the injection instrument may be moved in a circular pattern while inside a port to inject the bonding agent in a corresponding circular pattern on the back surface 1566. Each of the first set of ports 1620 and the second set of ports 1630 may be utilized to inject a bonding agent on the back surface 1566. However, utilizing all of first ports 1620 and/or the second set of ports 1630 may not be necessary. For example, using every other adjacent port may be sufficient to inject a bonding agent on the entire back surface 1566. In another example, ports 1621, 1622 1631, 1633 and 1636 may be used to inject the bonding agent on the back surface 1566. The apparatus, methods, and articles of manufacture are not limited in this regard.

The example process 5500 may also include spreading or overlaying the bonding agent on the back surface 1566 (not shown) after injecting the bonding agent onto the back surface 1566 so that a generally uniform coating of the bonding agent is provided on the back surface 1566. According to one example, the bonding agent may be spread on the back surface 1566 by injecting air into the interior cavity 2100 through one or more ports of the first set of ports 1620 and/or the second set of ports 1630. The air may be injected into the interior cavity 2100 and on the back surface 1566 by inserting an air nozzle into one or more ports of the first set of ports 1620 and/or the second set of ports 1630. According to one example, the air nozzle may be moved, rotated and/or swiveled at a certain distance from the back surface 1566 to uniformly blow air onto the bonding agent and spread the bonding agent on the back surface 1566 for a uniform coating or a substantially uniform coating of the bonding agent on the back surface 1566. Further, the golf club head 1500 may be pivoted back and forth in one or several directions so that the bonding agent may spread along a portion or substantially the entire area of the back surface 1566 of the face portion 1562. In one example, the golf club head 1500 may be vibrated with the back surface 1566 of the face portion 1562 in a generally horizontal orientation so that the bonding agent may spread or overlay on the back surface 1566 in a uniform coating manner or a substantially uniform coating manner. The apparatus, methods, and articles of manufacture are not limited in this regard.

The example process 5500 is merely provided and described in conjunction with other figures as an example of one way to manufacture the golf club head 1500 or any of the golf club heads described herein. While a particular order of actions is illustrated in FIG. 55, these actions may be performed in other temporal sequences. Further, two or more actions depicted in FIG. 55 may be performed sequentially, concurrently, or simultaneously. The example process 5500 may include a single action (not shown) of injecting and uniformly or substantially uniformly coating the back surface 1566 with the bonding agent. In one example, the bonding agent may be injected on the back surface 1566 by being converted into fine particles or droplets (i.e., atomized) and sprayed on the back surface 1566. Accordingly, the back surface 1566 may be uniformly or substantially uniformly coated with the bonding agent in one action. A substantially uniform coating of the bonding agent on the back surface 1566 may be defined as a coating having slight non-uniformities due to the injection process or the manufacturing process. However, such slight non-uniformities may not affect the bonding of the elastic polymer material or elastomer material to the back surface 1566 with the bonding agent as described herein. For example, spraying the bonding agent on the back surface 1566 may result in overlapping regions of the bonding agent having a slightly greater coating thickness than other regions of the bonding agent on the back surface 1566. The apparatus, methods, and articles of manufacture are not limited in this regard.

In one example as shown in FIG. 56, the bonding agent may be an epoxy having different curing states based on the temperature and the amount of time to which the epoxy may be exposed. The bonding agent may have an uncured state, an initial cure state, and a final cure state. In one example, the uncured state may be a liquid state, the initial cure state may be gel or a semi-solid/semi-liquid state, and the final cure state may be a solid state. The bonding agent may transition from the uncured state to the initial cure state when the bonding agent is heated to a temperature between an initial cure state temperature ($Temp_i$) and a final cure state temperature ($Temp_f$) for a period of time. Accordingly, an initial cure state temperature range may be defined by temperatures that are greater than or equal to the initial cure state temperature $Temp_i$ and less than the final cure state temperature $Temp_f$. The bonding agent may transition from the initial cure state to the final cure state when the bonding agent may be heated to a temperature greater than or equal to the final cure state temperature $Temp_f$ for a period of time. Accordingly, a final cure state temperature range may be defined by temperatures that are greater than or equal to the final cure state temperature $Temp_f$. The initial cure state temperature $Temp_i$ and the final cure state temperature $Temp_f$ may vary based on the amount of time that the bonding agent may be heated. In particular, a transition from the uncured state to the initial cure state and a transition from the initial cure state to the final cure state may be dictated by certain temperature and time profiles based on the properties of the bonding agent. At a temperature below the initial cure temperature $Temp_i$, the bonding agent may be in the uncured state (e.g., a liquid state). In the initial cure state, the bonding agent may form an initial bond with an object and become pliable to be manipulated (e.g., moved, spread, overlay, etc.) without obtaining full cross linking or forming a permanent bond. In other words, the bonding agent may form an initial bond with an object and be manipulated without forming a permanent bond. In the final cure state, the bond of the bonding agent (e.g., cross linking for a bonding agent that includes epoxy) may be complete or become permanently set.

The bonding agent may be applied to the back surface 1566 of the face portion 1562 when the bonding agent is in the uncured state, which may be a liquid state. Subsequently, the golf club head 1500 and/or the bonding agent may be heated to a first temperature $Temp_i$ that is greater than or equal to the initial cure state temperature $Temp_i$ and less than the final cure state temperature $Temp_f$ to change the bonding agent from an uncured state to an initial cure state (i.e., an initial cure state temperature range) (block 5520). Accordingly, the bonding agent may form an initial bond with the back surface 1566 of the face portion 1562. After bonding the bonding agent to the back surface 1566, the golf club head 1500 may be cooled for a period of time at ambient or room temperature (not shown). Accordingly, the bonding agent may be in an initial cured state and bonded to the back surface 1566 of the face portion 1562 so that the bonding agent may be bonded to the back surface 1566 during the injection molding of a polymer material in the interior cavity 2100. Ambient or room temperature may be defined as a room temperature ranging between 5° C. (32° F.) and 31° C. (104° F.). The first temperature $Temp_i$ and duration by which the golf club head 1500 and/or the bonding agent heated to the first temperature $Temp_i$ may depend on the curing or bonding properties of the bonding agent. The apparatus, methods, and articles of manufacture are not limited in this regard.

After the bonding agent is bonded to the back surface 1566 of the face portion 1562, the golf club head 1500 may be heated (i.e., pre-heating the golf club head 1500) prior to receiving a polymer material (not shown). The golf club head 1500 may be heated so that when the polymer material is injected in the golf club head 1500, the polymer material is not cooled by contact with the golf club head and remains in a flowing liquid form to fill the interior cavity 2100. The temperature at which the golf club head is heated, which may be referred to herein as a third temperature, may be similar to the temperature of the polymer material when being injected into the interior cavity 2100. However, the temperature at which the golf club head is heated may be less than the final cure temperature $Temp_f$ of the bonding agent. Accordingly, the bonding agent may not transition from the initial cure state to the final cured state during the injection molding process. Further, the pre-heating temperature of the golf club head 1500 may be determined so that excessive cooling of the golf club head 1500 may not be necessary after injection molding the polymer material in the interior cavity 2100. Prior to being injected into the interior cavity 2100, the polymer material may also be heated to a liquid state (not shown). The temperature at which the polymer material may be heated may depend on the type of polymer material used to partially or fully fill the interior cavity 2100. Further, the temperature at which the polymer material is heated may be determined so that shrinkage of the polymer material is reduced during the injection molding process. However, as described herein, the polymer material may be heated to a temperature that is less than the final cure temperature $Temp_f$ of the bonding agent. The apparatus, methods, and articles of manufacture are not limited in this regard.

As described herein, the cavity 2100 may be partially or fully filled with a polymer material by injecting the polymer material in the cavity 2100 (block 5530). The injection speed of the polymer material may be determined so that the interior cavity 2100 may be slowly filled to provide a better fill while allowing air to escape the interior cavity 2100 and allowing the injected polymer material to rapidly cool. For example, the polymer material may be a non-foaming and injection-moldable thermoplastic elastomer (TPE) material. The polymer material may be injected into the interior cavity 2100 from one or more of the ports described herein (e.g., one or more ports of the first set of ports 1620 and the second set of ports 1630 shown in FIG. 28). One or more other ports may allow the air inside the interior cavity 2100 displaced by the polymer material to vent from the interior cavity 2100. In one example, the golf club head 1500 may be oriented horizontally as shown in FIG. 28 during the injection molding process. The polymer material may be injected into the interior cavity 2100 from ports 1631 and 1632. The ports 1621, 1622 and/or 1623 may serve as air ports for venting the displaced air from the interior cavity 2100. Thus, regardless of the orientation of the golf club head 1500 during the injection molding process, the polymer material may be injected into the interior cavity 2100 from one or more lower positioned ports while one or more upper positioned ports may serve as air vents.

According to one example, any one of the ports or any air vent of the golf club head 1500 used as air port(s) for venting the displaced air may be connected to a vacuum source (not shown) during the injection molding process. Accordingly, air inside the interior cavity 2100 and displaced by the polymer material may be removed from the interior cavity 2100 by the vacuum source. Accordingly, trapped air pocket(s) in the interior cavity 2100 and/or a non-uniform filling of the interior cavity 2100 with the polymer material may be reduced. The apparatus, methods, and articles of manufacture described herein are not limited in this regard.

After injecting the polymer material into the interior cavity 2100, the golf club head 1500 may be heated to a second temperature $Temp_2$ that is greater than or equal to the final cure temperature $Temp_f$ of the bonding agent to reactivate the bonding agent to bond the polymer material to the bonding agent (i.e., a final cure state temperature range) (block 5540). The second temperature $Temp_2$ and the duration by which the golf club head 1500 is heated to the second temperature $Temp_2$ may depend on the properties of the bonding agent as shown in FIG. 56 to form a permanent bond between the golf club head 1500 and the bonding agent and between the polymer material and the bonding agent. The golf club head 1500 may be then cooled at ambient or room temperature (not shown). According to one example, the characteristic time (CT) of the golf club head 1500 may be measured (not shown) after manufacturing the golf club head 1500 as described herein. CT measurements may determine if the golf club head 1500 conforms to CT rules established by one or more golf governing bodies.

The heating and cooling processes described herein may be performed by conduction, convention, and/or radiation. For example, all of the heating and cooling processes may be performed by using heating or cooling systems that employ conveyor belts that move the golf club head 1500 through a heating or cooling environment for a period of time as described herein. The apparatus, methods, and articles of manufacture described herein are not limited in this regard.

Figure 57:
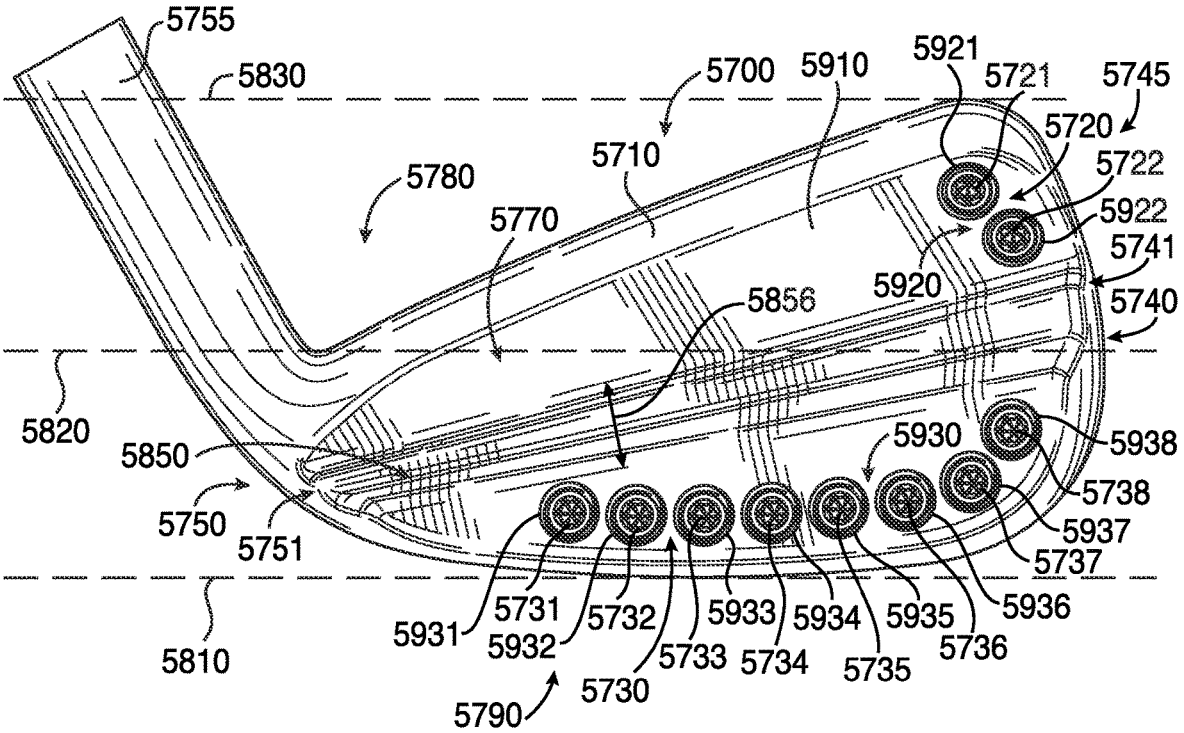
FIGS. 57, 58, and 59 depict a rear view, a toe portion view, and a heel portion view of a golf club head according to an embodiment of the apparatus, methods, and articles of manufacture described herein.
Figure 58:
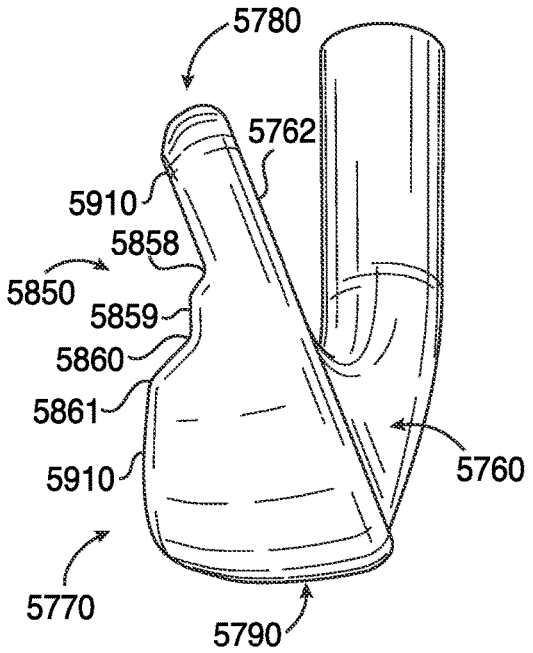
Figure 59:
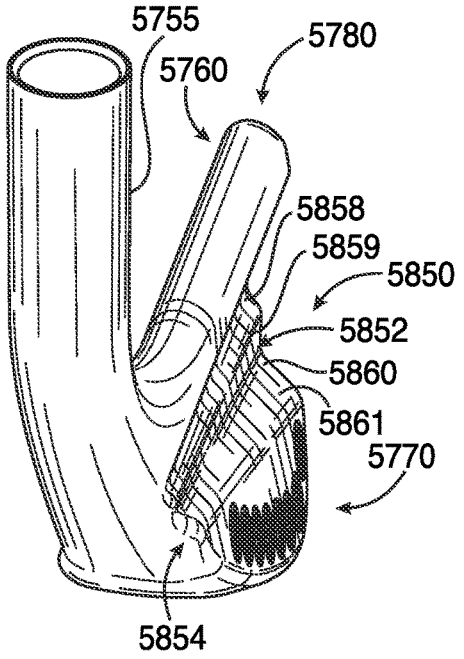

In the example of FIGS. 57-59, a golf club head 5700 may include a body portion 5710, and two or more mass portions, generally shown as a first set of mass portions 5720 (e.g., shown as mass portions 5721 and 5722) and a second set of mass portions 5730 (e.g., shown as mass portions 5731, 5732, 5733, 5734, 5735, 5736, 5737, and 5738). The body portion 5710 may include a toe portion 5740, a heel portion 5750, a front portion 5760, a back portion 5770, a top portion 5780, and a sole portion 5790. The body portion 5710 may include a hosel portion 5755 configured to receive a shaft (an example shown in FIG. 14) with a grip (an example shown in FIG. 14) on one end and the golf club head 5700 on the opposite end of the shaft to form a golf club. The golf club head 5700 may include a face portion 5762 (e.g., a strike face), which may be similar to any of the face portions of the golf club head described herein and coupled to the front portion 5760. The golf club head 5700 may be manufactured by any of the methods described and illustrated herein. The apparatus, methods, and articles of manufacture are not limited in this regard.

The body portion 5710 may be made of a first material whereas the first set of mass portions 5720 and the second set of mass portions 5730 may be made of a second material. The first material and the second material may be similar or different materials. The materials from which the golf club head 5700, mass portions 5720 and/or mass portions 5730 are constructed may be similar in many respects to any of the golf club heads and the mass portions described herein such as the golf club head 1500. The apparatus, methods, and articles of manufacture are not limited in this regard.

As illustrated in FIG. 57, the back portion 5770 may include a back wall portion 5910 with one or more ports along a periphery of the back portion 5770, generally shown as a first set of ports 5920 (e.g., shown as ports 5921 and 5922) and a second set of ports 5930 (e.g., shown as ports 5931, 5932, 5933, 5934, 5935, 5936, 5937, and 5938). Each port may be defined by an opening in the back wall portion 5910. The first set of ports 5920 and the second set of ports 5930, respectively, may be ports configured to receive one or more mass portions of the first set of mass portions 5720 and/or the second set of mass portions 5730 similar to the example of the golf club head 1500 as discussed herein. The dimensions of each port, the location of each port relative to an adjacent port, methods of manufacturing the exterior weigh ports, the method by which each mass portions is received and secured in each port, and/or any other characteristic of each port of the ports 5920 and 5930 may be similar to any of the ports described herein. The apparatus, methods, and articles of manufacture are not limited in this regard.

Alternatively, the golf club head 5700 may not include (i) the first set of mass portions 5720, (ii) the second set of mass portions 5730, or (iii) both the first set of mass portions 5720 and the second set of mass portions 5730. In particular, the back portion 5770 of the body portion 5710 may not include ports at or proximate to the top portion 5780 and/or the sole portion 5790. For example, the mass of the first set of mass portions 5720 (e.g., 3 grams) and/or the mass of the second set of mass portions 5730 (e.g., 16.8 grams) may be integral part(s) the body portion 5710 instead of separate mass portions(s). The physical properties of the first set of mass portions 5720 and the second set of mass portions 5730 may be similar in many respect to any of the mass portions described herein, such as the mass portions shown in the example of FIG. 25. Furthermore, the devices and/or methods by which the first set of mass portions 5720 and the second set of mass portions 5730 are coupled to the golf club head 5700 may be similar in many respect to any of the mass portions described herein, such as the mass portions shown in the example of FIGS. 12 and 13. The apparatus, methods, and articles of manufacture described herein are not limited in this regard.

As illustrated in FIG. 57, golf club head 5700 may be associated with a ground plane 5810, a horizontal midplane 5820, and a top plane 5830. In particular, the ground plane 5810 may be a plane that may be substantially parallel with the ground and be tangential to the sole portion 5790 of the golf club head 5700 when the golf club head 5700 is at an address position (e.g., the golf club head 5700 is aligned to strike a golf ball). A top plane 5830 may be a tangential to the top portion of the 5780 of the golf club head 5700 when the golf club head 5700 is at the address position. The ground plane 5810 and the top plane 5830 may be substantially parallel to each other. The horizontal midplane 5820 may be located at half the vertical distance between the ground plane 5810 and the top plane 5830.

To provide optimal perimeter weighting for the golf club head 5700, the first set of mass portions 5720 (e.g., mass portions 5721 and 5722) may be configured to counterbalance the weight of the hosel portion 5755 and/or increase the moment of inertia of the golf club head 5700 about a vertical axis (not shown) of the golf club head 5700 that extends through the center of gravity (not shown) of the golf club head 5700. For example, as shown in FIG. 57, the first set of mass portions 5720 (e.g., mass portions 5721 and 5722) may be located near the periphery of the body portion 5710 and extend in a transition region 5745 between the top portion 5780 and the toe portion 5740. In another example, the first set of mass portions 5720 (e.g., mass portions 5721 and 5722) may be located near the periphery of the body portion 5710 and extend proximate to the toe portion 5740. The locations of the first set of mass portions 5720 and the physical properties and materials of construction of the mass portions of the first set of mass portions 5720 may be determined to optimally affect the weight, weight distribution, center of gravity, moment of inertia characteristics, structural integrity and/or or other static and/or dynamic characteristics of the golf club head 5700. The apparatus, methods, and articles of manufacture described herein are not limited in this regard.

The second set of mass portions 5730 (e.g., mass portions 5731, 5732, 5733, 5734, 5735, 5736, 5737, and 5738) may be configured to place the center of gravity of the golf club head 5700 at an optimal location and/or optimize the moment of inertia of the golf club head about a vertical axis (not shown) that extends through the center of gravity of the golf club head 5700. Referring to FIG. 57, all or a substantial portion of the second set of mass portions 5730 may be near the sole portion 5790. For example, the second set of mass portions 5730 (e.g., mass portions 5731, 5732, 5733, 5734, 5735, 5736, 5737, and 5738) may extend at or near the sole portion 5790 between the toe portion 5740 and the heel portion 5750 to lower the center of gravity of the golf club head 1500. A greater number of the mass portions 5731, 5732, 5733, 5734, 5735, 5736, 5737, and 5738 may be closer to the toe portion 5740 than the heel portion 5750 to increase the moment of inertia of the golf club head 5700 about a vertical axis that extends through the center of gravity. Some of the mass portions of the second set of mass portions 5730 may be located at the toe portion. To lower the center of gravity of the golf club head 5700, all or a portion of the second set of mass portions 5730 may be located closer to the sole portion 5790 than to the horizontal midplane 5820. The golf club head 5700 may have a greater number of mass portions below the horizontal midplane 5820 than above the horizontal midplane 5820. The golf club head 5700 may have a greater number of mass portions near the toe portion 5740 than the heel portion 5750. The locations of the second set of mass portions 5730 and the physical properties and materials of construction of the mass portions of the second set of mass portions 5730 may be determined to optimally affect the weight, weight distribution, center of gravity, moment of inertia characteristics, structural integrity and/or or other static and/or dynamic characteristics of the golf club head 5700. The apparatus, methods, and articles of manufacture described herein are not limited in this regard.

The first set of mass portions 5720 and the second set of mass portions 5730 may be similar in mass (e.g., all of the mass portions of the first set of mass portions 5720 and the second set of mass portions 5730 weigh about the same). Alternatively, the first set of mass portions 5720 and the second set of mass portions 5730 may be different in mass individually or as an entire set. In particular, each of the mass portions of the first set of mass portions 5720 (e.g., shown as 5721 and 5722) may have relatively less mass than any of the mass portions of the second set of mass portions 5730 (e.g., shown as 5731, 5732, 5733, 5734, 5735, 5736, 5737, and 5738). For example, the second set of mass portions 5730 may account for more than 50% of the total mass from exterior mass portions of the golf club head 5700. In another example, the second set of mass portions 5730 may account for between 55% to 75% of the total mass from the exterior mass portions of the golf club head 5700. In yet another example, the second set of mass portions 5730 may account for between 60% to 90% of the total mass from the exterior mass portions of the golf club head 5700. As a result, the golf club head 5700 may be configured to have at least 50% of the total mass from exterior mass portions disposed below the horizontal midplane 5820. In one example, the total mass from exterior mass portions may be greater below the horizontal midplane 5820 that the total mass from exterior mass portions above the horizontal midplane 5820. The apparatus, methods, and articles of manufacture described herein are not limited in this regard.

In one example, the golf club head 5700 may have a mass in the range of about 220 grams to about 330 grams based on the type of golf club (e.g., a 4-iron versus a lob wedge). The body portion 5710 may have a mass in the range of about 200 grams to about 310 grams with the first set of mass portions 5720 and the second set of mass portions 5730 having a mass of about 16-24 grams (e.g., a total mass from exterior mass portions). Each of the mass portions of the first set of mass portions 5720 may have a mass of about one gram (1.0 g) whereas each of the mass portions of the second set of mass portions 5730 may have a mass of about 2.4 grams. The total mass of the second set of mass portions 5730 may weigh more than five times as much as the total mass of the first set of mass portions 5720. Accordingly, the first set of mass portions 5720 may account for about 15% of the total mass from exterior mass portions of the golf club head 5700 whereas the second set of mass portions 5730 may be account for about 85% of the total mass from exterior mass portions of the golf club head 5700. The apparatus, methods, and articles of manufacture described herein are not limited in this regard.

By coupling the first set of mass portions 5720 and the second set of mass portions 5730 to the body portion 5710 (e.g., securing the first set of mass portions 5720 and the second set of mass portions 5730 in the ports on the back portion 5770), the location of the center of gravity (CG) and the moment of inertia (MOI) of the golf club head 5700 may be optimized. In particular, the first set of mass portions 5720 and the second set of mass portions 5730 may lower the location of the CG towards the sole portion 5790 and further back away from the face portion 5762. Further, the MOI may be higher as measured about a vertical axis extending through the CG (e.g., perpendicular to the ground plane 5810). The MOI may also be higher as measured about a horizontal axis extending through the CG (e.g., extending towards the toe portion 5740 and the heel portion 5750 of the golf club head 5700). As a result, the club head 5700 may provide a relatively higher launch angle and a relatively lower spin rate than a golf club head without the first set of mass portions 5720 and the second set of mass portions 5730. The apparatus, methods, and articles of manufacture described herein are not limited in this regard.

Figure 46:
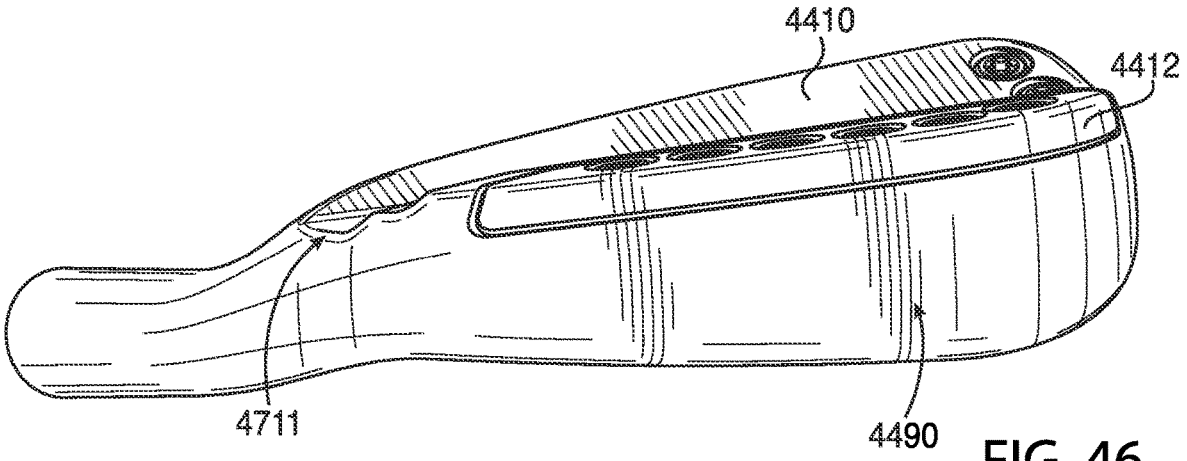
Figure 47:
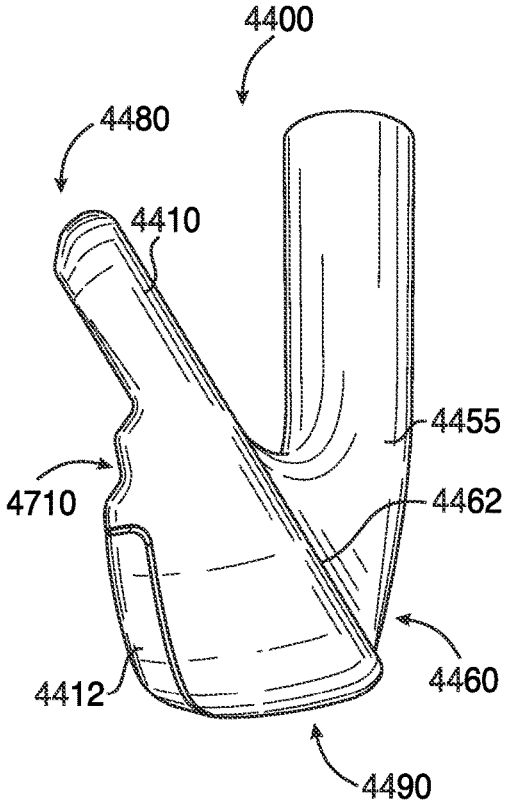
Figure 48:
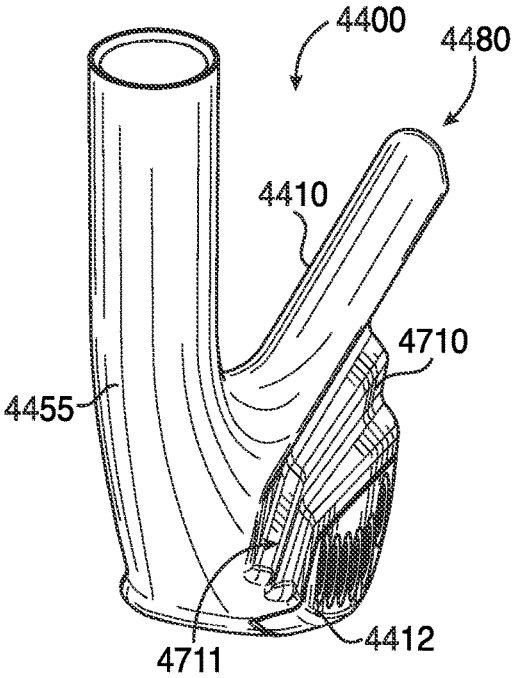
Figure 49:
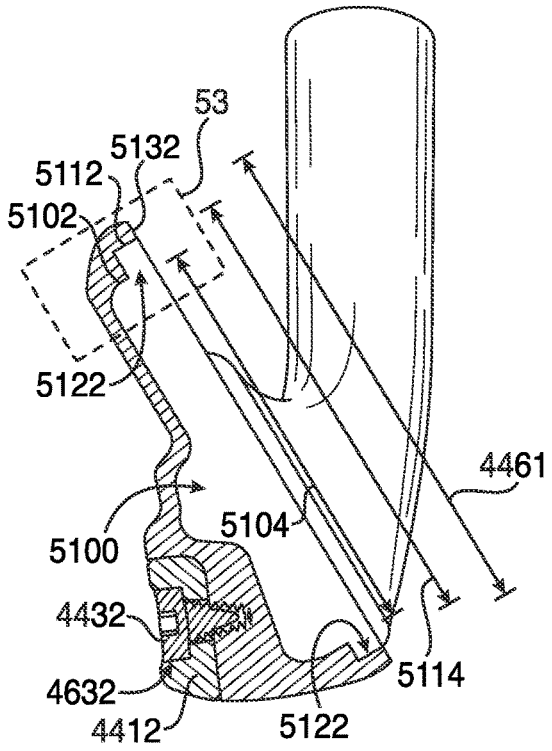

Alternatively, two or more mass portions in the same set may be different in mass. In one example, the mass portions 5721 of the first set of mass portions 5720 may have a relatively lower mass than the mass portions 5722 of the first set of mass portions 5720. In another example, the mass portions 5731 of the second set of mass portions 5730 may have a relatively lower mass than the mass portions 5735 of the second set of mass portions 5730. With relatively greater mass at the top-and-toe transition region and/or the sole-and-toe transition region, more weight may be distributed away from the center of gravity (CG) of the golf club head 5700 to increase the moment of inertia (MOI) about the vertical axis through the CG. Although the figures may depict the mass portions as separate and individual parts, each set of the first set of mass portions 5720 and the second set of mass portions 5730 may be a single piece of mass portions as shown in FIG. 46. The apparatus, methods, and articles of manufacture described herein are not limited in this regard.

The body portion 5710 of the golf club head 5700 may be a hollow body including the interior cavity (not shown) similar to the golf club head 1500. Further, the interior cavity may be unfilled, partially filled with a polymer material or entirely filled with a polymer material similar to the golf club head 1500 as discussed in detail herein. Further, the configuration of the interior cavity of the body portion 5710 and the coupling of the face portion 5762 to the body portion 5710 may be similar to the golf club head 4400 and as shown in FIGS. 49-53, 60 and 61. The apparatus, methods, and articles of manufacture described herein are not limited in this regard.

For example, as shown in FIGS. 57-59, the back wall portion 5910 may include a channel 5850 that may extend in a direction from the toe portion 5740 to the heel portion 5750 and have any length. The channel 5850 may extend parallel (not shown) to the horizontal midplane 5820 or extend at an angle relative to the horizontal midplane 5820 as shown in the example of FIG. 57. In one example shown in FIGS. 57-59, the channel 5850 extends from the toe portion edge 5741 of the toe portion 5740 at a location at or above the horizontal midplane 5820 to the heel portion edge 5751 of the heel portion 5750 at a location blow the horizontal midplane 5820. In the examples of FIGS. 57-59, the channel 5850 includes a toe-end portion 5852 at the toe portion edge 5741 and a heel-end portion 5854 at the heel portion edge 5751. The channel 5850 may partially extend between the toe portion 5740 and the heel portion 5750. The apparatus, methods, and articles of manufacture described herein are not limited in this regard.

In one example, as shown in FIGS. 57-59, the top channel width ($W_{CT}$) 5856 may decrease from the toe-end portion 5852 to the heel-end portion 5854. The top channel width 5856 may be between 0.22 inch (0.55 cm) and 0.65 inch (1.66 cm) at toe-end portion 5852, and between 0.15 inch (0.38 cm) and 0.46 inch (1.16 cm) at the heel-end portion 5854. In another example, the top channel width 5856 may be between 0.30 inch (0.77 cm) and 0.57 inch (1.44 cm) at toe-end portion 5852, and between 0.21 inch (0.54 cm) and 0.40 inch (1.01 cm) at the heel-end portion 5854. In another example, the top channel width 5856 may be between 0.37 inch (0.94 cm) and 0.5 inch (1.27 cm) at toe-end portion 5852, and between 0.26 inch (0.66 cm) and 0.35 inch (0.89 cm) at the heel-end portion 5854. The apparatus, methods, and articles of manufacture described herein are not limited in this regard.

In one example, as shown in FIGS. 57-59, the top channel width 5856 may decrease from the toe-end portion 5852 to the heel-end portion 5854. In one example, the top channel width 5856 may increase from the toe-end portion 5852 to the heel-end portion 5854. In another example, the top channel width 5856 may remain constant from the toe-end portion 5852 to the heel-end portion 5854. In another example, the top channel width 5856 may vary independently from the toe-end portion 5852 to the heel-end portion 5854. In another example, the top channel width 5856 may vary from the toe-end portion 5852 to the heel-end portion 5854 by between 25% and 75%. In another example, the top channel width 5856 may vary from the toe-end portion 5852 to the heel-end portion 5854 by between 35% and 65%. In another example, the top channel width 5856 may vary from the toe-end portion 5852 to the heel-end portion 5854 by between 40% and 60%. In another example, the top channel width 5856 may decrease continuously and uniformly from the toe-end portion 5852 to the heel-end portion 5854 (shown in FIGS. 57-59). In another example, the top channel width 5856 may increase continuously and uniformly from the toe-end portion 5852 to the heel-end portion 5854 (not shown). In another example, the top channel width 5856 may change in a discontinuous or step-wise manner (not shown) from the toe-end portion 5852 to the heel-end portion 5854 (not shown). The apparatus, methods, and articles of manufacture described herein are not limited in this regard.

In the example of FIGS. 57-59, the channel 5850 includes a first groove portion 5858 and a first step portion 5859, and a second groove portion 5860 and a second step portion 5861. Each groove portion 5858 and 5860 may include side walls that form a generally right angle, an acute angle or an obtuse angle relative to the channel width 5856 or a bottom portion of each groove portion, respectively. Accordingly, the groove portions 5858 and 5860 may define valley-shaped groove portions. The areas of joinder between the sidewalls of the groove portions 5858 and 5860 and the bottom portion of each groove portion may include a chamfer or a transition region. The apparatus, methods, and articles of manufacture described herein are not limited in this regard.

The depth of each groove portion 5858 and 5860 may be generally constant or may vary from the toe-end portion 5852 to the heel-end portion 5854. In one example, the depth of each groove portion 5858 and/or 5860 may decrease from the toe-end portion 5852 to the heel-end portion 5854. In another example, as shown in FIGS. 57-59, the depth of each groove portion 5858 and/or 5860 may increase from the toe-end portion 5852 to the heel-end portion 5854. In one example, the depth of each groove portion 5858 and/or 5860 may be between 0.04 inch (0.09 cm) and 0.11 inch (0.28 cm) at the toe-end portion 5852 and between 0.06 inch (0.16 cm) and 0.19 inch (0.48 cm) at the heel-end portion 5854. In another example, the depth of each groove portion 5858 and/or 5860 may be between 0.05 inch (0.13 cm) and 0.09 inch (0.24 cm) at the toe-end portion 5852 and between 0.09 inch (0.22 cm) and 0.16 inch (0.41 cm) at the heel-end portion 5854. In another example, the depth of each groove portion 5858 and/or 5860 may be between 0.06 inch (0.16 cm) and 0.08 inch (0.21 cm) at the toe-end portion 5852 and between 0.11 inch (0.27 cm) and 0.14 inch (0.37 cm) at the heel-end portion 5854. The apparatus, methods, and articles of manufacture described herein are not limited in this regard.

The first step portion 5859 defines a transition portion between the first groove portion 5858 and the second groove portion 5860. The second step portion 5861 defines a transition portion between the second groove portion 5860 and the portion back wall portion 5910 below the channel 5850. The width of the first step portion 5859 and/or the second step portion 5861 may be generally constant or may vary from the toe-end portion 5852 to the heel-end portion 5854. In one example, as shown in FIGS. 57-59, the width of the first step portion 5859 and/or the second step portion 5861 may decrease from the toe-end portion 5852 to the heel-end portion 5854. In another example (not shown), the width of the first step portion 5859 and/or the second step portion 5861 may increase from the toe-end portion 5852 to the heel-end portion 5854. In one example, the width of the first step portion 5859 and/or the second step portion 5861 may be between 0.04 inch (0.09 cm) and 0.11 inch (0.28 cm) at the toe-end portion 5852 and between 0.06 inch (0.16 cm) and 0.19 inch (0.48 cm) at the heel-end portion 5854. In another example, the width of the first step portion 5859 and/or the second step portion 5861 may be between 0.05 inch (0.13 cm) and 0.09 inch (0.24 cm) at the toe-end portion 5852 and between 0.09 inch (0.22 cm) and 0.16 inch (0.41 cm) at the heel-end portion 5854. In another example, the width of the first step portion 5859 and/or the second step portion 5861 may be between 0.06 inch (0.16 cm) and 0.08 inch (0.21 cm) at the toe-end portion 5852 and between 0.11 inch (0.27 cm) and 0.14 inch (0.37 cm) at the heel-end portion 5854. The apparatus, methods, and articles of manufacture described herein are not limited in this regard.

The channel 5850 may define a portion of the body portion 5710 from which mass has been removed to form the channel 5850. The removed mass defined by the channel 5850 may be transferred to other portions of the body portion 5710 to impart certain characteristics to the golf club head 5700. At least a portion of the removed mass defined by the channel 5850 may be transferred below the horizontal midplane 5820 of the body portion 5710 to lower the center of gravity of the golf club head 5700 while maintaining or substantially maintaining the overall mass of the body portion 5710. Further, at least a portion of the removed mass defined by the channel 5850 may be transferred below the horizontal midplane 5820 of the body portion 5710 and closer to the toe portion 5740 than the heel portion 5750 to increase the MOI of the golf club head 5700. In one example, the removed mass defined by the channel 5850 may be incorporated into the body portion 5710 below the horizontal midplane 5820 by increasing the volume of the body portion 5710 below the horizontal midplane 5820. In other words, the volume and hence the mass of the body portion 5710 below the horizontal midplane 5820 may be increased. In another example, the removed mass defined by the channel 5850 may be incorporated into the body portion 5710 as additional mass portions as compared to a golf club head that does not have the channel 5850. For example, the golf club head 5700 includes a greater number of mass portions of the second set of mass portions 5730 below the horizontal midplane 5820 as compared to the golf club head 1500. The increased mass below the horizontal midplane 5820 and/or toward the toe portion 5740 lowers the center of gravity and/or increases the MOI of the golf club head 5700, respectively. The apparatus, methods, and articles of manufacture described herein are not limited in this regard.

The masses of the mass portions of the first set of mass portions 5720 and/or the second set of mass portions 5730 may vary. The mass of each mass portions may be increased and/or decreased by changing the length, diameter and/or the material of construction of the mass portions. For example, the mass of a mass portions may be increased by increasing the length of the mass portions without increasing the diameter of the mass portions so that the mass portions can be used in any of the ports of the body portion 5710. In another example, the mass of a mass portions may be increased by using a denser material for the mass portions. The apparatus, methods, and articles of manufacture described herein are not limited in this regard.

In one example, the masses of the second set of mass portions 5730 may decrease from the toe portion 5740 to the heel portion 5750 to increase the MOI of the golf club head 5700. In one example, each of the mass portions of the second set of mass portions 5730 may have a reduced mass relative to an adjacent mass portions of the second set of mass portions 5730 in a direction from the toe portion 5740 to the heel portion 5750. For example, the mass portions 5737 may have a smaller mass than the mass portions 5738, the mass portions 5736 may have a smaller mass than the mass portions 5737, the mass portions 5735 may have a smaller mass than the mass portions 5736, the mass portions 5734 may have a smaller mass than the mass portions 5735, the mass portions 5733 may have a smaller mass than the mass portions 5734, the mass portions 5732 may have a smaller mass than the mass portions 5733, and the mass portions 5731 may have a smaller mass than the mass portions 5732. In another example, groups of mass portions of the second set of mass portions 5730 may have similar masses and yet have a smaller overall mass than an adjacent group of mass portions in a direction from the toe portion 5740 to the heel portion 5750. For example, each of the mass portions 5731, 5732 and 5733 may have similar masses and yet have an overall mass that is less than the overall mass of the mass portions 5734, 5735 and 5736. Each of the mass portions 5734, 5735 and 5736 may have similar masses and yet have an overall mass that is less than the overall mass of the mass portions 5737, and 5738. Accordingly, the masses of the mass portions of the second set of mass portions 5730 may decrease in a direction from the toe portion 5740 to the heel portion 5750 in any manner. The apparatus, methods, and articles of manufacture described herein are not limited in this regard.

The configuration of the channel 5850, such as width, depth, volume, cross-sectional shape and any of the other characteristics described herein may vary as the channel 5850 extends from the toe-end portion 5852 to the heel-end portion 5854. Accordingly, the mass that is removed from the body portion 5710 due to the presence of the channel 5850 may similarly vary. According to another example, the masses of the mass portions of the second set of mass portions 5730 may correspondingly vary in a direction from the toe portion 5740 to the heel portion 5750 at a similar rate or a substantially similar rate as the variation in the channel configuration from the toe portion 5740 to the heel portion 5750. In another example, all of the mass portions of the second set of mass portions 5730 may have similar masses. The apparatus, methods, and articles of manufacture described herein are not limited in this regard.

In the example of FIGS. 62-67, a golf club head 6200 may include a body portion 6210 and two or more mass portions, generally shown as a first set of mass portions 6220 (e.g., shown as mass portion 6221 and mass portion 6222) and a second set of mass portions 6230 (e.g., shown as mass portions 6231, 6232, 6233, 6234, 6235, 6236, and 6237). The body portion 6210 may include a toe portion 6240 with a toe portion edge 6241, a heel portion 6250 with a heel portion edge 6251, a front portion 6260, a back portion 6270, a top portion 6280 with a top edge 6281, and a sole portion 6290 with a sole edge 6291. The back portion 6270 may be portions of the golf club head 6200 that are aft of the front portion 6260. The golf club head 6200 may include a face portion 6262 (e.g., a strike face) which may be similar in many respects to the face portions of any of the golf club heads described herein. The face portion 6262 may be coupled to the front portion 6260 by any of the methods described herein such as welding, soldering, bonding, etc. The body portion 6210 may include a hosel portion 6255 configured to receive a shaft (an example shaft shown in FIG. 14) with a grip (an example grip shown in FIG. 14) on one end and the golf club head 6200 on the opposite end of the shaft to form a golf club. The golf club head 6200 may be any type of golf club head such as any of the golf club heads described herein and be manufactured by any of the methods described herein and illustrated in FIG. 31. The apparatus, methods, and articles of manufacture are not limited in this regard.

The body portion 6210 may also include a hosel transition portion 6295 that may be positioned at or near the heel portion 6250 and located between the front portion 6260, the back portion 6270, and the hosel portion 6255. In one example, the hosel transition portion 6295 may extend from the face portion 6262 to the hosel portion 6255. In another example, the hosel transition portion 6295 may define portions of the heel portion 6250, the front portion 6260, the back portion 6270, the top portion 6280 and/or the sole portion 6290 near the hosel portion 6255. In another example, the hosel transition portion 6295 may be a cutout or an undercut portion of the body portion 6210 located between the face portion 6262 and the hosel portion 6255. In yet another example, the hosel transition portion 6295 may be a portion of the front portion 6260 that is between the face portion 6262 and the hosel portion 6255 and which is not generally used to strike a golf ball (i.e., between the ball strike region of the face portion 6262 and the hosel portion 6255). The apparatus, methods, and articles of manufacture are not limited in this regard.

The body portion 6210, the first set of mass portions 6220 and/or the second set of mass portions 6230 may include or be made of different materials. For example, the body portion 6210, the first set of mass portions 6220, and/or the second set of mass portions 6230 may be made of a first, a second and/or a third material. The first, second and third materials may be similar or different materials. For example, the materials of construction of the body portion 6210, the first set of mass portions 6220 and/or the second set of mass portions 6230 may be steel, aluminum, titanium, tungsten, metal alloys, polymers, or composite materials. The materials from which the golf club head 6200, the first set of mass portions 6220 and/or the second set of mass portions 6230 are constructed may be similar in many respects to any of the golf club heads and the mass portions described herein. The apparatus, methods, and articles of manufacture are not limited in this regard.

Figure 63:
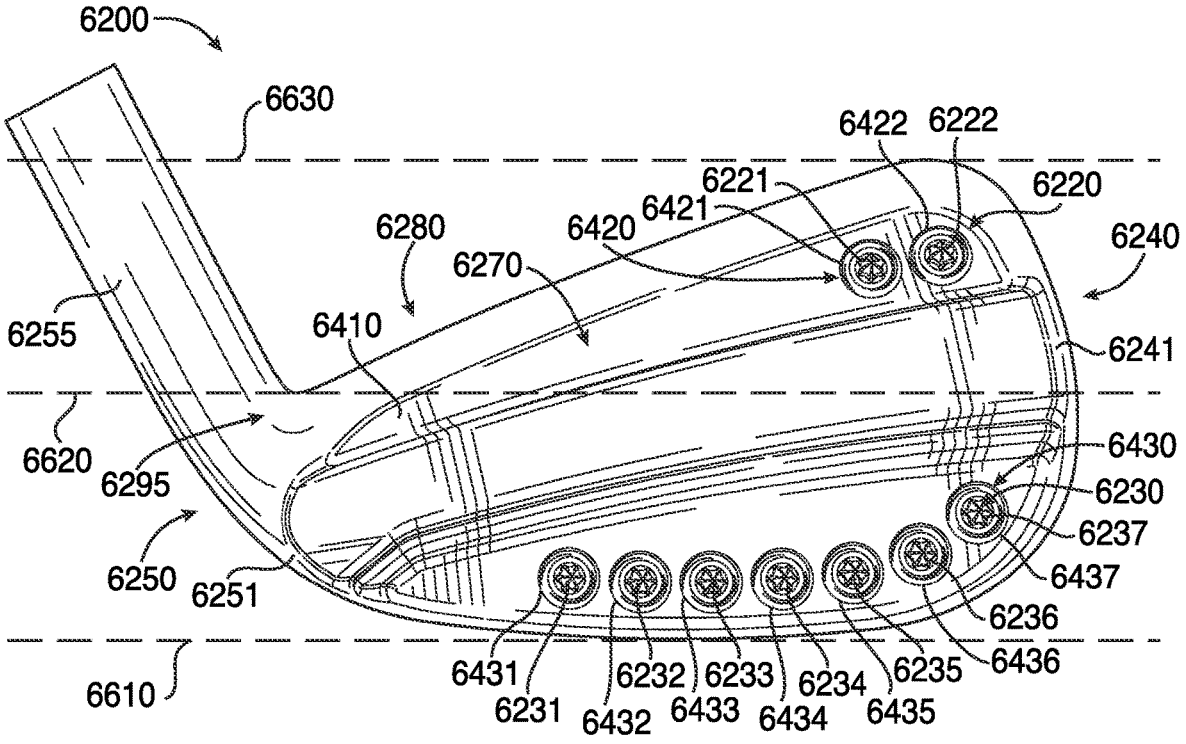
Figure 64:
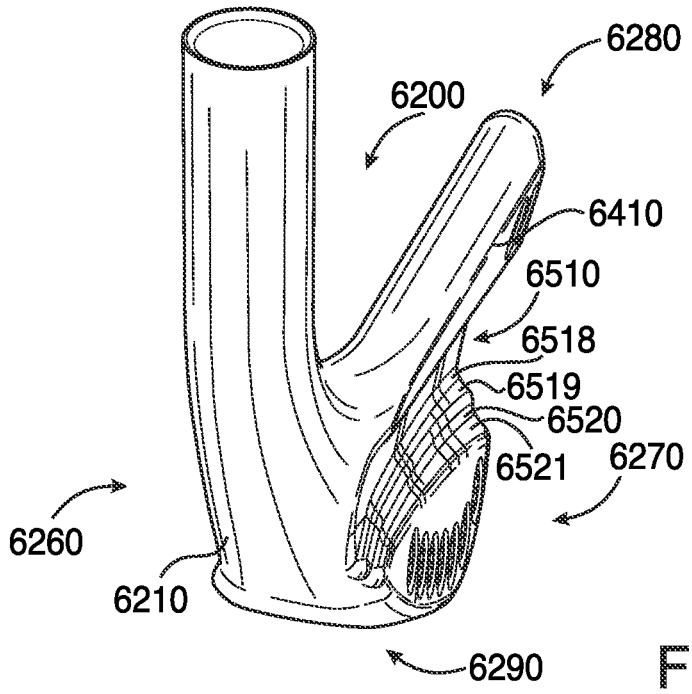

As illustrated in FIG. 63, the golf club head 6200 may be associated with a ground plane 6610, a horizontal midplane 6620, and a top plane 6630. In particular, the ground plane 6610 may be a plane that may be substantially parallel with the ground and be tangent to the sole portion 6290 of the golf club head 6200 when the golf club head 6200 is at an address position (e.g., the golf club head 6200 is aligned to strike a golf ball). A top plane 6630 may be a tangent to the top portion of the 6280 of the golf club head 6200 when the golf club head 6200 is at the address position. The ground plane 6610 and the top plane 6630 may be substantially parallel to each other. The horizontal midplane 6620 may be located at half the vertical distance between the ground plane 6610 and the top plane 6630.

The back portion 6270 may include a back wall portion 6410 with one or more ports, which may be exterior ports (e.g., located on an exterior surface of the body portion so as to be visible or exposed) and/or interior ports (e.g., located inside the body portion 6210). In one example, as illustrated in FIG. 63, the back portion 6270 may include one or more ports along a periphery of the back portion 6270, which are generally shown as a first set of ports 6420 (e.g., shown as ports 6421 and 6422) and a second set of ports 6430 (e.g., shown as ports 6431, 6432, 6433, 6434, 6435, 6436 and 6437). Each port may be an opening in the back wall portion 6410. The first set of ports 6420 and the second set of ports 6430, respectively, may be ports configured to receive one or more mass portions of the first set of mass portions 6220 and/or the second set of mass portions 6230 similar to any of the golf club heads discussed herein. The first set of ports 6420, which are shown for example as ports 6421 and 6422 may be recesses or bores in the body portion 6210 that are configured to receive any one of the mass portions of the first set of mass portions 6220 or any of the mass portions of the second set of mass portions 6230. The second set of ports 6430, which are shown for example as ports 6431, 6432, 6433, 6434, 6435, 6436 and 6437, may be recesses or bores in the body portion 6210 that are configured to receive any one of the mass portions of the first set of mass portions 6220 or any of the mass portions of the second set of mass portions 6230. Each mass portion of the first set of mass portion 6220 and the second set of mass portions 6230 may be coupled to any of the ports of the first and second sets of ports 6420 and 6430 with various manufacturing methods and/or processes (e.g., a bonding process, a welding process, a brazing process, a mechanical locking method, any combination thereof, or other suitable manufacturing methods and/or processes) such as the methods and processes described herein. The locations of the ports, the distances between the ports, the configurations and/or properties of the ports and the mass portions (e.g., dimensions and/or masses) may be similar in many respects to any of the golf club heads, ports and/or mass portions described herein. The apparatus, methods, and articles of manufacture described herein are not limited in this regard.

The first set of ports 6420 (e.g., shown as ports 6421 and 6422) may be located above the horizontal midplane 6620 and/or at or near the toe portion 6240. The first set of ports 6420 may be configured to receive one or more mass portions of the first set of mass portions 6220 to offset and/or balance the weight of the hosel portion 6255 and/or place more mass near the toe portion 6240 to increase the moment of inertia (MOI) of the golf club head 6200. The second set of mass portions 6230 (e.g., mass portions 6231, 6232, 6233, 6234, 6235, 6236 and 6237) may be configured to place the center of gravity of the golf club head 6200 at an optimal location and/or optimize the MOI of the golf club head about a vertical axis (not shown) that extends through the center of gravity of the golf club head 6200. Referring to FIG. 63, all or a substantial portion of the second set of mass portions 6230 may be near the sole portion 6290. For example, the second set of mass portions 6230 (e.g., mass portions 6231, 6232, 6233, 6234, 6235, 6236 and, 6237) may extend at or near the sole portion 6290 between the toe portion 6240 and the heel portion 6250 to lower the center of gravity of the golf club head 1500. A greater number of the mass portions 6231, 6232, 6233, 6234, 6235, 6236 and 6237 may be closer to the toe portion 6240 than the heel portion 6250 to increase the MOI of the golf club head 6200 about a vertical axis that extends through the center of gravity. Some of the mass portions of the second set of mass portions 6230 may be located at the toe portion. One or more mass portions of the first set of mass portions 6220 and/or the second set of mass portions 6230 may be at or near the toe portion edge 6241 or at or near the heel portion edge 6251. To lower the center of gravity of the golf club head 6200, all or a portion of the second set of mass portions 6230 may be located closer to the sole portion 6290 than to the horizontal midplane 6620. The golf club head 6200 may have a greater number of mass portions below the horizontal midplane 6620 than above the horizontal midplane 6620. The golf club head 6200 may have a greater number of mass portions that are closer the toe portion 6240 than the heel portion 6250. The locations of the first set of mass portions 6220 and/or the second set of mass portions 6230 and the physical properties and materials of construction of the mass portions of the first set of mass portions 6220 and/or the second set of mass portions 6230 may be determined to optimally affect the weight, weight distribution, center of gravity, MOI characteristics, structural integrity and/or or other static and/or dynamic characteristics of the golf club head 6200. The apparatus, methods, and articles of manufacture described herein are not limited in this regard.

The mass portions of the second set of mass portions 6230 may have similar or different masses. In one example, the mass portions 6231, 6232, 6233, 6234 and 6235 may be constructed from a less dense material than the mass portions 6236 and 6237. For example, the mass portions 6231, 6232, 6233, 6234 and 6235 may be constructed from titanium, while the mass portions 6236 and 6237 may be constructed from tungsten. The mass portions 6231, 6232, 6233, 6234 and 6235 may be changed with heavier or lighter mass portions to affect the swing weight of the golf club head 6200. Each of the mass portions 6236 and 6237 may be heavier as compared to each of the mass portions 6231, 6232, 6233, 6234 and 6235 to increase the MOI of the golf club head 6200. In one example, the mass of the mass portions may progressively increase from the heel portion 6250 to the toe portion 6240. In another example, the mass of the mass portions 6231, 6232, 6233, 6234 and 6235 may progressively increase from the heel portion 6250 to the toe portion 6240, while the mass of the mass portions 6236 and 6237 may be constant and each greater than the mass of any of the mass portions 6231, 6232, 6233, 6234 and 6235. In yet another example, the mass portions 6231, 6232, 6233, 6234 and 6235 may have similar masses, and the mass portions 6236 and 6237 may also have similar masses but each being greater than the mass of any of the mass portions 6231, 6232, 6233, 6234 and 6235. The apparatus, methods, and articles of manufacture described herein are not limited in this regard.

Alternatively, two or more mass portions in the same set may be different in mass. In one example, the mass portion 6221 of the first set of mass portions 6220 may have a relatively lower mass than the mass portion 6222 of the first set of mass portions 6220. In another example, the mass portion 6231 of the second set of mass portions 6230 may have a relatively lower mass than the mass portion 6235 of the second set of mass portions 6230. With relatively greater mass at the top-and-toe transition region and/or the sole-and-toe transition region, more weight may be distributed away from the center of gravity (CG) of the golf club head 6200 to increase the MOI about the vertical axis through the CG.

While the figures may depict ports with a particular cross-sectional shape, the apparatus, methods, and articles of manufacture described herein may include ports with other suitable cross-section shapes. The ports of the first and/or second sets of ports 6420 and 6430 may have cross-sectional shapes that are similar to the cross-sectional shapes of any of the ports described herein. The apparatus, methods, and articles of manufacture described herein are not limited in this regard.

The first set of mass portion 6220 and the second set of mass portions 6230 may be similar in mass (e.g., all of the mass portions of the first set of mass portions 6220 and the second set of mass portions 6230 weigh about the same). Alternatively, the first set of mass portions 6220 and the second set of mass portions 6230 may be different in mass individually or as an entire set. In particular, each of the mass portions of the first set of mass portions 6220 (e.g., shown as 6221 and 6222) may have relatively less mass than any of the mass portions of the second set of mass portions 6230 (e.g., shown as 6231, 6232, 6233, 6234, 6235, 6236 and 6237). For example, the second set of mass portions 6230 may account for more than 50% of the total mass from mass portions of the golf club head 6200. In another example, the second set of mass portions 6230 may account for between 55% to 75% of the total mass from the mass portions of the golf club head 6200. In yet another example, the second set of mass portions 6230 may account for between 60% to 90% of the total mass from the mass portions of the golf club head 6200. As a result, the golf club head 6200 may be configured to have at least 50% or between 50% to 90% of the total mass from mass portions disposed below the horizontal midplane 6620. In one example, the total mass from mass portions may be greater below the horizontal midplane 6620 that the total mass from mass portions above the horizontal midplane 6620. The apparatus, methods, and articles of manufacture described herein are not limited in this regard.

In one example, the golf club head 6200 may have a mass in the range of about 220 grams to about 240 grams based on the type of golf club (e.g., a 4-iron versus a lob wedge).

The body portion 6210 may have a mass in the range of about 200 grams to about 310 grams with the first set of mass portion 6220 and the second set of mass portions 6230 having a mass of about 16-24 grams (e.g., a total mass from mass portions). Each of the mass portions of the first set of mass portions 6220 may have a mass of about one gram (1.0 g) whereas each of the mass portions of the second set of mass portions 6230 may have a mass of about 2.4 grams. The total mass of the second set of mass portions 6230 may weigh more than five times as much as the total mass of the first set of mass portions 6220. Accordingly, the first set of mass portions 6220 may account for about 15% of the total mass from mass portions of the golf club head 6200 whereas the second set of mass portions 6230 may be account for about 85% of the total mass from mass portions of the golf club head 6200. The apparatus, methods, and articles of manufacture described herein are not limited in this regard.

By coupling the first set of mass portion 6220 and the second set of mass portions 6230 to the body portion 6210 (e.g., securing the first and second sets of mass portions 6220 and 6230 in the ports on the back portion 6270) the location of the center of gravity (CG) and the MOI of the golf club head 6200 may be optimized. In particular, the first set of mass portion 6220 and the second set of mass portions 6230 may lower the location of the CG towards the sole portion 6290 and further back away from the face portion 6262. Further, the first set of mass portion 6220 and the second set of mass portions 6230 may provide a higher moment of inertia as measured about a vertical axis extending through the CG (e.g., perpendicular to the ground plane 6610). The MOI may also be higher as measured about a horizontal axis extending through the CG (e.g., extending towards the toe portion 6240 and the heel portion 6250 of the golf club head 6200). As a result, the club head 6200 may provide a relatively higher launch angle and a relatively lower spin rate than a golf club head without the first and second sets of mass portions 6220 and 6230, respectively. The apparatus, methods, and articles of manufacture described herein are not limited in this regard.

Although the figures may depict the mass portions as separate and individual parts, each set of the first set of mass portion 6220 and the second set of mass portions 6230 may be a single piece of mass portion. In one example, all of the mass portions of the first set of mass portions 6220 (e.g., shown as 6221 and 6222) may be combined into a single piece of mass portion (e.g., a first mass portion). In a similar manner, all of the mass portions of the second set of mass portions 6230 (e.g., 6231, 6232, 6233, 6234, 6235, 6236 and 6237) may be combined into a single piece of mass portion as well (e.g., a second mass portion) similar to the example of FIGS. 22 and 23. While the figures may depict a particular number of mass portions, the apparatus, methods, and articles of manufacture described herein may include more or less number of mass portions. The apparatus, methods, and articles of manufacture described herein are not limited in this regard.

In one example, as shown in FIGS. 62-67, the back wall portion 6410 may include a channel 6510 that may extend in a direction from the toe portion 6240 to the heel portion 6250 and have any length. The channel 6510 may extend parallel (not shown) to the horizontal midplane 6620 or extend at an angle relative to the horizontal midplane 6620 as shown in the example of FIG. 63. In one example, as shown in FIGS. 62-67, the channel 6510 may extend from the toe portion edge 6241 of the toe portion 6240 at or above the horizontal midplane 6620 to the heel portion edge 6251 of the heel portion 6250 at or below the horizontal midplane 6620. In another example (not shown), the channel 6510 may extend from the toe portion edge 6241 to a location between the toe portion 6240 and the heel portion 6250. In yet another example, the channel 6510 may partially extend between the toe portion 6240 and the heel portion 6250. The apparatus, methods, and articles of manufacture described herein are not limited in this regard.

In one example, as shown in FIGS. 62-67, the channel 6510 may include a channel width (WCT) 6516 that may decrease in a direction from the toe portion 6240 to the heel portion 6250. In one example, the channel width 6516 may represent the width of the top of the channel 6510 (e.g., the outer most portion of the channel 6510). In another example, the channel width 6516 may represent the width of the bottom of the channel 6510. The channel width 6516 may be between 5% to 50% of the distance between the top edge 6281 of the top portion 6280 and the sole edge 6291 of the sole portion 6290. In one example, as shown in FIGS. 62-67, the channel width 6516 may decrease from the toe portion edge 6241 to the heel portion edge 6251. In another example (not shown), the channel width 6516 may increase from the toe portion edge 6241 to the heel portion edge 6251. In another example (not shown), the channel width 6516 may remain constant from the toe portion edge 6241 to the heel portion edge 6251. In yet another example, the channel width 6516 may vary in any manner from the toe portion edge 6241 to the heel portion edge 6251. In yet another example, the channel width 6516 may vary from the toe portion edge 6241 to the heel portion edge 6251 by between 5% and 20%. In yet another example, the channel width 6516 may vary from the toe portion edge 6241 to the heel portion edge 6251 by between 25% and 75%. In yet another example, the channel width 6516 may vary from the toe portion edge 6241 to the heel portion edge 6251 by between 26% and 65%. In yet another example, the channel width 6516 may vary from the toe portion edge 6241 to the heel portion edge 6251 by between 40% and 60%. In yet another example, the channel width 6516 may decrease continuously from the toe portion edge 6241 to the heel portion edge 6251 (shown in FIGS. 62-67). In yet another example, the channel width 6516 may increase continuously from the toe portion edge 6241 to the heel portion edge 6251 (not shown). In yet another example, the channel width 6516 may change in a discontinuous or step-wise manner (not shown) from the toe portion edge 6241 to the heel portion edge 6251. The apparatus, methods, and articles of manufacture described herein are not limited in this regard.

In the example of FIGS. 62-67, the channel 6510 includes a first groove portion 6518, a first step portion 6519, a second groove portion 6520, and a second step portion 6521. Each groove portion 6518 and 6520 may include side walls that form a generally right angle, an acute angle or an obtuse angle relative to the channel width 6516 or relative to a bottom portion of each groove portion, respectively. Accordingly, the groove portions 6518 and 6520 may define valley-shaped groove portions. The areas of joinder between the sidewalls of the groove portions 6518 and 6520 and the bottom portion of each groove portion may include a chamfer or a transition region. The first step portion 6519 defines a transition portion between the first groove portion 6518 and the second groove portion 6520. The second step portion 6521 defines a transition portion between the second groove portion 6520 and the portion back wall portion 6410 between the channel 6510 and the sole edge 6291 of the sole portion 6290. The width of the first step portion 6519 and/or the second step portion 6521 may be generally constant or may vary from the toe portion edge 6241 to the heel portion edge 6251. In one example, the width of the first step portion 6519 and/or the second step portion 6521 may decrease from the toe portion edge 6241 to the heel portion edge 6251. In another example, the width of the first step portion 6519 and/or the second step portion 6521 may increase from the toe portion edge 6241 to the heel portion edge 6251. The apparatus, methods, and articles of manufacture described herein are not limited in this regard.

The channel 6510 may define a portion of the body portion 6210 from which mass has been removed or displaced to other portions of the body portion 6210 to form the channel 6510. The removed or displaced mass may be transferred to other portions of the body portion 6210 to impart certain characteristics to the golf club head 6200 such as to increase the MOI, lower the CG, optimize vibration and dampening characteristics, and/or improve the sound and feel of the golf club head 6200. At least a portion of the removed or displaced mass may be transferred below the horizontal midplane 6620 of the body portion 6210 to lower the center of gravity of the golf club head 6200 while maintaining or substantially maintaining the overall mass of the body portion 6210. Further, at least a portion of the removed or displaced mass may be transferred below the horizontal midplane 6620 of the body portion 6210 and closer to the toe portion 6240 than the heel portion 6250 to increase the MOI of the golf club head 6200. In one example, the removed or displaced mass may be incorporated into the body portion 6210 below the horizontal midplane 6620 by increasing the volume of the body portion 6210 below the horizontal midplane 6620. In another example, the removed or displaced mass may be incorporated into the body portion 6210 as additional mass portions. The increased mass below the horizontal midplane 6620 and/or toward the toe portion 6240 lowers the center of gravity and/or increases the MOI of the golf club head 6200, respectively. The apparatus, methods, and articles of manufacture described herein are not limited in this regard.

The configuration of the channel 6510, such as width, depth, volume, cross-sectional shape and any of the other characteristics described herein may vary as the channel 6510 extends from the toe portion edge 6241 to the heel portion edge 6251. Accordingly, the mass that is removed or displaced from the body portion 6210 due to the presence of the channel 6510 may similarly vary. According to another example, the masses of the mass portions of the second set of mass portions 6230 may correspondingly vary in a direction from the toe portion 6240 to the heel portion 6250 at a similar rate or a substantially similar rate as the variation in the channel configuration from the toe portion 6240 to the heel portion 6250. In another example, all of the mass portions of the second set of mass portions 6230 may have similar masses. The apparatus, methods, and articles of manufacture described herein are not limited in this regard.

The masses of the mass portions of the first set of mass portions 6220 and/or the second set of mass portions 6230 may vary. The mass of each mass portion may be increased and/or decreased by changing the length, diameter and/or the material of construction of the mass portions. For example, the mass of a mass portion may be increased by increasing the length of the mass portion without increasing the diameter of the mass portion so that the mass portion can be used in any of the ports of the body portion 6210. In another example, the mass of a mass portion may be increased by using a denser material for the mass portion. In yet another example, two similarly sized mass portions may have different masses by having one of the mass portions being a non-hollow mass portion and the other mass portion having a hollow portion. The apparatus, methods, and articles of manufacture described herein are not limited in this regard.

In one example, the masses of the second set of mass portions 6230 may decrease from the toe portion 6240 to the heel portion 6250 to increase the MOI of the golf club head 6200. In one example, each of the mass portions of the second set of mass portions 6230 may have a reduced mass relative to an adjacent mass portion of the second set of mass portions 6230 in a direction from the toe portion 6240 to the heel portion 6250. In another example, groups of mass portions of the second set of mass portions 6230 may have similar masses and yet have a greater overall mass than an adjacent group of mass portions that are closer to the heel portion 6250. Accordingly, the masses of the mass portions of the second set of mass portions 6230 may decrease in a direction from the toe portion 6240 to the heel portion 6250 in any manner. The apparatus, methods, and articles of manufacture described herein are not limited in this regard.

The body portion 6210 of the golf club head 6200 may be a hollow body including a first interior cavity 6370, which may be similar to the interior cavity 700 of the golf club head 1500. The first interior cavity 6370 may be unfilled, partially filled, or entirely filled with a polymer material similar to the golf club head 1500 as discussed in detail herein. Any one or more ports of the first set of ports 6420 and/or the second set of ports 6430 may be connected to the first interior cavity 6370 similar to the golf club head 1500 as discussed in detail herein and shown in the example of FIGS. 23 and 32. Accordingly, the first interior cavity 6370 may be partially filled or entirely filled with a polymer material from any one or more ports of the first set of ports 6420 and/or any one or more ports of the second set of ports 6430 that may be connected to the first interior cavity 6370. In one example, the first set of ports 6420 may include one or more ports that may be connected to the interior cavity 6370 and the second set of ports 6430 may not include any ports that are connected to the interior cavity 6370. In another example, the first set of ports 6420 may not include any ports that are connected to the interior cavity 6370, but the second set of ports 6430 may include one or more ports that are connected to the interior cavity 6370. In yet another example, both the first set of ports 6420 and the second set of ports may include one or more ports that are connected to the interior cavity 6370. The apparatus, methods, and articles of manufacture described herein are not limited in this regard.

Figure 65:
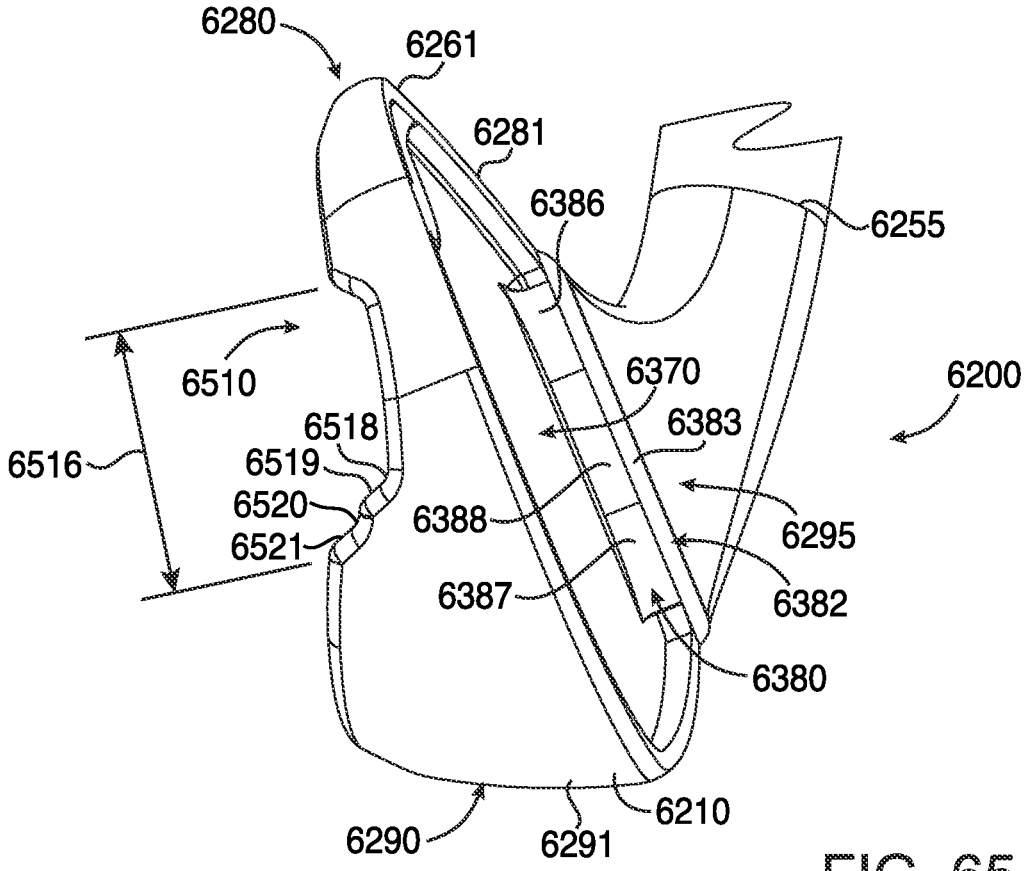
Figure 66:
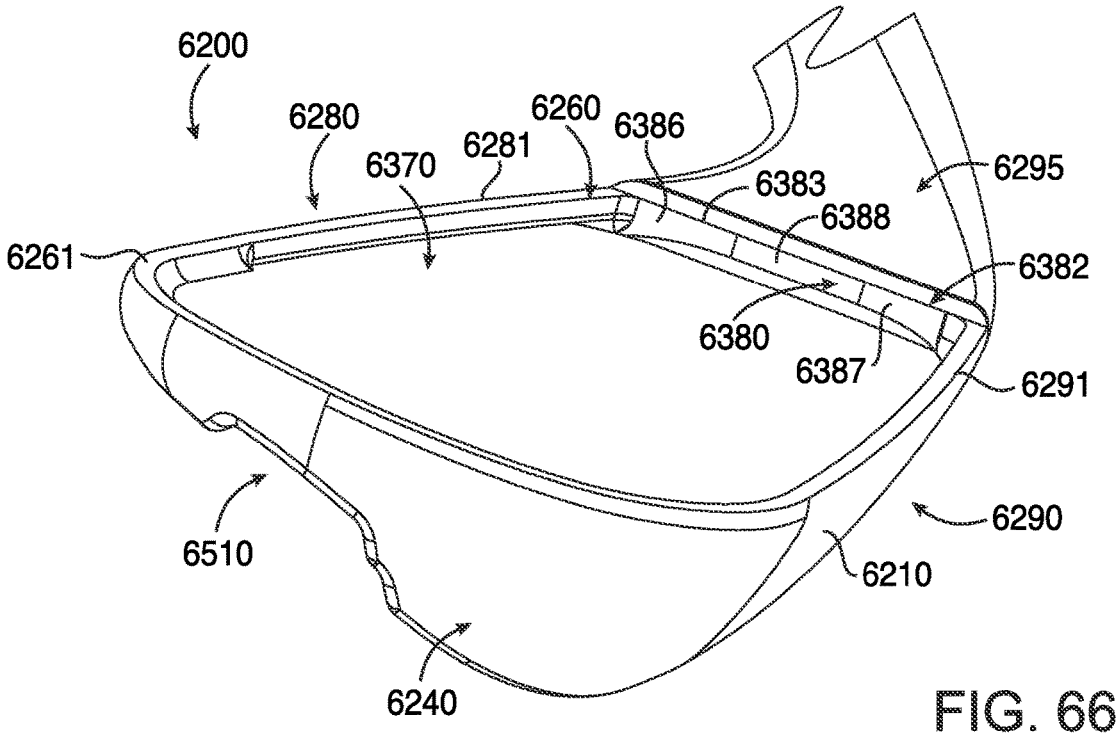
Figure 67:
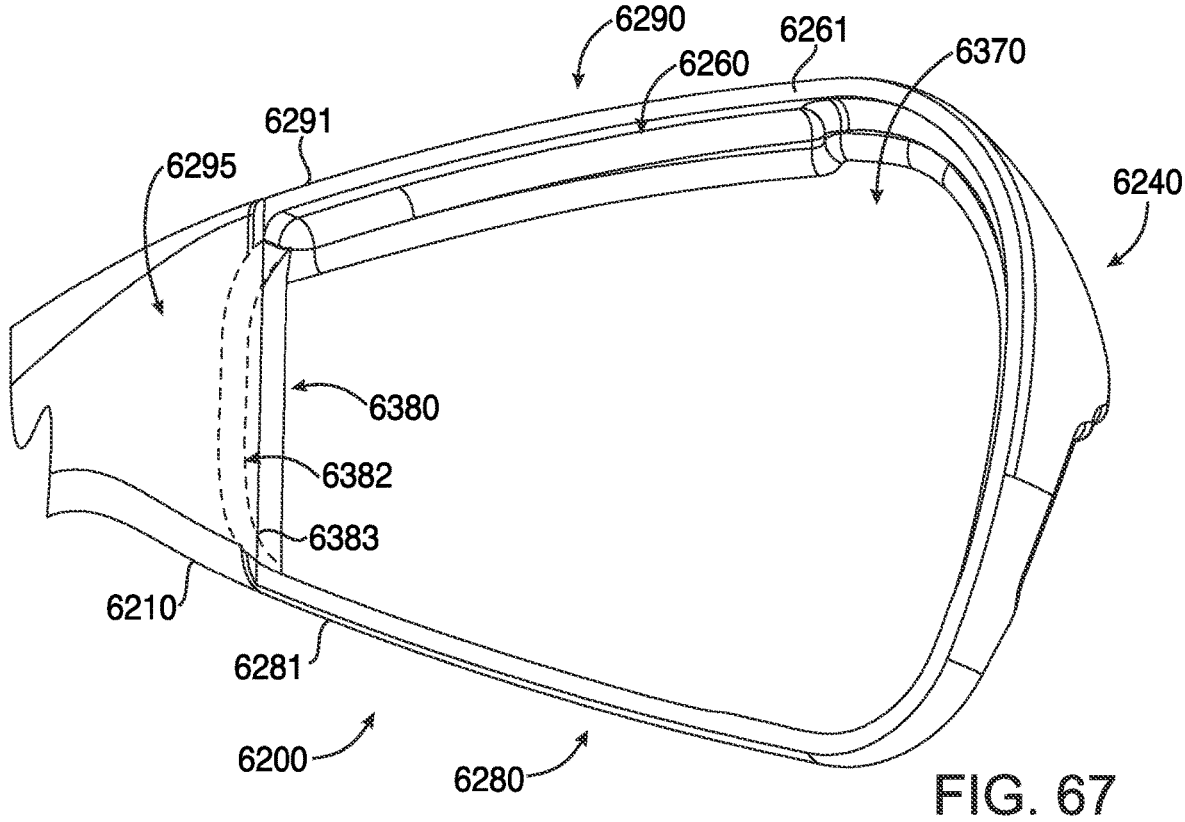

The body portion 6210 may include a second interior cavity 6380 at or proximate the hosel transition portion 6295. The second interior cavity 6380 may extend partially or fully through the hosel transition portion 6295 and be positioned between the first interior cavity 6370 and the hosel portion 6255. The second interior cavity 6380 may define an undercut portion of the hosel transition portion 6295. In one example, as shown in FIGS. 65-67, the second interior cavity 6380 may be connected to the first interior cavity 6370. Accordingly, the second interior cavity 6380 may be partially or fully filled with a polymer material similar to the first interior cavity 6370. In another example, the second interior cavity 6380 may not be filled with a filler material. The apparatus, methods, and articles of manufacture described herein are not limited in this regard.

The second interior cavity 6380 may be located at or proximate to the hosel transition portion 6295. The second interior cavity may be at any location between and/or including the front portion 6260 and the back portion 6270, and extend in any dimension between and/or including the front portion 6260 and the back portion 6270. In one example, as shown in FIGS. 65-67, the second interior cavity 6380 may be at or near the face portion 6262. Accordingly, a front wall 6382 that defines the front boundary of the second interior cavity 6380 may define a portion of the body portion 6210 to which the face portion 6262 may be coupled. In other words, the front wall 6382 of the second interior cavity 6380 may be define an extension of the face portion 6262. In one example, as shown in FIGS. 65-67, the second interior cavity 6380 may extend from the front portion 6260 to a location between the front portion 6260 and the back wall portion 6410. Accordingly, the second interior cavity 6380 may be closer to the face portion 6262 than the back wall portion 6410. In another example (not shown), the second interior cavity 6380 may extend from the face portion 6262 to the back wall portion 6410 of the back portion 6270. In another example, the second interior cavity 6380 may extend partially between the face portion 6262 and the back wall portion 6410 of the back portion 6270. In yet another example, the second interior cavity 6380 may partially extend from the back wall portion 6410 of the back portion 6270 toward the face portion 6262. Accordingly, the second interior cavity 6380 may be closer to the back wall portion 6410 than the face portion 6262. In yet another example (not shown), the second interior cavity 6380 may be equidistant relative to the face portion 6262 and the back wall portion 6410. The apparatus, methods, and articles of manufacture described herein are not limited in this regard.

The second interior cavity 6380 may be in or proximate to the hosel transition portion 6295 and extend at any dimension between the toe portion 6240 and the heel portion 6250. In one example, as shown in FIGS. 65-67, the second interior cavity 6380 may extend from the first interior cavity 6370 at or proximate to the front portion 6260 into the hosel transition portion 6295. In another example (not shown), the second interior cavity 6380 may extend from the first interior cavity 6370 into the hosel transition portion 6295 and to a location near the hosel portion 6255. In another example (not shown), the second interior cavity 6380 may extend from the first interior cavity 6370 into the hosel transition portion 6295 and up to and/or including the hosel portion 6255. Accordingly, the second interior cavity 6380 may extend through all or a substantial portion of the hosel transition portion 6295 and/or extend through the hosel portion 6255. The apparatus, methods, and articles of manufacture described herein are not limited in this regard.

The second interior cavity 6380 may be located at or proximate to the hosel transition portion 6295 at any location between the top edge 6281 of the top portion 6280 and the sole edge 6291 of the sole portion 6290 and extend at any dimension between the top edge 6281 of the top portion 6280 and the sole edge 6291 of the sole portion 6290. In one example, as shown in FIGS. 65-67, the second interior cavity 6380 may extend from a location at or proximate to the top edge 6281 of the top portion 6280 to a location at or proximate to the sole edge 6291 of the sole portion 6290. Accordingly, the top and bottom boundaries of the second interior cavity 6380 may be defined by portions of the top portion 6280 and the sole portion 6290. In another example, the second interior cavity 6380 may be at or proximate to the top edge 6281 of the top portion 6280 and extend a certain distance toward the sole portion 6290. In another example, the second interior cavity 6380 may be at or proximate to the sole edge 6291 of the sole portion 6290 and extend a certain distance toward the top portion 6280. In yet another example, the second interior cavity 6380 may be equidistant relative to the top edge 6281 of the top portion 6280 and the sole edge 6291 of the sole portion 6290. The apparatus, methods, and articles of manufacture described herein are not limited in this regard.

The second interior cavity 6380 may have any shape, such as rectangular, elliptical, triangular, spherical, or a shape that partially or fully conforms to the shape of the hosel transition portion 6295. In one example, as shown in FIGS. 65-67, the second interior cavity 6380 may have a curved first portion 6386 at or proximate to the top edge 6281 of the top portion 6280, a curved second portion 6387 at or proximate to the sole edge 6291 of the sole portion 6290, and a generally planar or slightly curved third portion 6388 between the first portion 6386 and the second portion 6387. In another example (not shown), the second interior cavity 6380 may have a semi-circular or curved shape that extends from a location at or proximate to the top edge 6281 of the top portion 6280 to a location at or proximate to the sole edge 6291 of the sole portion 6290. Accordingly, the second interior cavity 6380 may extend from the first interior cavity 6370 at or proximate to the top edge 6281 of the top portion 6280 toward and/or into the hosel transition portion 6295, and from the hosel transition portion 6295 toward and/or into the first interior cavity 6370 at or proximate to the sole edge 6291 of the sole portion 6290 in a semi-circular, a curved path or a partially curved path (i.e., having one or more linear segments). The curved or semi-circular shape (i.e., non-angular or non-sharp) of the second interior cavity 6380 may reduce stress concentration points in the hosel transition portion 6295 to prevent damage or failure of the hosel transition portion 6295. The apparatus, methods, and articles of manufacture described herein are not limited in this regard.

The second interior cavity 6380 may define a portion of the body portion 6210 from which mass has been removed or displaced to other portions of the body portion 6210 to form second interior cavity 6380. The removed or displaced mass may be transferred to other portions of the body portion 6210 to impart certain characteristics to the golf club head 6200 such as to increase the MOI, lower the CG, optimize vibration and dampening characteristics, and/or improve the sound and feel of the golf club head 6200. At least a portion of the removed or displaced mass may be transferred below the horizontal midplane 6620 of the body portion 6210 to lower the center of gravity of the golf club head 6200 while maintaining or substantially maintaining the overall mass of the body portion 6210. Further, at least a portion of the removed or displaced mass may be transferred below the horizontal midplane 6620 of the body portion 6210 and closer to the toe portion 6240 than the heel portion 6250 to increase the MOI of the golf club head 6200. In one example, the removed or displaced mass may be incorporated into the body portion 6210 below the horizontal midplane 6620 by increasing the volume of the body portion 6210 below the horizontal midplane 6620. In another example, the removed or displaced mass may be incorporated into the body portion 6210 as additional mass portions. The increased mass below the horizontal midplane 6620 and/or toward the toe portion 6240 lowers the center of gravity and/or increases the MOI of the golf club head 6200, respectively. The apparatus, methods, and articles of manufacture described herein are not limited in this regard.

In the example of FIGS. 62-67, the front portion 6260 may include a perimeter ledge portion 6261. The perimeter ledge portion 6261 may define a portion of the outer boundary of the front portion 6260. A perimeter portion (not shown) of a back surface of the face portion 6262 may be coupled to the perimeter ledge portion 6261 when the face portion 6262 is coupled to the body portion as described herein. The perimeter portion of the back surface of the face portion 6262 may be coupled to the perimeter ledge portion 6261 by welding, soldering, using on or more adhesives, and/or other suitable methods. The apparatus, methods, and articles of manufacture described herein are not limited in this regard.

In the example of FIGS. 62-67, the front wall 6382 may include a front wall edge 6383 that may be coupled to the face portion 6262 by welding, soldering, using one or more adhesives, and/or other suitable methods. Accordingly, the face portion 6262 may be coupled to the body portion 6210 by a perimeter portion of the back surface of the face portion 6262 being coupled to the perimeter ledge portion 6261, and a side wall portion (not shown) of the face portion 6262 being coupled to the front wall edge 6383. The apparatus, methods, and articles of manufacture described herein are not limited in this regard.

Figure 68:
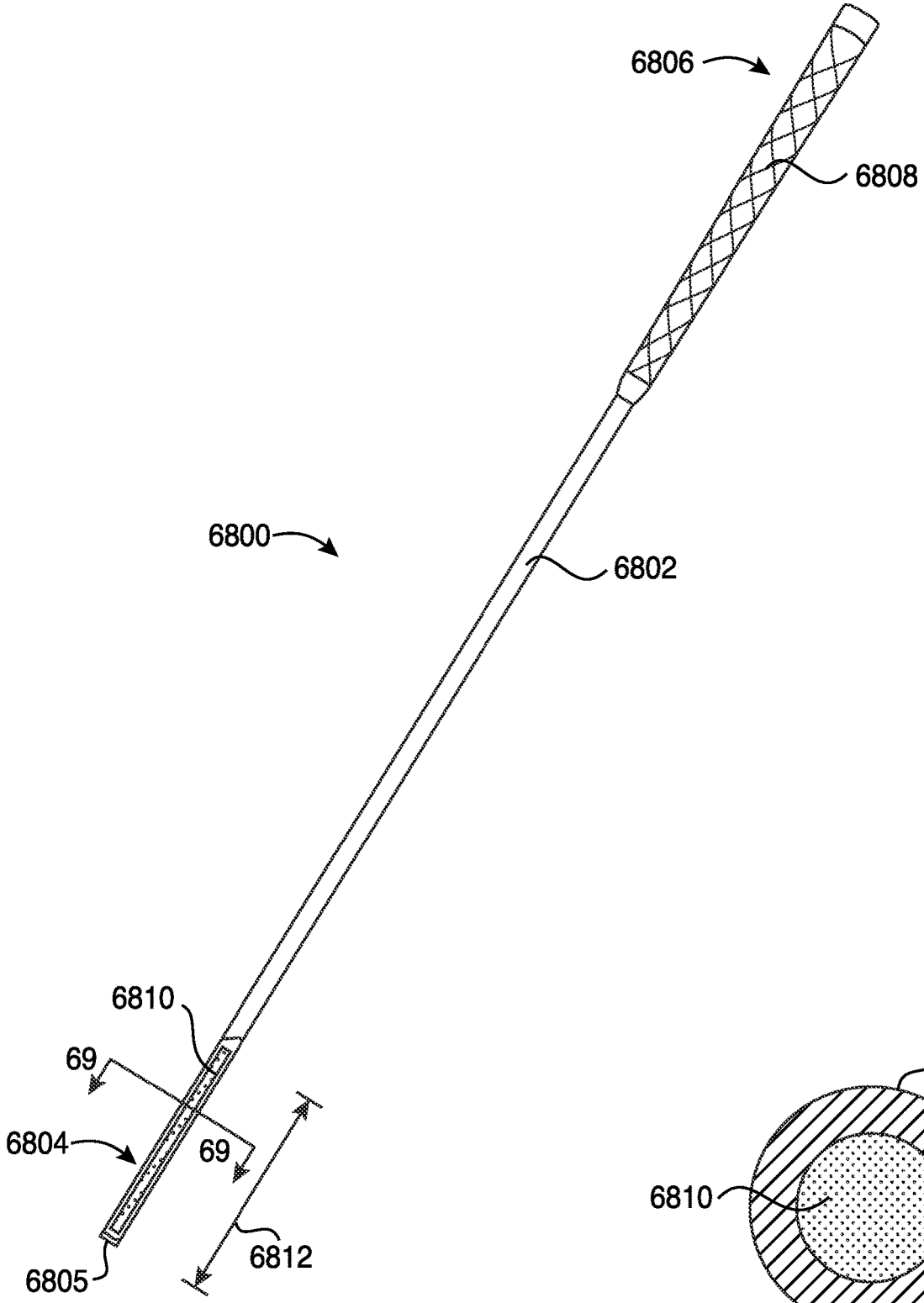
FIG. 68 depicts a perspective and partial cross-sectional view of an example of a golf club shaft according to an embodiment of the apparatus, methods, and articles of manufacture described herein.

In one example shown in FIG. 68, a golf club shaft 6800 for use with a golf club including any of the golf club heads described herein may include a shaft body portion 6802 having a first end 6805 and a second end 6807. The golf club shaft 6800 may be similar to the shaft 1504 of the golf club 1400 of FIG. 14. The shaft body portion 6802 may include a first end portion 6804, which may be a portion of the shaft body portion 6802 that extends from a location on the shaft body portion 6802 near the first end 6805 to the first end 6805. The shaft body portion 6802 may also include a second end portion 6806, which may be a portion of the shaft body portion 6802 that extends from a location on the shaft body portion 6802 near the second end 6807 to the second end 6807. A portion or all of the first end portion 6804 may be configured to connect to a body portion (e.g., one shown as 1500 in FIG. 15) of a golf club head or a hosel portion (e.g., one shown as 1555 in FIG. 15) of a golf club head. A portion or all of the second end portion 6806 may receive a grip portion 6808 that may be held by an individual to use the golf club. The grip portion 6808 may be similar to the grip 1506 of the golf club 1400 of FIG. 14. The grip portion 6808 may extend from the second end 6807 of the shaft body portion 6802 to a certain location on the shaft body portion 6802. A golf club head to which the golf club shaft 6800 may be attached may be any type of golf club head or any of the golf club heads described herein. The apparatus, methods, and articles of manufacture described herein are not limited in this regard.

Figure 69:
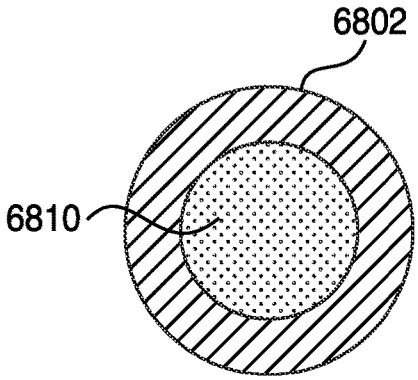
FIG. 69 depicts a cross-sectional view of the golf club shaft of FIG. 68 taken at line 69-69 of FIG. 68.

In one example shown in FIGS. 68 and 69, the first end portion 6804 may be filled with an elastic polymer material or an elastomer material (shown in FIGS. 68 and 69 as filler material 6810) to reduce vibration, increase dampening, and/or improve sound and feel when striking a golf ball (not shown) with a golf club. The filler material 6810 may extend from the first end 6805 of the shaft body portion 6802 through the first end portion 6804 and/or to a certain location along the shaft body portion 6802. The filler material 6810 may be similar in many respects to any of the elastic polymer materials or elastomer materials described herein. The apparatus, methods, and articles of manufacture described herein are not limited in this regard.

The portion of the shaft body portion 6802 that may be filled with the filler material 6810 may have a length 6812. In one example, the length 6812 may define the length of the first end portion 6804. In one example, the length 6812 may be between 10 inches (25.4 centimeters) and 20 inches (50.8 centimeters). In one example, the length 6812 may be between 12 inches (30.5 centimeters) and 18 inches (45.7 centimeters). In one example, the length 6812 may be between 14 inches (35.6 centimeters) and 16 inches (40.6 centimeters). The apparatus, methods, and articles of manufacture described herein are not limited in this regard.

Figure 70:
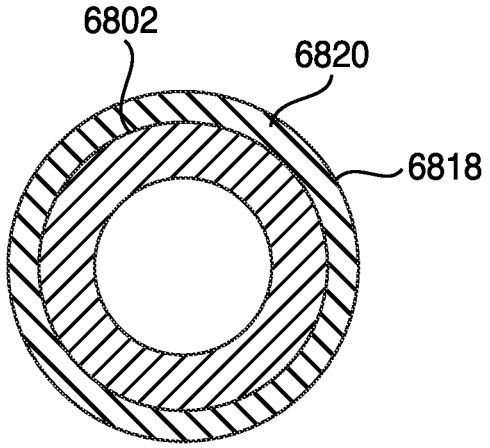
FIG. 70 depicts a cross-sectional view of an example of a golf club shaft according to an embodiment of the apparatus, methods, and articles of manufacture described herein.

In one example shown in FIG. 70, the first end portion 6804 may include a sleeve portion 6818 constructed from an elastic polymer or elastomer material (shown as sleeve material 6820 in FIG. 70) to reduce vibration, increase dampening, and/or improve sound and feel when striking a golf ball (not shown) with a golf club. The sleeve portion 6818 may be constructed from different or similar materials as any of the elastic polymer or elastomer materials described herein. The sleeve portion 6818 may surround all or portions of the shaft body portion 6802. In one example, the length (not shown) of the sleeve portion 6818 may be similar to the length of the first end portion 6804. In one example, the length of the sleeve portion 6818 may extend from the first end 6805 of the shaft body portion 6802 to a certain location along the shaft body portion 6802. In one example, the length of the sleeve portion 6818 may be between 10 inches (25.4 centimeters) and 20 inches (50.8 centimeters). In one example, the length of the sleeve portion 6818 may be between 12 inches (30.5 centimeters) and 18 inches (45.7 centimeters). In one example, the length of the sleeve portion 6818 may be between 14 inches (35.6 centimeters) and 16 inches (40.6 centimeters). The apparatus, methods, and articles of manufacture described herein are not limited in this regard.

Figure 71:
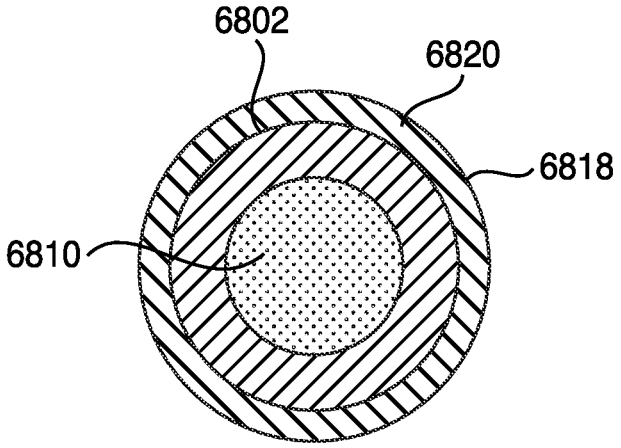
FIG. 71 depicts a cross-sectional view of an example of a golf club shaft according to an embodiment of the apparatus, methods, and articles of manufacture described herein.

In one example shown in FIG. 71, the first end portion 6804 may be filled with the filler material 6810 similar to the example of FIG. 69 and further include the sleeve portion 6818 constructed from the sleeve material 6820 similar to the example of FIG. 70. The filler material 6810 and the sleeve material 6820 may be the same or different materials. The filler material 6810 and the sleeve portion 6818 may further reduce vibration, increase dampening, and/or improve sound and feel when striking a golf ball (not shown) with a golf club. The apparatus, methods, and articles of manufacture described herein are not limited in this regard.

In the example of FIG. 68, the first end portion 6804 may be filled with an elastic polymer material or an elastomer material (shown in FIGS. 68 and 69 as filler material 6810) to reduce vibration, increase dampening, and/or improve sound and feel when striking a golf ball (not shown) with a golf club. In one example, a portion of the filler material 6810 may be located inside the hosel portion and/or inside the body portion of the golf club head to reduce vibration, increase dampening, and/or improve sound and feel of the golf club as the vibration and forces are transmitted from the body portion of the golf club head to the golf club shaft 6800. In other words, the filler material 6810 may extend from the first end 6805 of the shaft body portion 6802 into a portion of the hosel portion and/or the body portion of the golf club head and at least partially fill portions of the hosel portion and/or the body portion of the golf club head. The apparatus, methods, and articles of manufacture described herein are not limited in this regard.

Figure 72:
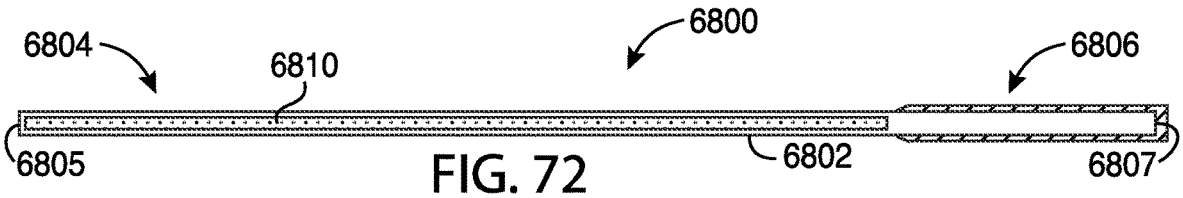
FIGS. 72-77 depict cross-sectional views of examples of golf club shafts according to embodiments of the apparatus, methods, and articles of manufacture described herein.
Figure 73:
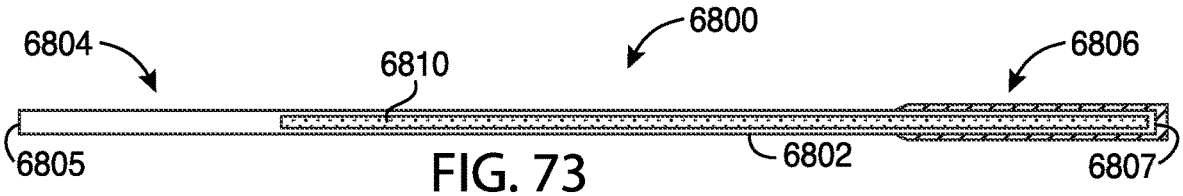
Figure 74:
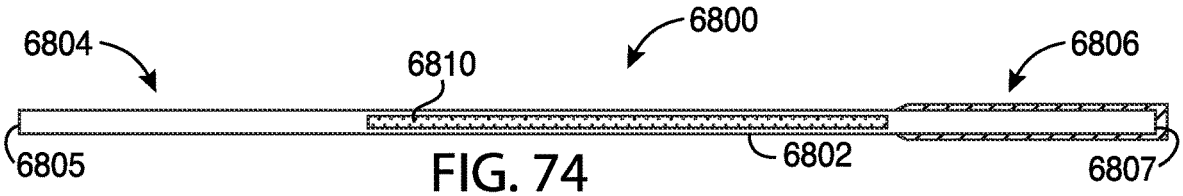
Figure 75:
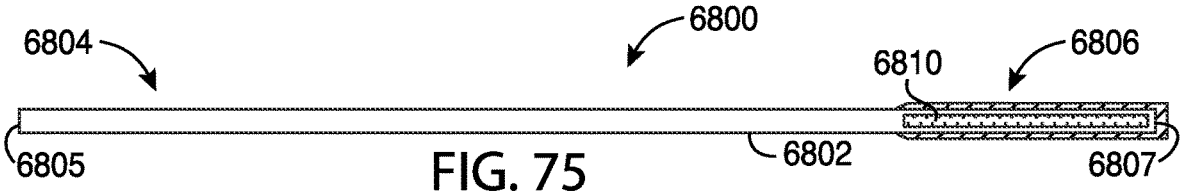
Figure 76:
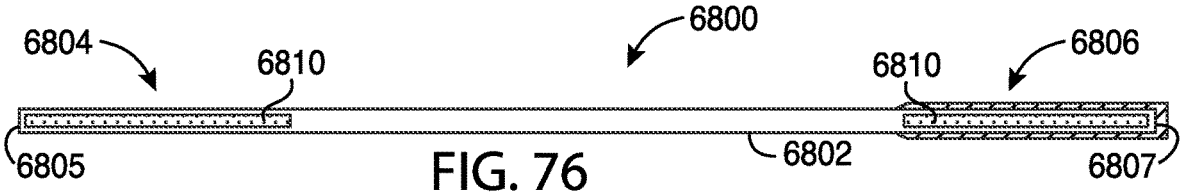
Figure 77:
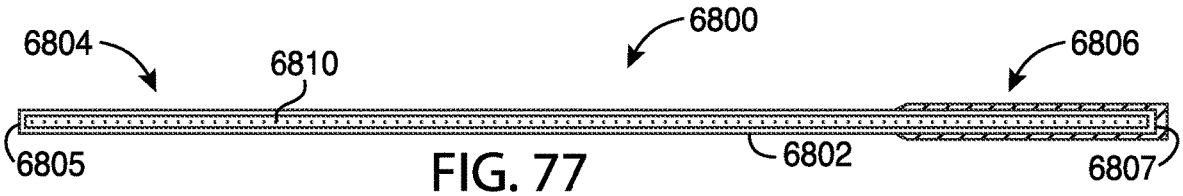

As shown in the examples of FIGS. 72-77, the filler material 6810 may be placed at any single and/or multiple inner and/or outer locations (i.e., a sleeve portion) of the shaft body portion 6802 to provide certain vibration reduction, dampening increase, and/or improvement in sound and feel of the golf club. In the example of FIG. 72, the filler material 6810 (and/or a sleeve portion as described herein) may extend from a location at or near the grip portion 6808 to the first end 6805 of the shaft body portion 6802. In the example of FIG. 73, the filler material 6810 (and/or a sleeve portion as described herein) may extend from the second end 6807 of the shaft body portion 6802 to a certain location past the grip portion 6808 and between the first end portion 6804 and the second end portion 6806. In the example of FIG. 74, the filler material 6810 (and/or a sleeve portion as described herein) may extend from at or near the grip portion 6808 to a certain location between the first end portion 6804 and the second end portion 6806. In the example of FIG. 75, the filler material 6810 (and/or a sleeve portion as described herein) may extend along a portion of the shaft body portion 6802 that includes the grip portion 6808. The golf club shaft 6800 may include the filler material 6810 (and/or a sleeve portion as described herein) at multiple and separate locations along the shaft body portion 6802. As shown in FIG. 76, the filler material 6810 (and/or a sleeve portion as described herein) may extend from the first end 6805 of the shaft body portion 6802 to a certain location along the shaft body portion 6802, and also extend along a portion of the shaft body portion 6802 that includes the grip portion 6808. In the example of FIG. 77, the filler material 6810 (and/or a sleeve portion as described herein) may extend the entire length of the shaft body portion 6802. The apparatus, methods, and articles of manufacture described herein are not limited in this regard.

The filler material 6810 may be any of the elastic polymer or elastomer materials described herein. Portions of the golf club shaft 6800 may be filled with the filler material 6810 from the first end 6805 and/or the second end 6807. The filler material 6810 may be injected into the shaft body portion 6802 to fill portions of shaft body portion 6802 (i.e., injection molding) as described in detail herein. In one example, the inner walls of the shaft body portion 6802 may be coated with one or more adhesives so that the filler material 6810 adheres to the inner walls of the shaft. The apparatus, methods, and articles of manufacture described herein are not limited in this regard.

Any of the apparatus, methods, or articles of manufacture described herein may include one or more visual identifiers such as alphanumeric characters, colors, images, symbols, logos, and/or geometric shapes. For example, one or more visual identifiers may be manufactured with one or more portions of a golf club such as the golf club head (e.g., casted or molded with the golf club head), painted on the golf club head, etched on the golf club (e.g., laser etching), embossed on the golf club head, machined onto the golf club head, attached as a separate badge or a sticker on the golf club head (e.g., adhesive, welding, brazing, mechanical lock(s), any combination thereof, etc.), or any combination thereof. The visual identifier may be made from the same material as the golf club head or a different material than the golf club head (e.g., a plastic badge attached to the golf club head with an adhesive). Further, the visual identifier may be associated with manufacturing and/or brand information of the golf club head, the type of golf club head, one or more physical characteristics of the golf club head, or any combination thereof. In particular, a visual identifier may include a brand identifier associated with a manufacturer of the golf club (e.g., trademark, trade name, logo, etc.) or other information regarding the manufacturer. In addition or alternatively, the visual identifier may include a location (e.g., country of origin), a date of manufacture of the golf club or golf club head, or both.

The visual identifier may include a serial number of the golf club or golf club head, which may be used to check the authenticity to determine whether or not the golf club or golf club head is a counterfeit product. The serial number may also include other information about the golf club that may be encoded with alphanumeric characters (e.g., country of origin, date of manufacture of the golf club, or both). In another example, the visual identifier may include the category or type of the golf club head (e.g., 5-iron, 7-iron, pitching wedge, etc.). In yet another example, the visual identifier may indicate one or more physical characteristics of the golf club head, such as one or more materials of manufacture (e.g., visual identifier of "Titanium" indicating the use of titanium in the golf club head), loft angle, face portion characteristics, mass portion characteristics (e.g., visual identifier of "Tungsten" indicating the use of tungsten mass portions in the golf club head), interior cavity and filler material characteristics (e.g., one or more abbreviations, phrases, or words indicating that the interior cavity is filled with a polymer material), any other information that may visually indicate any physical or play characteristic of the golf club head, or any combination thereof. Further, one or more visual identifiers may provide an ornamental design or contribute to the appearance of the golf club or the golf club head.

Although a particular order of actions may be described herein with respect to one or more processes, these actions may be performed in other temporal sequences. Further, two or more actions in any of the processes described herein may be performed sequentially, concurrently, or simultaneously.

While the above examples may describe an iron-type or a wedge-type golf club head, the apparatus, methods, and articles of manufacture described herein may be applicable to other types of golf club heads.

A numerical range defined using the word "between" includes numerical values at both end points of the numerical range. A spatial range defined using the word "between" includes any point within the spatial range and the boundaries of the spatial range. A location expressed relative to two spaced apart or overlapping elements using the word "between" includes (i) any space between the elements, (ii) a portion of each element, and/or (iii) the boundaries of each element.

The terms "and" and "or" may have both conjunctive and disjunctive meanings. The terms "a" and "an" are defined as one or more unless this disclosure indicates otherwise. The term "coupled" and any variation thereof refer to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby", "neighboring", etc., and such terms may be used interchangeably as appearing in this disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising:

a body portion having an interior cavity, a front portion, a back portion, a toe portion, a heel portion, a sole portion, and a top portion having an opening;

a face portion attached to the front portion, the face portion having a face center;

a crown portion attached to the top portion and covering the opening, the crown portion comprising a composite material;

a port on the body portion connected to the interior cavity; and a mass portion comprising a material having a different density than a material of the body portion, wherein the port is configured to receive the mass portion to close the port, wherein the interior cavity is at least partially filled with a polymer material from the port, wherein the interior cavity at least partially extends over the port, wherein a width of the interior cavity varies between the sole portion and the top portion, and wherein a maximum width of the interior cavity is below the face center and above the port.

2. A golf club head as recited in claim 1, wherein a width of the interior cavity between the port and the face portion is less than the maximum width.

3. A golf club head as recited in claim 1, wherein a width of the interior cavity above the face center is less than the maximum width.

4. A golf club head as recited in claim 1 comprising a plurality of mass portions coupled to the body portion, wherein each mass portion of the plurality of mass portions comprises a material having a greater density than a material of the body portion.

5. A golf club head as recited in claim 1 further comprising a plurality of ports below the face center and a plurality of mass portions, wherein each port of the plurality of ports is configured to receive a mass portion of the plurality of mass portions.

6. A golf club head as recited in claim 1, wherein a width of the interior cavity above the face center is uniform or substantially uniform.

7. A golf club head comprising:

a body portion having an interior cavity, a front portion, a back portion, a toe portion, a heel portion, a sole portion, and a top portion, the body portion comprising a body portion material;

a face portion attached to the front portion;

a polymer material in the interior cavity;

a port on the body portion connected to the interior cavity;

a first mass portion comprising a different material than the body portion material; and a second mass portion comprising a different material than the body portion material, the second mass portion having a length extending between the toe portion and the heel portion and a width being less than the length, at least a portion of the second mass portion being located below a horizontal midplane of the body portion;

wherein the first mass portion has a mass of less than or equal to 1.0 gram, wherein the interior cavity includes a first width above the horizontal midplane, a second width below the horizontal midplane, and a third width below the second width, wherein the second width is greater than the first width, wherein the second width is greater than the third width, wherein the port is below the third width, wherein the interior cavity at least partially extends over the port at a location of the third width, wherein the interior cavity is at least partially filled with the polymer material from the port, and wherein the port is configured to receive the first mass portion to close the port.

8. A golf club head as recited in claim 7, wherein the port includes a threaded portion and the first mass portion includes a threaded portion, and wherein the threaded portion of the first mass portion engages the threaded portion of the port to secure the first mass portion in the port.

9. A golf club head as recited in claim 7, wherein more than 50% of a total mass of the golf club head is below the horizontal midplane.

10. A golf club head as recited in claim 7, wherein the third width is between the port and the face portion.

11. A golf club head as recited in claim 7, wherein the second mass portion comprises a material having a smaller density than a material of the first mass portion.

12. A golf club head as recited in claim 7, wherein the first mass portion comprises a material having a greater density than a density of the body portion material.

13. A golf club head as recited in claim 7, wherein the first width is uniform or substantially uniform between the top portion and the horizontal midplane.

14. A golf club head comprising:

a body portion having an interior cavity, a front portion, a back portion, a toe portion, a heel portion, a sole portion, and a top portion;

a face portion attached to the front portion to enclose the interior cavity;

a port on the body portion and connected to the interior cavity;

a first mass portion coupled to the body portion and comprising a first material; and a second mass portion coupled to the body portion and comprising a second material different from the first material;

wherein a total mass of the first mass portion and the second mass portion is less than or equal to 20 grams, wherein the sole portion includes a visible marking to identify a type of the golf club head, wherein a width of the interior cavity varies between the sole portion and the top portion, wherein a maximum width of the interior cavity is below a horizontal midplane of the body portion and above the port, wherein the interior cavity is at least partially filled with a filler material from the port, wherein the interior cavity at least partially extends over the port at a location of the maximum width, and wherein the port is configured to receive the first mass portion to close the port.

15. A golf club head as recited in claim 14, wherein a length of the second mass portion extends between the toe portion and the heel portion and is greater than a width of the second mass portion extending between the top portion and the sole portion.

16. A golf club head as recited in claim 14, wherein the filler material is an elastic polymer material.

17. A golf club head as recited in claim 14, wherein a width of the interior cavity between the port and the face portion is less than the maximum width.

18. A golf club head as recited in claim 14, wherein a width of the interior cavity above the horizontal midplane is less than the maximum width.

19. A golf club head as recited in claim 14, wherein the second material has a smaller density than the first material.

20. A golf club head as recited in claim 14, wherein a width of the interior cavity above the horizontal midplane is uniform or substantially uniform.

* * * * *